US008613481B2

(12) United States Patent
Parker et al.

(10) Patent No.: US 8,613,481 B2
(45) Date of Patent: Dec. 24, 2013

(54) CHAIR

(75) Inventors: Kent Wallace Parker, Lower Hutt (NZ); Paul Michael Wilkinson, Wellington (NZ); Lyall Douglas Stewart, Porirua (NZ); Daryl Owen Neal, Lower Hutt (NZ); Gregory W. Baum, Kapiti (NZ); Noah Juniper Rainbow McNeill, Christchurch (NZ)

(73) Assignee: Formway Furniture Limited, Wellington (NL)

( * ) Notice: Subject to any disclaimer, the term of this patent is extended or adjusted under 35 U.S.C. 154(b) by 0 days.

(21) Appl. No.: 13/297,077

(22) Filed: Nov. 15, 2011

(65) Prior Publication Data

US 2012/0086251 A1 Apr. 12, 2012

Related U.S. Application Data

(62) Division of application No. 12/057,640, filed on Mar. 28, 2008, now Pat. No. 8,096,615, which is a division of application No. 12/088,348, filed as application No. PCT/NZ2007/000289 on Oct. 4, 2007, now Pat. No. 8,087,727.

(60) Provisional application No. 60/849,540, filed on Oct. 4, 2006, provisional application No. 60/849,524, filed on Oct. 4, 2006, provisional application No. 60/849,585, filed on Oct. 4, 2006, provisional application No. 60/849,622, filed on Oct. 4, 2006, provisional application No. 60/849,504, filed on Oct. 4, 2006, provisional application No. 60/829,646, filed on Oct. 16, 2006.

(51) Int. Cl.

| | |
|---|---|
| ***A47C 7/14*** | (2006.01) |
| ***A47C 1/024*** | (2006.01) |
| ***A47C 7/54*** | (2006.01) |

(52) U.S. Cl.
USPC ..... 297/284.3; 297/301.1; 297/354.11; 297/411.36

(58) Field of Classification Search
USPC ..... 297/284.1, 284.3, 284.4, 284.9, 411.36, 297/411.46, 452.13, 300.1, 300.2
See application file for complete search history.

(56) References Cited

U.S. PATENT DOCUMENTS

| | | | |
|---|---|---|---|
| 2,787,315 | A | 4/1957 | Siebert |
| 2,916,084 | A | 12/1959 | Bottemiller et al. |

(Continued)

FOREIGN PATENT DOCUMENTS

| | | | |
|---|---|---|---|
| AU | 323224 | S | 12/2008 |
| AU | 323225 | S | 12/2008 |

(Continued)

OTHER PUBLICATIONS

Notice of allowance and issue fee issued in U.S. Appl. No. 29/306,463, dated May 18, 2009.

(Continued)

*Primary Examiner* — Philip Gabler
(74) *Attorney, Agent, or Firm* — Workman Nydegger

(57) ABSTRACT

A back portion for a chair has a back frame, the back frame having a lower portion adapted to extend across at least a major part of a lower region of a seated adult occupant's back, an upper portion vertically spaced from the lower portion and adapted to extend across at least a major part of an upper region of the occupant's back, and a relatively narrow interconnecting region between the upper portion and lower portion. The relatively narrow interconnecting region is resiliently flexible to provide a flexing movement in a rearward direction of the upper portion relative to the lower portion. A cover operatively connected to the back frame provides a supporting surface for the back of the seated occupant.

33 Claims, 97 Drawing Sheets

(56) References Cited

U.S. PATENT DOCUMENTS 3,362,749 A * 1/1968 Clement ..... 297/411.21
3,681,792 A 8/1972 Korber
3,722,955 A 3/1973 Trotman
3,797,886 A 3/1974 Griffiths
3,813,073 A 5/1974 Mohr et al.
3,877,750 A 4/1975 Scholpp
3,929,374 A 12/1975 Hogan et al.
4,032,190 A 6/1977 Müller-Deisig et al.
4,040,661 A 8/1977 Hogan et al.
4,084,850 A 4/1978 Ambasz
4,119,343 A 10/1978 Pentzien
4,143,916 A 3/1979 Trotman et al.
4,157,203 A 6/1979 Ambasz
4,183,494 A 1/1980 Cleveland
4,340,250 A 7/1982 Ward
4,361,357 A 11/1982 Pollock
4,370,000 A 1/1983 Kazaoka et al.
4,411,468 A 10/1983 Apissomian
4,455,047 A 6/1984 Watanabe
4,469,738 A 9/1984 Himelreich, Jr.
4,502,729 A 3/1985 Locher
4,545,617 A 10/1985 Drexler et al.
4,575,150 A 3/1986 Smith
4,585,272 A 4/1986 Ballarini
4,652,049 A 3/1987 Maruyama et al.
4,717,203 A 1/1988 Meiller
4,830,432 A 5/1989 Fuhrmann et al.
4,842,257 A 6/1989 Abu-Isa et al.
4,890,886 A 1/1990 Opsvik
4,911,501 A 3/1990 Decker et al.
4,981,326 A 1/1991 Heidmann
5,035,466 A 7/1991 Mathews et al.
D320,120 S * 9/1991 Samuelsson ..... D6/366
5,046,780 A 9/1991 Decker et al.
5,114,211 A 5/1992 Desanta
5,121,934 A 6/1992 Decker et al.
5,238,294 A 8/1993 Ishi et al.
5,409,295 A 4/1995 Edstrom
5,577,804 A 11/1996 Tedesco
5,599,064 A 2/1997 Vanderminden, Sr.
5,649,739 A 7/1997 Zapf
5,671,972 A 9/1997 Tedesco
5,681,092 A 10/1997 Hanson et al.
5,700,060 A 12/1997 Bullard et al.
5,769,492 A 6/1998 Jensen
5,775,779 A 7/1998 Abu-Isa et al.
5,782,536 A * 7/1998 Heidmann et al. ..... 297/440.15
5,795,026 A 8/1998 Dral et al.
5,802,643 A 9/1998 Sloot
5,810,440 A 9/1998 Unwalla
5,887,946 A 3/1999 Raftery
5,890,765 A 4/1999 LaPointe et al.
5,899,530 A 5/1999 Tedesco
5,909,923 A 6/1999 DeKraker
5,934,758 A 8/1999 Ritch et al.
5,967,610 A 10/1999 Lin
5,979,984 A 11/1999 DeKraker et al.
5,988,757 A 11/1999 Vishey et al.
6,029,962 A 2/2000 Shorten et al.
6,059,368 A 5/2000 Stumpf et al.
6,079,782 A 6/2000 Berg et al.
D438,392 S * 3/2001 Lucci et al. ..... D6/366
6,213,553 B1 4/2001 Fitz
D445,580 S 7/2001 Pennington et al.
6,257,665 B1 7/2001 Nagamitsu et al.
D446,397 S 8/2001 Pennington et al.
6,279,998 B1 8/2001 Chu et al.
6,318,800 B1 11/2001 DeKraker
6,349,992 B1 2/2002 Knoblock et al.
6,357,827 B1 3/2002 Brightbill et al.
6,367,877 B1 4/2002 Knoblock et al.
6,382,719 B1 5/2002 Heidmann et al.
6,386,634 B1 5/2002 Stumpf et al.
6,394,545 B2 5/2002 Knoblock et al.
6,394,546 B1 5/2002 Knoblock et al.
6,394,548 B1 5/2002 Battey et al.
6,394,549 B1 5/2002 DeKraker et al.
D460,300 S 7/2002 Fifield et al.
6,439,665 B1 8/2002 Cvek
D463,144 S 9/2002 Pennington et al.
6,460,928 B2 10/2002 Knoblock et al.
6,478,379 B1 11/2002 Ambasz
6,523,898 B1 2/2003 Ball et al.
D471,042 S 3/2003 Nicolai et al.
6,536,841 B1 3/2003 Pearce et al.
6,572,190 B2 6/2003 Koepke et al.
6,588,842 B2 7/2003 Stumpf et al.
6,588,843 B1 7/2003 Ebenstein
6,595,586 B2 7/2003 Brightbill et al.
6,598,251 B2 7/2003 Habboub et al.
6,605,332 B2 8/2003 Calhoun et al.
6,609,755 B2 8/2003 Koepke et al.
6,609,760 B1 8/2003 Matern et al.
D479,416 S 9/2003 Raftery
6,616,228 B2 9/2003 Heidmann
6,623,079 B2 9/2003 Gregory
6,626,497 B2 9/2003 Nagamitsu et al.
6,644,741 B2 * 11/2003 Nelson et al. ..... 297/302.1
6,669,292 B2 12/2003 Koepke et al.
6,669,301 B1 12/2003 Funk et al.
6,672,669 B2 1/2004 Chu et al.
6,685,268 B2 2/2004 Meyer
6,687,933 B2 2/2004 Habboub et al.
6,698,833 B2 3/2004 Ball et al.
6,702,390 B2 3/2004 Stumpf et al.
6,722,741 B2 4/2004 Stumpf et al.
6,726,285 B2 4/2004 Caruso et al.
6,729,691 B2 5/2004 Koepke et al.
6,733,080 B2 * 5/2004 Stumpf et al. ..... 297/411.36
6,742,839 B2 6/2004 Piretti
6,749,840 B2 6/2004 Orlow et al.
D494,792 S 8/2004 Schmitz et al.
6,802,566 B2 10/2004 Prince et al.
6,817,667 B2 11/2004 Pennington et al.
6,840,582 B2 1/2005 Burwell et al.
6,843,530 B1 * 1/2005 Wu ..... 297/284.4
6,869,142 B2 3/2005 Heidmann et al.
6,880,886 B2 4/2005 Bodnar et al.
6,899,398 B2 5/2005 Coffield
6,905,171 B2 6/2005 Knoblock et al.
6,908,159 B2 6/2005 Prince et al.
6,910,736 B2 6/2005 White
6,910,741 B2 6/2005 Footitt
D506,894 S 7/2005 Harley
6,913,315 B2 7/2005 Ball et al.
6,945,601 B1 * 9/2005 Wu ..... 297/284.4
D510,488 S 10/2005 Su
6,955,402 B2 10/2005 VanDeRiet et al.
6,957,863 B2 10/2005 Heidmann et al.
6,959,965 B2 11/2005 Diffrient
6,966,606 B2 11/2005 Coffield
6,969,116 B2 11/2005 Machael et al.
6,979,059 B1 12/2005 Conlin
6,979,984 B2 12/2005 Perrier et al.
6,981,743 B2 1/2006 Edwards et al.
6,994,400 B2 2/2006 Koepke et al.
7,004,543 B2 * 2/2006 Caruso et al. ..... 297/300.2
D516,828 S 3/2006 Tsai
7,014,269 B2 3/2006 Coffield et al.
7,032,971 B2 4/2006 Williams
7,055,911 B2 6/2006 Simpson et al.
7,059,682 B2 6/2006 Caruso et al.
7,066,537 B2 6/2006 Coffield et al.
7,066,538 B2 6/2006 Machael et al.
7,066,546 B2 6/2006 Trego et al.
7,070,727 B2 7/2006 Calhoun et al.
7,083,234 B2 8/2006 Dowty et al.
7,096,549 B2 8/2006 Coffield
7,100,983 B1 9/2006 Grant
7,104,607 B2 9/2006 Yasuda et al.
7,114,777 B2 10/2006 Knoblock et al.
7,118,177 B2 10/2006 Piretti
7,131,700 B2 11/2006 Knoblock et al.
7,147,285 B2 12/2006 Lin

| | | | | |
|---|---|---|---|---|
| D534,384 | S | 1/2007 | Su | |
| 7,165,811 | B2 | 1/2007 | Bodnar et al. | |
| 7,188,177 | B2 | 3/2007 | Taylor | |
| D542,043 | S | 5/2007 | Wu | |
| 7,213,880 | B2 | 5/2007 | Schmitz et al. | |
| 7,234,774 | B2 | 6/2007 | Heidmann et al. | |
| 7,264,311 | B2 | 9/2007 | Heidmann | |
| 7,270,378 | B2 | 9/2007 | Wilkerson et al. | |
| D553,378 | S | 10/2007 | Wang | |
| D556,481 | S | 12/2007 | Harley | |
| D577,521 | S | 9/2008 | Su | |
| 7,419,222 | B2 | 9/2008 | Schmitz et al. | |
| D577,934 | S | 10/2008 | Raftery et al. | |
| D580,689 | S | 11/2008 | Su | |
| D581,708 | S | 12/2008 | Su | |
| 7,475,943 | B1 | 1/2009 | Huang | |
| D593,337 | S | 6/2009 | Su | |
| D600,051 | S | 9/2009 | Parker et al. | |
| D604,535 | S | 11/2009 | Parker et al. | |
| 7,726,740 | B2 | 6/2010 | Masunaga | |
| 7,794,016 | B1 | 9/2010 | Lucci et al. | |
| 8,029,060 | B2 | 10/2011 | Parker et al. | |
| 2002/0089219 | A1* | 7/2002 | Blanco et al. | 297/284.4 |
| 2002/0109384 | A1 | 8/2002 | Hansen | |
| 2002/0149247 | A1 | 10/2002 | Diffrient | |
| 2002/0158492 | A1 | 10/2002 | Ko et al. | |
| 2003/0085601 | A1 | 5/2003 | Hudswell et al. | |
| 2003/0127901 | A1 | 7/2003 | Lovato | |
| 2003/0178882 | A1 | 9/2003 | Schmitz et al. | |
| 2004/0012237 | A1 | 1/2004 | Horiki et al. | |
| 2004/0100139 | A1 | 5/2004 | Williams | |
| 2004/0183350 | A1 | 9/2004 | Schmitz et al. | |
| 2004/0245840 | A1 | 12/2004 | Tubergen et al. | |
| 2004/0245841 | A1 | 12/2004 | Peterson et al. | |
| 2005/0017557 | A1 | 1/2005 | Caruso et al. | |
| 2005/0146184 | A1 | 7/2005 | Machael et al. | |
| 2005/0168030 | A1 | 8/2005 | Bykov et al. | |
| 2005/0206212 | A1 | 9/2005 | Peterson | |
| 2005/0279591 | A1 | 12/2005 | Coffield et al. | |
| 2006/0001303 | A1 | 1/2006 | Raftery et al. | |
| 2006/0006715 | A1 | 1/2006 | Chadwick et al. | |
| 2006/0071523 | A1 | 4/2006 | Stumpf et al. | |
| 2006/0091714 | A1 | 5/2006 | Schmitz et al. | |
| 2006/0091715 | A1 | 5/2006 | Schmitz et al. | |
| 2006/0103208 | A1 | 5/2006 | Schmitz et al. | |
| 2006/0226691 | A1 | 10/2006 | Bedford et al. | |
| 2006/0261655 | A1 | 11/2006 | Dowty et al. | |
| 2007/0069565 | A1* | 3/2007 | Diffrient | 297/300.5 |
| 2008/0191533 | A1 | 8/2008 | Poniatowski | |
| 2008/0290712 | A1 | 11/2008 | Parker et al. | |
| 2009/0085388 | A1 | 4/2009 | Parker et al. | |
| 2009/0218864 | A1 | 9/2009 | Parker et al. | |

FOREIGN PATENT DOCUMENTS

| | | | |
|---|---|---|---|
| AU | 2232226 | S | 12/2008 |
| DE | 23 40 919 | A1 | 2/1975 |
| DE | 41 37 488 | A1 | 6/1992 |
| DE | 41 14 101 | A1 | 11/1992 |
| DE | 196 10 714 | A1 | 9/1997 |
| DE | 200 06 038 | U1 | 6/2000 |
| DE | 199 08 592 | C1 | 11/2000 |
| DE | 203 15 179 | U1 | 1/2004 |
| DE | 10 2005 016 198 | A1 | 10/2006 |
| EM | 001016659-0001 | | 1/2009 |
| EM | 001016695-0002 | | 1/2009 |
| EM | 001016695-0003 | | 1/2009 |
| EP | 0 107 627 | B1 | 1/1986 |
| EP | 0 482 439 | B1 | 4/1992 |
| EP | 0 433 099 | B1 | 5/1994 |
| EP | 0 589 834 | B1 | 4/1996 |
| EP | 0 721 751 | B1 | 8/2000 |
| EP | 0 850 005 | B1 | 11/2003 |
| EP | 1 616 504 | A2 | 1/2005 |
| EP | 1 621 108 | A1 | 2/2006 |
| EP | 1 408 794 | B1 | 9/2006 |
| GB | 2 212 392 | A1 | 7/1989 |
| GB | 2 347 853 | A1 | 9/2000 |
| GB | 2 412 576 | A1 | 10/2005 |
| JP | 60-160759 | | 10/1985 |
| JP | 8-24083 | | 1/1996 |
| JP | 2001-245748 | | 9/2001 |
| JP | 2003-189965 | | 7/2003 |
| JP | 2003-189966 | | 7/2003 |
| JP | 2003-290577 | | 10/2003 |
| JP | 2004-290605 | | 10/2004 |
| JP | 3117226 | | 1/2006 |
| JP | 2006-110004 | | 4/2006 |
| JP | 2006-218047 | | 8/2006 |
| SG | D2008/978/J | | 10/2009 |
| SG | D2008/980 | E | 10/2009 |
| SG | D2008/981 | A | 10/2009 |
| WO | WO 92/12654 | | 8/1992 |
| WO | WO 93/03652 | | 3/1993 |
| WO | WO 98/16140 | | 4/1998 |
| WO | WO 99/44475 | | 9/1999 |
| WO | WO 99/58022 | | 11/1999 |
| WO | WO 03/055674 | A1 | 7/2003 |
| WO | WO 03/103455 | A1 | 12/2003 |
| WO | WO 2005/030007 | A1 | 4/2005 |
| WO | WO 2006/110227 | A2 | 10/2006 |
| WO | WO 2007/110729 | A2 | 10/2007 |
| WO | WO 2007/110737 | A2 | 10/2007 |
| WO | WO 2007/133458 | A2 | 11/2007 |
| WO | WO 2007/142448 | A1 | 12/2007 |
| WO | WO 2008/041868 | A3 | 4/2008 |

OTHER PUBLICATIONS

Notice of allowance and issue fee issued in U.S. Appl. No. 29/306,464, dayed Jul. 23, 2009.

Office Action issued in U.S. Appl. No. 12/057,640, dated Mar. 12, 2010.

Office Action issued in U.S. Appl. No. 12/057,640, dated Aug. 31, 2010.

Office Action issued in U.S. Appl. No. 12/057,640, dated Feb. 16, 2011.

Office Action issued in U.S. Appl. No. 12/088,348, dated Jan. 1, 2011.

Final Office Action issued in U.S. Appl. No. 12/088,348, dated Jun. 14, 2011.

Notice of allowance and issue fee in U.S. Appl. No. 12/088,348, dated Aug. 19, 2011.

Office Action issued in U.S. Appl. No. 12/057,674, dated Oct. 6, 2010.

Final Office Action issued in U.S. Appl. No. 12/057,674, dated Apr. 12, 2011.

Notice of allowance and issue fee issued in U.S. Appl. No. 12/057,674, dated Jun. 23, 2011.

International Search Report dated Jun. 2, 2008 issued in PCT/NZ2007/000289.

Notice of allowance and issue fee in U.S. Appl. No. 12/057,640 dated Sep. 15, 2011.

2nd Notice of allowance and issue fee issued Dec. 5, 2011 in U.S. Appl. No. 12/057,640, filed Mar. 28, 2008.

Office Action issued Dec. 27, 2011 in U.S. Appl. No. 13/223,545, filed Sep. 1, 2011.

* cited by examiner

CHAIR

CROSS-REFERENCE TO RELATED APPLICATIONS

This application is a divisional of U.S. patent application Ser. No. 12/057,640 filed Mar. 28, 2008, which is a divisional of U.S. patent application Ser. No. 12/088,348, filed Mar. 27, 2008, which is a U.S. Nationalization of PCT Application No. PCT/NZ2007/000289, filed Oct. 4, 2007, which claims priority to U.S. Provisional Application Nos. 60/849,540, filed Oct. 4, 2006; 60/849,524, filed Oct. 4, 2006; 60/849,585, filed Oct. 4, 2006; 60/849,622, filed Oct. 4, 2006; 60/849,504, filed Oct. 4, 2006; and 60/829,646, filed Oct. 16, 2006, which applications are hereby incorporated by reference.

BACKGROUND OF THE INVENTION

1. Field of the Invention

The invention relates generally to chairs and associated components. More particularly, although not exclusively, the invention relates to office chairs.

2. Background to the Invention

Traditionally chairs have been designed to offer satisfactory support in a single "correct" seating position of a user; that is facing directly forward on the seat. With that type of chair, while the user receives satisfactory support in the forward facing position, he or she does not receive satisfactory support in alternative positions. Therefore, the user is required to adjust their position to accommodate the chair, rather than the chair adjusting to accommodate the user. The applicants are of the view that it is acceptable, and even beneficial, to provide a wider range of supported positions for the seated occupant.

Additionally, reclinable office chairs have conventionally required a large number of separate interacting parts to provide reclining motion. When such chairs are disposed of, that results in a large amount of scrap material.

It is an object of at least preferred embodiments of the present invention to provide a chair that addresses at least one of the disadvantages outlined above, or that at least provides the public with a useful choice.

SUMMARY OF THE INVENTION

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

In accordance with a first aspect of the present invention, there is provided a chair comprising: a supporting frame; a seat portion for supporting an occupant; a back portion for supporting the back of a seated occupant; and a recline mechanism configured to move the seat portion upon a reclining action of the back portion, the recline mechanism comprising a rear deformable member operatively connecting a relatively rearward portion of the seat portion and the supporting frame, a front deformable member operatively connecting a relatively forward portion of the seat portion and the supporting frame, a lower deformable member operatively connecting a lower part of the back portion and the supporting frame, and a puller member above the lower deformable member, the recline mechanism configured such that as the back portion of the chair is reclined, the lower deformable member deforms and the puller member applies a rearward pulling action which causes the seat portion to move and the front and rear deformable members to deform.

Broadly, the first aspect of the present invention provides a recline mechanism with deformable members in a chair.

The pulling action preferably causes the seat portion to lift and move rearwardly. Preferably, the pulling action causes the seat portion to increase in rearward tilt angle as it lifts and moves rearwardly.

The puller member may also be deformable.

Preferably, one or more of the front deformable member, the rear deformable member, the puller member and the lower deformable member extend transversely to a forward direction of the chair. Preferably, the puller member and the lower deformable member extend transversely to a forward direction of the chair.

One or more of the front deformable member, the rear deformable member, the puller member, and the lower deformable member is formed of an elastomeric material. One or more of the front deformable member, the rear deformable member, the puller member, and the lower deformable member may be an elastomeric panel. The or each elastomeric panel may extend substantially the width of a main transom of the supporting frame. The elastomeric material may comprise rubber, or an elastomeric polymer such as a thermoplastic polyurethane elastomer (TPU) or a nylon elastomer for example. Most preferably, the polymeric material is HYTREL, which is a thermoplastic polyester elastomer available from Du Pont.

The front and rear deformable members may be pre-moulded with an inherent curvature. For example, in a relaxed state, the front and rear deformable members may have a sinuous configuration. Forward movement of the seat as an occupant sits on the seat portion, or rearward movement of the seat as an occupant reclines the back of the chair by leaning back, may cause the front and rear deformable members to initially straighten from the sinuous configuration. The chair may be provided with one or more recline springs to resist reclining action of the back portion.

Alternatively, the front and rear deformable members may be substantially planar in the relaxed state. This configuration is preferred, as the chair will not require recline springs. A seated occupant's body weight, along with any loading provided by the deformable members, may provide sufficient resistance to oppose the reclining of the back portion. The front and/or rear deformable members may be provided with one or more shaped faces.

One or more stops is/are preferably provided to support the weight of the seated occupant on the seat portion via the supporting frame when the back portion is not being reclined. Therefore, the front and rear flexible members may be substantially unloaded when the back portion is not undergoing a reclining action.

At least two of the deformable members may form an integrally moulded structure. For example, the upper and lower deformable members may form an integrally moulded structure. Part of the integral structure may comprise a member that interconnects the rear ends of the upper and lower deformable members. In a preferred form, the front deformable member, rear deformable member, and lower deformable member form an integrally moulded structure. That integrally moulded structure may be overmoulded onto a main transom of the chair.

The lower deformable member and puller may form an integrally moulded structure with the rear deformable member. As an alternative, the lower deformable member and puller, and the front and rear deformable members, may all form an integrally moulded structure.

The seat portion may be supported by a seat support, and the seat portion may be selectively moveable in a forward and rearward direction relative to the supporting frame. The upper end of each of the forward and rearward deformable members may be connected to the seat support.

The recline mechanism may comprise an intermediate support and the seat may be operatively supported above the intermediate support by at least one resilient member configured to deform as an occupant sits on the seat, and the upper end of each of the forward and rearward deformable members may be connected to the intermediate support.

A forward end of the puller may be operatively connected to the seat portion, seat support, intermediate support, or upper part of the rearward deformable member.

The recline mechanism preferably comprises two spaced apart front deformable members, positioned at or toward respective sides of the seat portion. The recline mechanism preferably also comprises two spaced apart rear deformable members, positioned at or toward respective sides of the seat portion.

Preferably, the recline mechanism comprises a preference control to adjust the mechanical advantage of the back portion to move a user's weight on the seat portion. The puller is preferably connected to the preference control.

In accordance with a second aspect of the present invention, there is provided a chair comprising: a supporting frame; a seat portion for supporting an occupant; a back portion for supporting the back of a seated occupant when in a normal forward oriented seated position on the seat; and a recline mechanism comprising an intermediate support, at least one member operatively connected to the back portion and configured to move the intermediate support relative to the supporting frame upon a reclining action of the back portion, and at least one resilient support operatively supporting the seat portion above the intermediate support, wherein the resilient support is configured to deform to enable the seat portion to move toward the intermediate support as an occupant sits on the seat portion, thereby absorbing at least some of the initial impact of the occupant sitting on the seat portion.

Broadly, the second aspect of the present invention provides a recline mechanism with an intermediate support in a chair.

The recline mechanism preferably comprises at least two resilient supports operatively supporting the seat portion above the intermediate support. The resilient supports may comprise at least one rear member positioned toward a rear section of the seat portion and at least one forward member positioned toward a front section of the seat portion. The rear member(s) preferably comprise(s) a flexing spring member, which may be in the form of a hinge member.

Preferably, the resilient supports are configured so that the rear section of the seat portion is configured to move toward the intermediate support as an occupant sits on the seat portion, while a more forward section of the seat portion remains a relatively constant distance above the intermediate support. Accordingly, the front support(s) may comprise(s) one or more hinges.

The resilient supports are preferably configured to enable the seat portion to tilt forwardly relative to the intermediate support as an occupant applies load to the front section of the seat portion by leaning forward or moving forward on the seat portion. That helps prevent or minimise load applied to the underside of the occupant's legs as the occupant leans or moves forward.

The resilient supports are preferably constructed from a polymeric material, and preferably an elastomeric material, such as rubber, thermoplastic polyurethane elastomer (TPU), or a nylon elastomer for example. Most preferably, the polymeric material is HYTREL, which is a thermoplastic polyester elastomer available from Du Pont. As an alternative, the resilient supports could be constructed from a metal material for example.

The seat portion is preferably supported by a seat support having a seat depth mounting, which provides selective movement of the seat portion in a forward and rearward direction to adjust the depth of the seat portion relative to the supporting frame. The resilient supports preferably extend between the intermediate support and the seat depth mounting.

The seat support preferably comprises a plurality of resilient members configured to enable a seated occupant to tilt the seat portion at least to either side, while providing sufficient support to support the seated occupant in a normal centrally disposed position on the seat portion. The seat support preferably comprises at least two resilient side members. Preferably, the seat support additionally comprises forward and rearward resilient members configured to enable a seated occupant to tilt the seat portion forward or rearward, while providing sufficient support to support the seated occupant in a normal centrally disposed position on the seat portion. The resilient members may be an integral part of a seat pan.

The recline mechanism may comprise one or more deformable members between the intermediate support and the supporting frame, with the deformable member(s) configured to deform to move the seat portion upon a reclining action of the back portion.

The intermediate support, the seat portion, the front or rear members, and/or the deformable member(s) is/are operatively connected to the back portion to move the intermediate support upon recline of the back portion. The operative connection could be by a puller member connected between the back portion and one of those other components for example.

Any other suitable type of recline mechanism could be used that provides any type of suitable movement of the seat portion upon recline of the back portion.

The recline mechanism is preferably configured to lift the seat portion upon recline of the back portion. The seat portion may lift with little or no change in angle relative to the supporting frame as the back portion is reclined. The seat portion preferably lifts and moves rearward as the back portion is reclined. In alternative configurations, the seat portion may move in a different direction such as forward or rearward, either with or without a change in height, upon recline of the back portion. Additionally, the seat portion may be configured to change in angle, either forward or rearward, as the back portion is reclined.

The resilient support(s) is/are preferably configured such that following initial deformation and load absorbing of the resilient support(s) as the occupant sits on the seat portion, the seat portion bottoms out and is supported by the intermediate support to take the load of the seated occupant until the occupant egresses the seat portion. The seat support and/or the intermediate support may comprise one or more stops to support the seat portion when bottomed out.

In accordance with a third aspect of the present invention, there is provided a height adjustable arm assembly for a chair, comprising: a support comprising an elongate slot having spaced apart generally parallel first and second elongate walls; and an arm rest for supporting the arm of a chair occupant and cantilevered from the support, the arm rest having an end proximal the support and an end distal the support, the arm rest comprising at or towards its proximal end a support engagement mechanism having at least two bearing mechanisms that are spaced apart in the elongate direction of the elongate slot and are slidably received in the elongate slot of the support with one of the bearing mechanisms contacting the first longitudinal wall and the other of the bearing mechanisms contacting the second longitudinal wall to provide a sliding action of the arm rest relative to the support; and a locking mechanism for locking the arm rest in a selected position relative to the support, comprising a locking member that engages with the support and an actuator located at or adjacent the distal end of the arm rest, wherein the height of the arm rest relative to the support is adjustable by moving the actuator which causes the locking member to release from engagement with the support thereby enabling a sliding movement therebetween.

Preferably, each bearing mechanism is able to contact both the first longitudinal wall and the second longitudinal wall, but each bearing mechanism is able to contact only one of the longitudinal walls at a time. The bearing mechanisms may each be in the form of a roller, each of which is mounted for rotation relative to the arm rest about a respective axis that extends substantially transversely to the elongate direction of the slot.

Alternatively, the bearing mechanisms may each have a pair of rollers in a side by side configuration for example, with one roller in each pair contacting one of the longitudinal walls and the other roller in each pair contacting the other of the longitudinal walls. As an alternative, the bearing mechanisms may each be in the form of a fixed self-lubricating polymer member, and the longitudinal walls could also be made of a suitable self-lubricating polymeric material.

The support may be part of a back portion of a chair. Alternatively, support may be adapted to be supported from another part of the chair as part of a standalone arm assembly that may be attached to the supporting frame or seat for example. In a preferred form, the support is mounted to a part of the back portion that supports the back portion from another part of chair.

The actuator preferably comprises a lever that is adapted to be pulled upward to release the locking mechanism. That enables the height of the arm rest component to readily be increased, as the same upward pulling action against the lever will additionally lift the arm rest. While the pulling action is toward the front of the arm rest, the bearing mechanisms will inhibit binding of the arm rest to the support during the height adjustment.

The locking member is preferably connected to part of the arm rest, and is adapted to selectively engage with one of a plurality of locking features in the support that are spaced apart in the elongate direction of the slot. The actuator lever may be pivotally connected to part of the arm rest and connected to the locking member by a connecting component, such that pivoting movement of the actuator lever provides a sliding movement of the locking member.

The slot may extend completely through a mounting plate or similar of the support. Alternatively, the slot may be defined by an elongate channel formed in the support for example.

In accordance with a fourth aspect of the present invention, there is provided a chair comprising: a supporting frame; a seat portion for supporting a seated occupant; a back portion, at least a part of which has a concave curvature for supporting the back of the occupant when in a normal forward oriented position in the chair; and a pair of arm rests above and at or toward either side of the seat portion, wherein each arm rest has an inner surface that is cushioned and forms a general continuation of the part of said back portion; wherein a sufficient clearance is provided between the arm rest and the seat portion that an occupant can sit sideways on the seat portion with their legs extending under one arm rest and part of their back supported by the cushioned inner surface of the other arm rest.

Broadly, the fourth aspect of the present invention provides a pair of arm rests in a chair.

The inner surface of each arm rest is preferably curved. Preferably, the inner surface forms a general continuation of said concave curvature of the part of the back portion, at least when an occupant is side-sitting in the chair and leaning against the back portion. Alternatively, the inner surfaces could be generally planar.

The arm rests are preferably sufficiently long in a forward direction to support at least a major part of the width of an occupant's lower back when the occupant is sitting generally sideways in the chair incorporating the back portion in use.

The arm rests may be height adjustable relative to the seat portion. In that case, in at least one height adjusted position of the arm rests there will be sufficient clearance provided between the arm rest and the seat portion that an occupant can sit sideways on the seat portion with their legs extending under one arm rest.

Preferably, the entire inner surface of the arm rest is cushioned.

The arm rests may be incorporated into the back portion, or could alternatively be part of arm assemblies that are supported from a different part of the chair such as the seat portion or supporting frame for example. In a preferred form, the arm rests are mounted to a part of the back portion that supports the back portion from another part of the chair. Preferably, the arm rests are forwardly cantilevered from the back portion.

In accordance with a fifth aspect of the present invention, there is provided a back portion for a chair comprising: a back frame, the back frame comprising a lower portion adapted to extend across at least a major part of a lower region of a seated adult occupant's back, an upper portion vertically spaced from the lower portion and adapted to extend across at least a major part of an upper region of the occupant's back, and a relatively narrow interconnecting region between the upper portion and lower portion, wherein the relatively narrow interconnecting region is resiliently flexible to provide a flexing movement in a rearward direction of the upper portion relative to the lower portion; and a cover operatively connected to the back frame to provide a supporting surface for the back of the seated occupant.

Broadly, the fifth aspect of the present invention provides a back portion for a chair with a resiliently flexible relatively narrow interconnecting region.

Preferably, the interconnecting region is further configured to twist with a torsional action, to enable the upper portion of the back frame to twist relative to the lower portion of the back frame. Such a configuration enables the upper portion of the back frame to twist relative to the lower portion as a seated occupant turns their shoulder region while seated in a chair incorporating the back portion in use. The lower portion of the back frame may be adapted to twist relative to a seat portion of the chair as a seated occupant turns his/her back. It is preferred that the amount of twist of the lower portion is less than the amount of twist of the upper portion. The lower portion of the back frame may not twist relative to the seat portion of the chair.

The relatively narrow interconnecting region may consist of a single member, or alternatively could consist of more than one member.

The upper and/or lower portion of the back frame may be substantially rigid. In an alternative embodiment, the upper and/or lower portions of the back frame may be resilient. In a preferred embodiment, at least a lower part of the upper portion and at least an upper part of the lower portion are resiliently flexible.

The back portion may be configured to be supported from any suitable part of a chair, such as a supporting frame, a seat portion, or from both the seat portion and supporting frame.

Preferably, the back portion comprises at least one support member extending from the lower portion, to provide a means of supporting the back portion from another part of the chair, such as the supporting frame, seat portion, or from both the seat portion and supporting frame. The support member(s) may be connected to the lower portion of the back frame, at a position above a bottom edge of the lower portion of the back frame, and the bottom edge of the lower portion of the back frame may be free of any connection to the support member(s). Preferably, the support member(s) extend from a position at or adjacent a bottom edge of the back portion.

When the support members are connected above the bottom edge of the lower part of the back frame, they may be resiliently flexible, to provide a flexing movement of upper portion(s) of the support member(s) in a rearward direction. Such a flexing movement will result in a forward movement of the bottom edge of the lower portion of the back frame relative to the support member(s).

The support member(s) may be configured such that the flexibility is substantially limited to the forward/rearward direction. The back portion preferably comprises two horizontally spaced support members. Preferably, the support members are adjoined at lower ends thereof by a transverse connector member. The transverse connector member may be integral with the support members.

The back frame and support member(s) may be of a unitary construction, and may be moulded from a polymeric material for example.

The upper portion of the back frame preferably comprises a transversely extending top member, a transversely extending bottom member connected to the relatively narrow interconnecting region, and at least two spaced apart generally vertical members interconnecting the top and bottom members. Preferably, the generally vertical members are positioned at or toward a respective end of the top and bottom transverse members. In one embodiment, the top member may be generally linear when viewed from above the back portion, while the bottom member may be generally concave when viewed from the front of the back portion. The top member may also be generally concave when viewed from the front of the back portion.

The lower portion of the back frame preferably comprises a transversely extending top member, a transversely extending bottom member, and at least two spaced apart members interconnecting the top and bottom members. Preferably, the spaced apart members connect respective ends of the top and bottom transverse members. The spaced apart members preferably extend outwardly and upwardly from the bottom member. In one embodiment, at least the top member may be generally concave when viewed from the front, and the top and spaced apart members are preferably sufficiently wide such that the outer ends of the top and spaced apart members extend around the sides of the lower back of a seated adult occupant, so that the lower portion of the back frame "cups" the lower back of the seated occupant.

The back portion preferably comprises arm assemblies having arm rests that are supported by the lower portion of the back portion. Arm supports may extend from a lower region of the back portion, with the arm rests mounted to the arm supports. The arm rests preferably extend forwardly in a cantilevered arrangement adjacent the lower portion of the back frame, and preferably have inner surfaces that form a general continuation of the portion of the cover corresponding in position to the lower portion of the back frame when supporting a user. The inner surface of each arm rest is preferably curved. Preferably, the inner surface forms a general continuation of said concave curvature of the cover, at least when an occupant is side-sitting in the chair and leaning against the back portion. The inner surfaces of the arm rests preferably have cushioning. The arm rests are preferably sufficiently long in a forward direction to support at least a major part of the width of an occupant's lower back when the occupant is sitting generally sideways in the chair incorporating the back portion in use. There will suitably be sufficient spacing beneath the arm rests that an occupant's legs can fit under the arm rests when sitting generally sideways in the chair incorporating the back portion in use.

The arm rests are preferably height adjustable relative to the back frame. If so, in at least one of the height adjusted positions of the arm rests, there is preferably sufficient spacing beneath the arm rests that an occupant's legs can fit under the arm rests when sitting generally sideways in the chair.

In the embodiment in which the support members are connected above the bottom edge of the lower part of the back frame and are resilient, the back portion may comprise a support block to limit rearward movement of the bottom of the lower portion relative to the support member(s). The support block acts to transfer downward loading applied to the arm rests as a chair occupant pushes down against the arm rests to assist them exiting the chair, to the support member(s) and thereby the part of the chair that supports the support member(s) in use. The support block may be mounted to the support member(s) or the lower portion of the back frame. The support block may comprise a recess, and the other of the support member(s) and the back frame may comprise an engagement member that engages in the recess to transfer load to the support block. At least one, and preferably both, of the recess and the engagement member may comprise a curved surface, to provide a pivoting support during twisting movement of the lower portion of the back frame.

The cover may be any suitable type of resilient material, such as a fabric or polymeric material for example. It is preferred that the cover is a moulded polymeric material, more preferably an elastomeric material, such as thermoplastic polyurethane elastomer (TPU) or a nylon elastomer for example. Most preferably, the polymeric material is HYTREL, which is a thermoplastic polyester elastomer available from Du Pont. The cover preferably comprises integrally moulded attachment features for connecting the cover to the back frame. The cover is preferably formed as a mesh to provide enhanced breathability through the cover. However, in an alternative embodiment, the cover may comprise a cushion.

In accordance with a sixth aspect of the present invention, there is provided a back portion for a chair comprising: a lower portion adapted to extend across at least a major part of a lower region of an adult occupant's back; an upper portion vertically spaced from the lower portion and adapted to extend across at least a major part of an upper region of the adult occupant's back; and a relatively narrow interconnecting region between the upper portion and lower portion; and a cover operatively connected to the upper portion and lower portion to provide a supporting surface for the back of the seated occupant, wherein the cover comprises two recessed sections, one extending into each side of the cover, wherein the recessed sections correspond generally in vertical position to the relatively narrow interconnecting region, to provide a clearance space for the elbows of a seated occupant in use.

Broadly, the sixth aspect of the present invention provides a back portion for a chair with clearance spaces for the elbows of a seated occupant in use.

The back portion may comprise arm rests. Preferably, the arm rests are supported from a lower region of the back portion and configured such that an upper surface of each arm rest substantially corresponds in position to a lower edge of a respective recess in the cover. The arm rests may be height adjustable relative to the back frame. If so, in at least one of the height adjusted positions of the arm rests the upper surface of each arm rest preferably substantially corresponds in position to a lower edge of a respective recess.

Alternatively, the arm rests could be supported from another part of a chair that supports the back portion in use, such as a seat portion or supporting frame for example. Again, the arm rests may be height adjustable.

The back portion may comprise a back frame, with the cover operatively connected to and extending over a front surface of the back frame. Alternatively, the back portion may comprise a back panel, and the cover could comprise a cushion for example.

In the preferred form, the cover is substantially unsupported in the recessed sections, to provide a compliant contact surface for a user's elbows.

The cover may comprise a section that extends rearwardly and inwardly from each recessed section. The section that extends rearwardly and inwardly may be connected to the relatively narrow interconnecting region of the back. The section that extends rearwardly and inwardly may be an integrally formed part of the cover, or may be a separate component that is connected to the front part of the cover.

In accordance with a seventh aspect of the present invention, there is provided a back portion for a chair comprising: a lower portion adapted to extend across at least a major part of a lower region of an adult occupant's back; and an upper portion adapted to extend across and support at least a major part of an upper region of an adult occupant's back; wherein the upper portion comprises an upper section that is adapted to be selectively folded rearwardly relative to a remainder of the upper portion, to reduce the overall vertical height of the back portion.

Broadly, the seventh aspect of the present invention provides a back portion for a chair that permits a section of the back portion to move relative to at least one other section of the back portion.

The upper section preferably provides a platform for resting the occupant's arm when folded rearwardly and when the occupant is side-sitting.

The upper portion may comprise at least one support member comprising at least one hinge or pivot in an overcentred configuration to provide a forward bias to said upper section. In such a configuration, when the occupant applies a rearward force to the back portion when in a normal forward seated orientation, said upper section will remain generally aligned with a remainder of the upper section due to the configuration of the hinge(s) or pivot(s). However, the hinge(s) or pivot(s) will enable the rearward folding of said upper section to occur when a rearward/downward force is discretely applied to the upper section, such as by an occupant pushing rearwardly/downwardly against said upper section with his/her arm.

Alternatively, the upper section may be configured to fold rearwardly upon a rearward force being applied to the upper section.

Said upper section may be defined by a plurality of slits extending into the upper portion from a front face thereof, which enable the front face to expand. The slits, in combination with the hinge(s) or pivot(s), suitably define the folding area. Alternatively, or in addition, the upper portion may have a plurality of slots extending into the upper portion from a rear face thereof. In a preferred form, the upper portion has a plurality of slots extending into the upper portion from a rear face thereof. The slots, when closed, preferably limit rearward movement of the upper section relative to the remainder of the upper portion.

The upper portion preferably comprises an elastomeric block with the plurality of slots. The elastomeric material may be any of the suitable materials listed elsewhere in this specification.

The upper portion is preferably provided with a limit mechanism that defines a forward and rearward limit of movement of the upper section. In a preferred form, the limit mechanism comprises a resilient strap connected to the upper section or to the remainder of the upper portion, and which operatively slidably engages with the other of the remainder of the upper portion and the upper section. The strap preferably comprises a member that defines the forward and rearward limit of the upper section movement. In the preferred form shown, the member comprises a block that is fixed relative to the strap and is slidably received in a recess such that engagement of the block with a wall of the recess defines a rearward limit of the upper section movement, and engagement of the block with another wall of the recess defines the forward limit of the upper section movement.

Rather than using a block and a recess, an alternative configuration could be used such as a pin that is fixed relative to the strap and is slidably received in a slot, for example.

The back portion may comprise a back frame and an operatively connected resiliently flexible cover that provides a support surface for a seated occupant. The back frame may comprise a relatively narrow interconnecting region between the upper portion and the lower portion. Alternatively, the back frame could be any suitable shape such as generally rectangular when viewed from the front. However, this feature could additionally be provided in a back portion of a different form that comprises a solid or generally solid back panel for example, which again could be substantially rectangular when viewed from the front or any other suitable shape, and said upper section may comprise an upper part of the panel that is configured to fold rearwardly relative to a lower part of the panel. The panel could be a panel made from a polymeric material for example. Again, said section may be supported from a lower part of the panel by one or more hinges or pivots as described above. The panel may provide the support surface for the seated occupant, or could alternatively support a cushion that provides the support surface for the seated occupant.

In the configuration having a frame and a resilient cover, the cover preferably comprises a fabric or polymeric material for example. The polymeric material is suitably an elastomeric material, such as thermoplastic polyurethane elastomer (TPU) or a nylon elastomer, for example. Most preferably, the polymeric material is HYTREL, which is a thermoplastic polyester elastomer available from Du Pont. The frame is also preferably made from a polymeric material, such as glass filled nylon for example.

In accordance with an eighth aspect of the present invention, there is provided a method of assembling a support which forms part of a chair, comprising: providing a frame; providing a moulded polymeric cover comprising a mesh having a plurality of members, wherein the cover has an as-moulded dimension less than a corresponding dimension of the frame; stretching the cover so as to have a stretched dimension greater than the corresponding dimension of the frame; relaxing the cover so as to have a post-relaxation dimension between the as-moulded dimension and the stretched dimension; and supporting the cover from the frame.

In one embodiment, the cover has a plurality of generally transversely extending elongate members, and a plurality of generally longitudinally extending elongate members. Preferably, the generally transversely extending elongate members differ from the generally longitudinally extending elongate members. Preferably, the generally transversely extending elongate members are thinner in a longitudinal direction of the cover than the generally longitudinally extending elongate members are in a transverse direction of the cover. Preferably, said dimension is a transverse dimension, and the method is such that the generally transversely extending elongate members are stretched and then relaxed as the cover is stretched and relaxed. Alternatively, said dimension may be a longitudinal dimension, and the method is such that the generally longitudinally extending elongate members are stretched and then relaxed as the cover is stretched and relaxed.

At least some of the generally longitudinally extending elongate members may have a greater depth than at least some of the generally transversely extending elongate members. For example, a generally centrally disposed plurality of the generally longitudinally extending elongate members may have a greater depth than the generally transversely extending elongate members. The generally centrally disposed plurality of the generally longitudinally extending elongate members may have a greater depth than the remaining generally longitudinally extending elongate members. Other configurations could be provided. Alternatively or in addition, at least some of the generally longitudinally extending elongate members may project further forward in a body supporting direction than at least some of the generally transversely extending elongate members.

The cover may be stretched and relaxed in both the transverse and longitudinal dimensions. The step of stretching may comprise stretching the cover in 360°. That is particularly useful if the cover comprises an irregular pattern of members and/or diagonal members.

Depending on the material used, in one embodiment the stretched dimension may be between about 1.4 and about 2.9 times the as-moulded dimension, and preferably about 2.15 times the as-moulded dimension. Each strand (between adjacent transverse members) of the elongate members oriented in the stretching direction is preferably stretched to between about 3 and about 10 times, more preferably to between about 3 and about 8 times its as-moulded length.

Preferably, the post-relaxation dimension of the cover is between about 1.1 and about 1.75 times the as-moulded dimension, preferably about 1.2 times the as-moulded dimension. The post-relaxation length of each strand (between adjacent transverse members) of the elongate members oriented in the stretching direction is preferably between about 1.5 and about 4.5 times its original length, more preferably about 2.1 times its original length.

The step of relaxing and supporting may occur concurrently. In particular, the cover may comprise pockets or the like to capture respective parts of the frame, and the parts may be captured by the pockets as the cover is relaxed. Alternatively, the cover may be connected to the frame after relaxing the cover. For example, following relaxing of the cover, the cover may be stretched a small amount and then supported from the frame. The stretched dimension for supporting the cover from the frame is preferably about 1.3 times its as-moulded dimension.

The cover may be directly connected to the frame such as by portions of one of the cover and the frame being received in respective complementary recesses of the other of the cover and the frame. Alternatively, separate fasteners could be used to connect the cover and the frame. As another alternative, one or more retaining strips could be used to connect the cover to the frame. Preferably, the cover is directly connected to the frame by attachment features that are integrally moulded with the cover as part of a moulding step.

The polymeric material is suitably an elastomeric material, such as thermoplastic polyurethane elastomer (TPU) or a nylon elastomer for example. Most preferably, the polymeric material is HYTREL, which is a thermoplastic polyester elastomer available from Du Pont.

The method may further comprise abrading at least a surface of the cover to provide a napped surface. The abrading will occur following moulding, and may occur prior to or following the stretching or relaxing step.

In a preferred embodiment, a surface texture is inmolded on the cover as part of a moulding step.

The method may comprise stretching different parts of the cover different amounts, to obtain varying properties in the cover.

The frame may comprise side members and upper and lower members (or front and rear members in the case of a seat frame), and the members may bound one or more openings that are covered by the cover when supported by the frame.

The support may be a back portion of a chair. In accordance with a ninth aspect of the present invention, there is provided a back portion for a chair when assembled using the method outlined above.

Alternatively, the support may be a seat portion of a chair. In accordance with a tenth aspect of the present invention, there is provided a seat portion for a chair when assembled using the method outlined above.

In accordance with an eleventh aspect of the present invention, there is provided a chair comprising: a supporting frame; a back portion; a seat portion having a central zone; and a seat support for operatively supporting the seat portion from the supporting frame, wherein the seat support comprises resilient support members located generally along respective sides of the central zone of the seat portion and configured to support a seated occupant when the seated occupant's weight is centrally located in the central zone, but which enable an angular change of the seat portion to the side if the seated occupant's weight is offset to the side of the central zone of the seat portion.

Broadly, the eleventh aspect of the present invention provides a seat support that enables an angular change in a seat portion in a chair.

The resilient support members may each consist of a single member that extends generally longitudinally in a forward-rearward direction along each side of the central zone. Preferably, there are a plurality of resilient support members along each side of the central zone.

The seat support may further comprise at least one resilient support member that supports a rearward part of the seat portion. That resilient support member is preferably configured to deform/flex as the occupant applies weight rearwardly to the seat portion, thereby providing a rearward angular movement of the seat portion. There are preferably a plurality of resilient support members that support a rearward part of the seat portion, and those support members may be positioned towards rear corners of the seat portion.

The seat support may further comprise at least one resilient support member that supports a more forward part of the seat portion. That resilient support member is preferably configured to deform/flex as the occupant applies weight forwardly to the seat portion, thereby providing a forward angular movement of the seat portion. Preferably, there are a plurality of support members, and more preferably three or four support members, supporting a more forward part of the seat portion.

The seat support may comprise a slide and may be selectively slidable relative to the support frame, to enable the depth of the seat portion to be selectively adjusted relative to the support frame. At least the slide and resilient supports may be part of a single unitary moulded polymeric component. The seat support may be operatively supported by an intermediate support that is supported by the support frame, and the seat support is preferably slidable relative to the intermediate support. The seat support is preferably operably supported above the intermediate support by at least one resilient member that is configured to deform as an occupant initially sits on the seat portion.

The intermediate support may form part of a recline mechanism that further comprises at least one member between the intermediate support and the supporting frame, and the back portion is operatively connected to the recline mechanism, wherein the seat support is operatively connected to the intermediate support and the recline mechanism is configured to move the intermediate support and thereby the seat support upon a reclining action of the back.

Preferably, the seat portion has two side zones, one on either side of the central zone, wherein the side zones are resiliently flexible and are substantially unsupported to enable the side zones to deform under the weight of an occupant's legs if the occupant sits sideways on the seat portion.

The central portion may define a rearward portion of the seat portion, and the seat portion may further comprise a forward portion that is resiliently flexible and is substantially unsupported to enable the forward portion to deform under the weight of an occupant's legs as the occupant sits forward on the seat portion. In an alternative embodiment, the forward portion of the seat portion may be relatively rigid, or at least of a similar rigidity to at least a major part of the seat portion. The side zones, however, may extend substantially to the front edge of the seat portion, whether or not the forward portion is resiliently flexible.

The seat portion may consist of a unitary component made of a polymeric material. Alternatively, the seat portion may further comprise a cushion construction to provide a compliant support for the seated occupant and which rests on a seat pan or seat panel.

In accordance with a twelfth aspect of the present invention, there is provided a cushion construction for providing a compliant support surface, the cushion construction comprising: a spring structure having a plurality of moulded spring components adapted to provide substantially independent compliant support, at least a majority of the moulded spring components each comprising a plurality of sections connected by platforms, so that the sections can telescope into one another under weight applied to the cushion construction; and a cover adapted to cover at least one side of the moulded spring components in the spring structure.

Preferably, within each spring of said majority of spring components, said sections are progressively larger toward the cover, and are progressively smaller away from the cover.

Preferably, the cover extends around the spring structure and terminates in an inwardly directed peripheral region that corresponds in position to another side of the spring structure, the cover providing for attachment to a supporting substrate by pulling the peripheral region of the cover around the substrate, thereby at least partly sandwiching the substrate between the peripheral region and the spring structure.

If desired, following pulling the peripheral region of the skin around the substrate to sandwich the substrate between the peripheral region and the spring structure, the skin may be fastened to the substrate to complete the attachment. The fastening may be via any suitable means, such as adhesive, or fasteners such as staples, pins, or clips for example. As another alternative, an attachment strip may capture the peripheral region of the skin in a recess in the substrate. The cover could be mounted to a substrate in any suitable way.

The cover may be formed using any suitable method, such as vacuum forming, injection moulding, or blow moulding for example. Preferably, the cover is formed by blow moulding to form a cover with minimal thickness. As another preferred alternative, the cover may be injection compression moulded.

The cover may be formed from any suitable material, such as TPU for example. TPU is preferred, as it can be colourless. Any other type of suitable elastomer may be used, such as HYTREL for example.

Preferably, the spring structure is formed from an elastomeric material, such as TPU or HYTREL for example.

The cover may be made from a breathable material, or may comprise a plurality of apertures to provide breathability. Alternatively, the cover may not be breathable, but apertures may be provided in the spring structure.

The cover may have a napped surface. Alternatively, a surface texture may be inmoulded on the cover.

The cover may be attached to the spring structure, or may be provided as a separate component for receipt of the spring structure. Alternatively, the cover may be integrally moulded with the spring structure.

The cushion may be for a support surface of a chair, such as a back portion, seat portion, or arm rest. For a back portion, the substrate may be a back frame or back panel. For a seat portion, the substrate may be a seat panel. For an arm rest, the substrate may be an arm support. Accordingly, in accordance with a thirteenth aspect of the present invention, there is provided a support surface for a chair, comprising a substrate and a cushion construction as outlined in the twelfth aspect above attached to and substantially covering a surface of the substrate. The chair may be any suitable type of chair, such as an office chair, lounge chair, or outdoor chair such as patio furniture or a stadium chair for example.

Preferably, the support surface is a seat portion for a chair, the seat portion comprising a seat panel or pan, and a cushion construction as outlined above attached to and substantially covering an upper surface of the seat panel or pan. The seat panel or pan may be substantially rigid, or may be resilient. Preferably, the seat panel or pan is resilient.

Alternatively, the support surface is an arm assembly for a chair, the arm assembly comprising an arm rest having an arm support, and a cushion construction as outlined above attached to and substantially covering at least an upper surface of the arm support. Preferably, the cushion construction additionally covers an inner surface of the arm support adapted to face a seated occupant in use.

As a further alternative, the cushion may be used as part of a lumbar support portion of the chair.

Alternatively, the cushion may be for a support surface of a different type. For example, the cushion could form a mattress of a bed.

In accordance with a fourteenth aspect of the present invention, there is provided a chair comprising: a supporting frame; a back portion; a seat portion operatively supported from the supporting frame and having a central zone and a peripheral edge region, wherein the peripheral edge region is resiliently flexible and is substantially unsupported to enable the peripheral edge region to deform under the weight of an occupant's legs; and an actuator operatively mounted beneath the peripheral edge region and that moves with the peripheral edge region as that deforms under the weight of the occupant's legs and which can be reached by a seated occupant reaching under the peripheral edge region of the seat portion, the actuator operatively connected to a mechanism that enables the chair to be reconfigured.

Broadly, the fourteenth aspect of the present invention provides a seat portion in a chair with a resiliently flexible peripheral edge region and an actuator mounted beneath the edge region.

The flexible peripheral edge region may be a forward edge of the seat portion, and the chair may comprise a recline mechanism that causes the central zone of the seat to raise in height as the back portion is rearwardly reclined, with a consequent downward deformation of the forward edge of the seat portion under the weight of the occupant's legs as the chair is reclined.

The forward edge may be deformed under the occupant's legs when the chair is not reclined and the occupant is in a normal seating position in the chair, with the downward deformation increasing as the chair is reclined. Alternatively, the forward edge may be substantially undeformed when the chair is not reclined and the occupant is in a normal seating position in the chair, with the downward deformation occurring as the chair is reclined or if the occupant sits forward on the seat portion.

One or more actuators may be provided under the forward edge, and could be provided under the front corner(s) for example.

Alternatively, or in addition, the seat portion may have two side zones, one on either side of the central zone, wherein the side zones are resiliently flexible and are substantially unsupported to enable the side zones to deform under the weight of an occupant's legs if the occupant sits sideways on the seat portion.

One or more actuators may be provided under each side edge.

The or each actuator preferably comprises a lever that is articulated to the underside of the peripheral edge region of the seat portion. The lever may require upward pulling toward the seat portion to actuate the mechanism, or may require downward pushing away from the seat portion to actuate the mechanism. The actuation lever preferably has a paddle surface sized and configured to receive a plurality of an occupant's fingers. In another alternative, the lever may require generally horizontal movement to actuate the mechanism. Any other suitable type of actuator could be used.

The chair may comprise a plurality of mechanisms that enable the chair to be reconfigured. By way of example, the mechanisms may comprise a height adjust spring that controls seat height, and a seat depth adjustment. The mechanism could be any other suitable type of mechanism. A separate actuator may be provided for each of the mechanisms. The or each actuator will preferably be operatively connected to the L=respective mechanism via a flexible linkage such as a cable for example. However, any other suitable connector could be used, such as an elongate rod for example.

The chair is preferably an office task chair.

In accordance with a fifteenth aspect of the present invention, there is provided a chair comprising: a supporting frame having a mounting section for mounting to an upper end of a height adjust pedestal that provides a height adjustable support for the supporting frame; a seat portion operatively supported from the supporting frame; and an actuation mechanism for actuating the height adjust pedestal, the actuation mechanism comprising a first lever that is articulated to the supporting frame and is biased toward the mounting section to engage with an upper end of the height adjust pedestal when mounted thereto, a second lever that is articulated to the first lever and comprising a portion adapted to selectively engage a release button on the height adjust pedestal to enable height adjustment of the height adjust pedestal, an actuator positioned for use by a seated occupant, and a flexible linkage that operatively connects the actuator to the second lever, such that when the mounting section of the supporting frame is mounted to an upper end of a height adjust pedestal, actuation of the actuator by a seated occupant causes said portion of the second lever to engage a release button on the height adjust pedestal, thereby enabling the height of the supporting frame to be adjusted.

Broadly, the fifteenth aspect of the present invention provides an actuation mechanism for a height adjust pedestal in a chair.

The first lever may be articulated to the supporting frame by a first pivot connection, and the second lever may be articulated to the first lever by a second pivot connection positioned toward the mounting section from the first pivot connection.

The first lever is preferably biased by at least one spring. Preferably, the spring is a torsion spring, although an alternative type of spring such as a leaf spring for example could be used.

The second lever preferably has a first section positioned generally parallel to the first lever and which comprises said portion, and a second section that extends generally transverse to the first section, with the flexible linkage operatively connected to the second section such that the cable pulls on the second lever in a direction generally transverse to the downward release direction of the height adjust pedestal button, to enable the height of the supporting frame to be adjusted.

The actuator may be any suitable known type, and that may be provided in any suitable position for use by a seated occupant. However, the benefit of using a flexible linkage is that the actuator can be provided on or in part of the chair that is configured to move relative to the support frame, and the height adjust pedestal will not be inadvertently released as the part of the chair moves relative to the support frame. For example, the actuator may be provided on or in any suitable part of the seat, back, or arm of the chair.

The preferred form of actuator is an actuator lever that is articulated to part of the chair. Preferably, the lever is articulated to the underside of the seat portion of the chair. The lever may be configured such that it must be pushed down away from the underside of the chair to release the height adjust pedestal, or such that it must be pulled up toward the underside of the chair to release the height adjust pedestal. Preferably, the actuator lever is pivoted to the underside of the seat portion, and is configured such that it must be pulled up toward the underside of the seat portion to release the height adjust pedestal.

The actuation lever preferably has a paddle surface sized and configured to receive a plurality of an occupant's fingers.

The flexible linkage preferably comprises a cable having a cable slidably received in a cable housing. The first lever preferably comprises a cable guide which receives the end of the cable housing, and the cable extends beyond the cable guide to engage with the second lever. A cable guide is also preferably provided adjacent the actuation lever, with the other end of the cable housing received in the cable guide and the cable extending beyond the cable guide to engage with the actuation lever.

The chair is preferably an office task chair.

In accordance with a sixteenth aspect of the present invention, there is provided a chair comprising: a supporting frame; a seat portion for supporting an occupant; and a back portion for supporting the back of a seated occupant, the back portion being reclinable relative to the supporting frame between a generally upright position and a generally reclined position; and a preference control operatively engaged between the back portion and a chair component, wherein the preference control is adjustable to vary an amount of displacement of the chair component for a given amount of displacement of the back portion toward the generally reclined position.

Broadly, the sixteenth aspect of the present invention provides a preference control in a chair that is adjustable to vary an amount of displacement of a chair component for a given amount of displacement of a back portion.

Preferably, the preference control comprises a preference block that is articulated to the supporting frame and is articulated to the back portion, and is operatively connected to the chair component. The preference block may be pivoted to the supporting frame of the chair and pivoted to the back portion of the chair. The preference control may comprise a preference pin that provides the pivoting of the preference block to the back portion of the chair. Preferably, the preference block and back portion each comprise an elongate slot through which the preference pin extends, wherein the preference pin is movable relative to the preference block to vary the amount of displacement of the chair component for a given amount of displacement of the back portion toward the generally reclined position.

The back portion slot may be provided in an integrally moulded part of the back portion. Alternatively, the back portion slot may be provided in a component that is connected to the back portion.

Preferably, the articulation of the preference block to the chair is spaced from a recline connection of the back portion to the supporting frame, such that an angular change of the preference control differs from an angular change of the back portion during recline.

The chair component may be the seat portion, and the chair may comprise a recline mechanism configured to move the seat portion upwardly upon a reclining action of the back portion, with the preference control incorporated into the recline mechanism. Preferably, the recline mechanism is configured to lift the seat portion upon a reclining action of the back portion. Preferably, the seat portion lifts and moves rearwardly upon a reclining action of the back portion. Preferably, the seat portion increases in rearward tilt angle as it lifts and moves rearwardly.

The recline mechanism may comprise a puller that pulls the seat portion rearwardly upon a reclining action of the back portion, and the preference control may be provided between the back portion and the puller. Alternatively, the preference control may be provided between the puller and the seat portion. The preference control could be used in a chair having a different type of recline mechanism.

The chair component may be a recline spring, and the preference control may be configured to vary the displacement of part of the recline spring for a given amount of displacement of the back portion toward the generally reclined position.

Preferably, the preference control provides a maximum mechanical advantage setting and a minimum mechanical advantage setting for the back portion. Preferably, the preference control provides at least one intermediate mechanical advantage setting for the back portion. Preferably, the preference control provides at least two intermediate mechanical advantage settings for the back portion.

A chair preferably comprises at least one actuator that enables a user to select a desired mechanical advantage of the back portion. The recline mechanism may be provided with a plurality of actuators. The actuator(s) could be any suitable type.

One or more of the above aspects may be provided with a lumbar support to provide additional support to a lumbar region of an occupant's back when sitting in a normal forward orientation in the chair, the lumbar support comprising two spaced apart occupant supporting portions that provide substantially independent support for the two sides of the occupant's lower back.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

In order that the invention may be more fully understood, some embodiments will now be described by way of example with reference to the accompanying figures in which:

FIG. 109 is a side view similar to FIG. 107, but showing a lowest mechanical advantage setting, in which the mechanical advantage is lowest;

FIG. 110 is a front overhead perspective view of part of the back portion of the chair of FIG. 56, showing a preferred form lumbar support;

FIG. 111 is a front view of the back portion of the chair shown in FIG. 110;

FIG. 112 is a side sectional view of the back portion of the back portion of the chair along line 112-112 of FIG. 111; and FIG. 113 is a front overhead perspective view of the lumbar support, showing the independent movement of the sides of the lumbar support.

DETAILED DESCRIPTION OF PREFERRED FORMS

Since the figures illustrate the preferred form chairs from various different angles as convenient to explain certain parts, an arrow marked "F" has been inserted into the figures where appropriate to indicate a forward direction of the chair. Accordingly the terms forward, rearward, left side, and right side (or similar) should be construed with reference to the forward direction F of the chair, not necessarily with reference to the orientation shown in the particular figure.

The features of the preferred form chairs are described and shown herein to give a full understanding of the components and operation of the preferred form chair. It will be appreciated that not all of the features described herein need be provided in every chair.

First Preferred Form Chair

Figure 1:
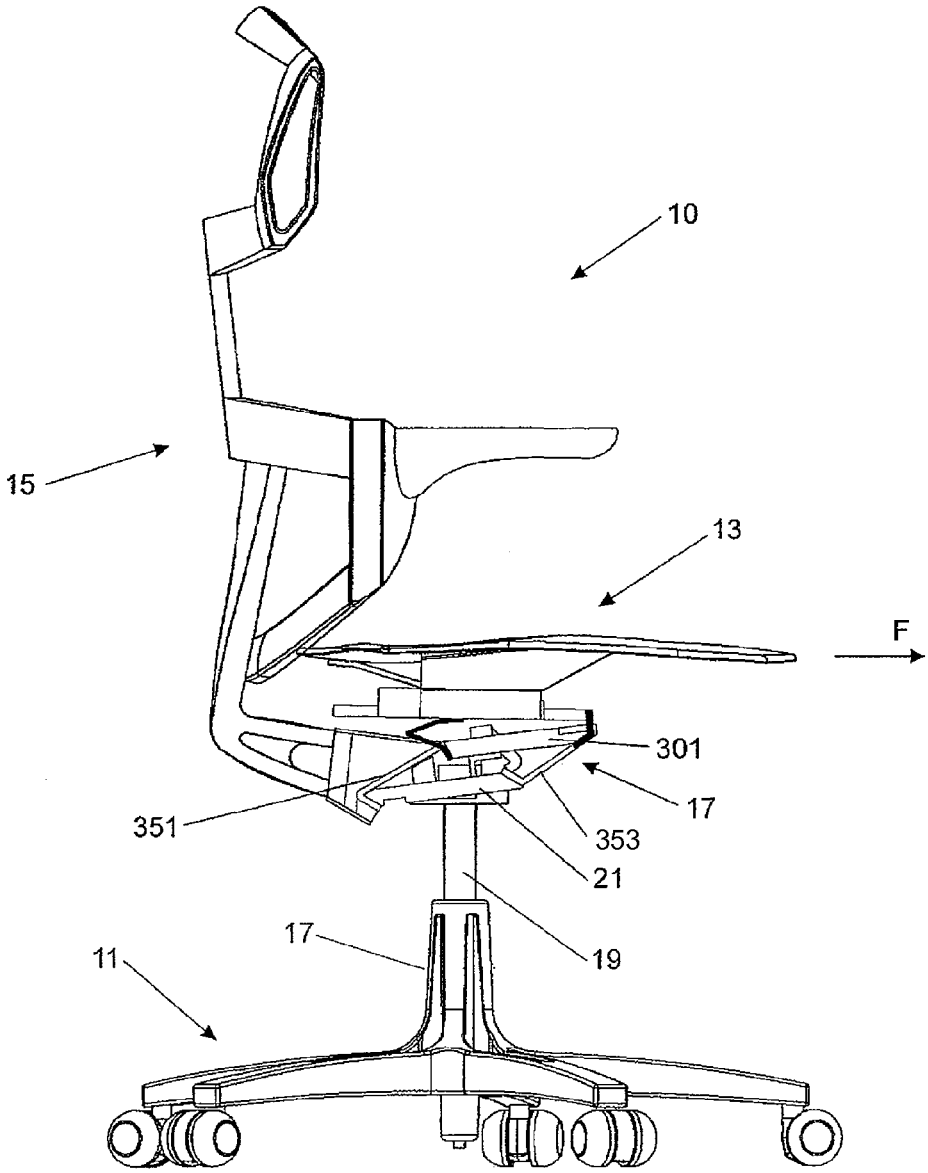
FIG. 1 is a side elevation view of a first preferred form chair.

FIG. 1 illustrates an office chair 10 including a main assembly having a seat portion 13 and a back portion 15. The seat portion 13 and the back portion 15 are operatively supported above the ground by a supporting frame including a wheeled or castored base 11 having a central support column 17 housing a pneumatic spring 19 for selective height adjustment of the main assembly. The base 11, support column 17, and spring 19 form a height adjust pedestal. An upper end of the pneumatic spring is connected to the main transom 21 of the chair. The castored base 11, pneumatic spring 19, and main transom 21 all form part of the supporting frame.

Details of the castored base will be described below with reference to FIGS. 51 and 52, and the main transom will be described in more detail below with reference to FIGS. 1 to 5.

Back Portion

Referring to FIGS. 23 to 29, the back portion 15 has a back frame 25. The back frame has a relatively wide lower portion 27, a relatively wide upper portion 29 that is vertically spaced from the lower portion, and a relatively narrow interconnecting region 31 interconnecting the lower portion and the upper portion. The lower portion 27 is adapted to extend across and support at least a major part of a lower region of a seated adult occupant's back, and the upper portion is adapted to extend across and support at least a major part of an upper region of the occupant's back. In the finished chair the back frame 25 has a cover 61 pulled taut and operatively connected to the upper and lower ends of the back frame to provide a supporting surface for the back of the seated occupant in a manner described more fully in connection with FIGS. 35*a* to 40.

The lower portion 27 has a transversely extending top member 33, a transversely extending bottom member 35, and at least two spaced apart generally vertical members 37*a*, 37*b* interconnecting the top and bottom members. In the form shown, the vertical members 37*a*, 37*b* are each positioned at a respective end of the top and bottom transverse members. However, in alternative embodiments, the vertical members could be positioned inwardly from the ends of the transverse members.

The relatively narrow interconnecting region is configured to be positioned generally in the region of, or above, a seated adult occupant's lumbar region.

The top 33 and bottom 35 members are generally concave when viewed from the front of the seat, and are sufficiently wide such that the outer ends of the top and bottom members extend around the sides of the lower back of a seated adult occupant, so that the lower portion of the back frame "cups" the lower back of the seated occupant.

The upper portion 29 has a transversely extending top member 39, a transversely extending bottom member 25, and at least two spaced apart generally vertical members 43*a*, 43*b*, 45*a*, 45*b* interconnecting the top and bottom members. In the form shown, the upper portion has four vertical members, the purpose of which will be described below with reference to FIGS. 30 to 34. Again, the generally vertical members may be positioned at or toward a respective end of the top and bottom transverse members. In one embodiment, the top member 39 is generally linear when viewed from above the back portion (see FIG. 3 for example) or may be generally concave when viewed from the front of the back portion. The bottom member 41 is generally concave when viewed from the front of the back portion. Accordingly, the upper portion 29 also "cups" the back of adult seated occupant, although to a lesser extent than the lower portion 27 as an adult's upper back region is typically flatter and wider than their lower back region.

The relatively narrow interconnecting region 31 is defined by a generally vertical member that is connected to the bottom transverse member 41 of the upper portion and the upper transverse member 33 of the lower portion. The relatively narrow interconnecting region 31 is of a resiliently flexible construction, to provide a flexing movement in a rearward direction of the upper portion 29 relative to the lower portion 27. The flexing is indicated by arrow R1 in FIGS. 23 and 24.

The relatively narrow interconnecting region 31 may consist of a single member as shown, or alternatively could consist of more than one member.

Figure 23:
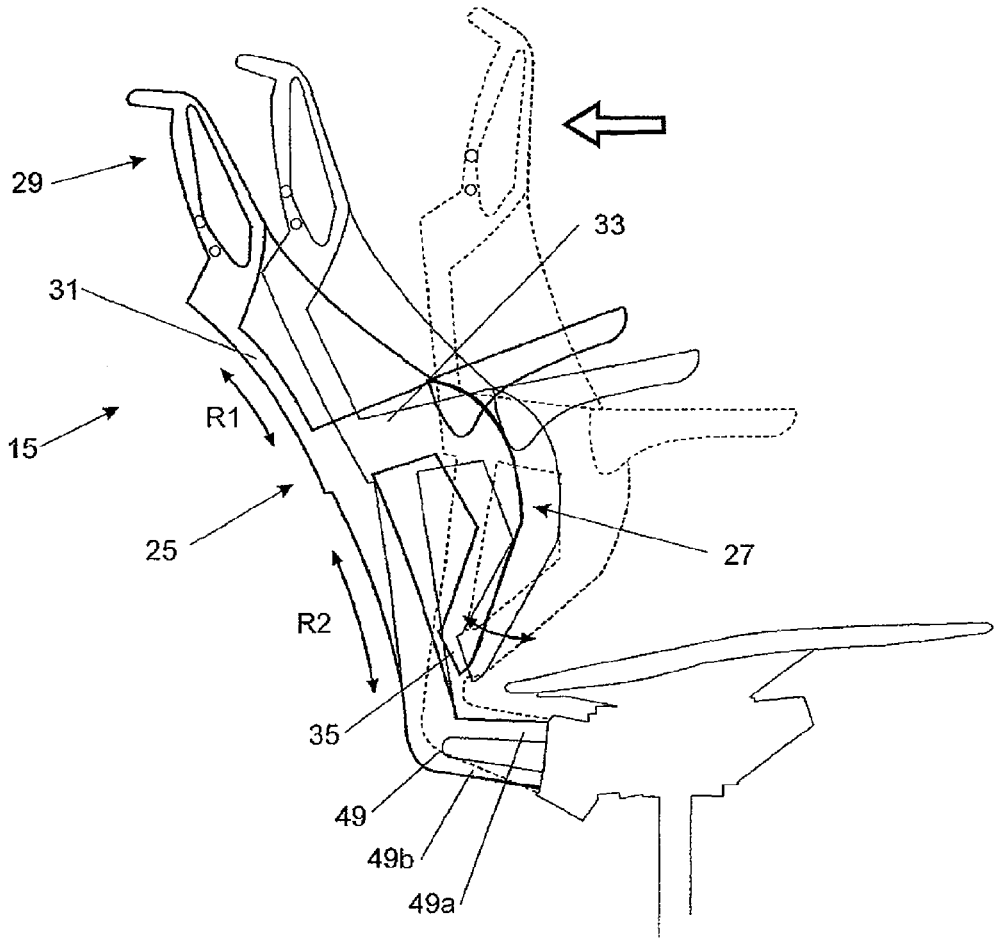
FIG. 23 is a side elevation view showing a reclining action of the preferred form back portion of the chair of FIG. 1.

The back portion comprises at least one support member 47*a*, 47*b* extending from the lower portion 27, to provide a means of supporting the back portion from another part of the chair, such as the main transom of the supporting frame, the seat portion, or from both the seat portion and supporting frame. In the form shown, the back portion has two horizontally spaced support members. The support members 47*a*, 47*b* are connected to the lower portion 27 of the back frame, at or adjacent a top edge of the lower portion of the back frame. In the form shown, the support members are connected to the top transverse member 33 of the lower portion of the back frame. A lower region of the lower portion 27 of the back frame is free of any connection to the support member(s), as shown in FIG. 23.

The support members 47*a*, 47*b* are of a resiliently flexible construction, to provide a flexing movement of upper parts of the support members in a rearward direction relative to a lower part of the support members. The flexing movement is indicated by arrows R2 in FIGS. 23 and 24. As shown in FIG. 23, as the lower region of the lower portion 27 is free of connection to the support members, that will result in a forward movement of the lower region of the lower portion of the back frame relative to the support members as the support members flex.

In alternative configurations, the support members 47*a*, 47*b* may be spaced further apart and connected to components 37*a*, 37*b* anywhere along those members. For example, each support member 47*a*, 47*b* may be connected to respective members 37*a*, 37*b* at the intersection of members 37*a*, 37*b* with cross member 33. As another example, the support members 47*a*, 47*b* may be attached to components 37*a*, 37*b* at or adjacent lower ends thereof.

In the form shown, the horizontally spaced support members 47*a*, 47*b* are adjoined at lower ends thereof by an integral transverse connector member 49. The transverse connector member incorporates upper and lower connectors 49*a*, 49*b* that extend in a generally forwardly-directed V-shaped configuration.

The back frame and support members are of a unitary construction, and may be moulded from a polymeric material for example.

The support members 47*a*, 47*b* may be configured such that the flexing is substantially limited to a forward/rearward direction; that is the flexing in the or each support member occurs within a plane extending through the or each support member in a forward/rearward direction.

Figure 25:
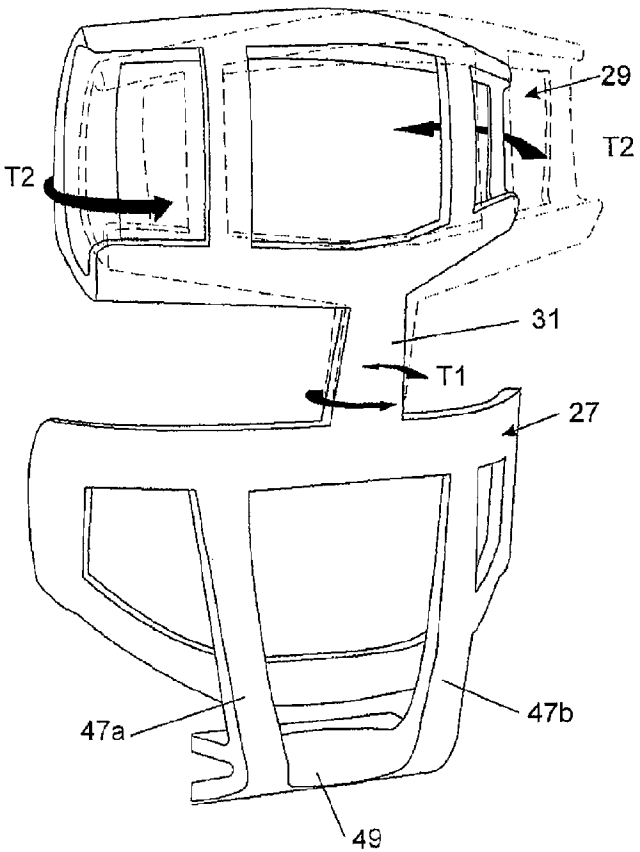
FIG. 25 is a view similar to FIG. 24, showing twisting actions.
Figure 24:
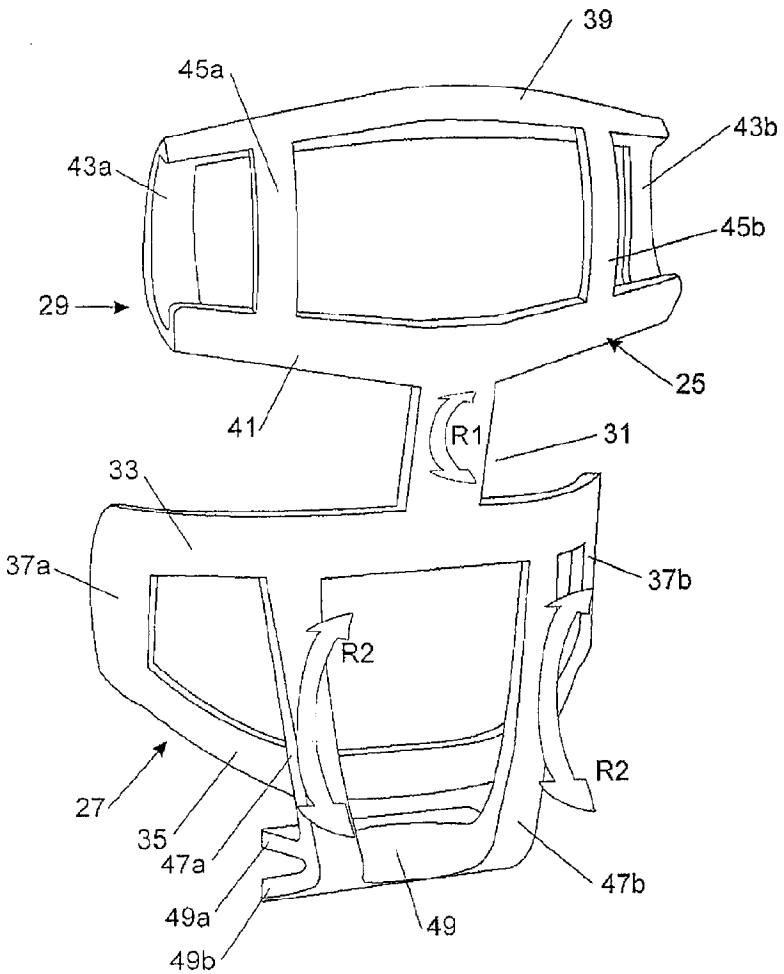
FIG. 24 is a rear perspective view of the preferred form back portion of the chair of FIG. 1, showing regions of flexibility.

Referring to FIG. 25, the interconnecting region is configured to twist T1 with a torsional action about an axis extending along the relatively narrow interconnecting region, to enable the upper portion of the back frame to twist relative to the lower portion of the back frame as indicated generally by T2. Such a configuration enables the upper portion 29 of the back frame to twist relative to the lower portion 27 as a seated occupant turns their shoulder region while seated in the chair. It will be appreciated that the upper portion will be able to twist in either direction. It is preferred that the lower portion of the back frame is also adapted to twist about an axis extending substantially parallel to and between the members 47*a*, 47*b*, to a lesser extent than the upper portion. The twisting of the lower portion is provided by the flexibility of the support members 47*a*, 47*b*. The amount of twist of the lower portion is preferably less than the amount of twist of the upper portion.

As flexibility is provided through the interconnecting region and the support members, the upper and/or lower portion of the back frame may be substantially rigid. In an alternative embodiment, the upper and/or lower portions of the back frame may be of a resilient construction.

Figure 26:
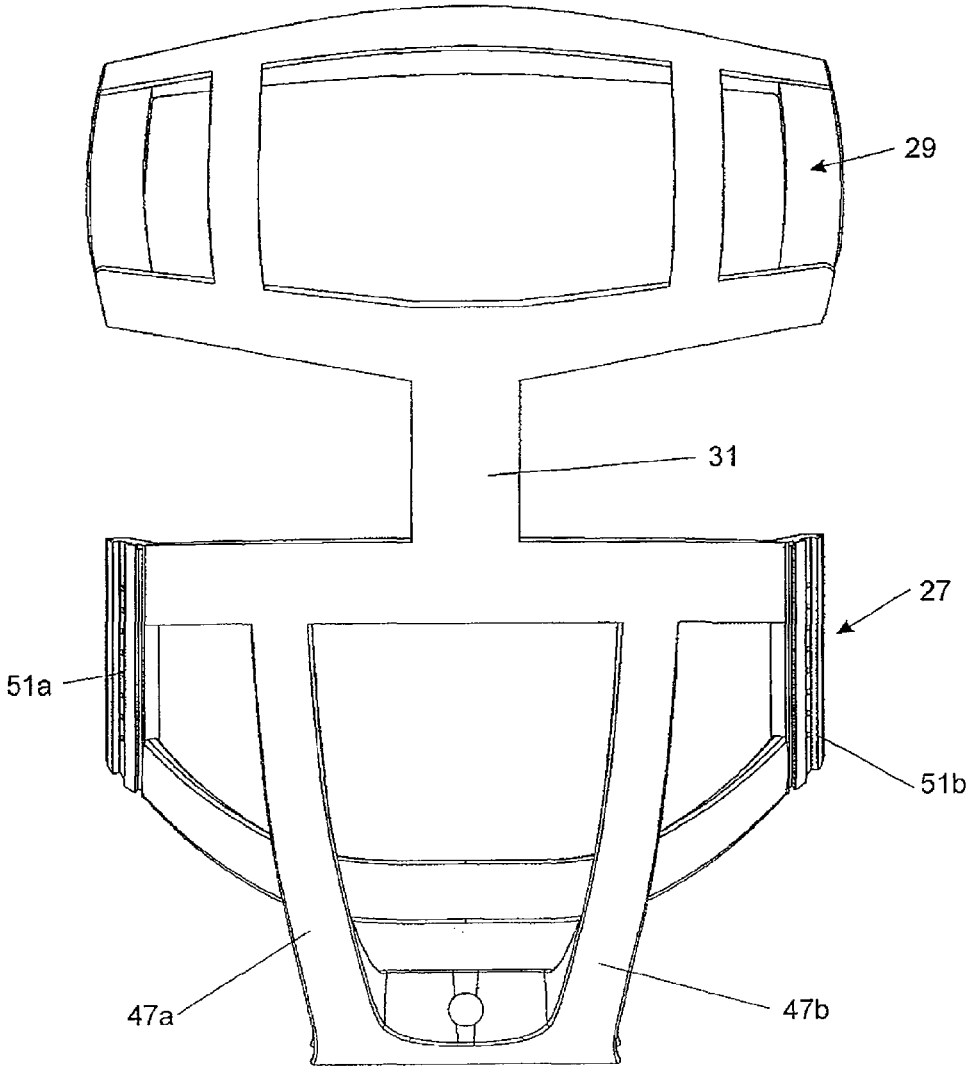
FIG. 26 is a rear view of the back frame, showing mounting regions for arm rests.

As shown in FIG. 26, the lower portion of the back frame may incorporate arm rest supports 51*a*, 51*b* to support arm rests in a cantilevered manner from the back portion as described in more detail below with reference to FIGS. 44 to 49*c*.

Figure 28:
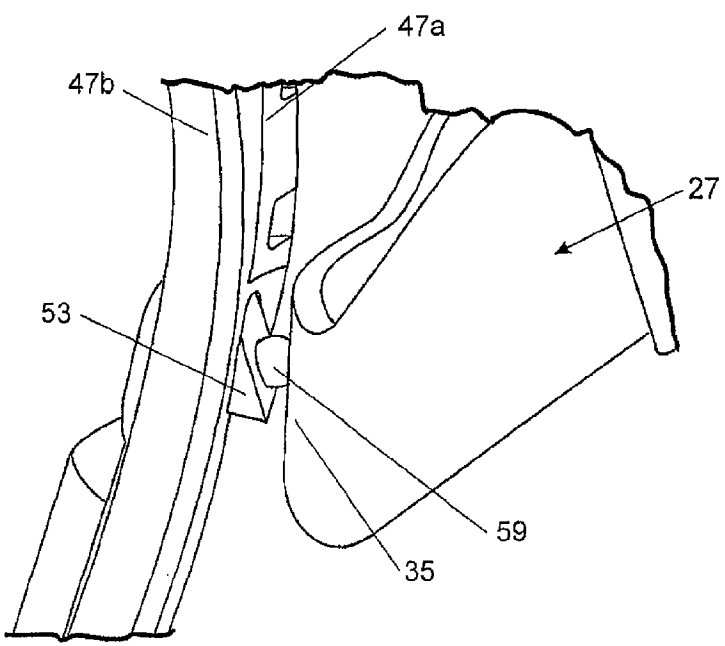
FIG. 28 is a view similar to FIG. 27, but with the lower portion in engagement with the support block.
Figure 27:
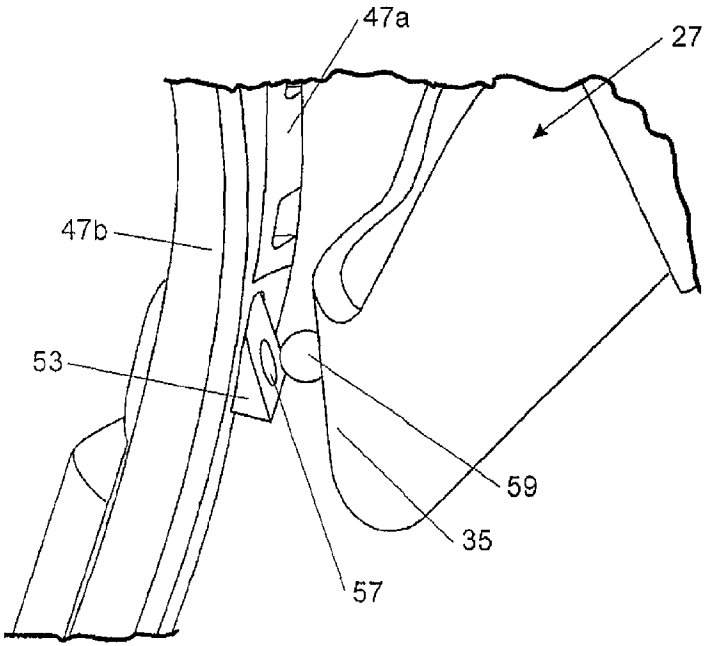
FIG. 27 is a detail side elevation view of a support block for a lower portion of the preferred form back portion of the chair of FIG. 1, with the lower portion moved forward relative to the support block.
Figure 29:
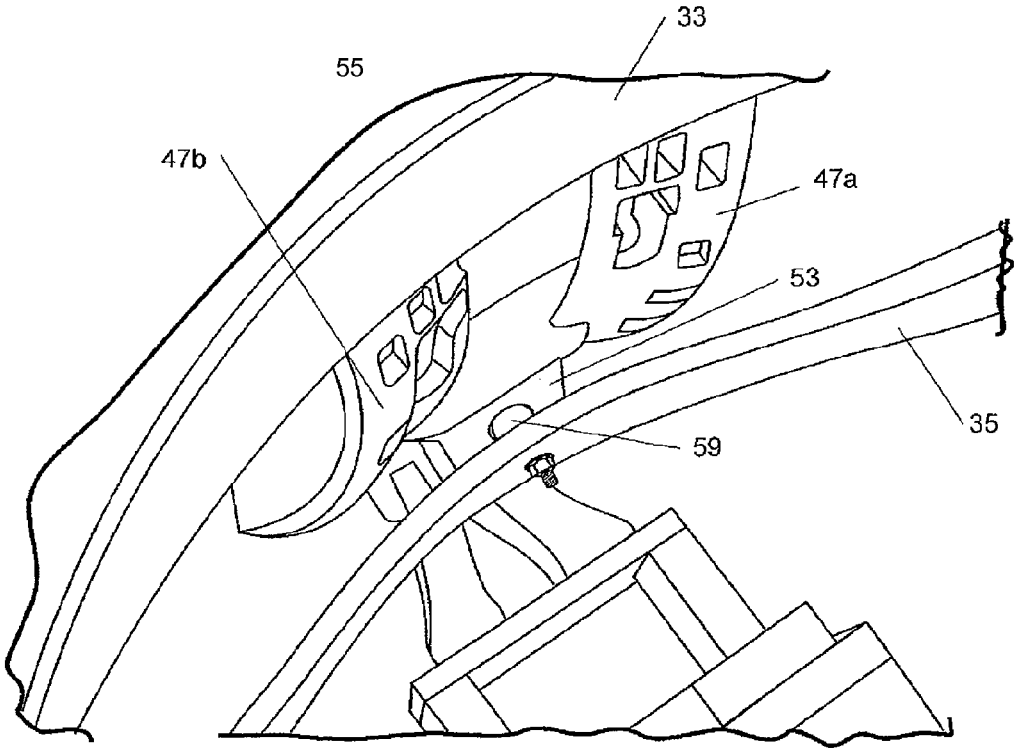
FIG. 29 is an overhead perspective view of the section show in FIG. 27, with the lower portion in engagement with the support block.
Figure 30:
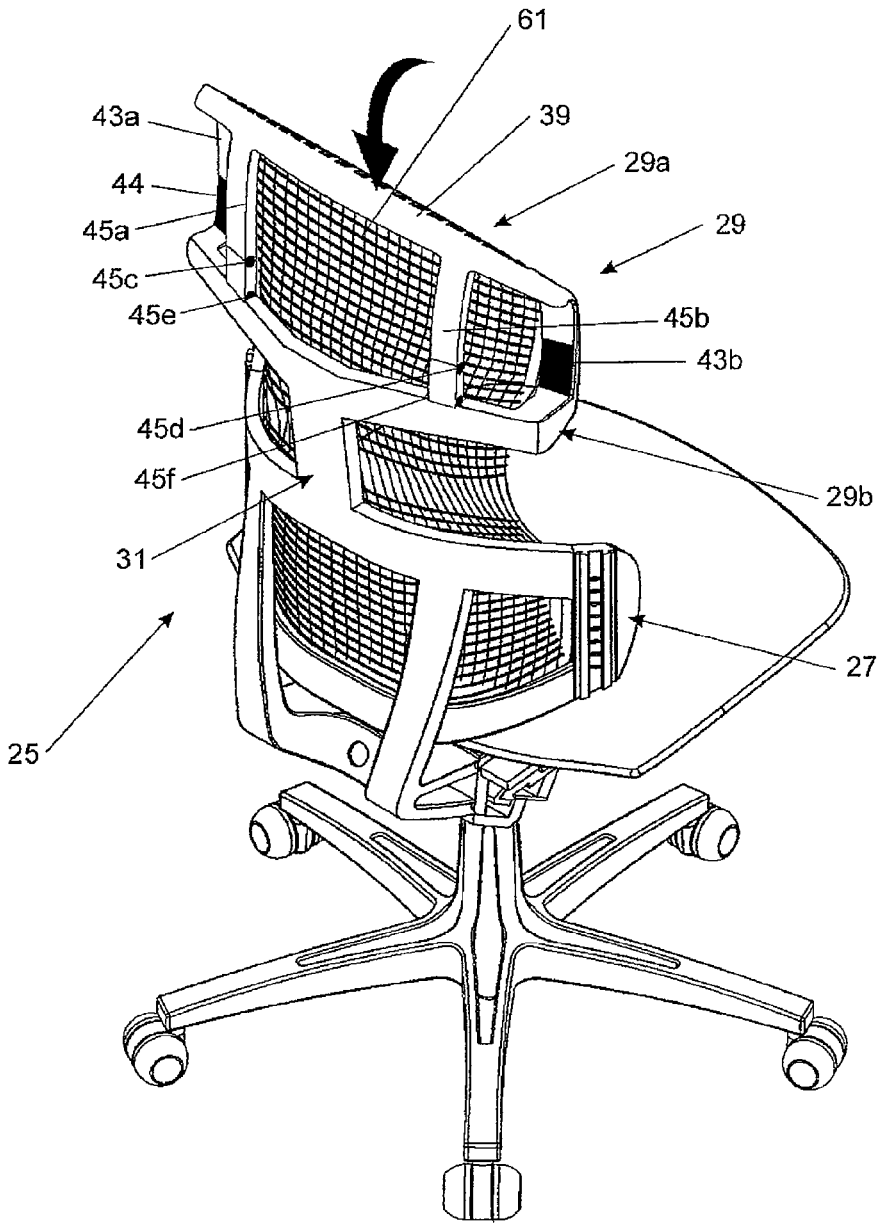
FIG. 30 is a rear overhead perspective view of the back portion of the chair of FIG. 1, showing an upper section in an upright configuration.

As shown in FIGS. 27 to 29, the back portion comprises a support block 53 to limit rearward movement of the bottom of the back frame relative to the support member(s). A cross member 55 extends between the support members 47*a*, 47*b* to mount the support block. The support block includes a curved recess 57 to receive a curved surface of an engagement member 59. The engagement member is mounted to the bottom transverse member 35 of the lower portion of the back frame. In the form shown, the engagement member is spherical, but could be any other suitable shape.

The support block 53 and engagement member 59 act to transfer downward load applied to the arm rests as a chair occupant pushes down against the arm rests to assist them in exiting the chair, to the support members 47*a*, 47*b* and thereby the part of the chair that supports the support members. By having a curved recess and/or a curved engagement member, a pivoting support action is provided during twisting movement of the lower portion of the back frame.

In the form shown, the support block is mounted to the support members (via a cross member) and the engagement member is mounted to the back frame. Alternatively, the configuration could be reversed.

The chair could be provided with a plurality of support blocks and engagement members.

Figure 35A:
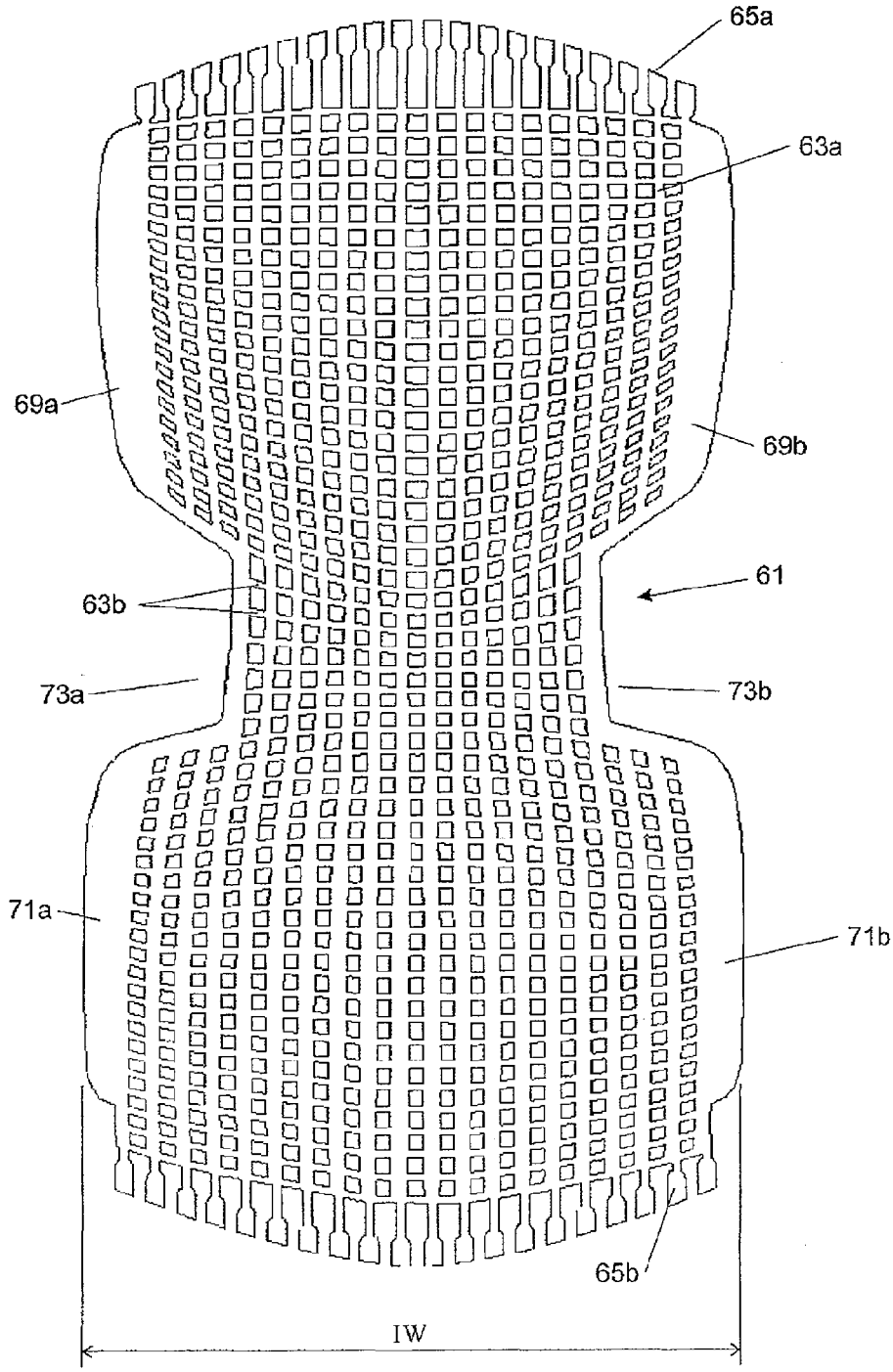
FIG. 35*a* is a front view of a preferred form back cover/skin of the chair of FIG. 1, in an as-moulded configuration.
Figure 35B:
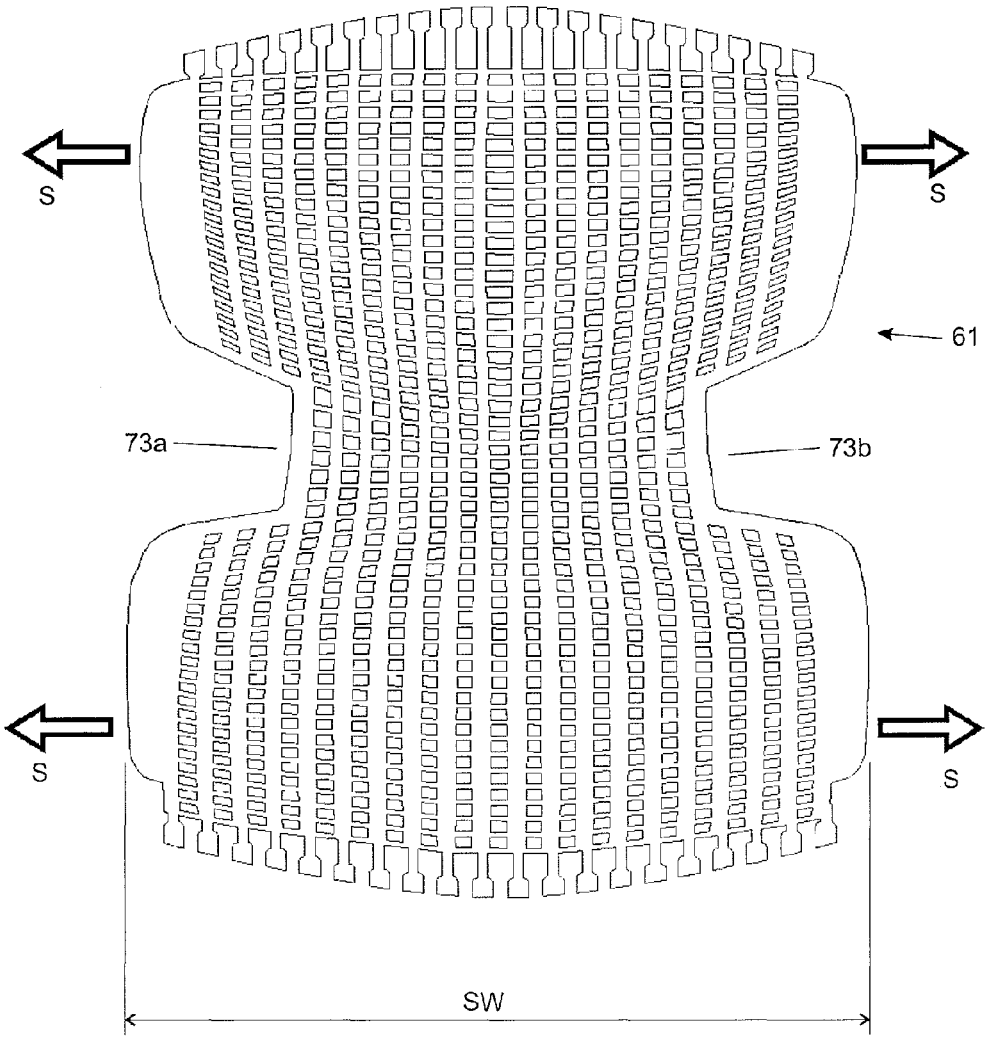
FIG. 35*b* is a front view of the back cover/skin of FIG. 35*a*, in a stretched configuration.
Figure 35C:
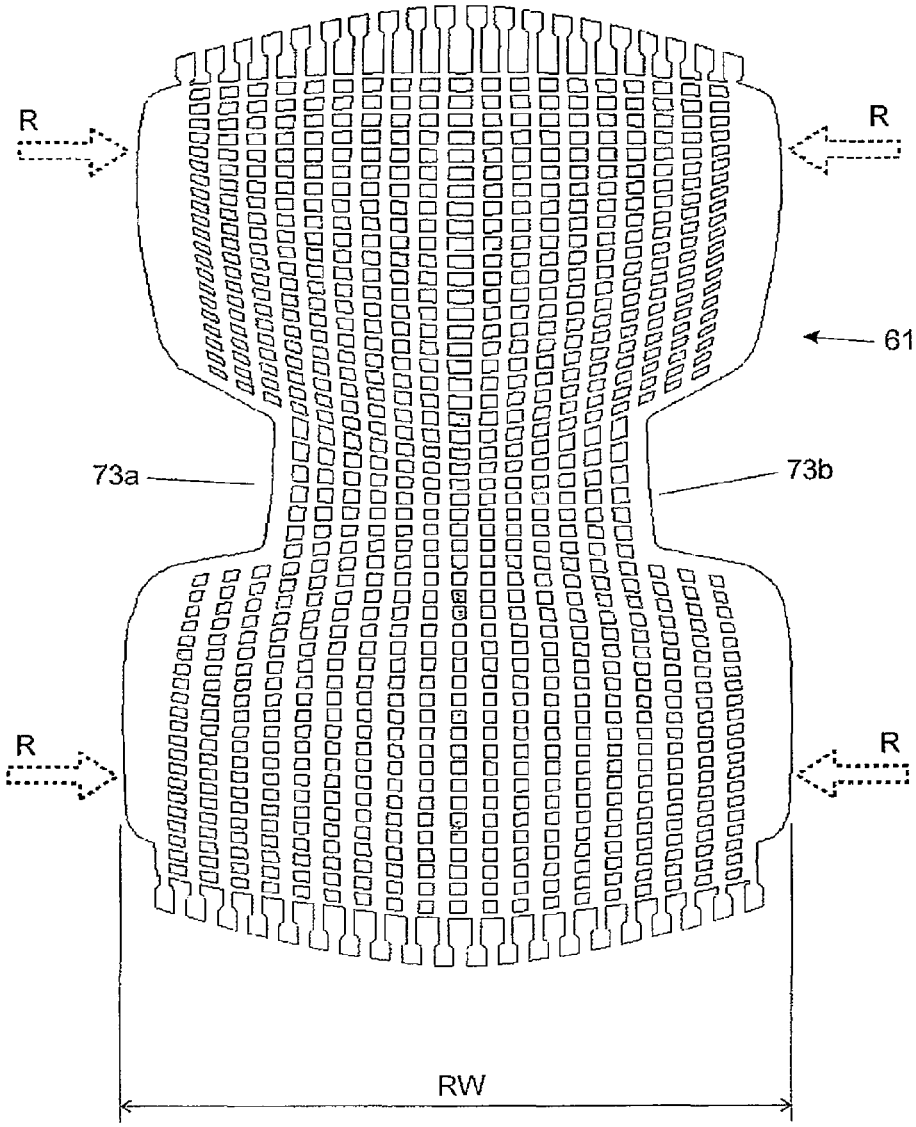
FIG. 35*c* is a front view of the back cover/skin of FIG. 35*a*, in a relaxed configuration.

Referring to FIGS. 35*a* to 40, a resiliently flexible cover is pulled taut and operatively connected to the back frame to provide a supporting surface for the back of the seated occupant. The cover is in the form of a non-woven mesh having a plurality of longitudinally extending elongate members 63*a* and a plurality of transversely extending elongate members 63*b*. The cover 61 is formed as a moulded polymeric item, and the as-moulded form is shown in FIG. 35*a*. Referring to FIGS. 35*a* and 36*a*, a dimension—in the form shown an initial width IW—of the as-moulded cover is less than a corresponding dimension of the back frame. To ready the cover for attachment to the back frame, the cover is stretched S so that the stretched dimension of the cover—stretched width SW—is greater than the corresponding dimension of the back frame—see FIGS. 35*b* and 36*b*. The cover is then relaxed R to provide a post-relaxation dimension—relaxed width RW—between the as-moulded dimension and the stretched dimension—see FIGS. 35*c* and 36*c*. Preferably, the post-relaxation dimension is similar to said dimension of the back frame. The cover can then be supported from the back frame.

Figure 36C:
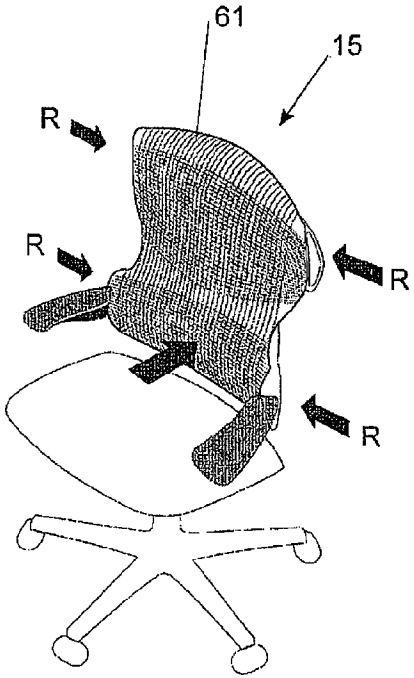
FIGS. 36*a*, 36*b*, and 36*c* are schematic front overhead perspective views of a preferred method of mounting the cover/skin of FIGS. 35*a-c* to the back frame, with the skin in the as-moulded, stretched, and relaxed configurations respectively.
Figure 36B:
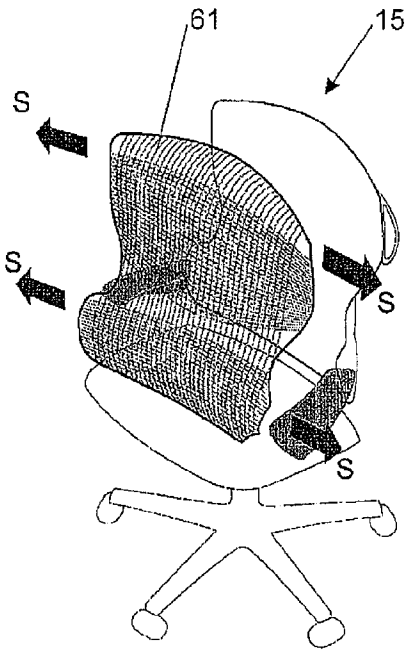
Figure 36A:
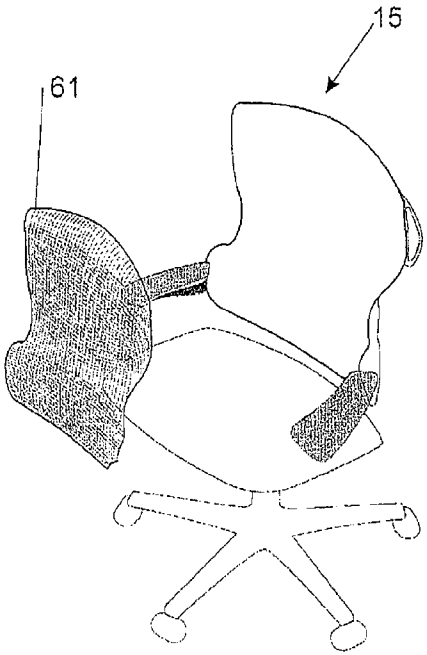

While the back portion is shown schematically in FIGS. 36*a*-36*c*, it will be appreciated that the back portion will preferably of the type shown above having a back frame. However, this type of cover and method can be used with different back portions.

As the cover is stretched and then relaxed in the transverse dimension, the transverse elongate members 63*b* are thereby stretched and then relaxed along their lengths.

The polymeric material is suitably an elastomeric material, such as thermoplastic polyurethane elastomer (TPU) or a nylon elastomer for example. Most preferably, the polymeric material is HYTREL, which is a thermoplastic polyester elastomer available from Du Pont.

HYTREL is made from hard crystalline polybutylene terephthalate (PBT) and soft amorphous polyether glycol. By stretching the lengths of the polymeric members, strain orientation occurs. In the as-moulded product, the polymer chains are relatively random. Following strain orientation, the polymer chains become aligned. That changes the material properties. Typically, the material becomes stronger and more elastic; that is the elastic limit is increased in comparison to the as-moulded material. For example, for the HYTREL 63xx series the linear elastic strain limit typically increases from 14% to 28%. The required orientation ranges from about 370% for HYTREL 6356 to about 750% for HYTREL 4069. That is, the stretched dimension of a strand would need to be about 3.7 times the as-moulded dimension for HYTREL 6356, and would need to be about 7.5 times the as-moulded dimension for HYTREL 4069. It will be appreciated that the strain orientation can occur in other elastomers, and the stretched to as-moulded ratios could be varied accordingly depending on the material.

The stretched dimension to as-moulded proportions can be varied through different parts of the cover, to provide varying properties throughout the cover. For example, the relatively narrow region of the cover may be stretched to a different extent than the other parts of the cover.

The method could be used with any material in which strain orientation occurs, or in which the properties of the material are otherwise beneficially modified by stretching and relaxing the material.

Depending on the material used, the stretched dimension SW of the cover is preferably such that the stretched length of a strand in the stretching direction is between about 3 and about 10 times the as-moulded length, more preferably between about 3 and about 8 times the as-moulded length. The ratio of stretched dimension SW to as-moulded dimension IW will be calculated accordingly. The post-relaxation dimension RW will suitably be a value that results in the post-relaxation length of a strand being a desired value. Preferably, for a strand in the stretching dimension, the stretched length is preferably about six and a half times the as-moulded length. When HYTREL 6356 is used, the length dimension is preferably between about 3.25 and about 4.25 times the as-moulded length, most preferably about 3.7 times. When HYTREL 4069 is used, the stretched length is preferably between about 5 and about 8, more preferably between about 6 and about 7, most preferably about 6.5 times the as-moulded length. It will be appreciated that the transverse strands of each transverse elongate member are crossed by longitudinal members. The stretching of the longitudinal members across their widths will be less than the stretching of the strands of the transverse elongate members, so the dimension changes for the overall cover will be less than those for the strands.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

The method may further comprise abrading at least a surface of the cover to provide a napped surface. Generally, that would be the front surface that a seated occupant rests against in use. The abrading will occur following moulding, and may occur prior to or following the stretching or relaxing step.

Figure 37:
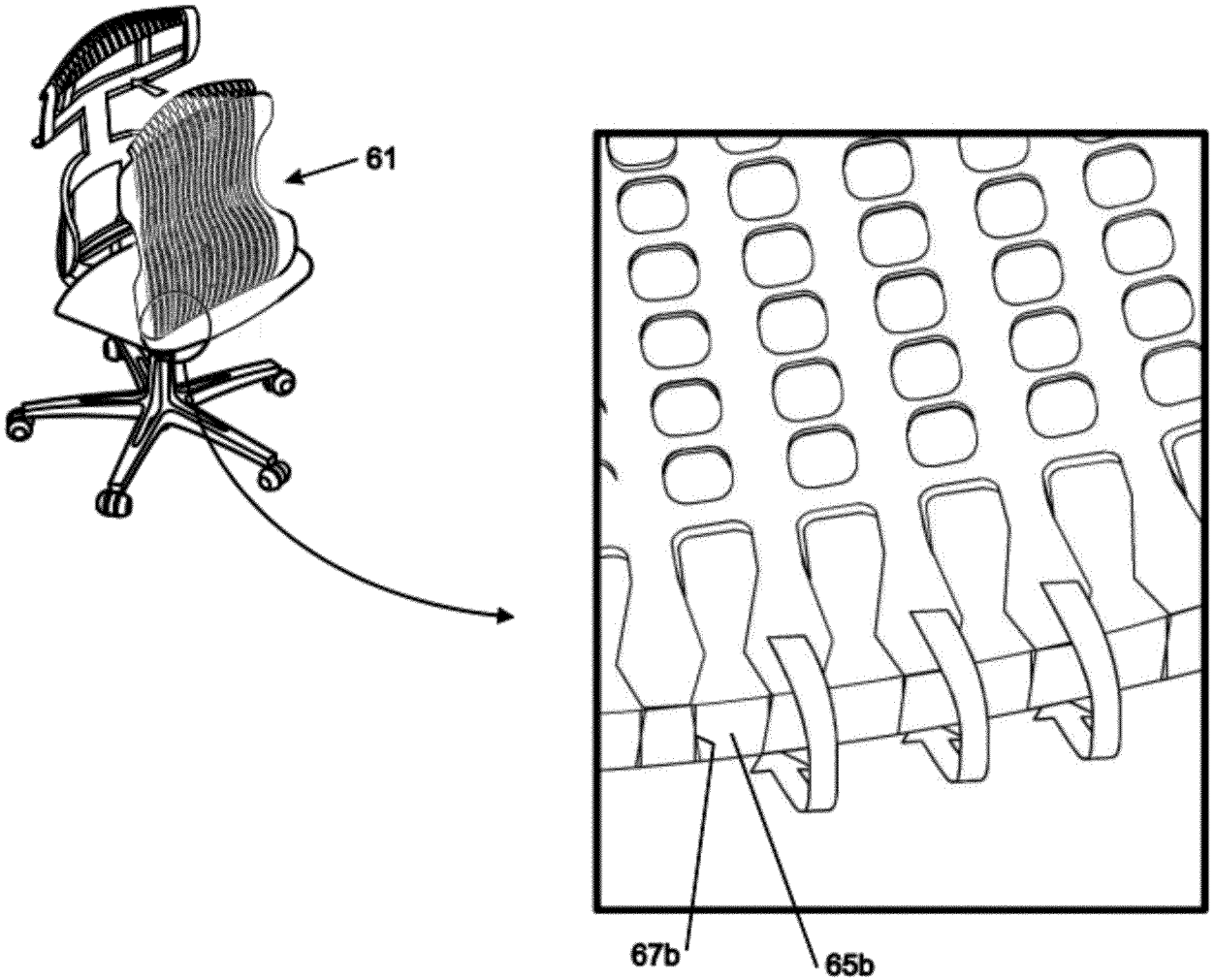
FIG. 37 is a schematic view of a preferred form mounting arrangement of the lower end of the cover/skin to the back portion of the chair of FIG. 1.
Figure 38:
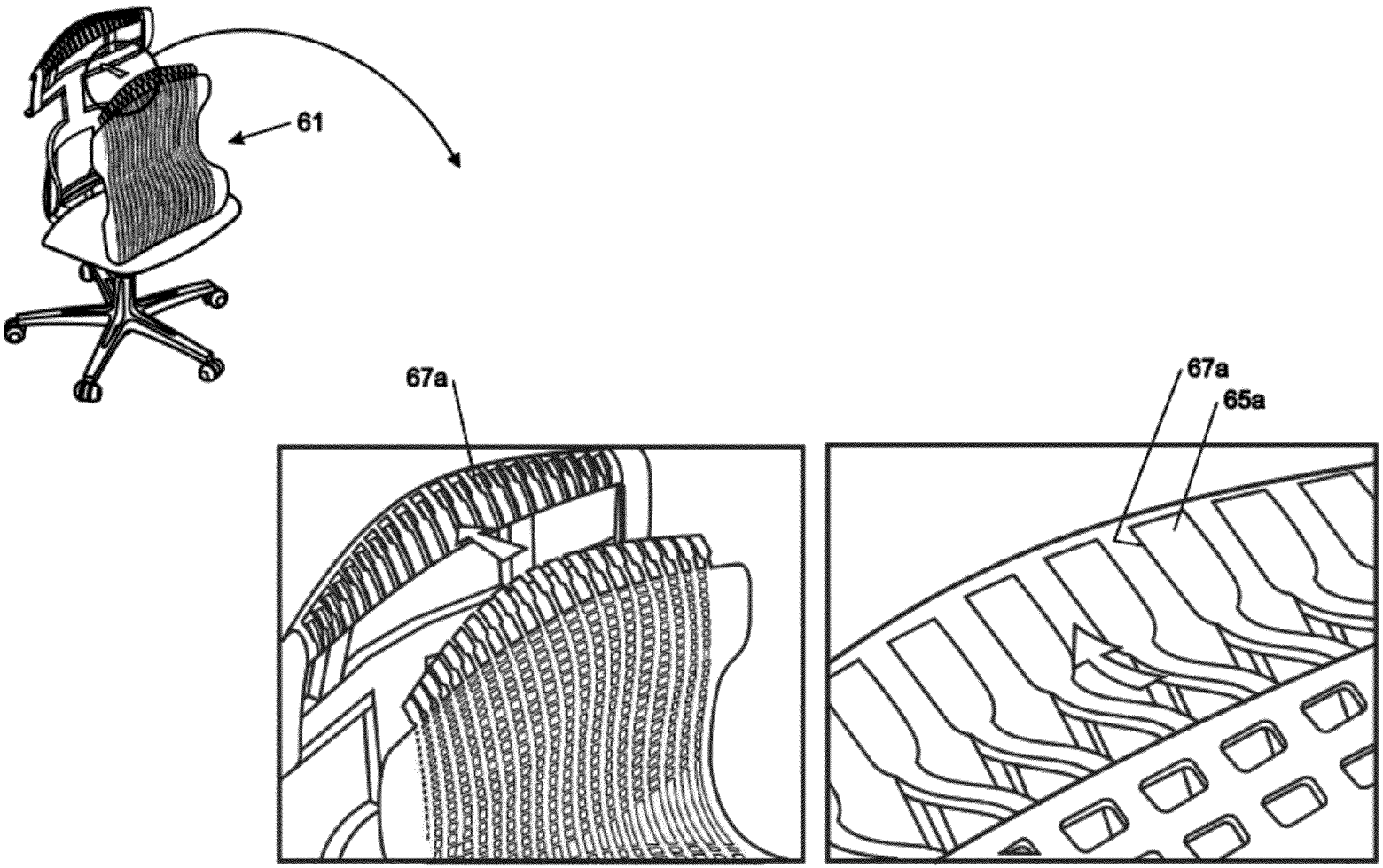
FIG. 38 is a schematic view of a preferred form mounting arrangement of the upper end of the cover/skin to the back portion of the chair of FIG. 1.

As shown in FIG. 35*a*, the upper and lower ends of the longitudinal elongate members 63*a*, 63*b* are provided with integrally moulded attachment features in the form of attachment members 65*a*, 65*b* to attach the cover to the back frame. The attachment members are in the form of enlarged heads that are receivable in recesses in the back frame. As shown in FIG. 37, the lower heads 65*b* preferably extend around the underside of the back frame and are received in recesses 67*b*, and as shown in FIG. 38 the upper heads 65*a* preferably extend into recesses 67*a* from above. As the cover is resilient, once the heads are fitted into the recesses, the resilience of the cover will retain the heads in engagement with the recesses by pulling the heads 65*a* toward heads 65*b*.

Figure 39:
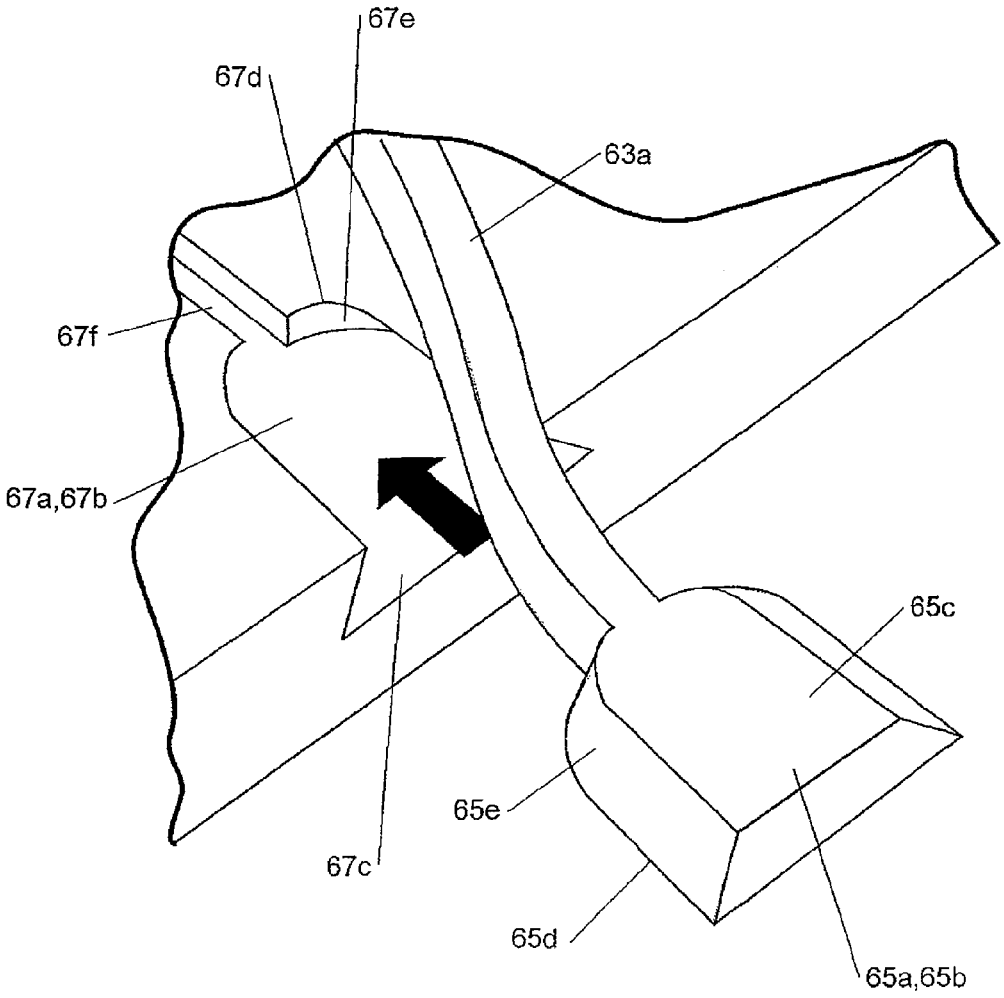
FIG. 39 is a detail view showing mounting features on the cover/skin and back frame of the chair of FIG. 1.

FIG. 39 shows a suitable form of head 65*a*, 65*b* and recess 67*a*, 67*b*. The head 65*a*, 65*b* has a relatively narrow first face 65*c* and a relatively wide second face 65*d*, with tapered side walls 65*e* extending between the front and rear faces. Similarly, the recess has a relatively wide base 67*c* and a relatively narrow opening 67*d*, with tapered side walls 67*e* extending between the base and the opening. A slot 67*f* extends from the recess for receipt of the elongate member 63*a*. The resilience of the cover material causes the head 65*a*, 65*b* to naturally pull in the direction of the arrow, thereby maintaining the head in position in the recess. The tapered side walls prevent the heads from pulling out of the recesses. Similar recesses may be provided on the rear side of the back frame for the heads 65*b*.

Figure 40:
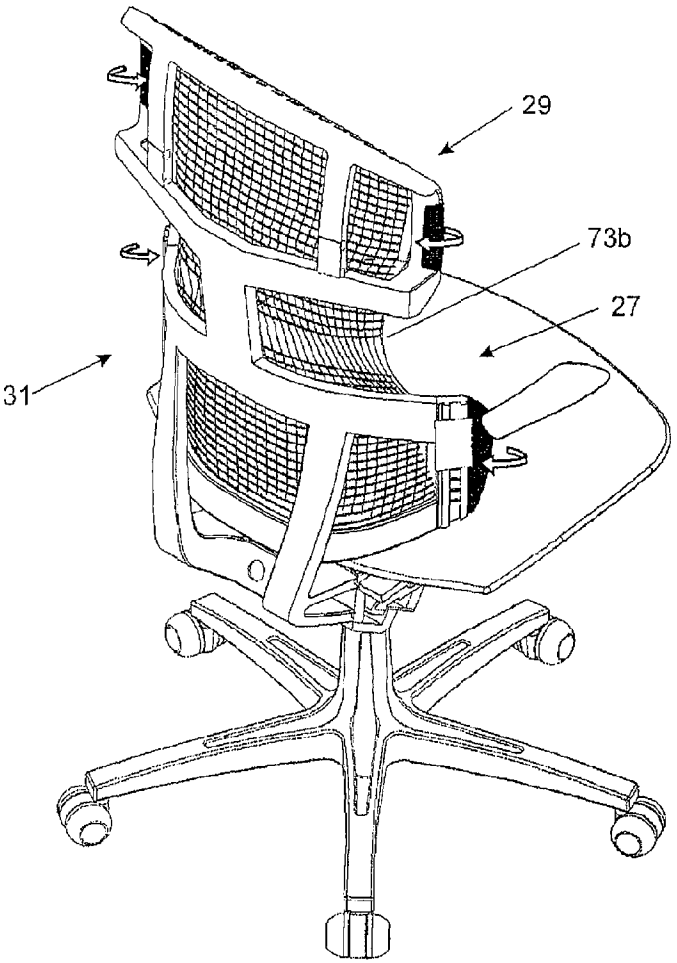
FIG. 40 is a rear overhead perspective view of the back portion of the chair of FIG. 1, showing a preferred form mounting arrangement of the cover/skin to the back frame.

FIG. 40 shows a suitable means of attaching the sides of the cover to the upper and lower portions 29, 27 of the back frame. The sides of the cover are preferably configured to encompass and capture parts of the frame, thereby maintaining the cover in position on the back frame. That is, the sides of the cover may form pockets 69*a*, 69*b*, 71*a*, 71*b* (FIG. 35*a*) that are sized and configured to receive parts of the back frame. Any other suitable means of connection could be used. The cover may be free of connection to the relatively narrow interconnecting region of the back frame 31, and the cover may be suspended between the upper 29 and lower 27 portions of the back frame.

Any other suitable means of connection could be used to operatively connect the cover to the back frame and support the cover from the back frame. For example, separate fasteners could be used to connect the cover and the frame. As another alternative, one or more retaining strips could be used to connect the cover to the frame.

The step of relaxing and supporting may occur concurrently. That is, the cover may be relaxed directly onto the back frame, and the frame captured the pockets as the relaxation occurs.

However, the method allows different steps to be carried out at different times and/or locations if desired. For example, the cover could be pre-moulded, stretched and relaxed as part of the manufacturing step, and then delivered to a separate location and supported from a chair frame. Alternatively, the as-moulded cover can be delivered in a pre-stretched state, and then stretched and relaxed and connected to the chair.

While in the form shown the cover is stretched and relaxed in the transverse (width) dimension, alternatively or in addition, the cover can be stretched and relaxed in the longitudinal dimension, so the generally longitudinally extending elongate members are stretched and then relaxed as the cover is stretched and relaxed. Alternatively, the cover may be stretched and relaxed in both the transverse and longitudinal dimensions. The step of stretching may comprise stretching the cover in 360°. That is particularly useful if the cover comprises an irregular configuration of members or diagonal members.

The same method may be used to support a cover from a seat frame to form a seat portion.

As can be seen in FIGS. 35*a*, 35*b*, 35*c*, and 40, the cover comprises a recessed section 73*a*, 73*b* extending into each side of the cover from opposite sides. The recessed sections correspond generally in vertical position to the relatively narrow interconnecting region 31 of the back frame, to provide a clearance space for the elbows of a seated occupant.

The chair may be provided with arm rests as described below, in which case the recessed sections preferably provide a clearance space for the elbows of the seated occupant when their arms are supported on the arm rests.

As the cover is resiliently flexible, and the relatively narrow interconnecting region is also resilient, the configuration of the back portion is such that when a seated occupant applies a rearward force to the cover, the lower end of the back frame is caused to move forward relative to the support member(s) to apply a forward directed force against the occupant's lower back.

Referring now to FIGS. 30 to 34, the upper portion 29 of the back frame comprises an upper section 29*a* that is adapted to be selectively folded rearwardly relative to a remainder 29*b* of the upper portion, to reduce the overall vertical height of the back portion. The reduction in the overall vertical height of the back portion enables an adult occupant to sit sideways in the chair with an upper end of the back portion positioned under their armpit and/or to rest their arm on the upper end of the back portion when sitting in that position.

Figure 32:
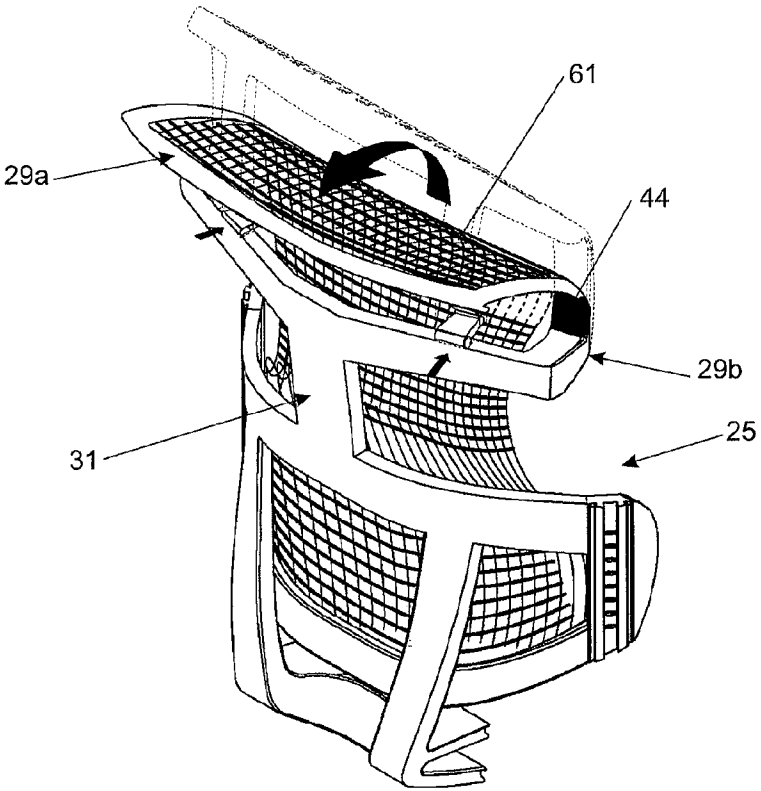
FIG. 32 is a rear overhead perspective view of the back portion of the chair of FIG. 1, showing the upper section in a folded configuration.
Figure 31:
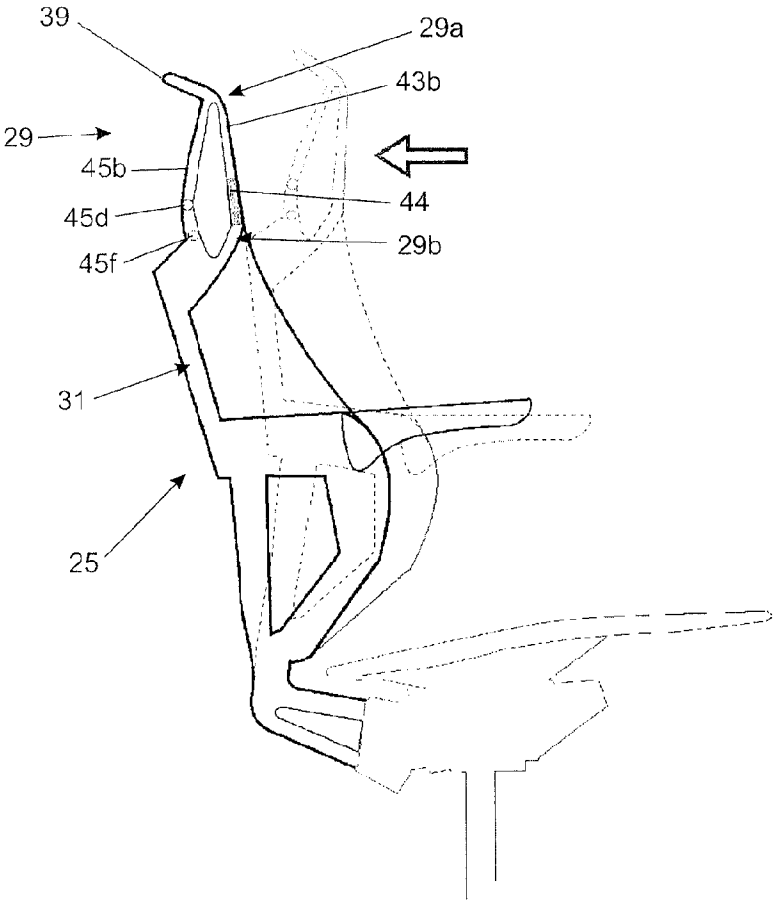
FIG. 31 is a side elevation view of the back portion of the chair of FIG. 1, showing the upper section in the upright configuration.
Figure 33:
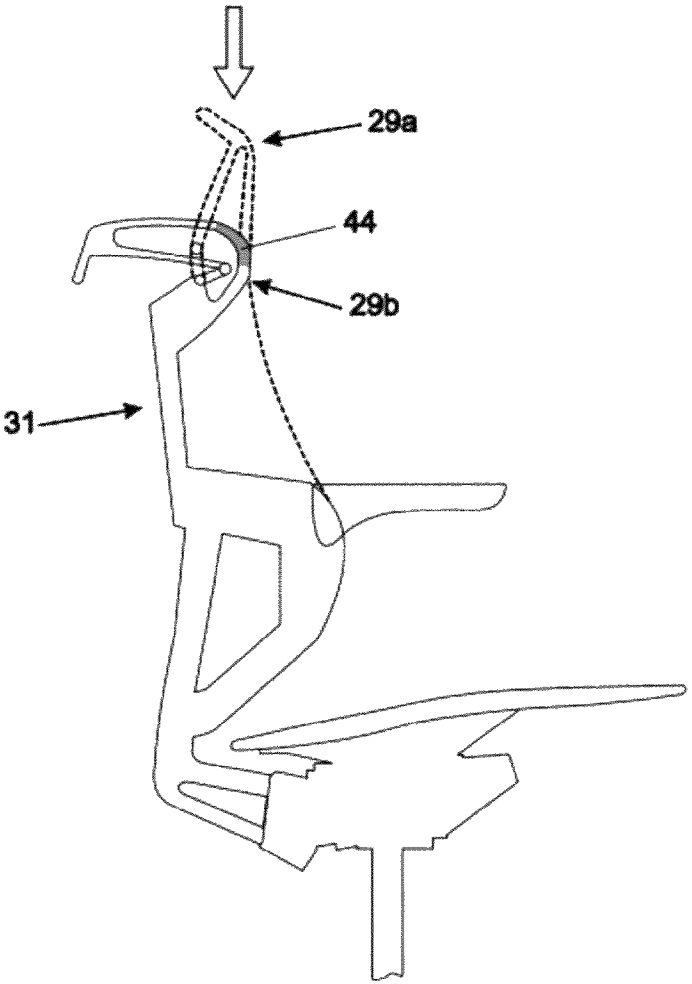
FIG. 33 is a side elevation view of the back portion of the chair of FIG. 1, showing the upper section in the folded configuration.

Two of the generally vertical support members 45*a*, 45*b* of the upper portion each comprise at least one hinge or pivot 45*c*, 45*d*, 45*e*, 45*f*, and preferably two hinges or pivots. As can be seen most readily from FIG. 31, the hinges or pivots are in an overcentred configuration to provide a forward bias to said upper section 29*a*. In such a configuration, when the occupant applies a rearward force to the back portion when in a normal forward seated orientation, said upper section will remain generally aligned with the remainder 29*b* of the upper section, as shown in FIG. 31. However, as shown in FIGS. 32 and 33, the hinge(s) or pivot(s) enable the rearward folding of said upper section 29*a* to occur when a rearward/downward force is discretely applied to the upper section, such as by an occupant pushing rearwardly/downwardly against said section with his/her arm.

In one embodiment, the hinge(s) or pivot(s) is/are preferably configured such that when the rearward force is discretely applied to said upper section of the back portion, the folding occurs with a "snapping" action. Alternatively, the action may be substantially smooth.

Figure 34:
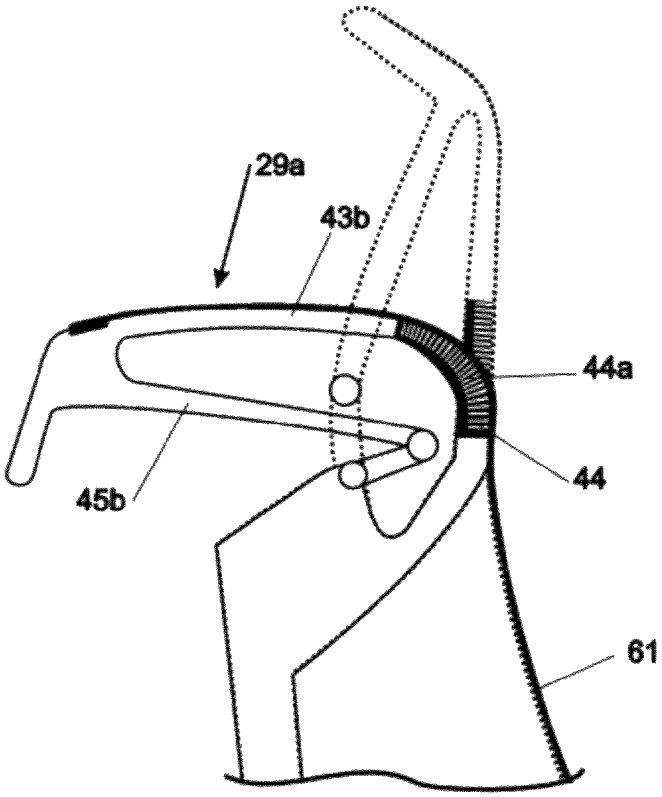
FIG. 34 is a detail side elevation view of the back portion of the chair of FIG. 1, showing features of the upper section.

As shown in FIG. 34, the upper section 29*a* is defined by a plurality of slits 44*a* extending into the members 43*a*, 43*b* of the upper portion from a front face thereof, which enable the front face to expand. The slits, in combination with the hinge(s) or pivot(s), define the folding area. Although not shown, alternatively or in addition the upper portion may have a plurality of slots extending into the upper portion from a rear face thereof. While the back frame may be made from a suitable polymeric material such as glass filled nylon for example, the portions 44 including slits 44*a* may be made from a different material to obtain the desired properties for that section. For example, the portions 44 may be made from an elastomeric material such as HYTREL for example.

This feature could be provided in a back portion of a different form that comprises a solid or generally solid back panel for example, and said upper section may comprise an upper part of the panel that is configured to fold rearwardly relative to a lower part of the panel. The panel could be a panel made from a polymeric material for example. Again, said section may be supported from a lower part of the panel by one or more hinges or pivots as described above. The panel may provide the support surface for the seated occupant, or could alternatively support a cushion that provides the support surface for the seated occupant.

Arm Assembly

Figure 41:
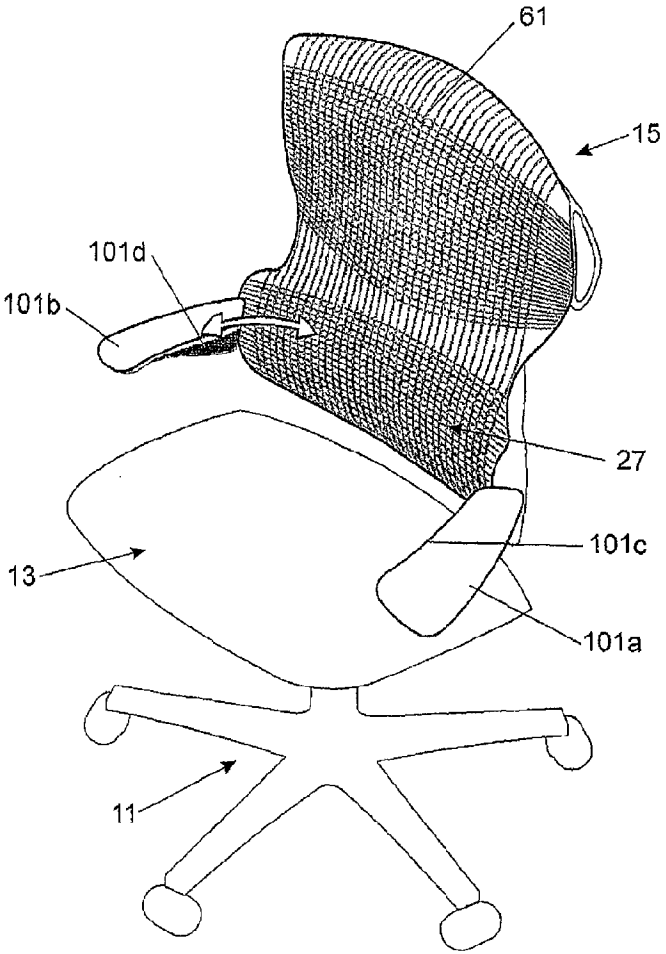
FIG. 41 is a front overhead perspective view of a preferred form arm assembly incorporated into the back portion of the chair of FIG. 1.
Figure 42:
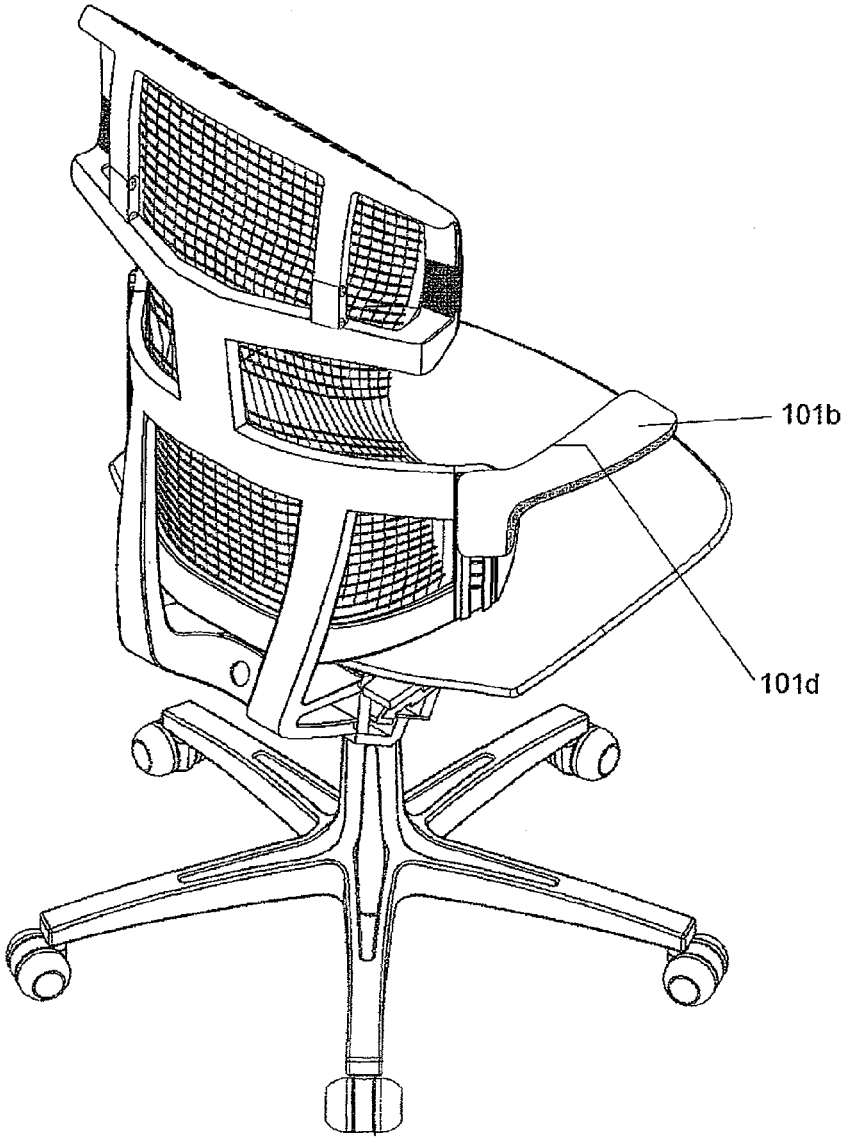
FIG. 42 is a rear overhead perspective view of the back portion of the chair of FIG. 1 with arm assemblies.
Figure 43:
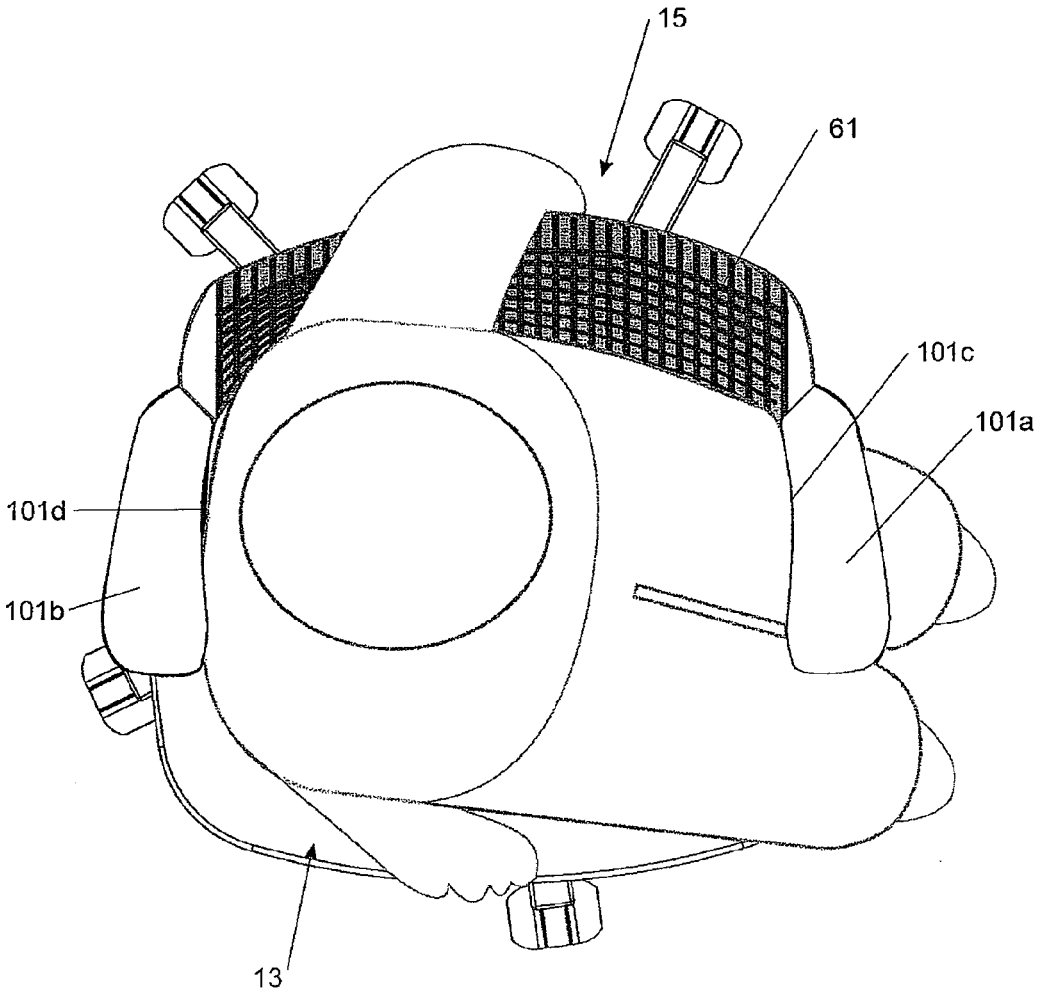
FIG. 43 is a schematic plan view showing an adult occupant sitting sideways in the preferred form chair of FIG. 1.

As outlined above, the back frame preferably incorporates supports 51*a*, 51*b* that form parts of arm assemblies for supporting arm rests 101*a*, 101*b* from the back portion. As discussed above, the lower portion 27 of the back frame curves around to encompass the sides of a seated occupant's back, and thereby has a concave curvature in that region. As shown in FIGS. 41 to 43, the arm rests 101*a*, 101*b* of the arm assemblies are configured to effectively form a continuation of the back portion in that region. Preferably, the inner surfaces 101*c* 101*d* of the arm rests 101*a*, 101*b* have a concave curvature to form a continuation of the concave curvature in that region. The inner surfaces are the body facing surfaces of the arm rests.

The arm rests 101*a*, 101*b* extend forwardly in a cantilevered arrangement from the lower portion 27 of the back frame. As the inner surfaces of the arm rests are curved, and effectively form a continuation of the curvature of the back portion when an occupant is side-sitting in the chair and leaning against the back portion, the inner surfaces of the arm rests are able to support at least a major part of an occupant's lower back when the occupant is sitting generally sideways in the chair—see FIG. 43. As can also be seen from FIG. 43, there is sufficient spacing or clearance provided beneath the arm rests that an occupant's legs can fit between the arm rests and the seat portion when the occupant sits generally sideways in the chair.

Figure 44:
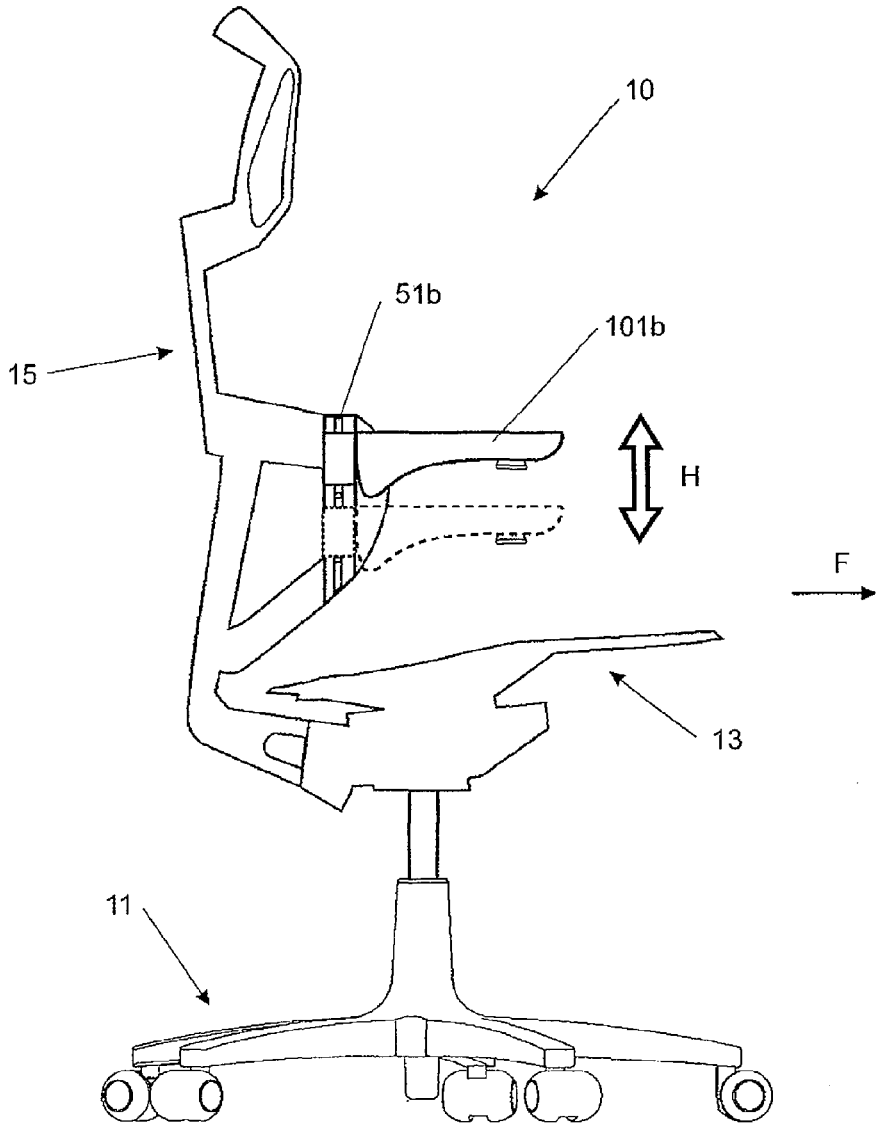
FIG. 44 is a schematic side elevation view of the chair of FIG. 1 showing height adjustment of the arm rest.
Figure 45A:
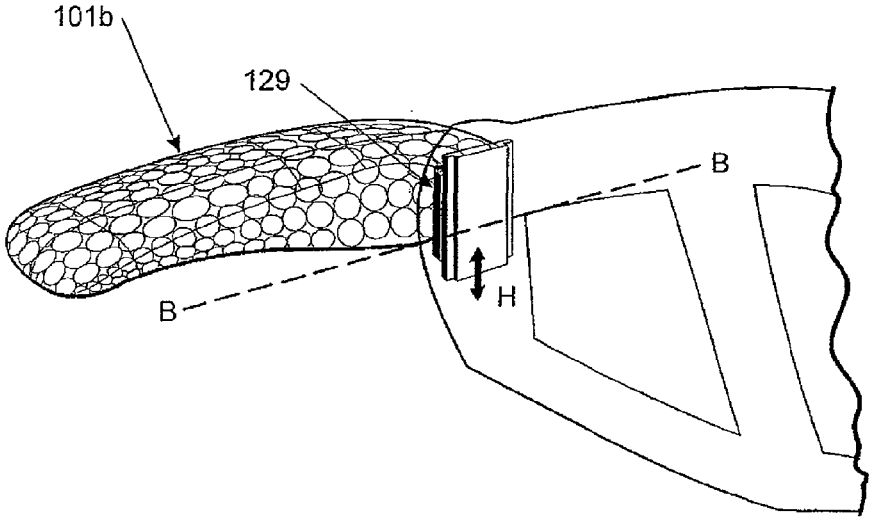
FIG. 45*a* is a perspective view of the arm rest and support arrangement.
Figure 45B:
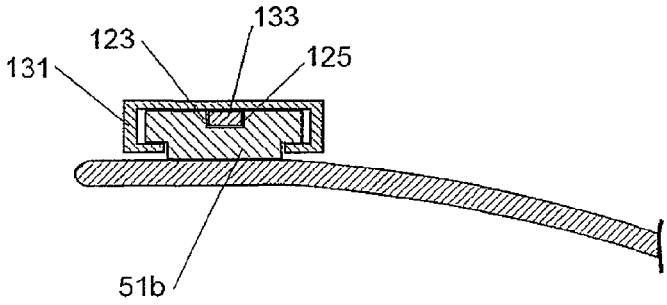
FIG. 45*b* is a plan sectional view of the support arrangement along line B-B of FIG. 45*a;*

The arm rests are preferably height adjustable H relative to the back portion as shown in FIG. 44 and using the mechanism described below, so sufficient spacing will preferably be provided beneath the arm rests in at least one adjusted position of the arm rests that the occupant's legs can fit between the arm rests and the seat.

Figure 46:
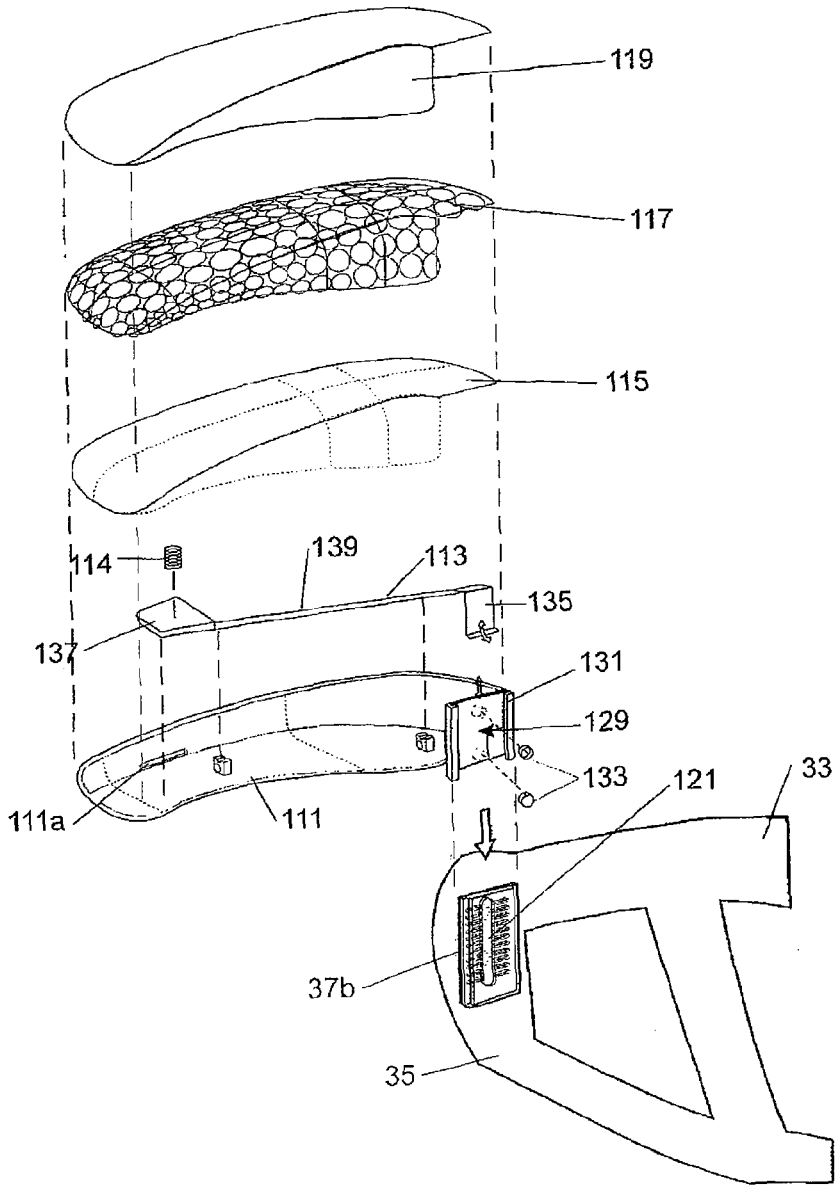
FIG. 46 is an exploded perspective view of one of the arm assemblies of FIG. 41.
Figure 47:
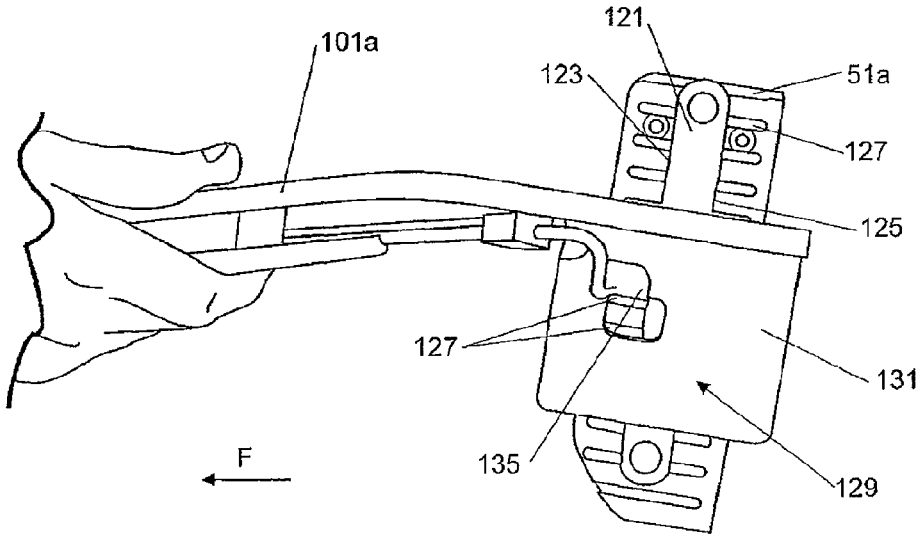
FIG. 47 is a view of some of the components of the arm assembly prior to incorporation into the chair of FIG. 1, showing details of the mechanism that provides height adjustment of the arm assembly.
Figure 48:
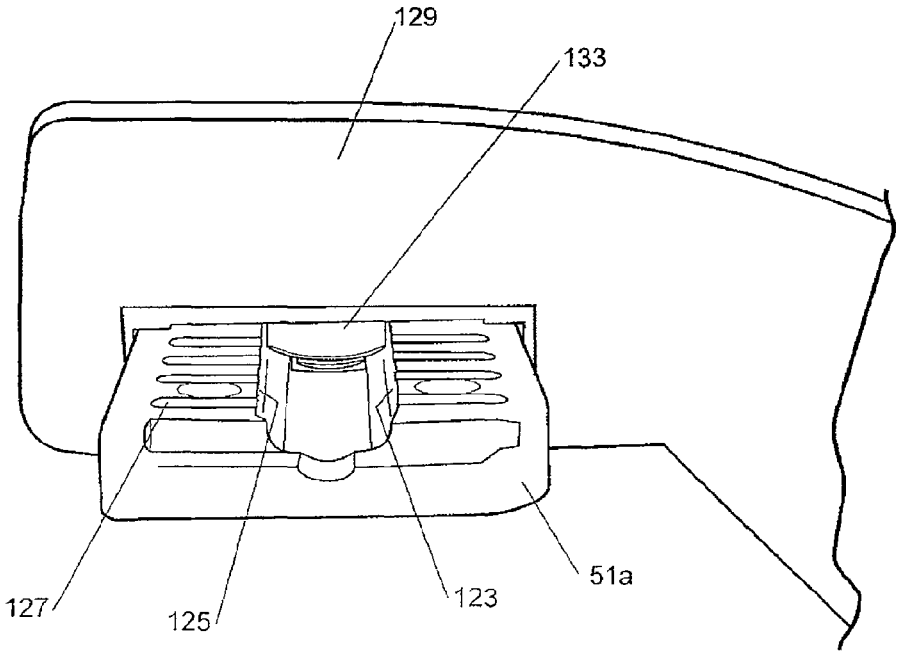
FIG. 48 is a plan view of part of the preferred form height adjustment mechanism of the arm assemblies.

FIGS. 45*a*, 45*b*, 46, 47, and 48 show the preferred construction of the arm rest. Referring to FIG. 46, each arm rest comprises a base member 111 which is suitably hollow, an actuator 113 of a locking mechanism for adjusting the height of the arm rest, a cover substrate 115, a cushion construction 117, and a cover 119. The actuator preferably extends from the slot 111*a* in the base member for use by a seated occupant. The cushion extends down the inner surface of the arm rest, to provide a compliant surface for the back of the seated occupant when sitting sideways in the chair and leaning backward against the arm rest.

Referring to FIGS. 45*b*, 46, 47, and 48, the support 51*a*, 51*b* has an elongate slot 121 having spaced apart generally parallel first and second elongate walls 123, 125. As can be seen from FIG. 47, wall 123 is a forward wall, and wall 125 is a rearward wall. The support also has a plurality of vertically spaced discrete locking positions defined by locking features which, in the form shown, are transverse slots 127.

An end of the armrest proximal the support comprises an engagement mechanism 129 for engaging with the support on the back of the chair. The arm rest is cantilevered from the support in a direction generally transverse to the slot 121—that is in a generally forwardly extending direction—by the engagement mechanism. The engagement mechanism 129 comprises a housing 131 that extends around and captures the sides of the support 51*b*. The engagement mechanism further comprises at least two bearing mechanisms 133 that are spaced apart in the elongate direction of the slot, and are slidably received in the elongate slot 121 of the support. One of the bearing mechanisms may contact the first longitudinal wall 123, and the other bearing mechanism may contact the second longitudinal wall 125, to provide a sliding action of the arm rest relative to the support. Preferably, each bearing mechanism is able to contact both the first longitudinal wall and the second longitudinal wall, but is able to contact only one of the longitudinal walls at a time. That enables the engagement mechanism to accommodate upward or downward load applied to the forward end of the arm rest.

In the form shown, the bearing mechanisms 133 are each in the form of a roller, each of which is mounted for rotation relative to the arm rest about a respective axis that extends substantially transverse to the elongate direction of the slot.

Alternatively, the bearing mechanisms may each have a pair of rollers in a side by side configuration for example, with one roller in each pair contacting one of the longitudinal walls 125 and the other roller in each pair contacting the other of the longitudinal walls 127. As an alternative, the bearing mechanisms may each be in the form of a fixed self-lubricating polymer member, and the longitudinal walls could also be made of a suitable self-lubricating polymeric material. With these two alternatives, each bearing mechanism could contact both longitudinal walls at the same time, while still enabling height adjustment of the arm rest.

A locking mechanism is provided for locking the arm rest in a selected position relative to the support. The locking mechanism has a locking member 135, an actuator 137 which is positioned at or toward a distal end of the arm rest, a connecting member 139 that connects the locking member and the actuator, and a spring 114. The spring may be integrally moulded with the actuator or locking member, and could be a leaf spring for example. Alternatively, in the embodiment in which the connecting member 139 is substantially rigid and the locking member moves by a pivoting action, the spring could be a torsion spring configured to rotationally bias the connecting member.

The locking member 135 extends from the engagement portion of the arm rest and engages in one of the locking features which, in the form shown are locking slots 127 of the support to maintain the arm rest in a desired position. When the user wishes to adjust the height of the arm rest, he or she pulls up on the actuator 137 against the bias of the spring, which causes the locking member 135 to release from engagement with the support thereby enabling a sliding movement therebetween. In the form shown, the actuator 137 is a lever that is pivoted relative to the arm rest, and the connecting member is substantially rigid, so that a pivoting movement of the actuator as it is pulled upward toward the underside of the arm rest pivots the locking member 139 out of engagement from the locking slot so the height of the arm rest can be adjusted. Instead, the actuator could be connected to the locking member by a cable or the like.

As the actuator is configured such that an upward pulling action is applied to release the locking member, the height of the arm rest component can readily be increased, as the same upward pulling action against the lever will additionally lift the arm rest. While the pulling action is toward the front of the arm rest, the bearing arrangement will inhibit binding of the arm rest to the support during the height adjustment.

The slot 121 may extend completely through a mounting plate of the support as shown. Alternatively, the slot may be defined by an elongate channel formed in the support for example.

Figure 49A:
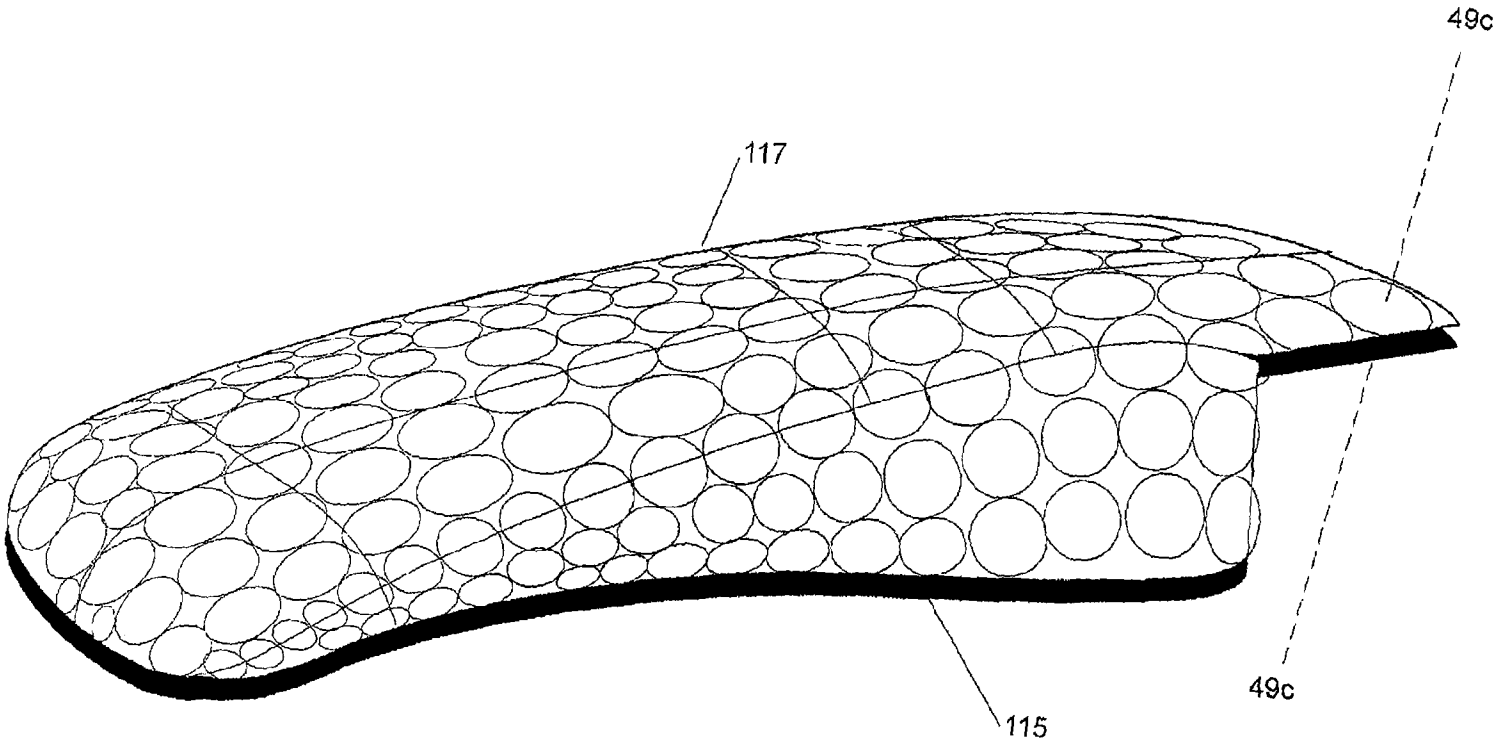
FIG. 49*a* is a schematic view of a preferred form cushion for the arm rest.
Figure 49B:
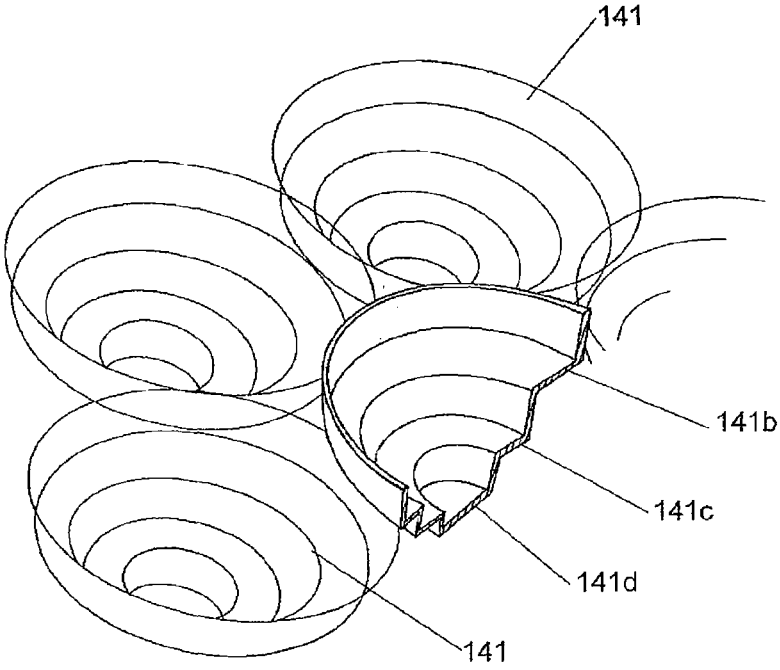
FIGS. 49*b* and 49*c* are overhead perspective and side sectional views respectively of a preferred form spring structure of the cushion of FIG. 49*a;*
Figure 49C:
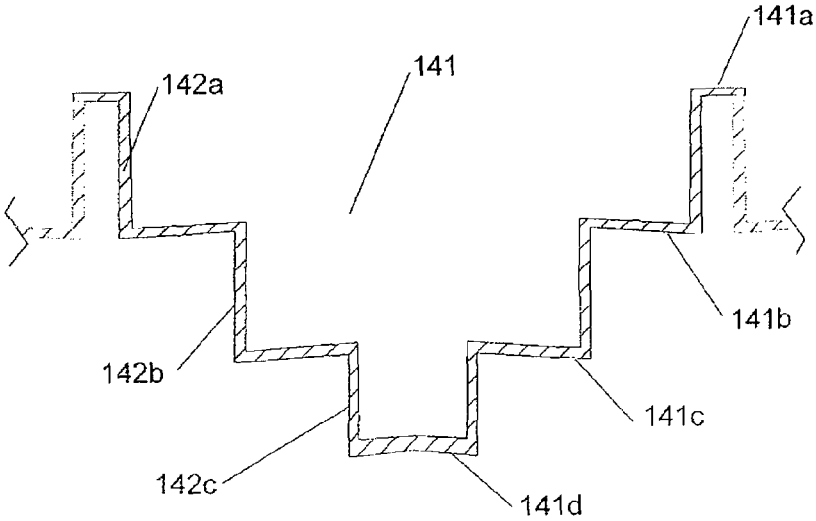

FIGS. 49*a* to 49*c* show details of the preferred cushion structure for the arm rest. The cushion is similar to the preferred form seat cushion described below. The cushion structure comprises a plurality of resilient polymeric spring members 141 that provide substantially independent cushioning for each part of the cushion substrate. The spring members have any suitable plan shape, such as circular or elliptical for example, and form a series of staggered platforms 141*a*, 141*b*, 141*c*, 141*d*. The smallest 141*d* of each of the platforms is configured to rest on the substrate 115 to support the spring member 141, and the largest of the platforms forms an upper load bearing surface and connects to an adjacent spring member as shown in FIG. 49*c*. The platforms are connected by annular walls 142*a*, 142*b*, 142*c*. A cover will cover the upper ends of the spring members, and will be connected to the spring members by any suitable means such as by RF welding or co-moulding with the spring members for example.

The spring members provide a compliant surface. When an occupant applies loading onto the larger end of the spring members, the spring members compress by somewhat of a telescopic movement of walls 141*c* into the space bounded by walls 141*b*, and of walls 141*b* into the space bounded by walls 141*a*. The resilience of the spring members will return them to the position shown in FIG. 49*c* when the load is removed.

The spring members may be provided in different sizes and/or with different numbers of steps or platforms to enable the cushion structure to be tuned so that different areas of the cushion structure exhibit different properties.

The spring members and/or the cover may be made from a breathable material or breathing holes could be incorporated if necessary.

The cover is preferably abraded to provide a napped surface.

Figure 50:
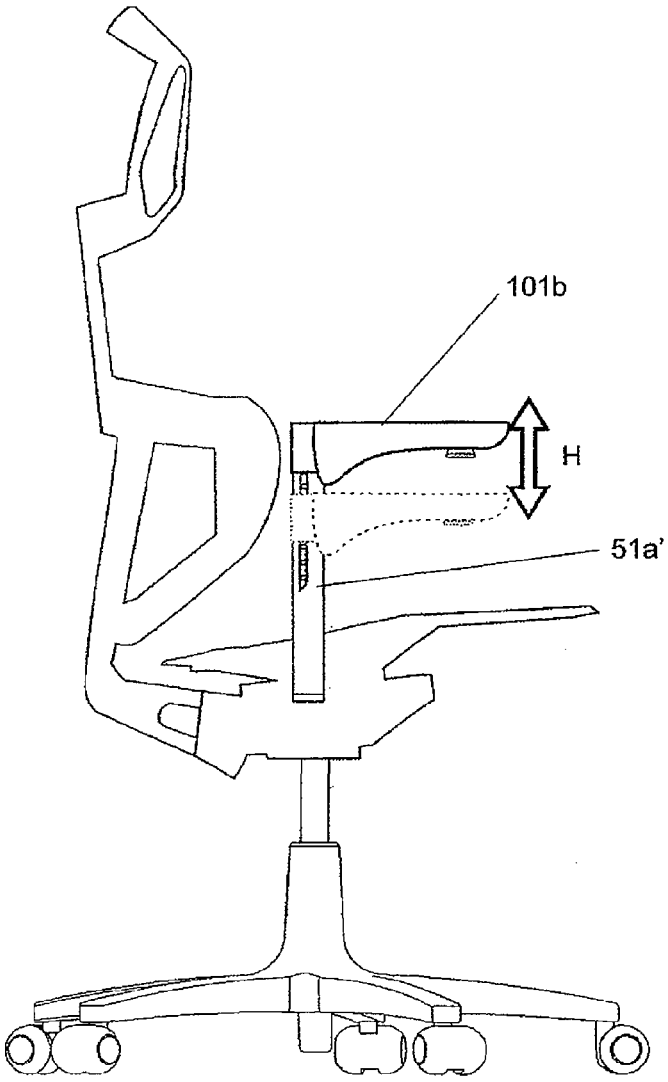
FIG. 50 is a schematic side view of a first preferred form chair but incorporating an alternative preferred form arm assembly.

In FIG. 50, the support 51*a*' is part of a standalone arm assembly that is adapted to be supported from another part of the chair, such as the seat portion or supporting frame for example. The arm assembly will have the other features described and shown with reference to the above figures. Again, this arm rest preferably forms a continuation of the curvature of the back portion. It will be appreciated that the preferred form arm assembly can therefore readily be incorporated into other types of chairs. However, it is preferred that the arm assemblies are incorporated into the back frame as discussed above, as when that portion of the back frame twists relative to the seat portion and supporting frame, the arm assemblies will move with that part of the back portion.

Seat Construction, Cushion, and Seat Support Mechanism

The seat portion is supported above the supporting frame by a preferred form recline mechanism that will be described in more detail below with reference to FIGS. 1 to 5. However, the seat portion and seat support mechanism have a number of features that can be incorporated into a chair having a different type of recline mechanism or, in the case of the seat construction, any type of chair.

Referring to FIGS. 7 to 22, the seat portion comprises a seat pan 201. The pan is a unitary moulded polymeric construction that has a plurality of members in a grid arrangement. The pan has a central zone 203 which defines a primary supporting region for a seated occupant when in a normal forward oriented seated position on the seat portion. The central zone is defined by a plurality of annular ribs 205*a*, 205*b*, 205*c* that extend around the central zone and separate the central zone from an outer zone 207 that is made up of a rear zone 209, left and right side zones 211*a*, 211*b*, and a front zone 213. The pan has a dished shape, at least in the outer zone, to provide a dished recess for receipt of a cushion construction described below.

The seat is supported by a seat support 215 which, in the preferred embodiment is integrally moulded as part of the seat pan. The seat support comprises a base member 217, and a plurality of resilient support members that terminate at their upper ends at the sides of the central zone. In the preferred form shown, the support has two side resilient support members 219*a*, 219*b*, 219*c*, 219*d* located along either side of the central zone of the seat portion. Additionally, in the form shown, the seat support has two rear support members 221*a*, 221*b* that support a rearward part of the seat portion, and two resilient support members 223*a*, 223*b* that support a forward part of the seat portion.

The central portion of the seat pan is adapted for receipt of the majority of a user's weight when in a normal forward oriented seated position on the seat portion.

Figure 11:
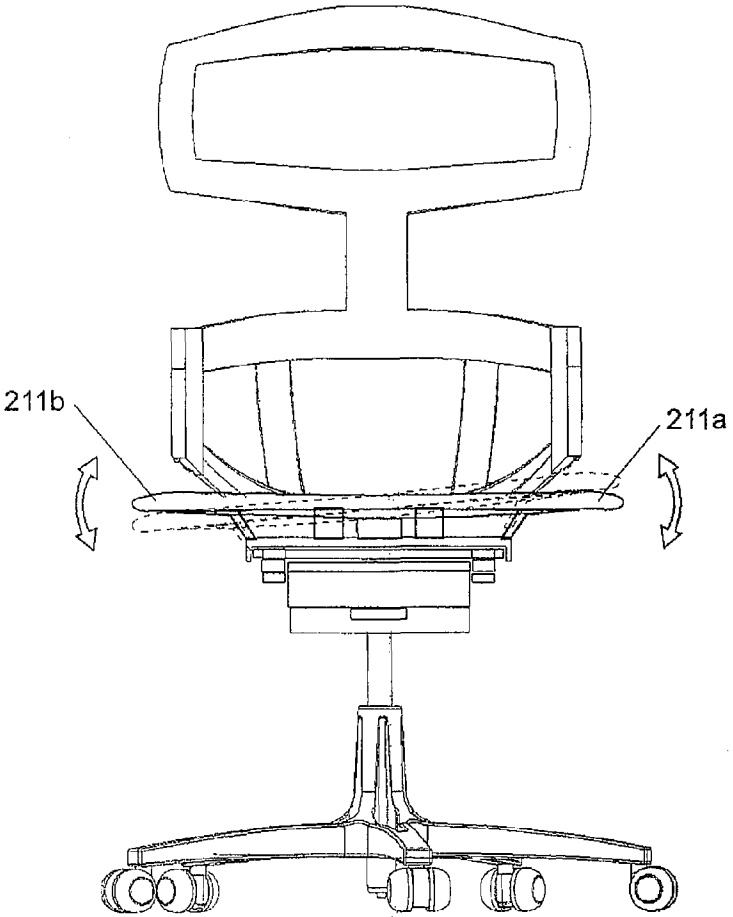
FIG. 11 is a schematic front elevation view showing a preferred tilting action of the seat portion of the chair of FIG. 1.

Each resilient support member is configured to deform/flex as the occupant applies weight either to the side, rearwardly, or forwardly on the seat portion, thereby providing angular movement of the seat portion. FIG. 11 schematically shows a tilting action of the seat portion if an occupant's weight is offset to the left 211*a* or right 211*b* side of a centre of the seat portion.

It will be appreciated that there could be a different number or type of resilient support members along the sides, front, or back of the seat portion.

Figure 12:
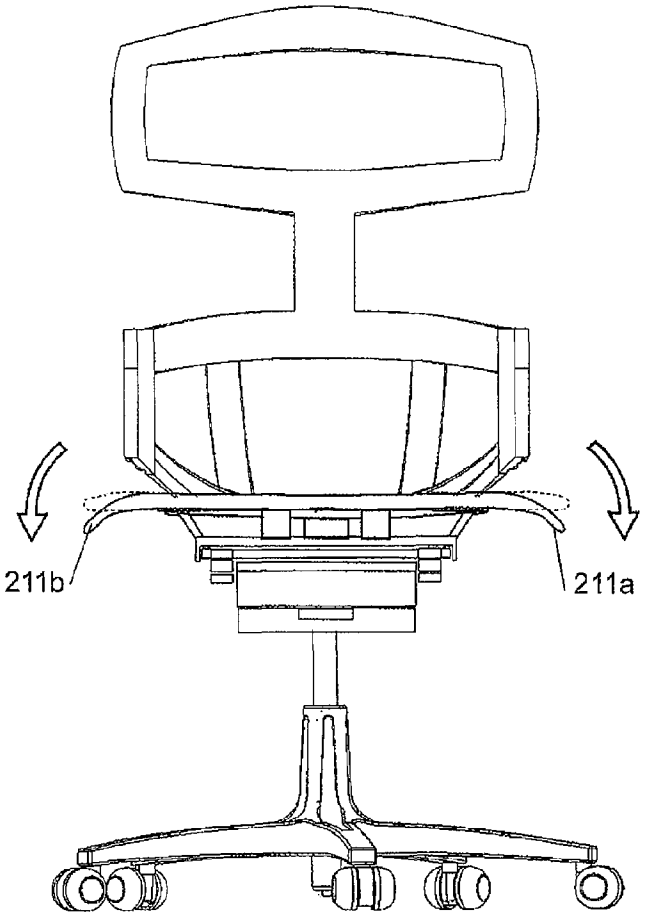
FIG. 12 is a schematic front elevation view showing a preferred flexing action of the sides of the seat portion of the chair of FIG. 1.
Figure 13:
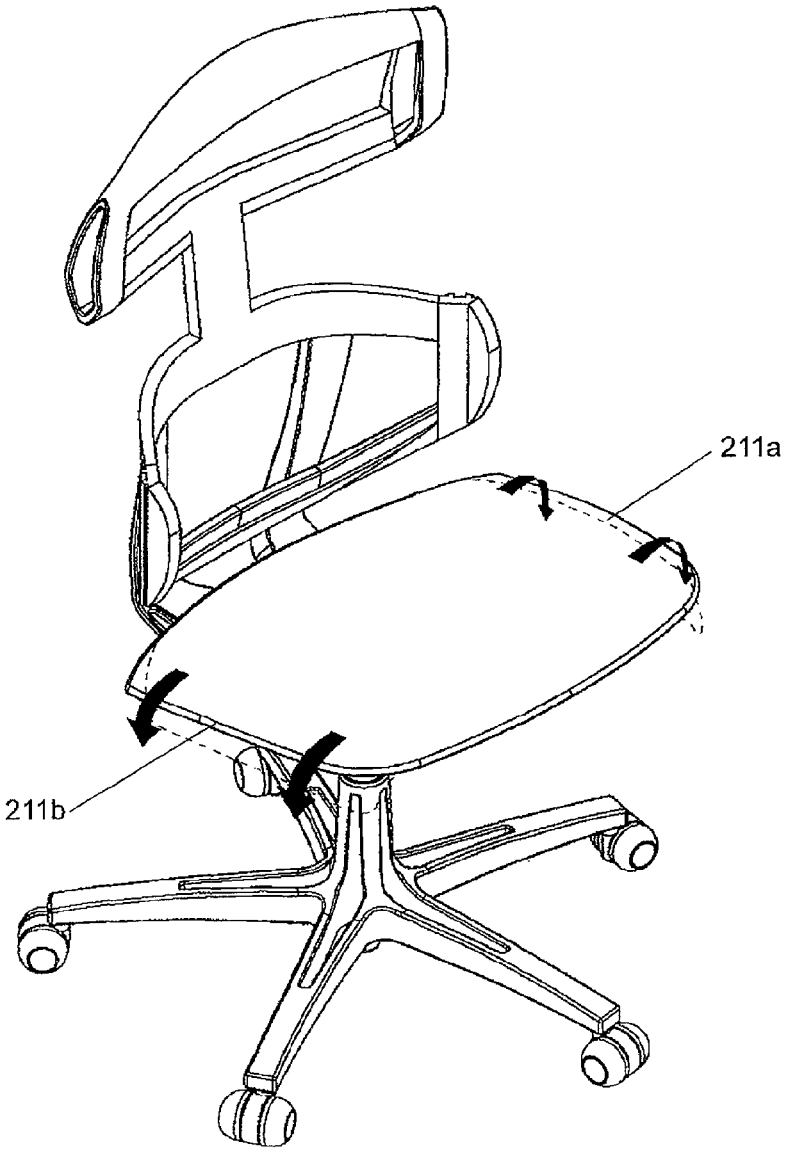
FIG. 13 is a front overhead perspective view showing the preferred flexing action of the sides of the seat portion of the chair of FIG. 1.

In addition to being supported on seat support having resilient members, the side zones 211*a*, 211*b* are resiliently flexible and unsupported to enable the side zones to deform under the weight of an occupant's legs if the occupant sits sideways on the seat portion. FIGS. 12 and 13 schematically show the side zones of the seat portion flexing under the weight of an occupant's legs. It will be appreciated that the resilient side support members of the seat support and the flexibility in the sides of the seat pan will work together to form a compliant comfortable surface for a seated occupant positioned sideways on the chair. For example, a user could sit sideways on the chair with their weight offset to the right side which would cause the seat pan to tilt to the right by virtue of the resilient supports, which would result in the left side of the seat pan lifting but the left side zone to flex under the weight of the occupant's legs so as to not apply excessive pressure to the underside of the occupant's legs.

The central portion 203 defines a rearward supported portion of the seat pan, and the forward portion in front of the central portion is resiliently flexible and is unsupported to enable the forward portion to deform under the weight of an occupant's legs as the occupant sits forward on the seat portion. It will be noted that the unsupported depth of the forward portion is significantly greater than the width of the side zones, so the forward portion will generally exhibit greater flexibility than the side zones. As will be described below, the preferred form recline mechanism causes the seat to lift as the back of the seat reclines, so there is benefit in having a flexible front portion of the seat panel, to prevent the front portion from applying excessive force to the underside of the occupant's legs.

The seat pan shown is configured to support a cushion, to provide a compliant surface for an occupant. Instead, the seat could be formed as a plastic panel that is designed to be used without a cushion. Such a panel could have the features described above, i.e. a seat support with resilient members, flexible sides and flexible front of the seat panel. Additionally, such a panel could be provided with greater flexibility in the front portion than the dished seat pan, such that the front portion is configured to fold around a transverse fold line under the weight of an occupant's legs as the seat portion lifts or the occupant sits forward on the seat portion.

Figure 14:
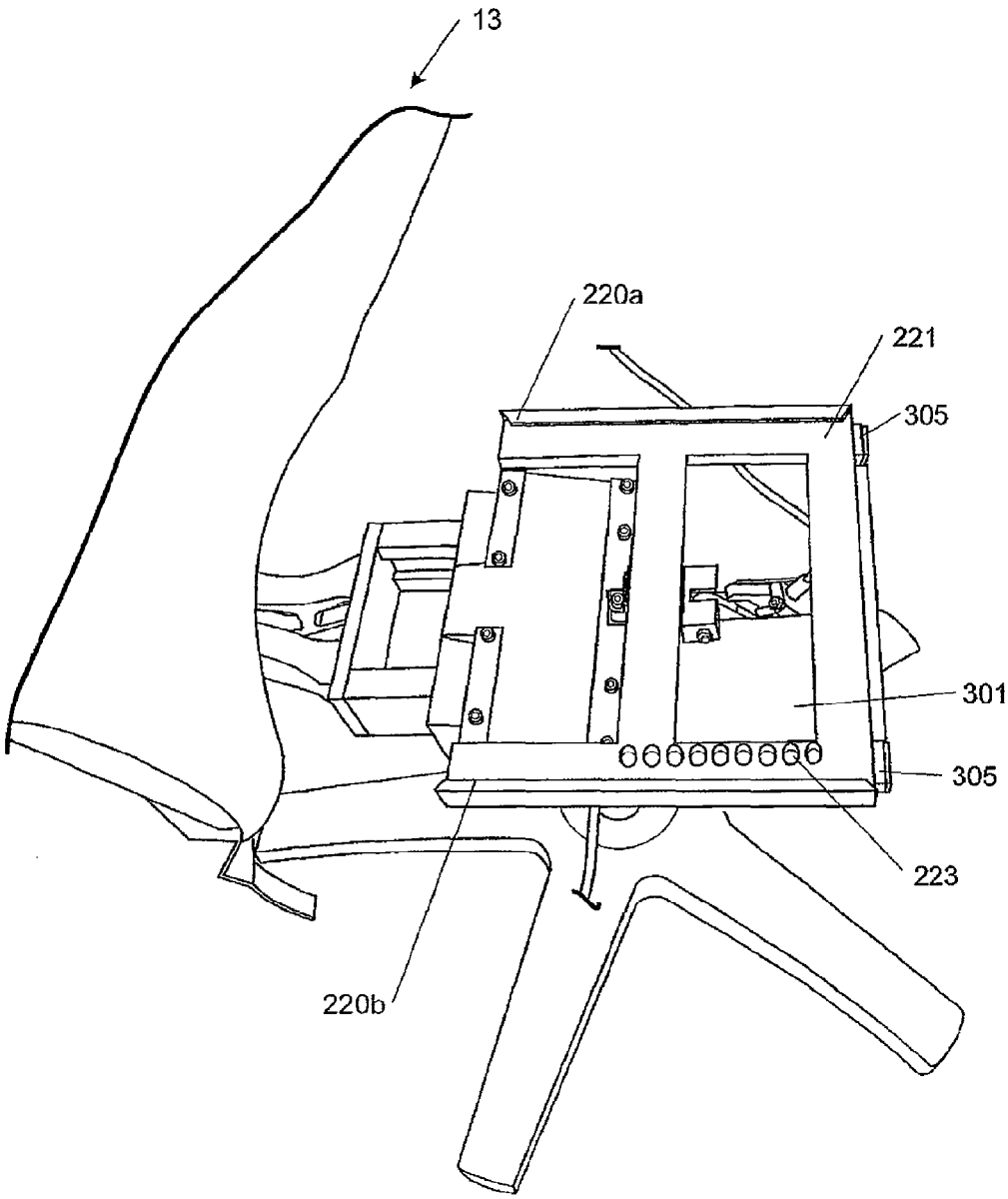
FIG. 14 is an overhead perspective view of a supporting frame of the chair of FIG. 1, showing a preferred form mechanism for adjusting the seat portion depth.

The seat support also includes a pair of longitudinally extending rails 217*a*, 217*b* that are receivable in corresponding channels 220*a*, 220*b* in a seat depth mounting 221 is shown in FIG. 14. The seat support is lockable in a selected position relative to the seat depth mounting 221. The seat depth mounting 221 has a number of spaced locking features 223 which define discrete locking positions of the seat support. The locking features may be slots, detents, notches, or similar. It will be appreciated that instead the seat support could include the channels and the seat depth mounting could include the rails.

Figure 15:
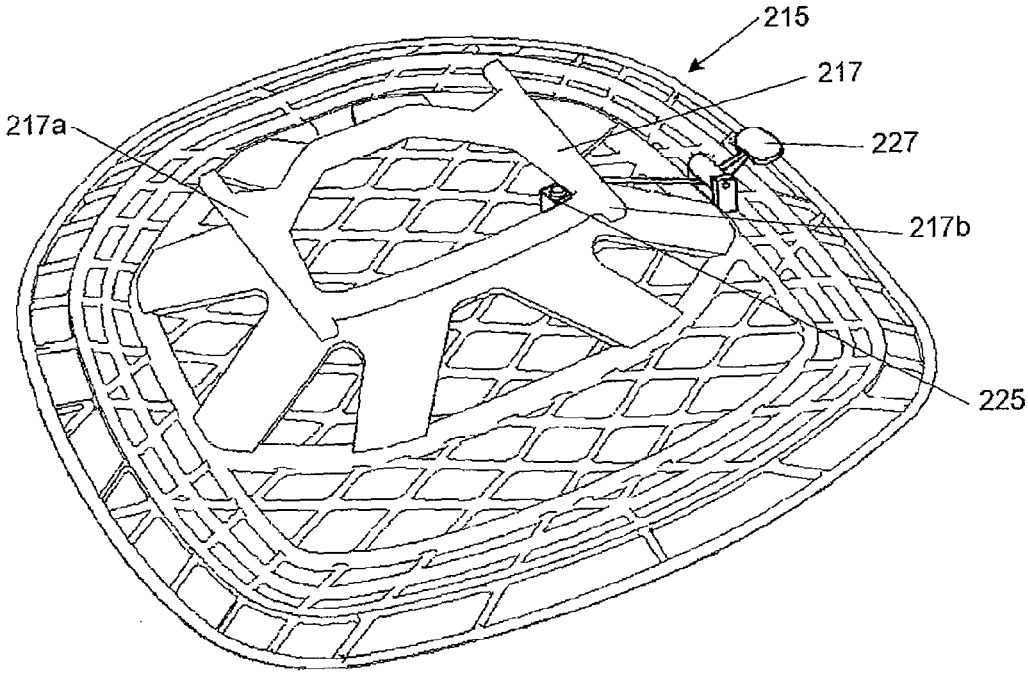
FIG. 15 is a schematic underside view of the seat portion of the chair of FIG. 1, showing an actuator and controller for providing selective seat portion depth adjustment, with the controller in a locked position.
Figure 16:
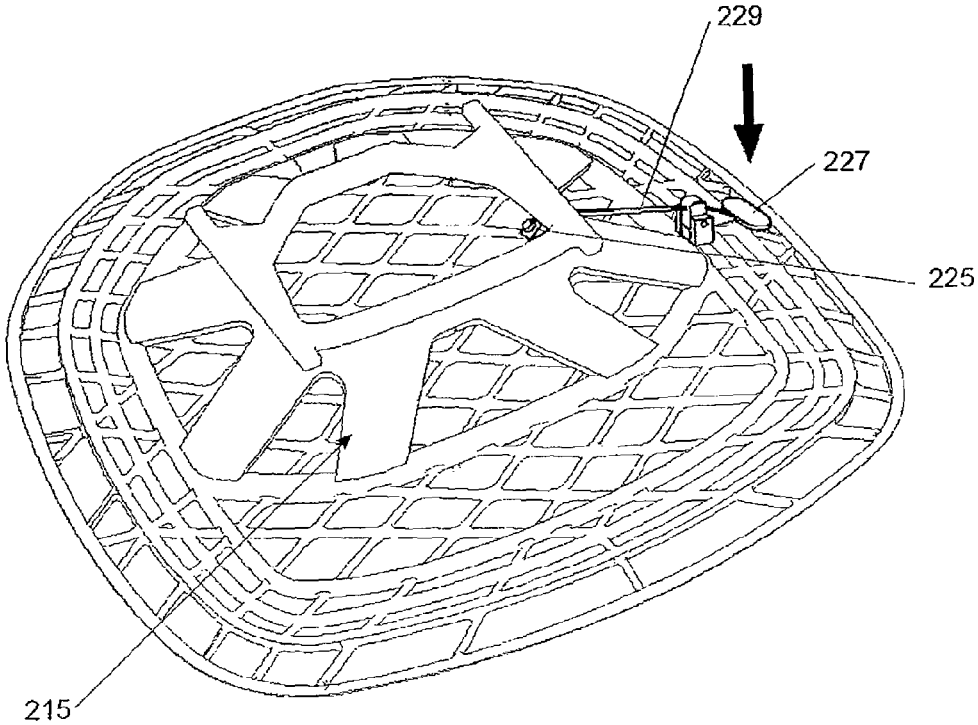
FIG. 16 is a view similar to FIG. 15 but with the controller in a released position.

Referring to FIGS. 15 and 16, the seat support carries a locking member 225 that is pivoted to the seat support and biased downwardly to engage with one of the locking features to lock the seat in a depth adjusted position. The locking member is operatively connected to an actuator lever 227 by a cable 229, and is configured such that lifting the actuator lever will release the locking member from engagement with a locking feature in the seat depth mounting, thereby enabling the depth of the seat to be adjusted. FIG. 16 shows the locking member 225 in the released position.

It is preferred that the actuator lever 227, cable 229, and locking member 225 together form an integral moulded polymeric component.

Figure 17:
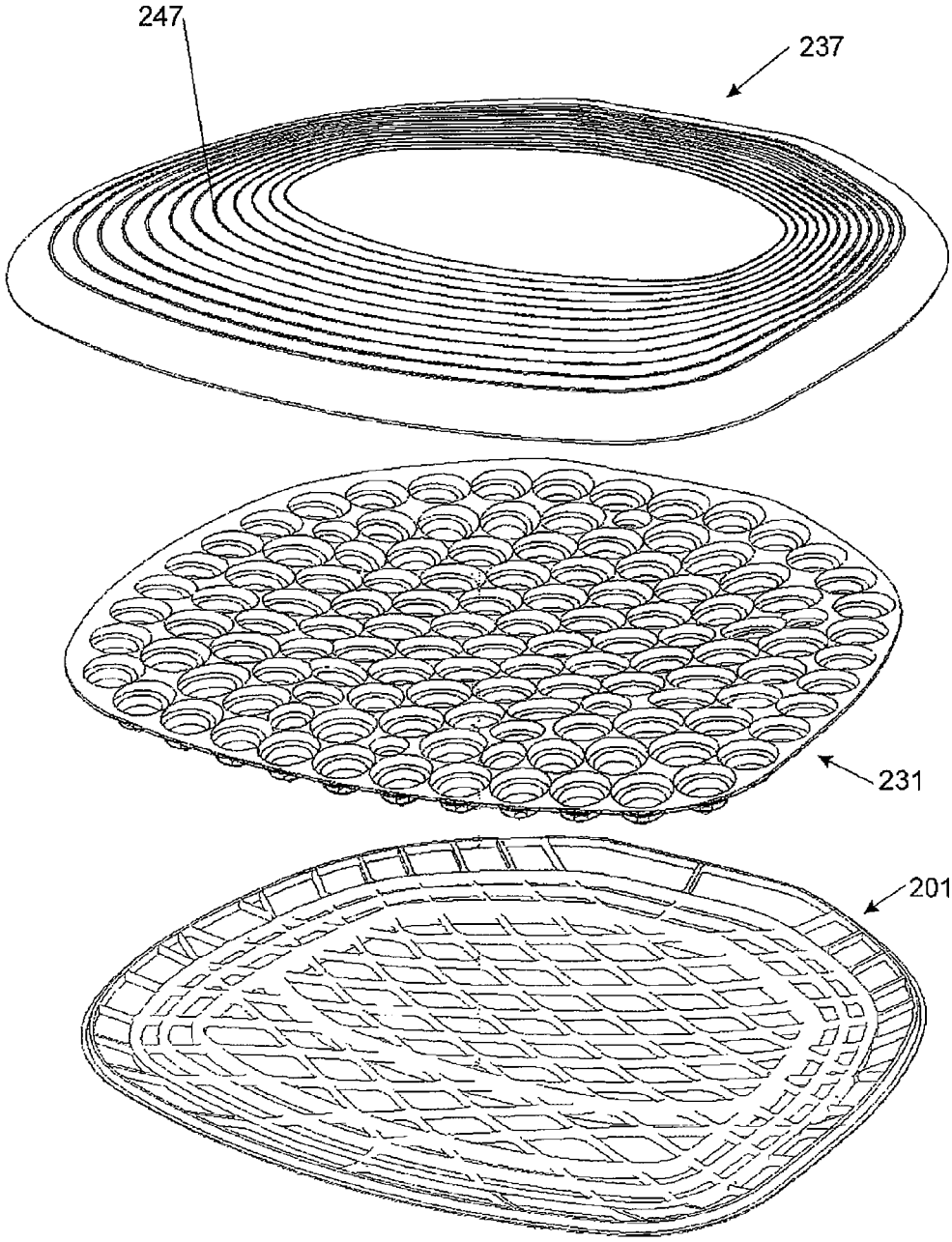
FIG. 17 is an exploded front perspective view of the seat pan of FIG. 7 with a preferred form cushion construction.
Figure 18:
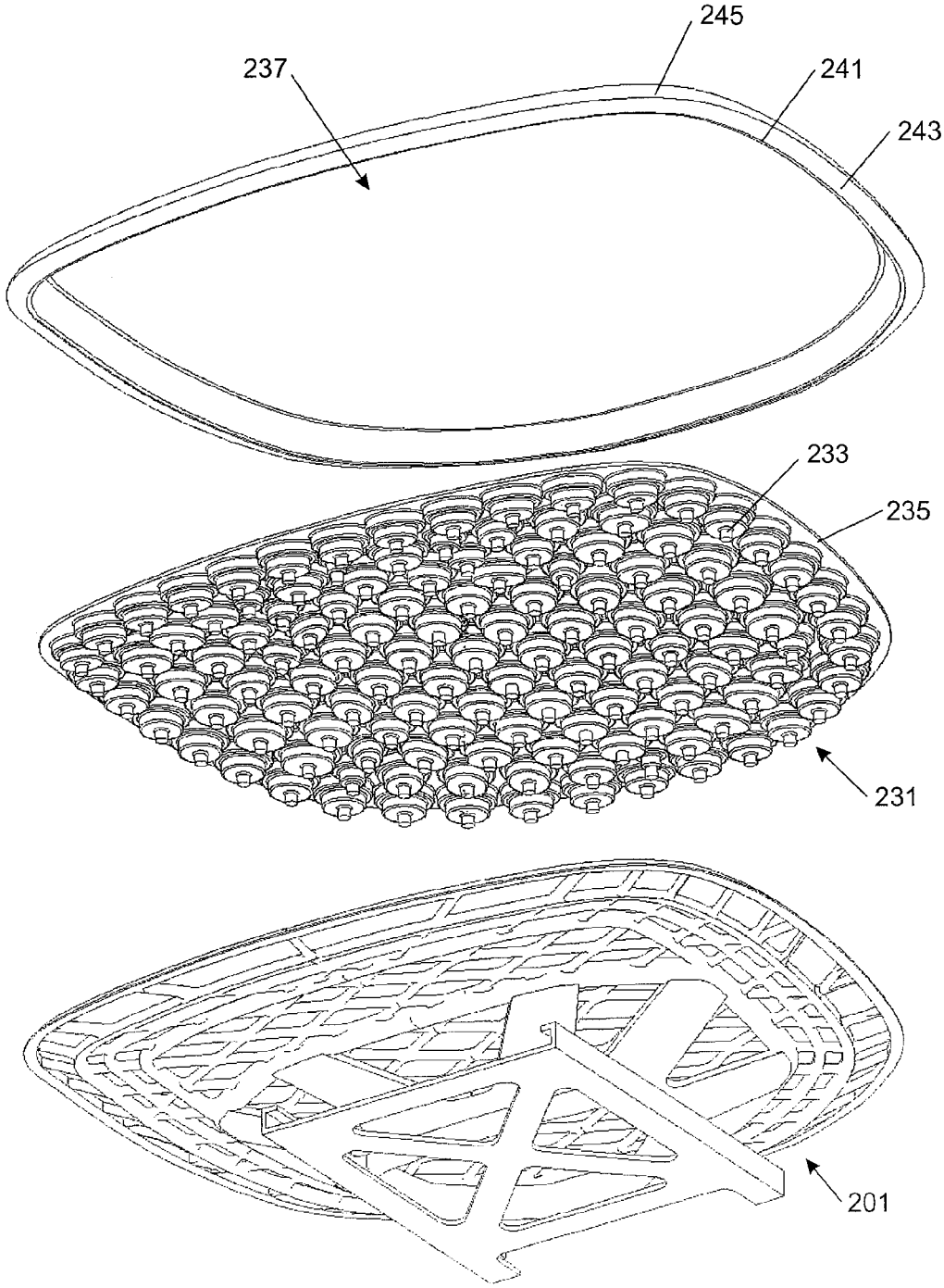
FIG. 18 is an exploded underside perspective view of the components of FIG. 17.
Figure 19:
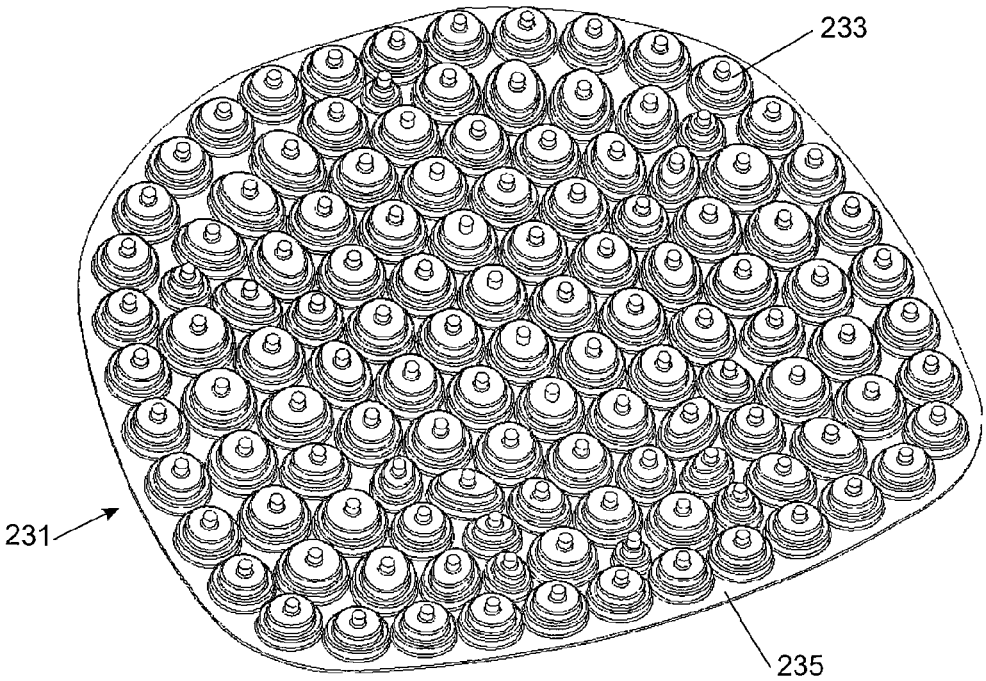
FIG. 19 is an underside perspective view of a spring structure of the cushion construction of FIG. 17.
Figure 20:
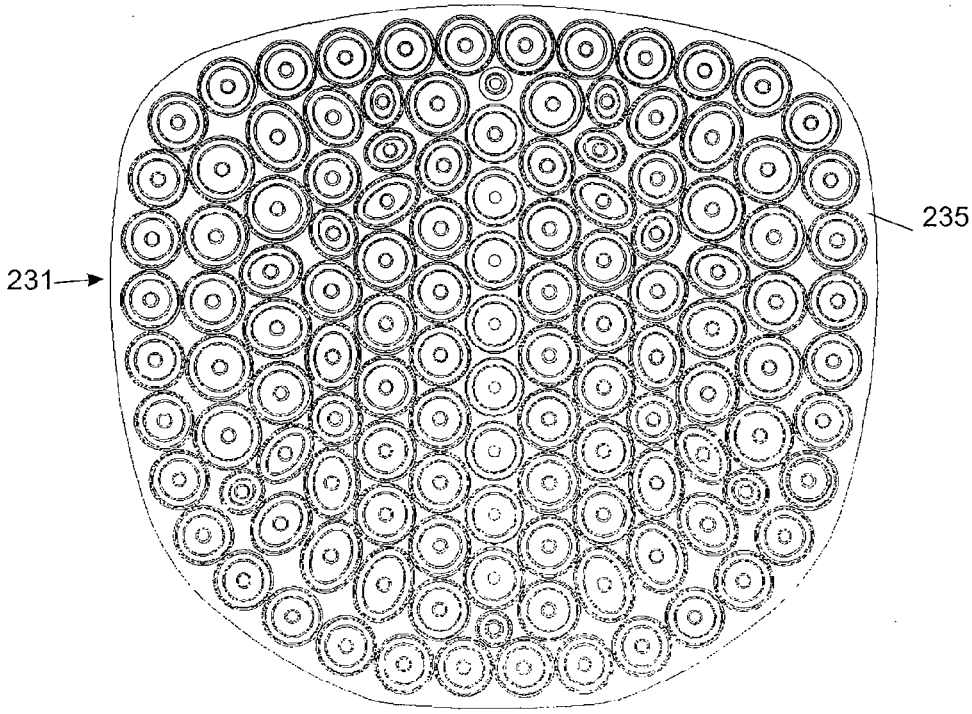
FIG. 20 is a plan view of the spring structure of FIG. 19.
Figure 21:
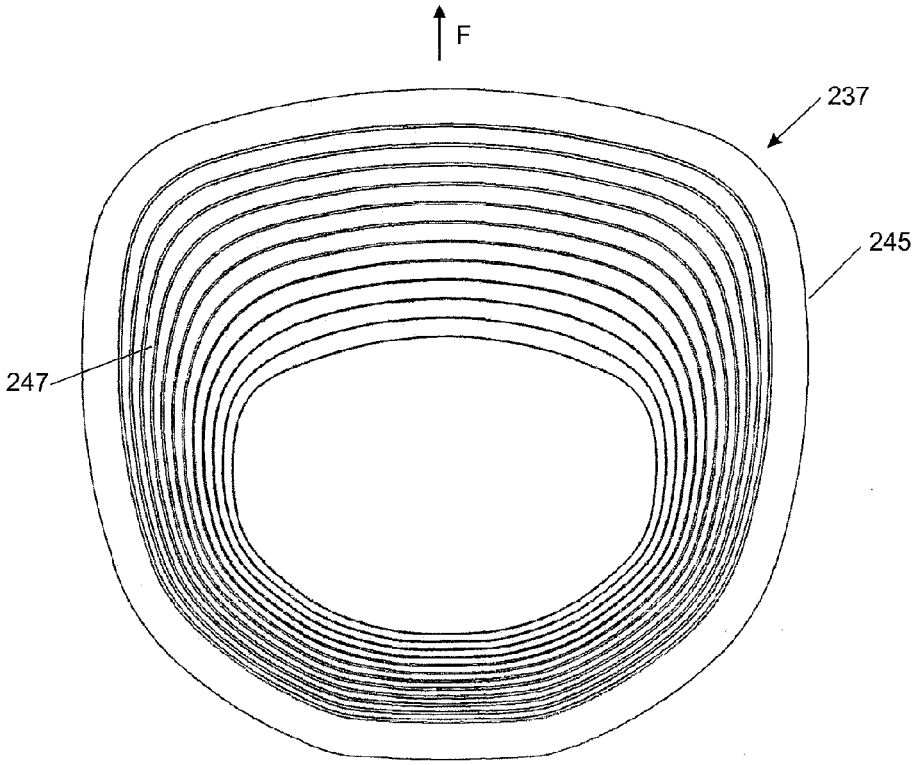
FIG. 21 is a plan view of a cover of the cushion construction of FIG. 17.
Figure 22:
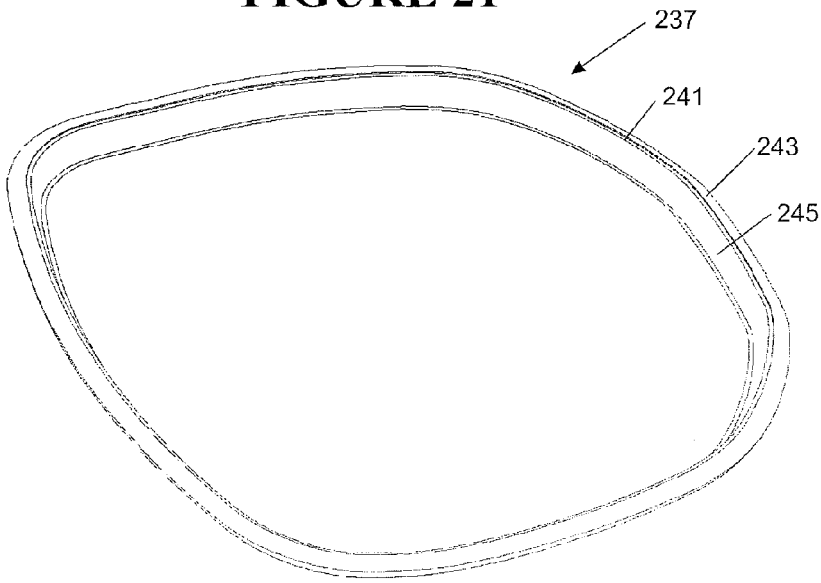
FIG. 22 is an underside perspective view of the cover of FIG. 21.

FIGS. 17 to 22 show other components of the preferred form seat portion. In addition to the base, the seat portion comprises a cushion construction for providing a compliant support surface, the cushion construction comprising a spring structure 231 and a cover 237 covering one side of the spring structure. As shown in FIGS. 18 to 20, the spring structure 231 is of the type described above with reference to the arm assembly; that is it comprises a plurality of moulded resilient polymeric spring members 233 adapted to provide substantially independent compliant support.

Again, the spring members 233 have any suitable plan shape, such as circular or elliptical for example, and each forms a series of staggered platforms. The smallest of each of the platforms is configured to rest on a member or intersection of members of the seat pan 201 to support the spring member 233, and the largest of the platforms forms an upper load bearing surface and connects to an adjacent spring member via a skin 235 which also covers the upper ends of the spring members. The skin will be connected to the spring members by any suitable means such as by RF welding or co-moulding with the spring members for example.

The spring members in the cushion are a range of sizes, shapes, and orientations, so they all engage with a member or intersection of members in the seat pan. However, such variations could be used to provide different levels of compliance in the seat portion, such as greater compliance in the central zone where a majority of the occupant's weight is taken or, further, zones of greater compliance for receiving an occupant's ischial protuberosities.

Again, the spring members may be provided with different numbers of steps or platforms to enable the cushion structure to be tuned so that different areas of the cushion structure exhibit different properties.

In the same manner described above for the arm rest, when an occupant applies loading onto the larger end of the spring members (by sitting on the seat portion), the spring members compress by somewhat of a telescopic movement of the annular walls. The resilience of the spring members will return them to the position shown in FIG. 18 when the load is removed.

The cover 237 as adapted to cover an upper side of the spring structure and extends around the spring structure, and terminates in an annular inwardly directed peripheral region 243 that has an inner opening 241 smaller than the outer periphery 245 of the cover. The polymeric cover is formed using any suitable method, such as vacuum forming, injection moulding, or blow moulding for example. The cover is preferably formed by blow moulding to form a cover with minimal thickness. The cover may be moulded with ribs or grooves 247 in the upper seating surface for comfort and to provide for some airflow between the seated occupant and the upper surface of the cover.

The cover is preferably abraded to provide a napped surface.

To mount the cushion to the seat pan, the spring structure is placed in the pan in the orientation shown in FIG. 17. The cover is then pulled over the spring structure and the periphery of the seat pan, thereby capturing or at least partly sandwiching the substrate between the annular peripheral lip 243 and the spring structure 231. The cushion could be mounted to the seat pan in any other suitable way.

The cover may be formed from any suitable material, such as TPU for example. TPU is preferred, as it can be colourless. Any other type of suitable elastomer may be used, such as HYTREL for example.

Preferably, the spring structure is formed from an elastomeric material, such as HYTREL for example. The preferred spring structure material is again TPU.

The cover and spring structure may be made from a breathable material, or may comprise a plurality of apertures to provide breathability.

It will be appreciated that the cover could be attached to the spring structure prior to mounting the cover to the seat pan.

Such a cushion design could be used to provide a compliant support for a different part of a chair, such as for a back portion of the chair or for a lumbar support portion of the chair for example.

Intermediate Support

As will be described in further detail below, the seat support, and thereby the seat portion, is supported on a recline mechanism that causes the seat portion to move upon a reclining action of the back. More particularly, the recline mechanism causes an intermediate support 301 shown in FIGS. 1, 2, and 6*a*-6*b* for example, to lift and move rearwardly as the back undergoes a reclining action.

The seat depth mounting 221 is supported above the intermediate support by a plurality of resilient supports 303, 305 which thereby operatively support the seat portion above the intermediate support 301. In the preferred form shown, there are two rear resilient supports 303 at or toward the sides of the intermediate support 301 at or toward a rear end thereof, and two front resilient supports 305 at or toward the sides of the intermediate support at or toward a front end thereof. In an alternative embodiment, there may be any suitable number of resilient support(s) operatively supporting the seat portion above the intermediate support.

The rear resilient supports 303 are configured to act as spring members that bias the seat depth mounting 221 upwardly from the intermediate support 301. The rear resilient supports 303 form hinge members. The front resilient supports 305 vertically support the front of the seat depth mounting 221 above the intermediate support 301.

Figure 6A:
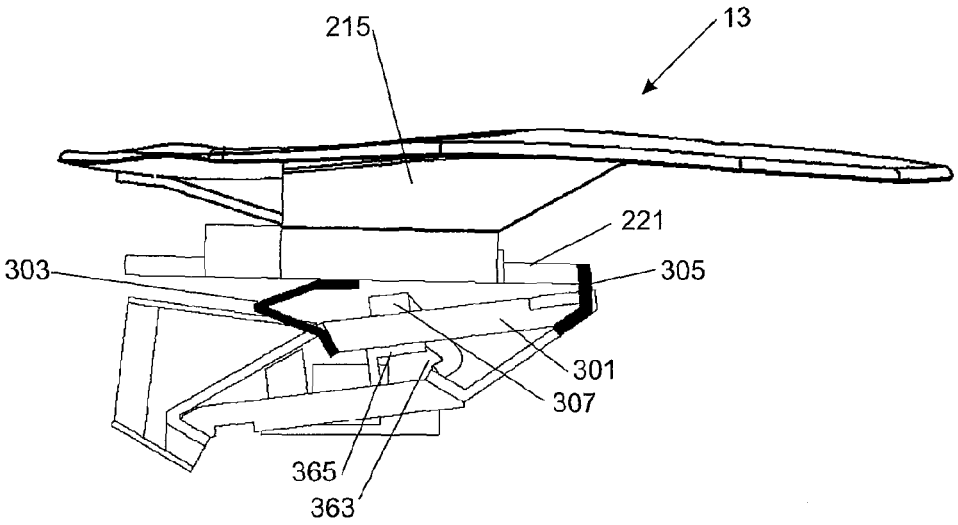
FIGS. 6*a*, 6*b*, 6*c*, and 6*d* are views of a preferred form auxiliary support mechanism of the chair, with the seat in a relaxed configuration, occupant-supporting configuration, forward tilting configuration, and reclining configuration respectively.
Figure 6B:
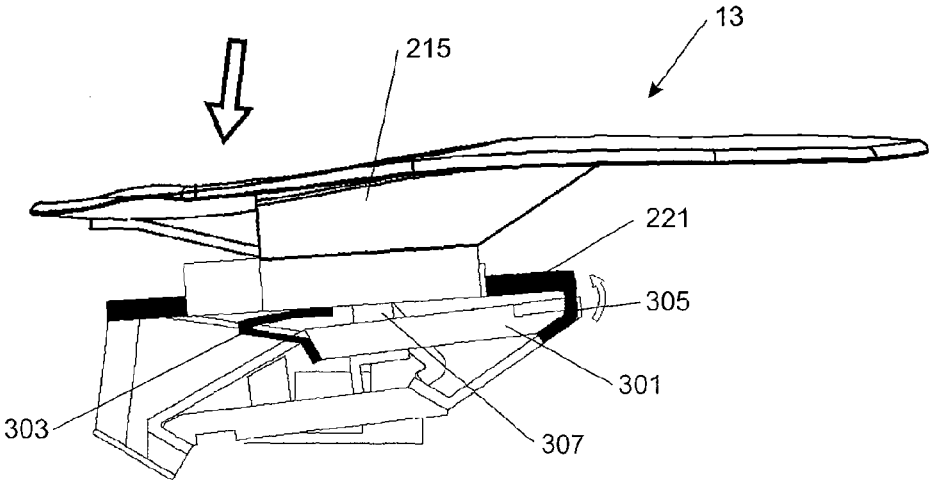

The resilient supports are configured to deform to enable the seat portion to move toward the intermediate support as an occupant sits on the seat portion, thereby absorbing at least some of the initial impact of the occupant sitting on the seat portion. FIG. 6*a* shows the configuration when the seat portion is not occupied. As an occupant sits on the seat portion with the majority of their weight on the central portion 203 of the seat pan, the rear supports 303 will compress and the seat depth mounting 221 will move to bottom out on the stop 307 as shown in FIG. 6*b*. That is, the rear end of the seat depth mounting and thereby the rear section of the seat portion is configured to move toward the intermediate support, while the front end of the seat depth mounting and thereby a more forward section of the seat portion remains a relatively constant distance above the intermediate support.

Figure 6C:
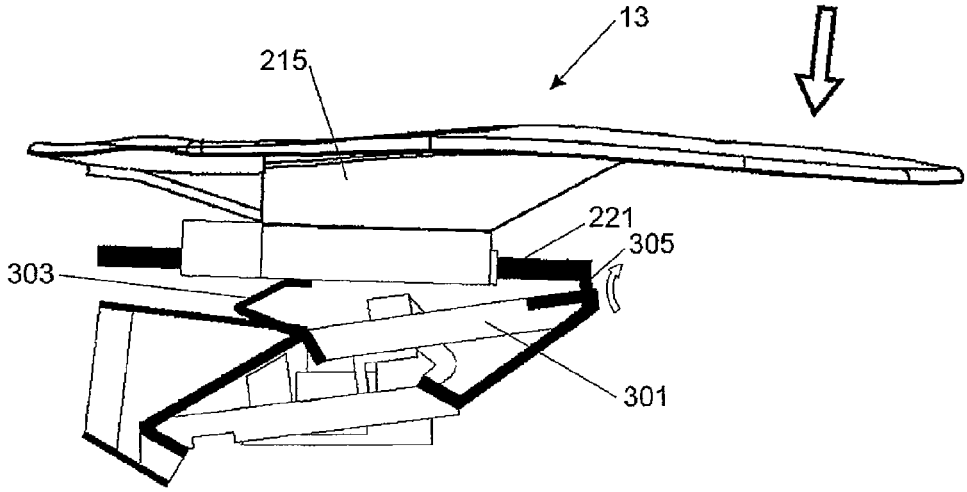

The resilient supports are configured to enable the seat portion to tilt forwardly relative to the intermediate support as an occupant applies load to the front section of the seat portion by leaning forward or moving forward on the seat portion. FIG. 6*c* shows the seat portion in the forward tilted configuration. The rear supports 303 have expanded to increase the vertical spacing between the rear of the intermediate support and the seat depth mounting, and the forward supports 305 have flexed forwardly to enable the lift of the rear of the seat depth mounting.

The resilient supports could be modified to enable the seat portion to tilt rearwardly relative to the intermediate support as an occupant applies load to a rear section of the seat portion, such as by applying a reclining action to the back portion. The rear supports 303 have compressed to decrease the vertical spacing between the rear of the intermediate support and the seat depth, and the forward supports 305 have flexed rearwardly to enable the lowering of the rear of the seat depth mounting.

Figure 6D:
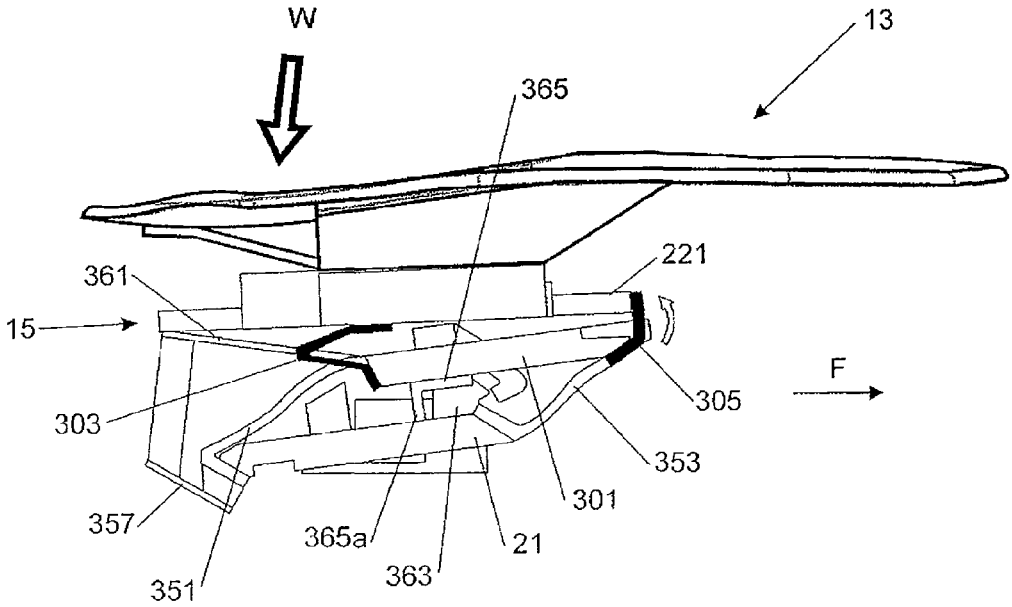
Figure 7:
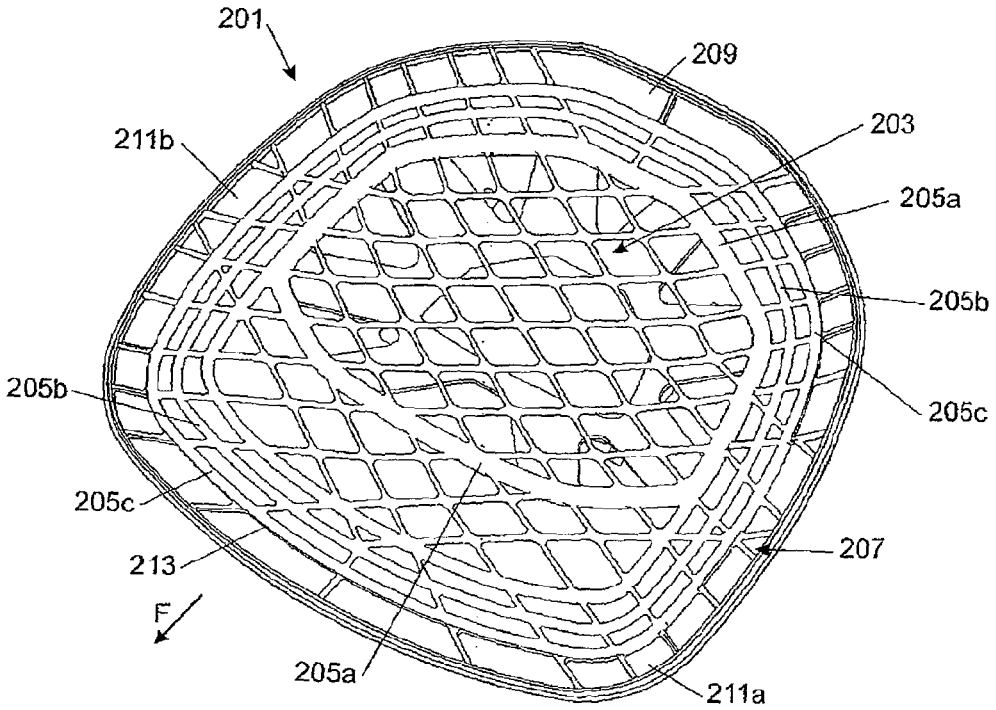
FIG. 7 is an overhead perspective view of a preferred form seat pan of the chair of FIG. 1.
Figure 8:
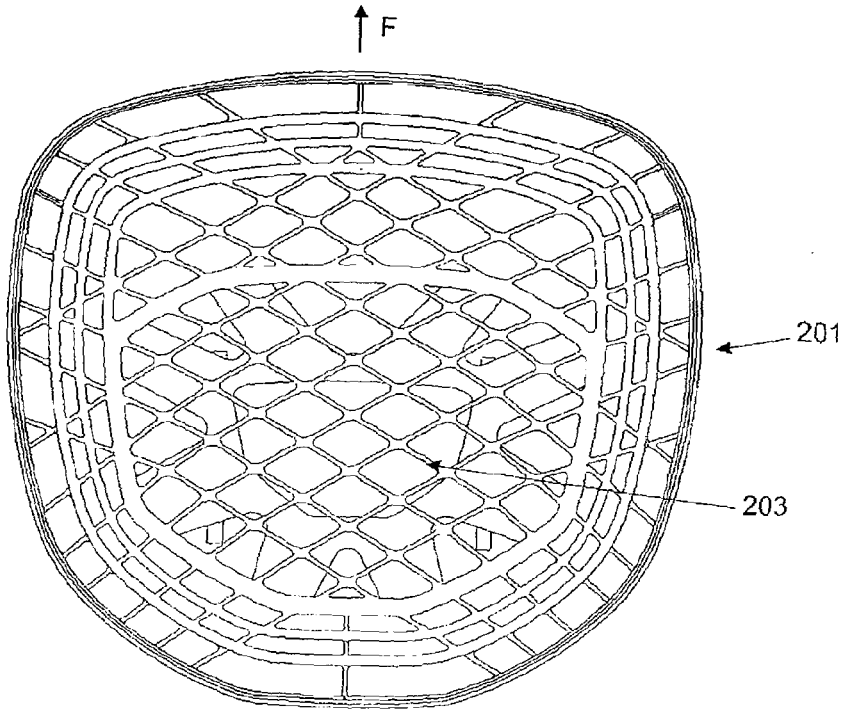
FIG. 8 is a plan view of the seat pan of FIG. 7.
Figure 9:
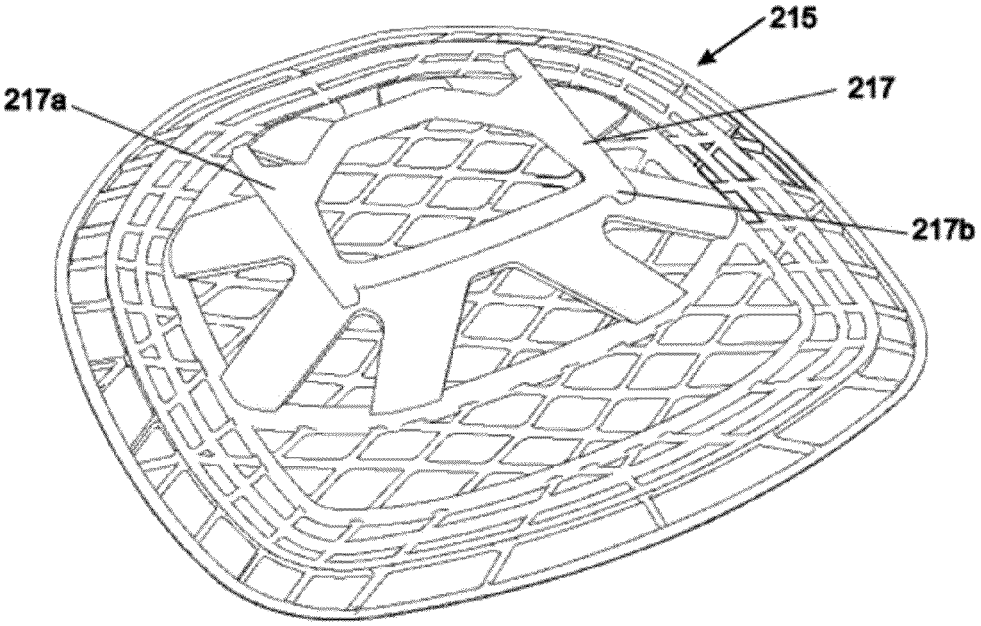
FIG. 9 is an underside perspective view of the seat pan of FIG. 7.
Figure 10:
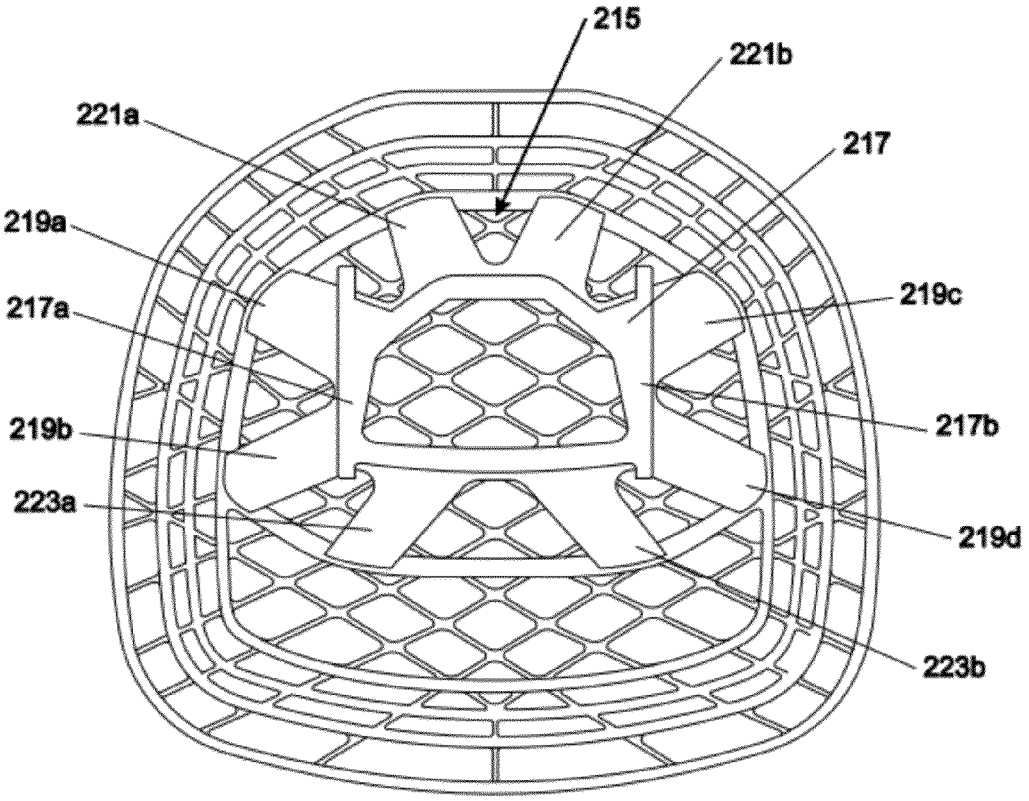
FIG. 10 is an underside view of the seat pan of FIG. 7.

FIG. 6*d* shows the configuration of the intermediate support and resilient supports as the seated occupant is causing the back portion of the chair to undergo a rearward reclining action by leaning rearwardly against the back portion. It can be seen that the rear supports 303 have expanded again to some extent. Additionally, the intermediate support 301 has moved upwardly and rearwardly due to the operation of the recline mechanism that is described below.

The resilient supports are preferably constructed from a polymeric material, and preferably an elastomeric material, such as rubber, thermoplastic polyurethane elastomer (TPU), or a nylon elastomer for example. Most preferably, the polymeric material is HYTREL, which is a thermoplastic polyester elastomer available from Du Pont. As an alternative, the resilient supports could be constructed from a metal material for example.

The front and/or rear resilient supports 303, 305 may be integrally formed with surrounding components, such as the intermediate support 301 and/or the seat depth mounting 221.

While the intermediate support and resilient supports are shown supported on a recline mechanism having deformable members as described below, it will be appreciated that the intermediate support and resilient supports could be incorporated into a chair having any suitable recline mechanism, which may lift, lower, and/or move forward or rearward the seat portion as the back portion undergoes a reclining action.

Castored Base

Figure 51:
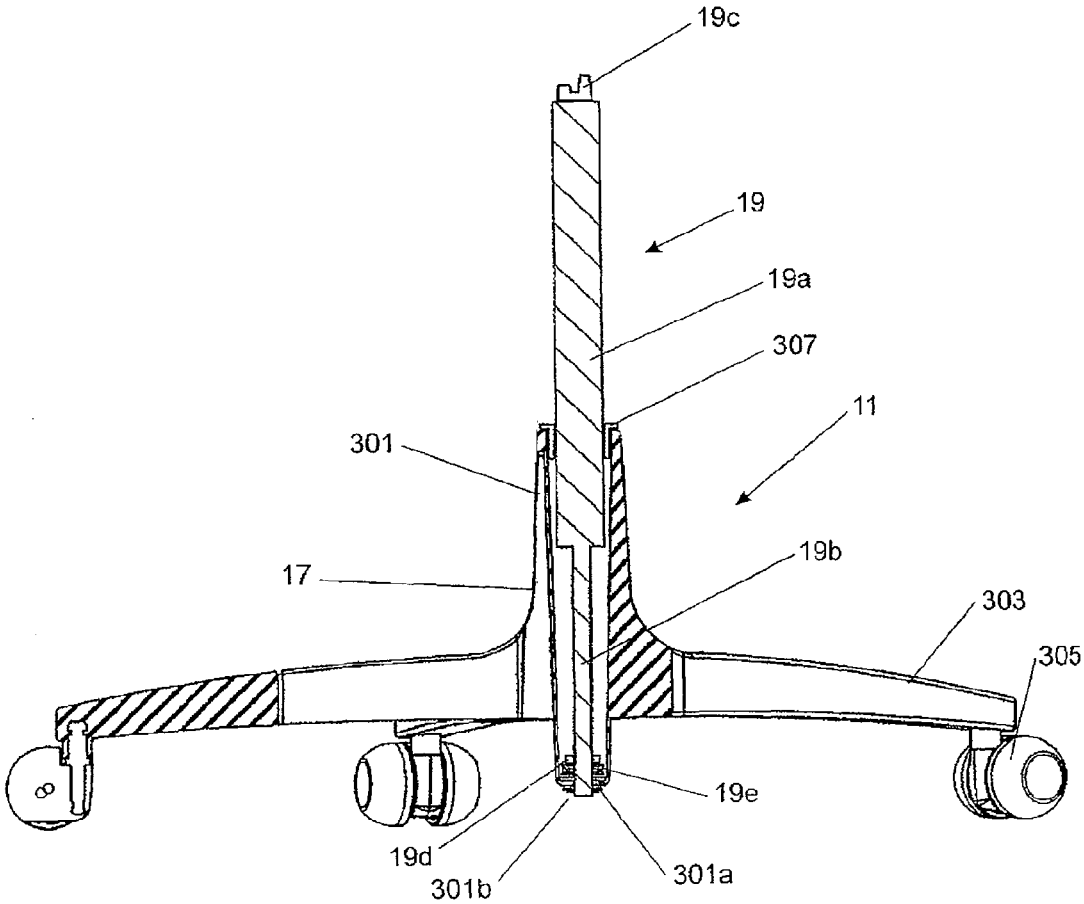
FIG. 51 is a side sectional view of a preferred form castored base for the chair of FIG. 1.
Figure 52:
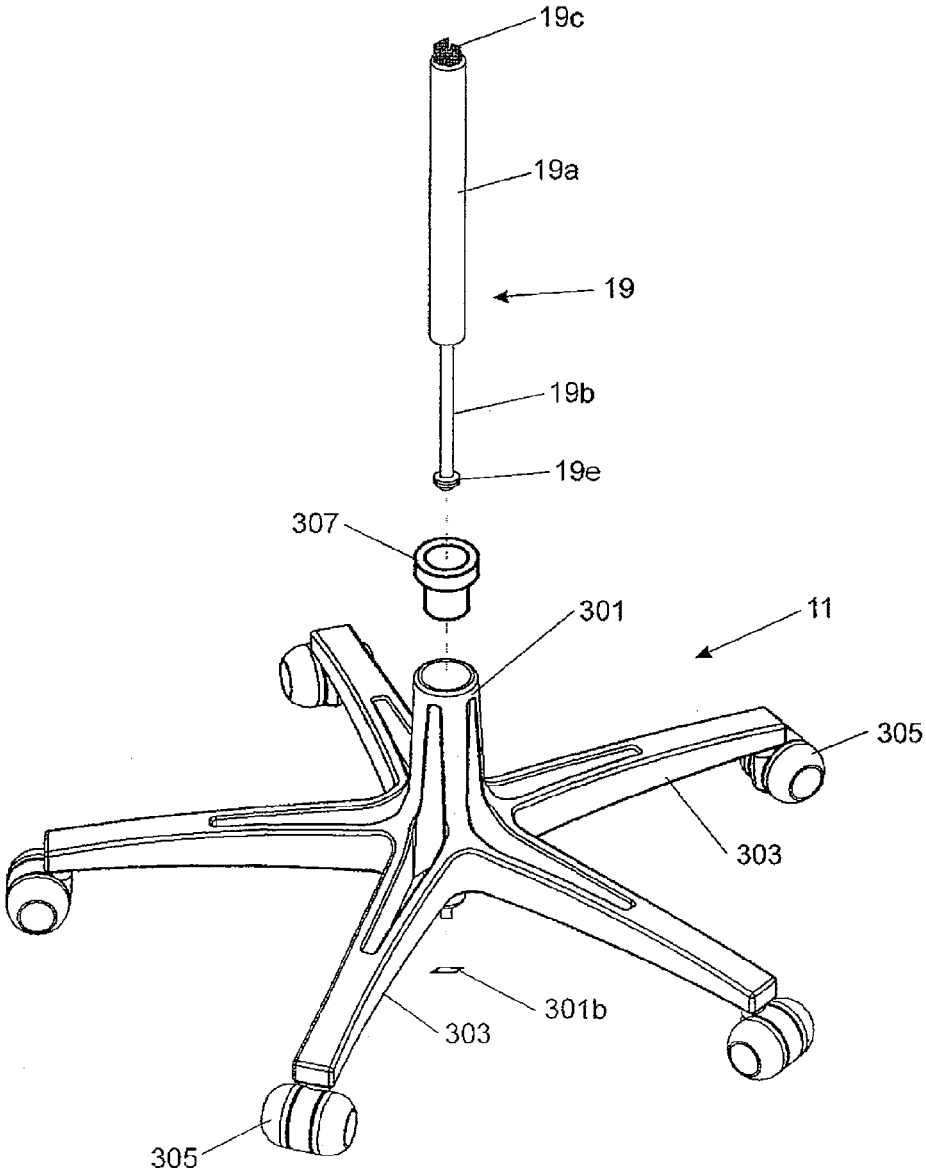
FIG. 52 is an exploded overhead perspective view of the castored base of FIG. 51.

Referring to FIGS. 51 and 52, the support frame includes a castored base 11. The castored base has a central portion 17 in the form of a tubular upstand 301 with a plurality of legs 303 extending radially outwardly therefrom, each leg having an end proximal the central portion and an end distal the central portion. A castor 305 is operatively supported for rotation at or adjacent the distal end of each leg. The tubular upstand 301 can have any suitable cross section.

The tubular upstand is integrally formed with the legs, and defines an internal cavity. The tubular upstand provides a support for the pneumatic spring 19. The pneumatic spring is of a standard type having a pressurised cylinder 19*a*, a rod 19*b* extending from the cylinder, and an actuator 19*c*. By moving the actuator, the rod and cylinder are caused to expand longitudinally, thereby increasing the height of the seat mechanism. If weight is applied to the seat portion at the time of moving the actuator, the weight will cause the rod to contract into the cylinder.

The central portion provides support for the pneumatic spring. The central portion has a floor 301*a* with an aperture through which the end of the rod can extend. The rod has a shoulder 19*d*, and a washer 19*e* which is axially fixed relative to the rod by the shoulder and which is larger than the aperture in the floor of the central portion. Accordingly, the washer 19*e* and the floor 301*a* of the central portion to resist the vertical loading applied to the chair mechanism. The rod is held in position by a clip 301*b* that clips to the rod beneath the floor 301*a*.

The cylinder extends from the upper end of the central portion through a bush 307 that is a press fit in the tubular upstand and that has an inner surface that provides a bearing surface for the cylinder 19*a*. The bush is adapted to resist side loading applied to the cylinder and provide a bearing surface for longitudinal movement of the rod or cylinder. The bush may be an integral part of the upstand.

In an alternative configuration, the pneumatic spring may be mounted in the central portion such that the cylinder is supported by a base of the central portion, and the rod extends from an upper end of the central portion.

The upstand and legs are preferably an integral moulded polymer component. The upstand and legs may alternatively be an integral cast metal component. By providing the tubular upstand that takes the load from the pneumatic spring and the legs as an integral component, superior strength and rigidity is achieved.

It will be appreciated that the height adjustment spring can be any suitable type, such as a pneumatic spring, hydraulic spring, or mechanical spring for example.

Recline Mechanism

The chair incorporates a preferred form recline mechanism as shown in FIGS. 1 to 5. The recline mechanism comprises a rear deformable member 351 extending between a rearward portion of the main transom 21 and a rearward portion of the intermediate support 301, thereby operatively connecting a rearward portion of the seat portion and the supporting frame. The recline mechanism further comprises a front deformable member 353 extending between a forward portion of the main transom 21 and a forward portion of the intermediate support 301, thereby operatively connecting a more forward portion of the seat portion and the supporting frame. In the form shown, each of the front and rear deformable members extends transversely to a forward direction of the chair, and extends substantially the width of the main transom 21.

The deformable members 351, 353 each comprise an elastomeric panel. The elastomeric material may comprise rubber, or an elastomeric polymer such as a thermoplastic polyurethane elastomer (TPU) or a nylon elastomer for example. Most preferably, the polymeric material is HYTREL, which is a thermoplastic polyester elastomer available from Du Pont. The panels may be made from any other suitable type of material.

A generally vertical rigid panel 355 that extends transversely to the forward direction of the chair extends between the upper 49*a* and lower 49*b* members of the back support. The panel may be an integral part of the back support, or alternatively could be an integral part of the recline mechanism as described below.

A lower deformable member 357 extends rearwardly from the main transom of the chair to a lower portion of the vertical panel 355, thereby operatively connecting a lower part of the back portion and the supporting frame. In the preferred form shown, a rigid member 359 extends below the rearward portion of the main transom to provide a mounting position for the lower deformable member 357. The rigid member 359 may be an integral part of the main transom 21. Again, the lower deformable member is preferably in the form of a panel which extends substantially the width of the main transom, and may be made of any of the materials outlined in relation to the panels 351, 353 above.

The recline mechanism further comprises a puller member 361 above the lower deformable member and extending from a rearward part of the intermediate support 301 to an upper portion of the vertical panel 355, thereby operatively connecting the back portion to the seat portion. Again, the puller member is preferably in the form of a panel which extends substantially the width of the main transom, and may be made of any of the materials outlined in relation to the panels 351, 353 above. However, depending on the particular configuration, the puller member could be substantially rigid rather than deformable, as its primary purpose is to apply a rearward pulling action to move the seat portion.

Figure 2:
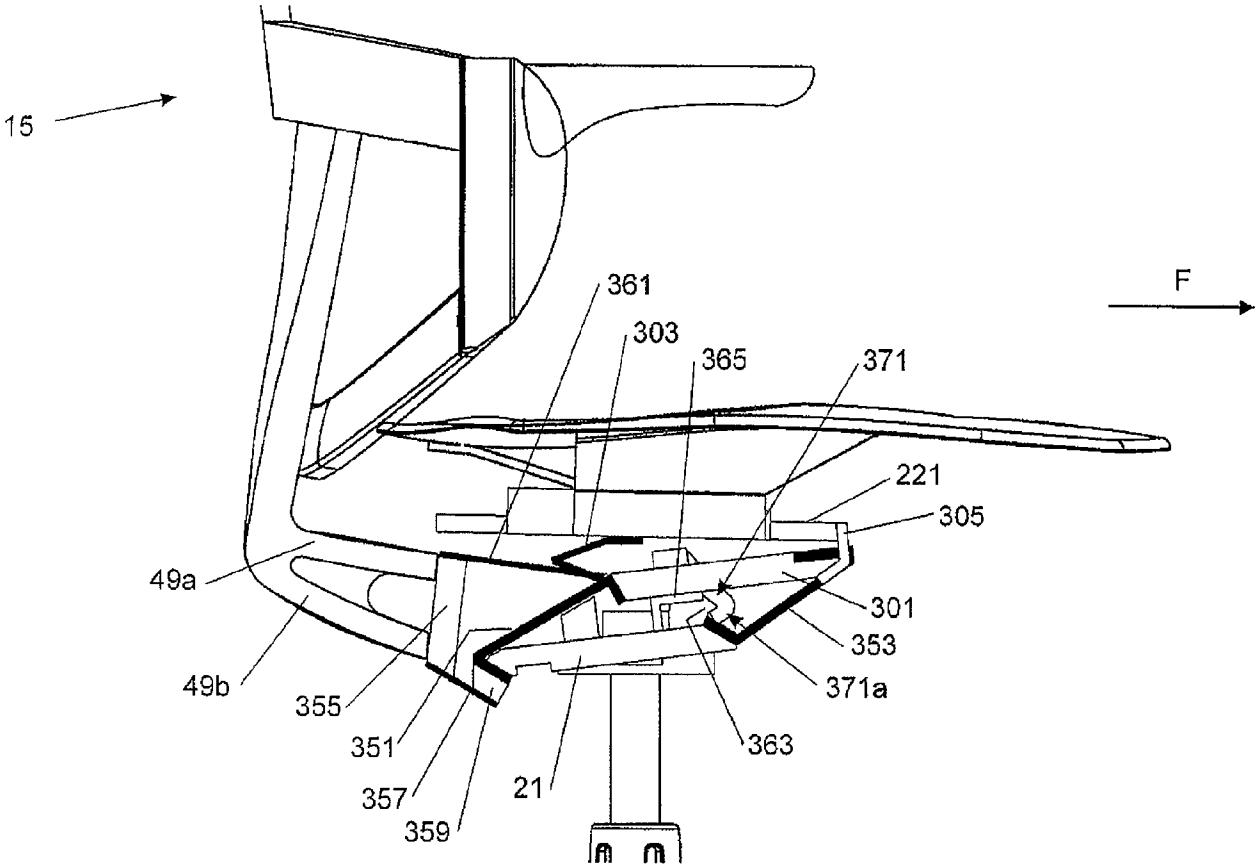
FIG. 2 is a detailed side view of a preferred form recline mechanism of the chair of FIG. 1.
Figure 4:
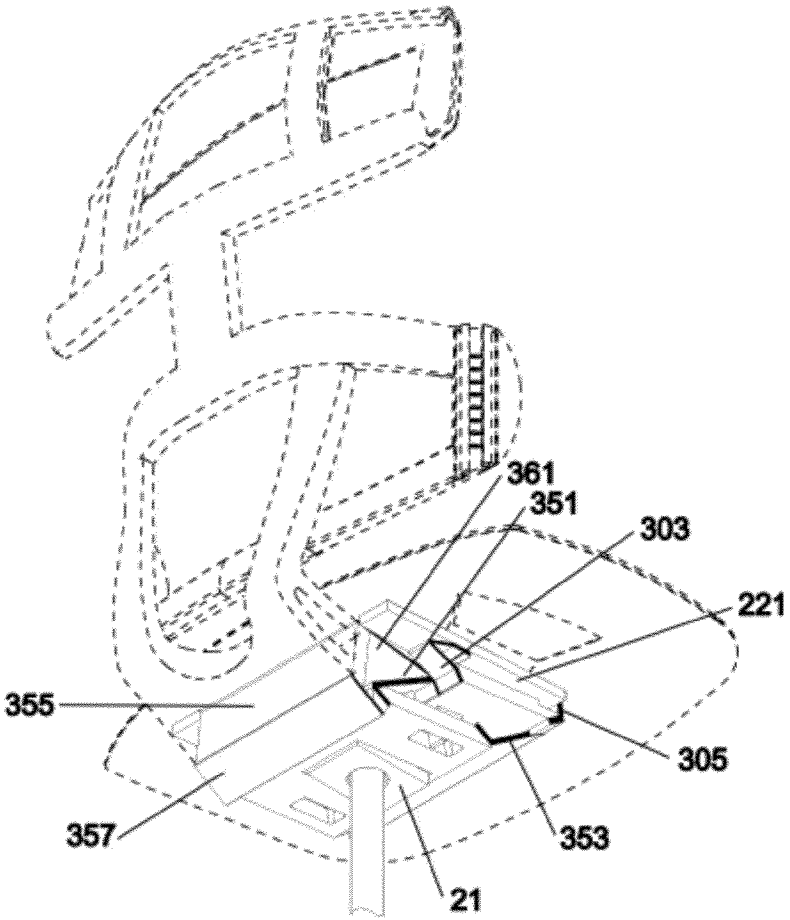
FIG. 4 is a rear underside perspective view of the recline mechanism of FIG. 2.
Figure 3:
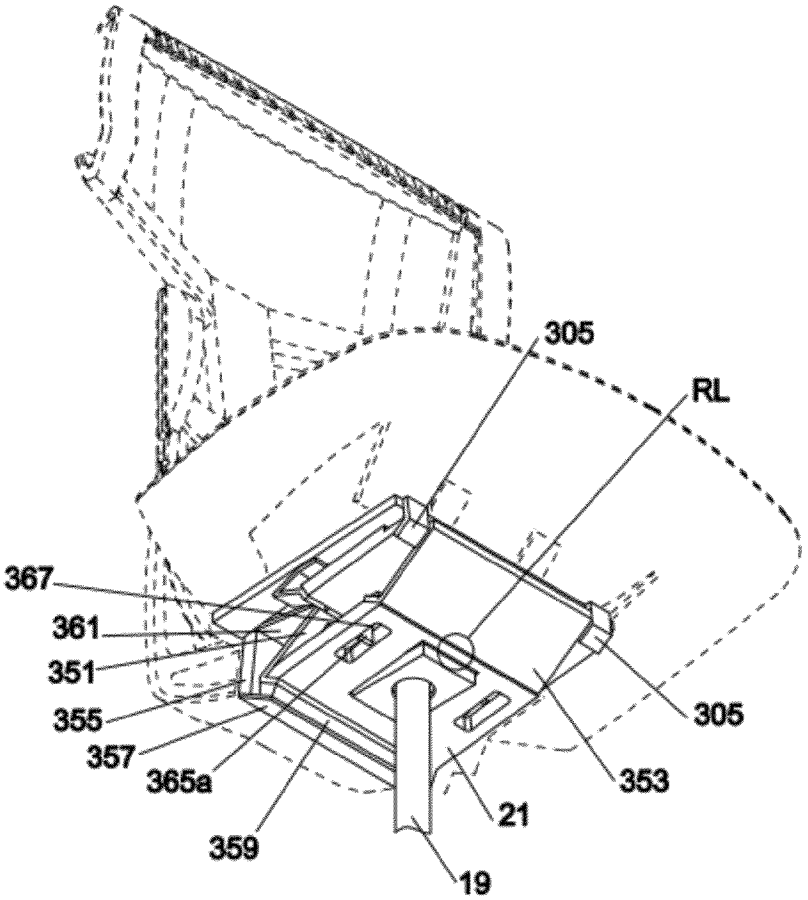
FIG. 3 is a front underside perspective view of the recline mechanism of FIG. 2.
Figure 5:
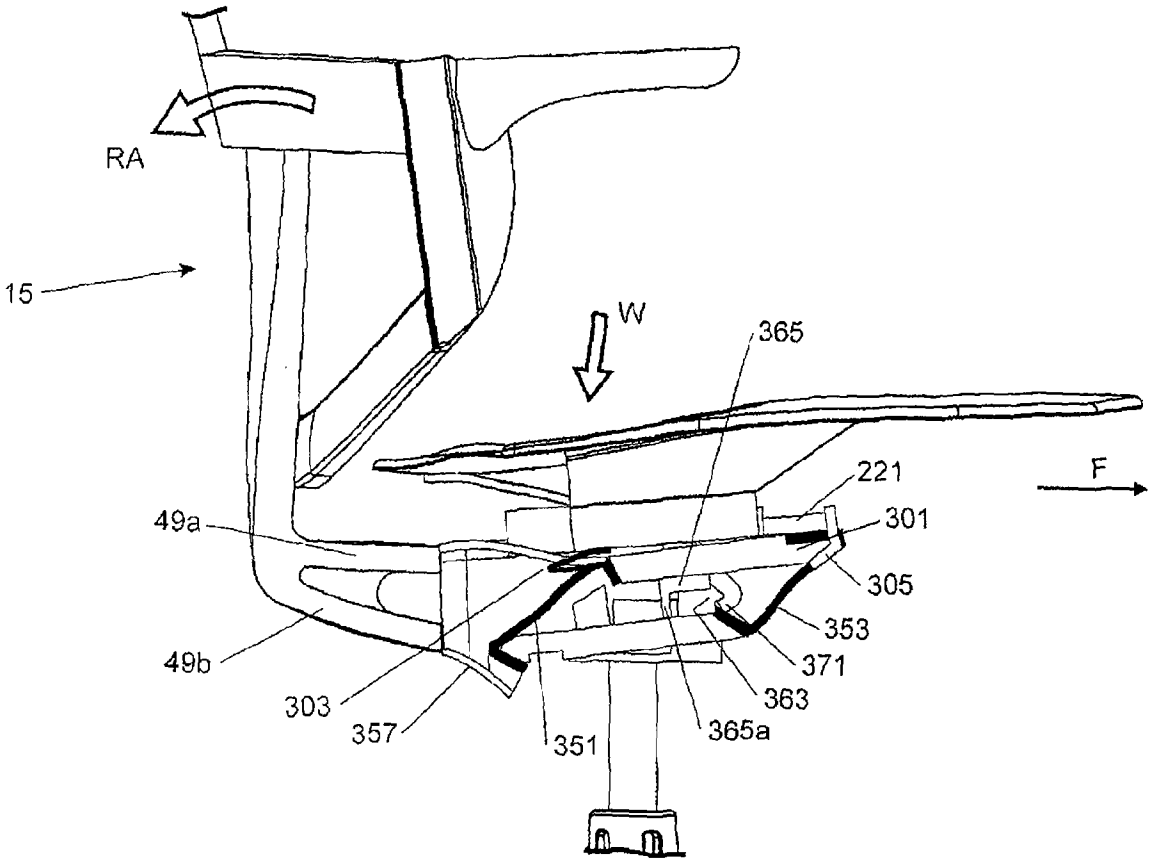
FIG. 5 is a side view of the recline mechanism of FIG. 2, showing deformation of the members as the back portion undergoes a reclining action.

The recline mechanism is configured such that as the back portion 15 of the chair is reclined, the lower deformable member 357 deforms and the puller member 361 applies a rearward pulling action which causes the seat to move rearwardly and the front and rear deformable members to deform. FIGS. 2 to 4 show the chair with the back portion 15 in the upright configuration. FIG. 5 shows the seat portion with the weight W of a seated occupant (not shown) applied to the seat portion and the back undergoing a reclining action RA. The lower deformable member 357 has flexed to enable the support extension 49*b* to lower, and the puller 361 has applied a rearward pulling action to the intermediate support, causing that to raise and move rearwardly from the position it is in when a load is applied to the seat but the back is not undergoing a reclining action. The front and rear deformable members 353, 351 have flexed into a sinuous shape, to provide the movement of the intermediate support and thereby the seat portion.

Because at least a major part—namely at least the rearward part—of the seat portion lifts and moves rearwardly as the back portion is reclined, the occupant's weight compensates the reclining action of the back portion. Accordingly, as the rearward force is removed from the back portion, the occupant's weight will cause the back portion to return to the upright position. If the deformable members 351, 353 are resilient, the resilience alone may act to return the back portion to the upright position if the back portion is caused to undergo a reclining action without an occupant in the chair.

The chair may be provided with one or more recline springs to apply a returning force for the back portion, which assists in returning the back portion to the upright position.

In an alternative configuration, rather than being substantially planar panels, the front and rear deformable members may be pre-moulded with an inherent curvature. For example, in a relaxed state, the front and rear deformable members may have a sinuous configuration. Forward movement of the seat as an occupant sits on the chair, or rearward movement of the seat as an occupant reclines the back of the chair by leaning back, may cause the front and rear deformable members to initially straighten from the sinuous configuration. The chair may be provided with one or more recline springs to resist reclining action of the back portion.

As an alternative, one or both of the as-moulded members could be concave or convex when viewed from above. For example, at least when the chair is in a relaxed state, the forward member may be concave when viewed from above and the rear member may be convex when viewed from above.

The front and rear members may have different widths.

The recline mechanism is provided with a downstop 365 configured such that the downstop 365 rests on the main transom to support the weight of the seated occupant on the seat portion via the supporting frame when the back portion is not being reclined. Therefore, the front and rear flexible members may be unloaded when the back portion is not undergoing a reclining action. An extension 365*a* of member 365 may extend into a slot 367 in the main transom 21, with a rearward end of the slot defining a recline limit for the recline mechanism. That is, once the extension 365*a* contacts the rearward end of the slot, the intermediate support is prevented from undergoing a further rearward or upward movement. There are preferably recline limits and downstops provided at or toward either side of the chair. Any other suitable type or configuration of downstop and recline limit could be used.

However, as the support members 47*a*, 47*b* are able to flex, additional force applied to the back portion can cause the back portion to undergo an additional reclining action as shown by the dark lines in FIG. 23. The seat portion will not move as the back portion moves from the reclined position shown in intermediate lines to the "hyper flex" position shown in dark lines. The resilience of the members 47*a*, 47*b* will cause the back portion to return to the reclined position as the force is removed from the back portion.

The recline mechanism is also provided with a recline lock, indicated generally by reference numeral 371 in FIG. 2. The recline lock comprises a hook member 371*a* that is pivotally mounted to the intermediate support 301, and that engages with a detent 363. The hook member will be biased into engagement with the detent 363. When the hook member is engaged with the detent, the intermediate support 301 is prevented from moving upwardly and rearwardly relative to the main transom. To enable the reclining action of the back portion to occur, the hook member is released from engagement with the detent, by pulling a cable connected to an actuator for example (not shown). That enables the intermediate support to move relative to the main transom, so the back portion can be reclined and the seat moved accordingly. It is preferred that the recline mechanism has a single recline lock that is generally centrally disposed, such as in the area RL indicated in FIG. 3.

At least two of the deformable members may form an integrally moulded structure. In particular, the upper 361 and lower 357 deformable members may form an integrally moulded structure. Part of the integral structure may comprise the vertical member 355 that interconnects the rear ends of the upper and lower deformable members. Alternatively, or in addition, the upper and lower deformable members 357, 361 may form an integrally moulded structure with the rear deformable member 351. That integral structure may include component 359. The integral structure can be moulded to have the desired properties in particular areas.

As an alternative, the upper 361 and lower 357 deformable members, and the front 353 and rear 351 deformable members, may all form an integrally molded structure.

It will be appreciated that this recline mechanism can be incorporated into a chair that does not have an intermediate support and/or that does not have a depth adjustable seat portion.

While in the form shown the puller member connects to the intermediate support, that could instead be operatively connected to the seat pan 207, seat support 217, or upper part of the rearward deformable member 351 to achieve the required pulling action. Rather than having single panels extending substantially the width of the main transom, any of the front deformable member, rear deformable member, lower deformable member, and the puller could be replaced with multiple components. However, single members may be used to reduce the parts count.

Second Preferred Form Chair

Figure 53:
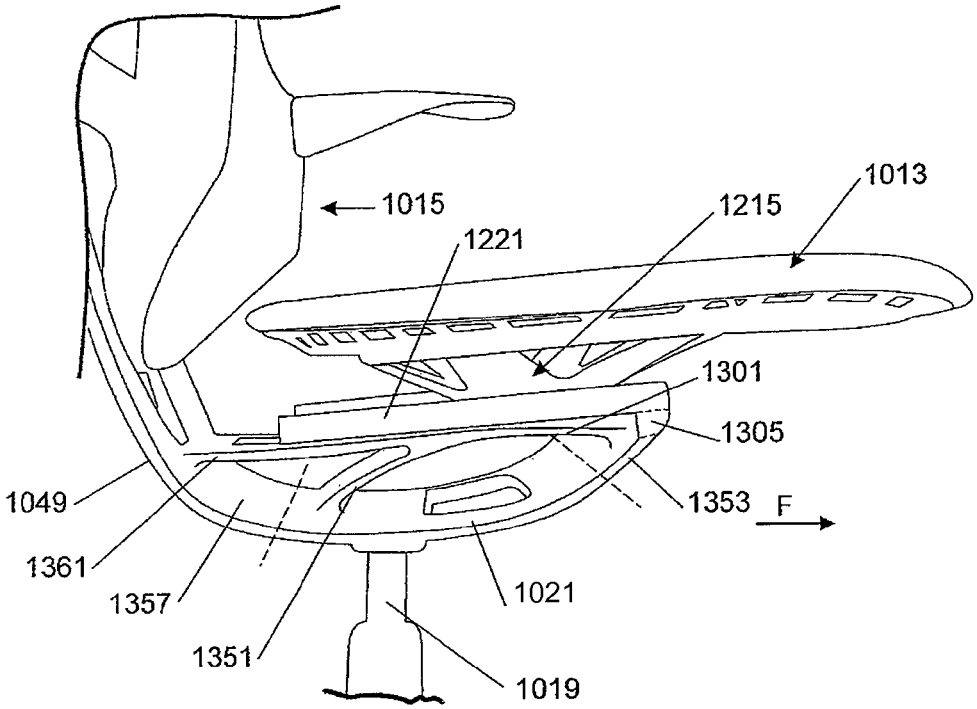
FIG. 53 is a side view of a recline mechanism of a second preferred form chair, with the back portion in an upright position.
Figure 54:
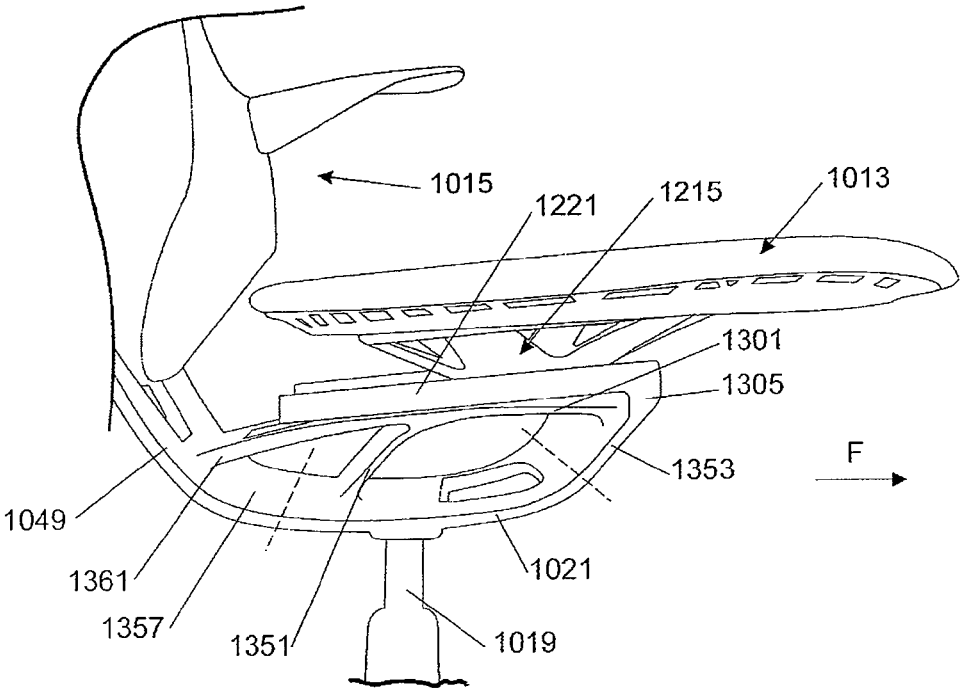
FIG. 54 is a side view similar to FIG. 53, but showing the back portion in an intermediate reclined position.
Figure 55:
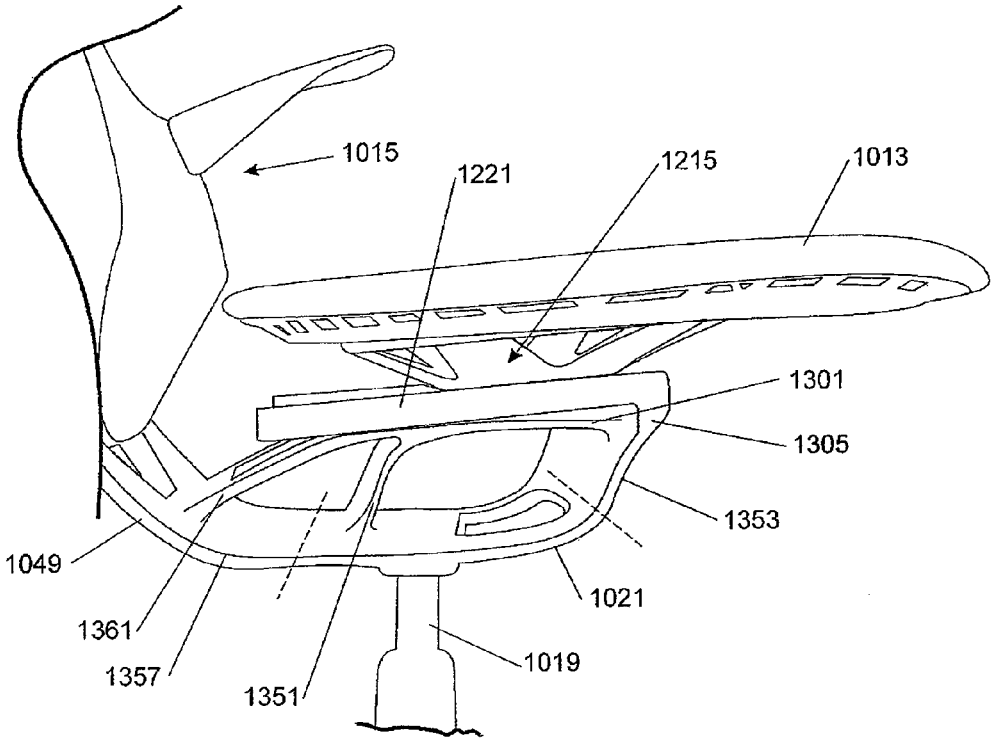
FIG. 55 is a side view similar to FIG. 53, but showing the back portion in a further reclined position.

FIGS. 53 to 55 show a second preferred form chair with a recline mechanism. Unless described below, the features and operation should be considered the same as described above with reference to FIGS. 1 to 52, and like reference numerals are used to indicate like parts, with the addition of 1000. It should be noted that while an occupant is not shown in FIGS. 53 to 55, the chair is shown in the position it would take with a seated occupant, so the seat support 1221 has bottomed out and is supported on the intermediate support 1301.

Again, the chair has a rigid base or main transom 1021. In this form, the transom 1021 has a gentle concave curvature when viewed from above. Phantom lines in FIGS. 53 to 55 indicate the front and rear ends of the main transom. A front deformable member 1353 that is generally concave when viewed from above extends forwardly and upwardly from the front of the main transom. A rear deformable member 1351 that is generally convex when viewed from above extends forwardly and upwardly from the rear of the main transom. The upper forward portion of the rear deformable member 1351 connects to the intermediate support 1301, and the front end of the intermediate support connects to an upper inner portion of the front deformable member 1353.

The front and rear deformable members 1351, 1353 each comprise an elastomeric member, which may be made of one of the materials discussed above.

A lower deformable member 1357 extends rearwardly from the main transom of the chair to a lower portion 1049 of the back portion, thereby operatively connecting the lower portion of the back portion and the supporting frame 1021. The lower deformable member 1357 has a concave curvature when viewed from above.

The recline mechanism further comprises a puller member 1361 above the lower deformable member 1357 and extending from a rearward portion of the intermediate support 1301 to the back portion. The rear portion of the lower deformable member 1357 may terminate at the interconnection of the puller 1361 to the back portion. Alternatively, there may be a relatively rigid section between the rearward portion of the lower deformable member 1357 and the interconnection of the puller to the back portion. Again, the puller member and the lower deformable member are preferably resilient members, and may be made of any of the materials discussed above. Again, depending on the particular configuration, the puller member could be substantially rigid rather than deformable, as its primary purpose is to apply a rearward pulling action to move the seat portion.

In the form shown, the puller 1361 and rear deformable member 1351 are narrower than the lower deformable member 1357 and front deformable member 1353.

The recline mechanism is configured such that as the back portion 1015 of the chair is reclined, the lower deformable member 1357 deforms and the puller member 1361 applies a rearward pulling action which causes the seat to move rearwardly and the front and rear deformable members to deform. FIG. 53 shows the chair with the back portion 1015 in an upright position. FIG. 54 shows the chair with the back portion 1015 in an intermediate reclined position. FIG. 55 shows the chair with the back portion 1015 in a further reclined position.

The preferred form recline mechanism has smooth intersections between components, and the recline mechanism can be readily formed as one or more integral items.

Third Preferred Form Chair

Figure 56:
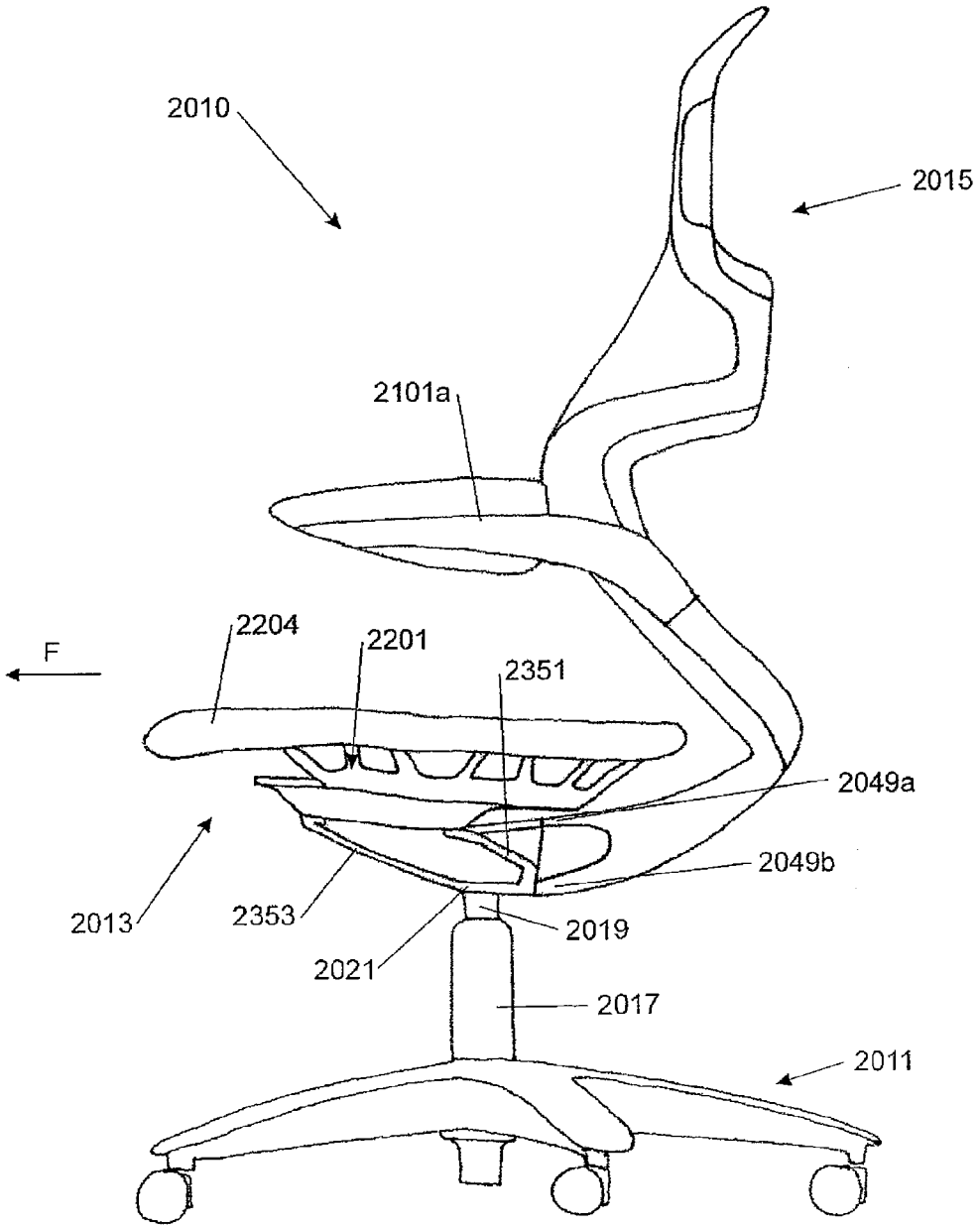
FIG. 56 is a side elevation view of a third preferred form chair.
Figure 113:
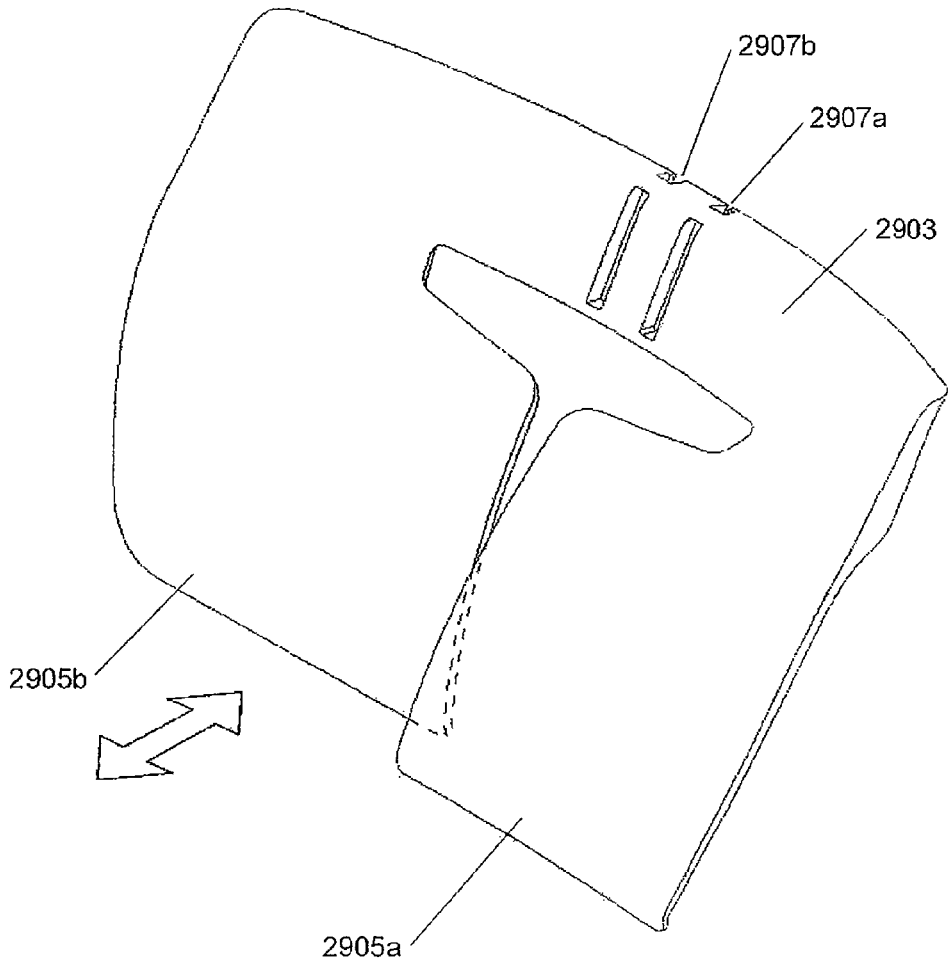

FIGS. 56 to 113 show a third preferred form chair with a recline mechanism. Unless described below, the features, operation, and alternatives should be considered the same as described above with reference to FIGS. 1 to 52, and like reference numerals are used to indicate like parts, with the addition of 2000.

FIG. 56 illustrates an office task chair 2010 including a main assembly having a seat portion 2013 and a back portion 2015. The seat portion 2013 and the back portion 2015 are operatively supported above the ground by a supporting frame including a wheeled or castored base 2011 having a central support column 2017 housing a height adjust spring 2019 for selective height adjustment of the main assembly. The base 2011, support column 2017, and spring 2019 form a height adjust pedestal. An upper end of the height adjust spring is connected to the main transom 2021 of the chair. The castored base 2011, height adjust spring 2019, and main transom all form part of the supporting frame. In this embodiment, the castored base 2011 is a standard configuration with a separate post 2017 mounted to the base 2011.

Back Portion

As can be seen from FIGS. 72 to 75, the lower portion 2027 of the back portion has a transversely extending top member 2033, a transversely extending bottom member 2035, and at least two spaced apart members 2037*a*, 2037*b* interconnecting the top and bottom members. The members 2037*a*, 2037*b* effectively form a continuation of the transversely extending bottom member 2035, and are angled forwardly, outwardly, and upwardly from the bottom member. At least part of each of the members 2037*a*, 2037*b* may be generally linear as shown. In the form shown, the members 2037*a*, 2037*b* are each positioned at a respective end of the top and bottom transverse members.

The top 2033 and bottom 2035 members are generally concave when viewed from the front of the seat. The top member 2033 and the spaced apart members 2037*a*, 2037*b* extend around the sides of the lower back of a seated adult occupant, so that the lower portion of the back frame "cups" the lower back of the seated occupant.

The back portion comprises at least one support member extending from the lower portion 2027, to provide a means of supporting the back portion from another part of the chair, such as the main transom of the supporting frame, the seat portion, or from both the seat portion and supporting frame. In the form shown, the back portion has two horizontally spaced support members 2045*a*, 2045*b*. The support members 2045*a*, 2045*b* are connected to the lower portion 2027 of the back portion, at or adjacent a bottom edge of the lower portion of the back frame. In the form shown, the support members 2045*a*, 2045*b* are connected to the bottom transverse member 2035 of the lower portion of the back frame.

The support members 2045*a*, 2045*b* are of a substantially rigid construction.

In the form shown, the horizontally spaced support members 2045*a*, 2045*b* are adjoined at lower ends thereof by an integral transverse connector member 2049. The transverse connector member incorporates upper and lower connectors 2049*a*, 2049*b* that extend in a generally forwardly-directed V-shaped configuration.

The back frame and support members are of a unitary construction, and may be moulded from a polymeric material for example.

It is preferred that the lower portion of the back frame is substantially unable to twist about an axis extending substantially parallel to and between the members 2045*a*, 2045*b*.

At least a lower part of the upper portion and at least an upper part of the lower portion are preferably resiliently flexible.

Figure 75:
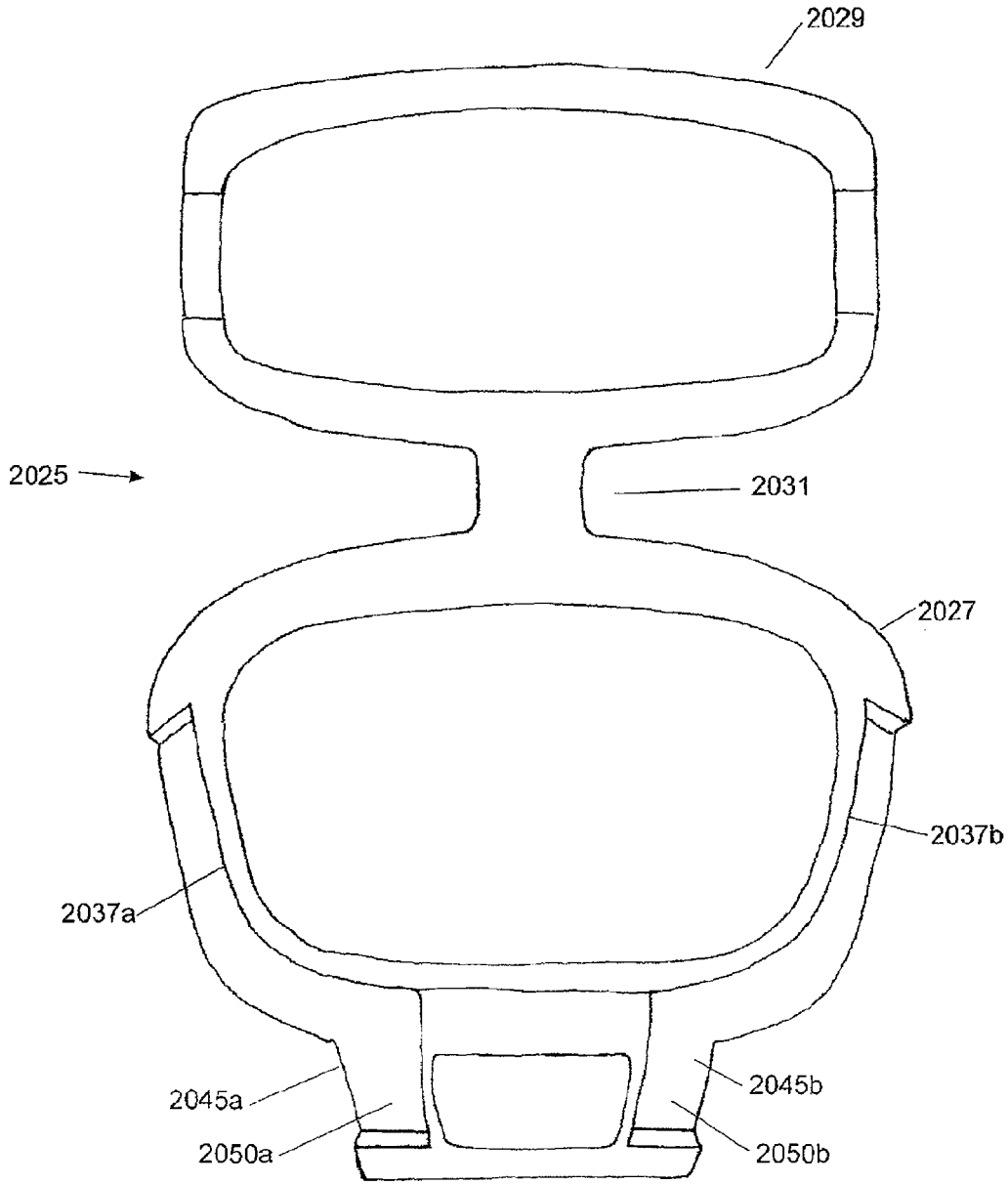
FIG. 75 is a rear view of the back frame, showing mounting regions for arm rest supports.
Figure 76:
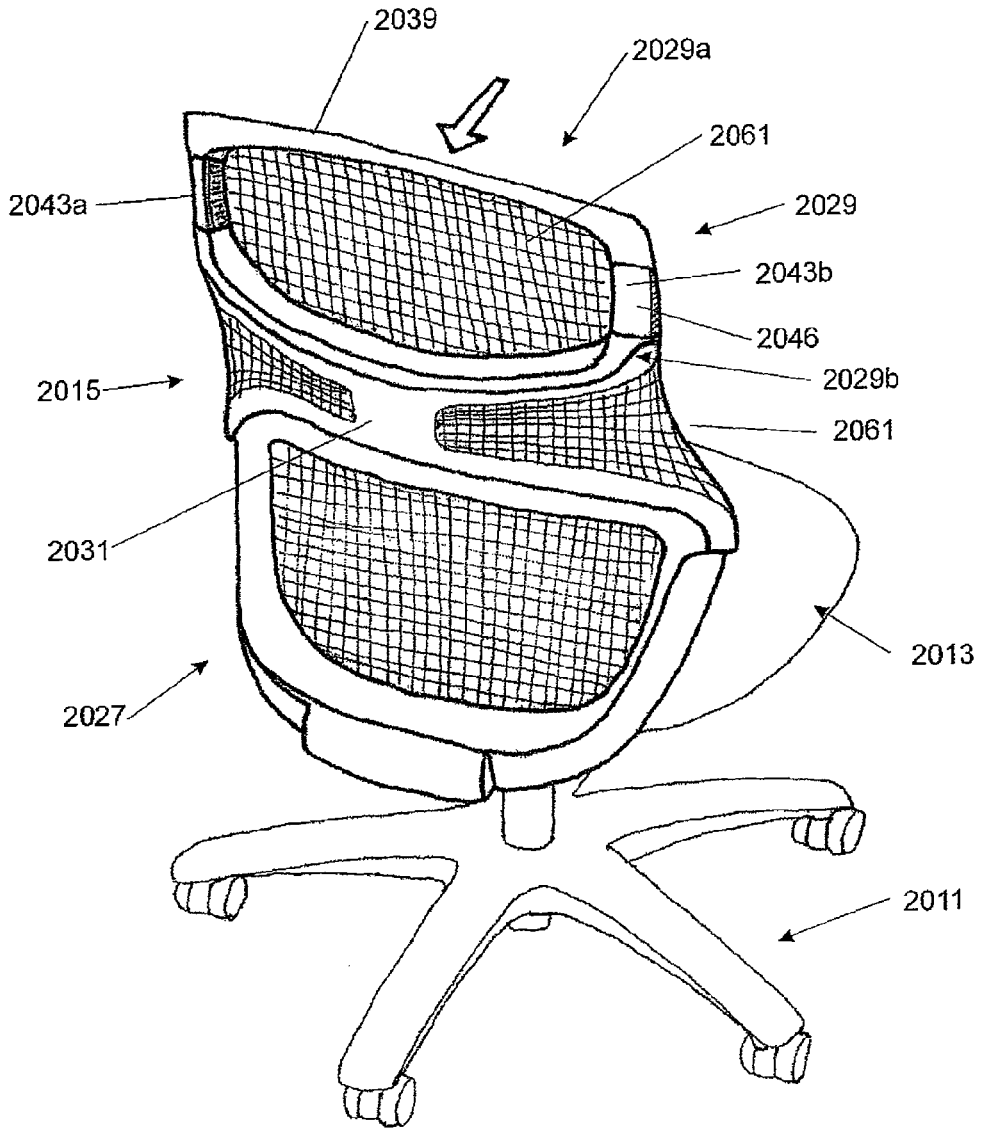
FIG. 76 is a rear overhead perspective view of the back portion of the chair of FIG. 56, showing an upper section in an upright configuration.
Figure 77:
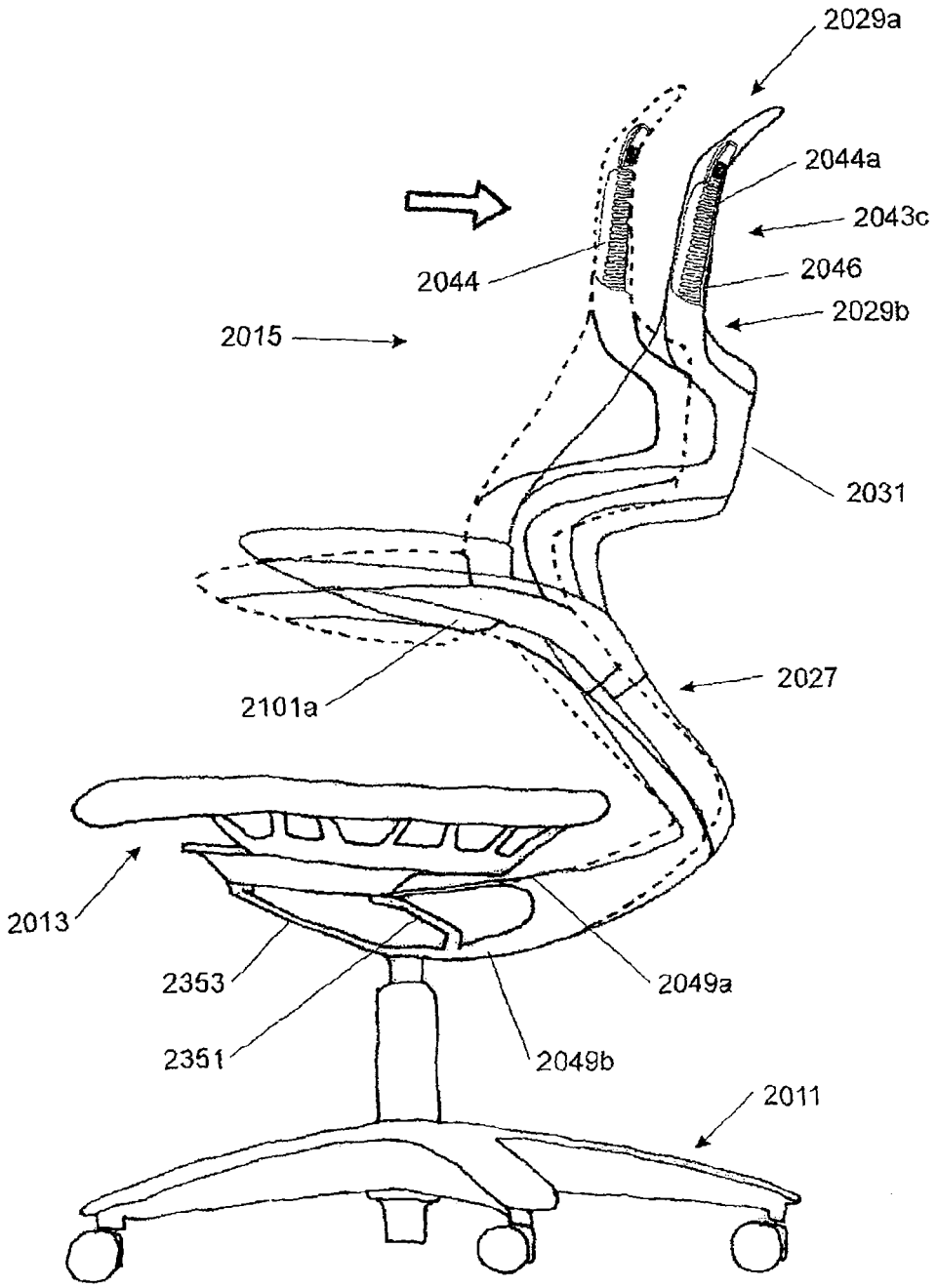
FIG. 77 is a side elevation view of the back portion of the chair of FIG. 56, showing the upper section in the upright configuration.
Figure 78:
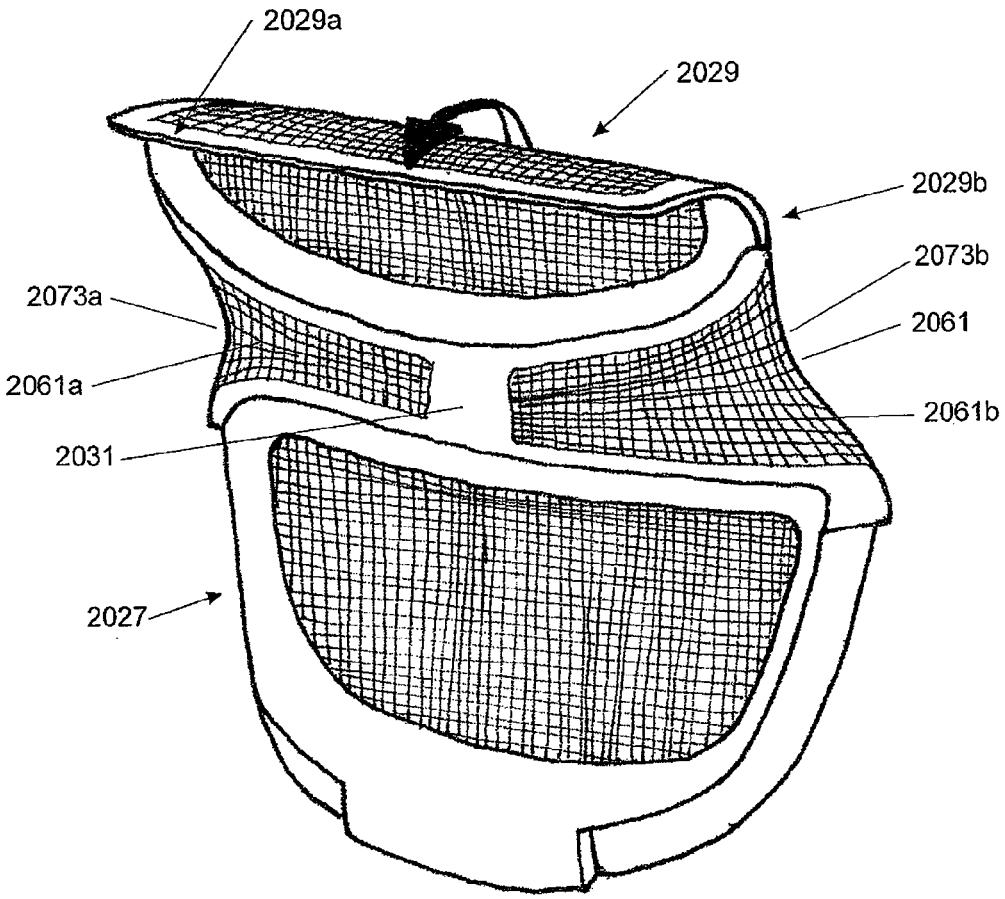
FIG. 78 is a rear overhead perspective view of the back portion of the chair of FIG. 56, showing the upper section in a folded configuration.
Figure 79:
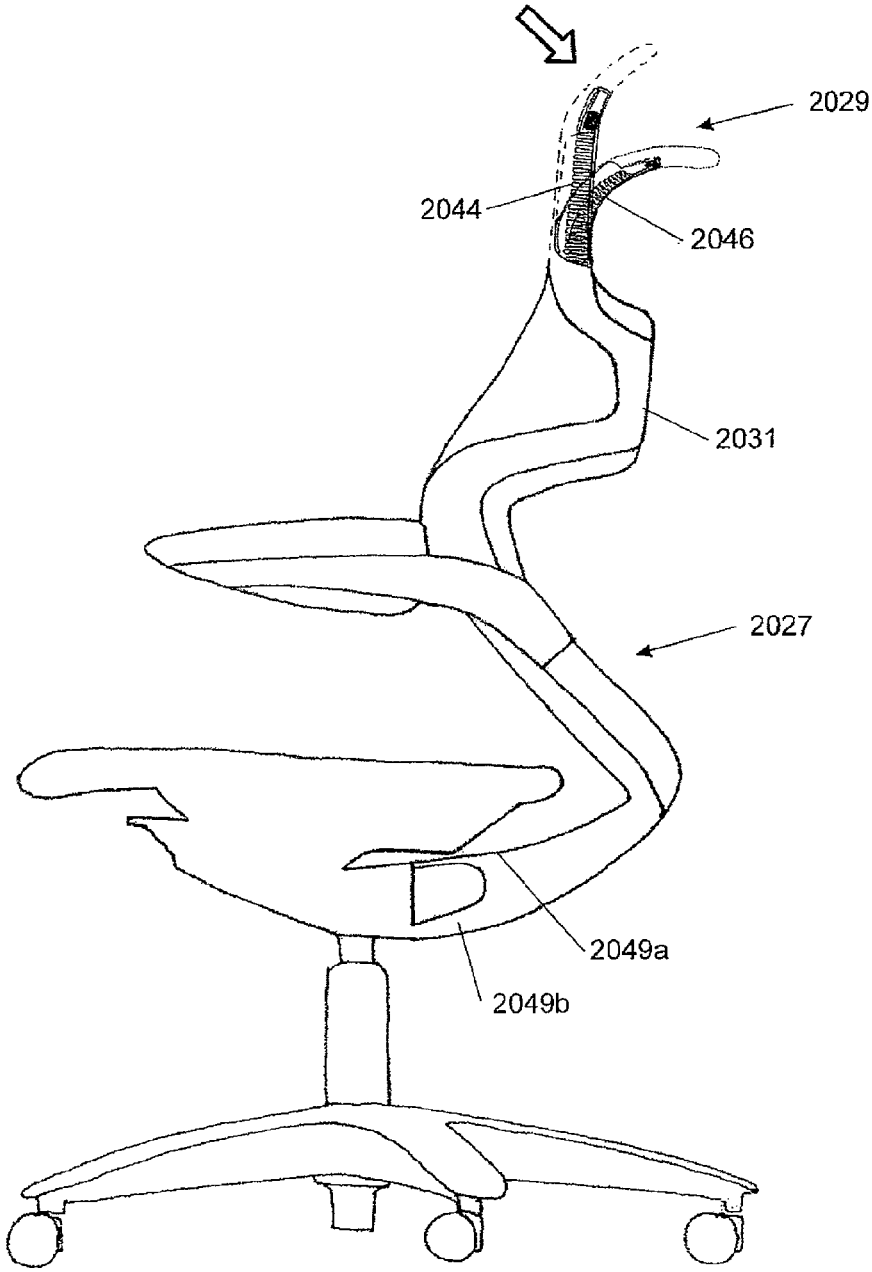
FIG. 79 is a side elevation view of the back portion of the chair of FIG. 56, showing the upper section in the folded configuration.
Figure 80:
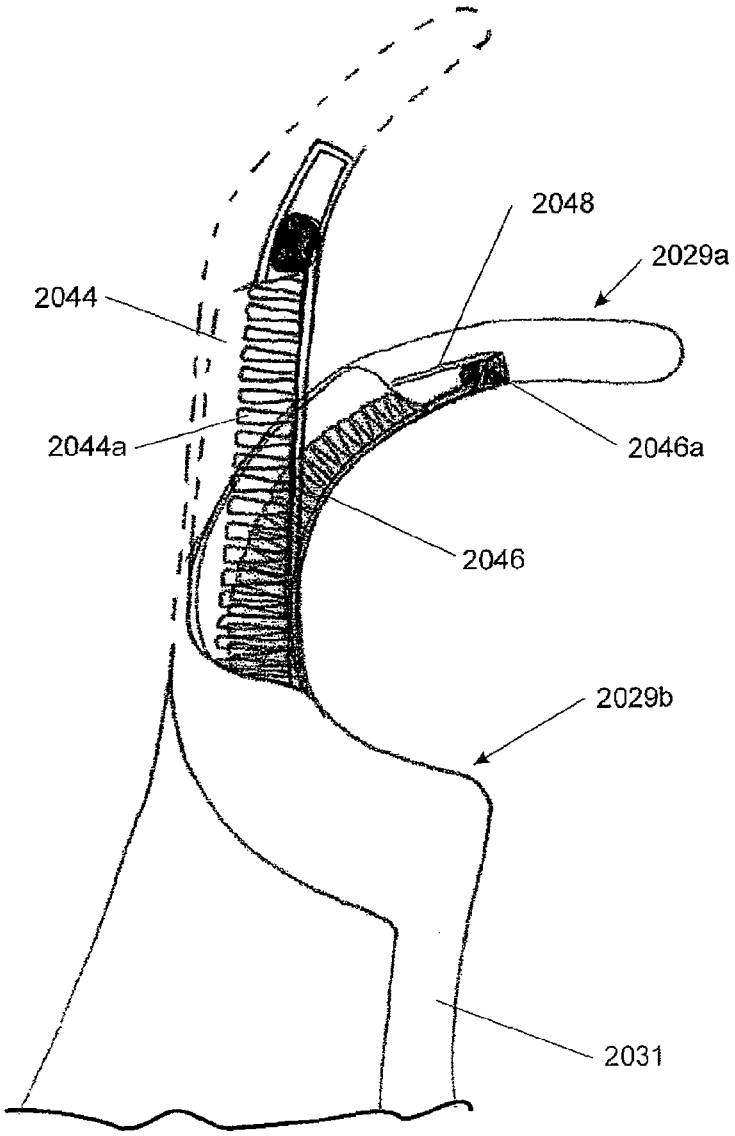
FIG. 80 is a detail side elevation view of the back portion of the chair of FIG. 56, showing features of the upper section.
Figure 81A:
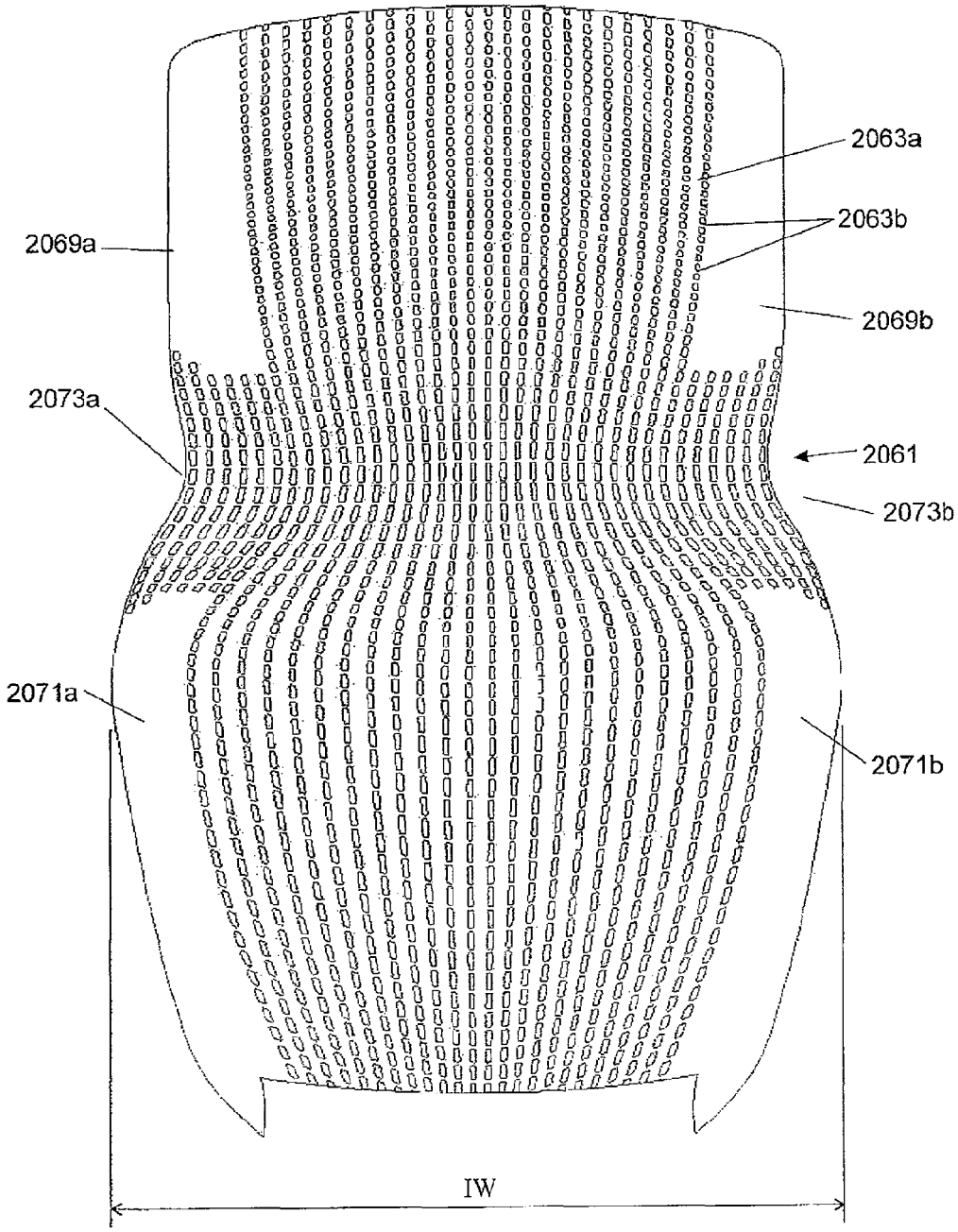
FIG. 81*a* is a front view of a preferred form back cover/skin of the chair of FIG. 56, in an as-moulded configuration.
Figure 81B:
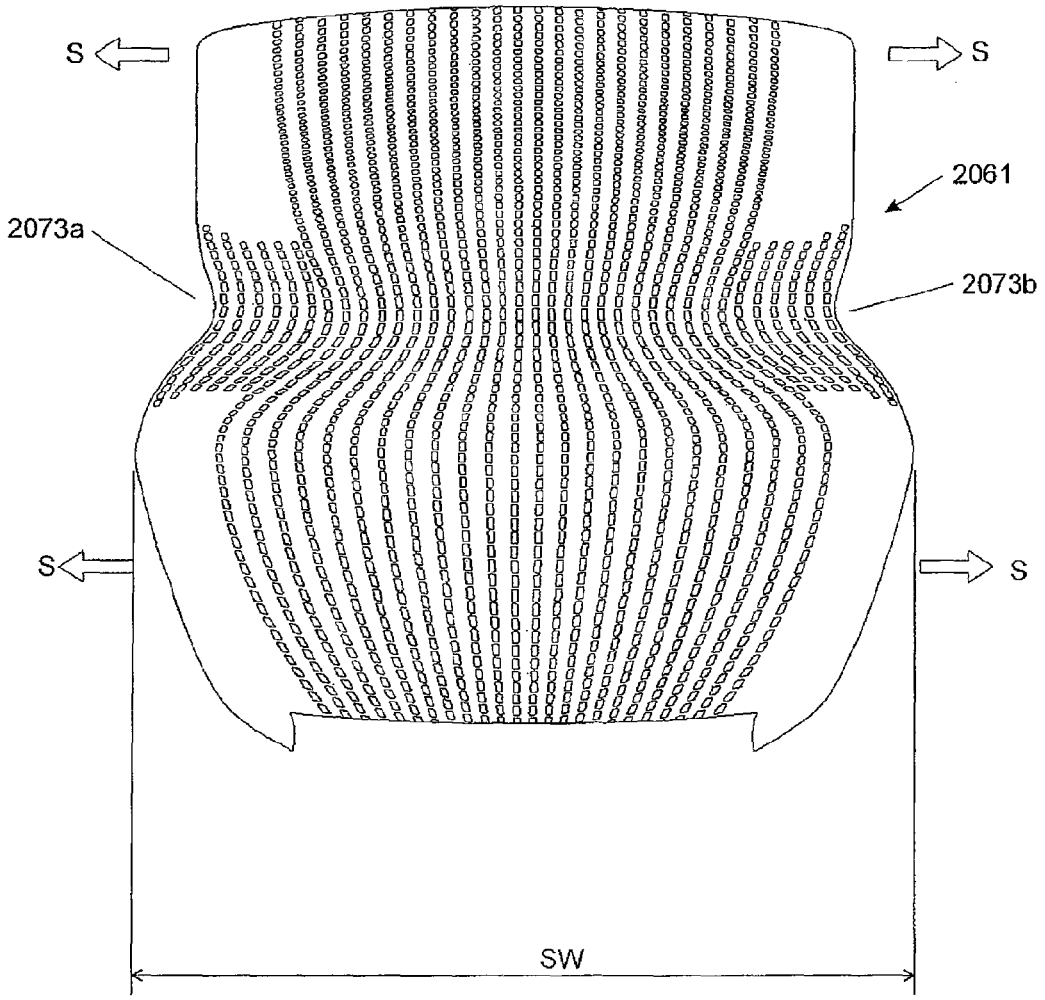
FIG. 81*b* is a front view of the back cover/skin of FIG. 81*a*, in a stretched configuration.
Figure 81C:
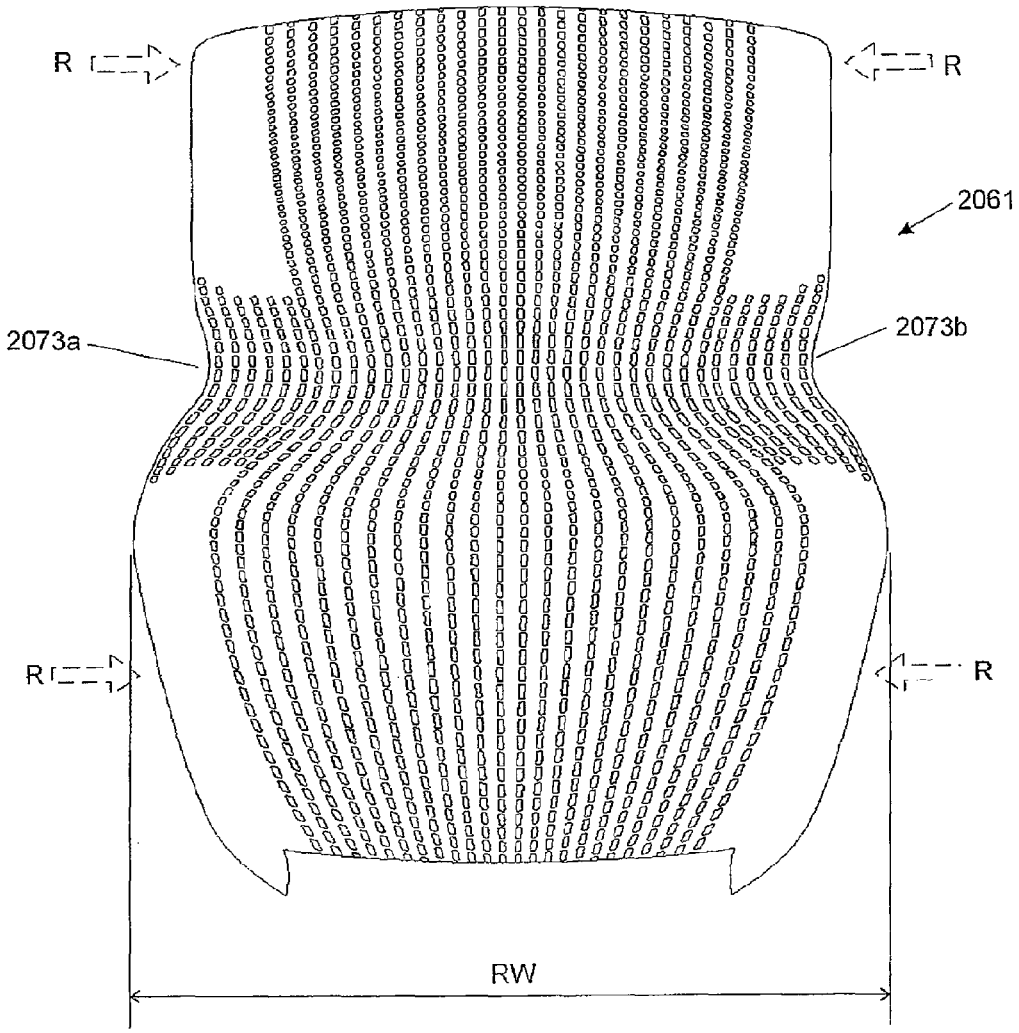
FIG. 81*c* is a front view of the back cover/skin of FIG. 81*a*, in a relaxed configuration.
Figure 82C:
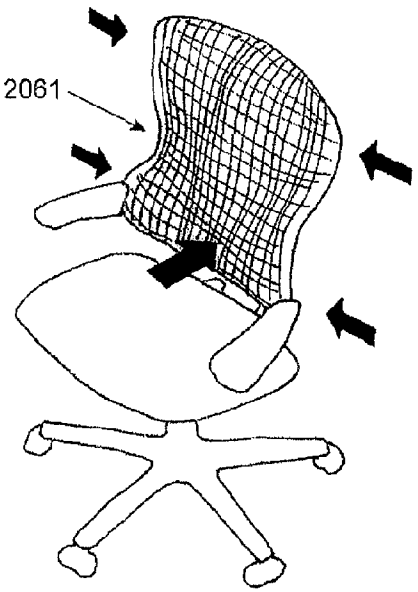
FIGS. 82*a*, 82*b*, and 82*c* are schematic front overhead perspective views of a preferred method of mounting the cover/skin of FIGS. 81*a-c* to the back frame, with the skin in the as-moulded, stretched, and relaxed configurations respectively.
Figure 82B:
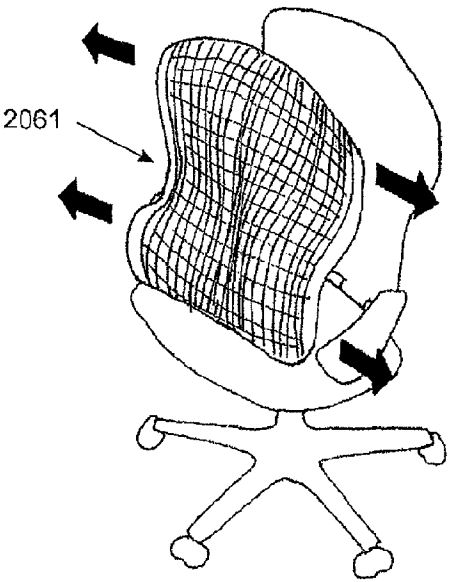
Figure 82A:
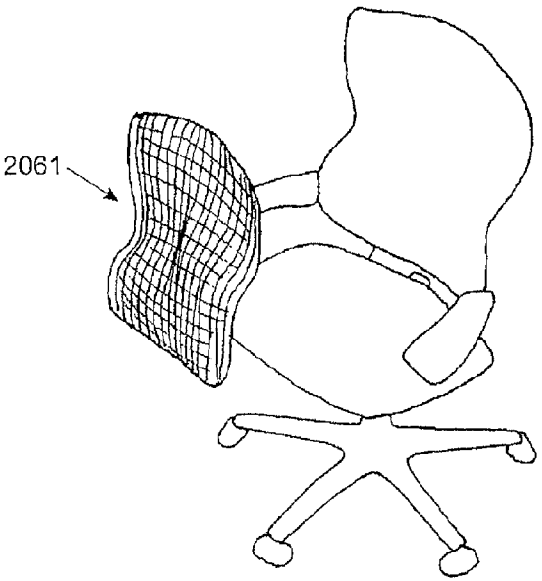

As shown in FIG. 75, the lower portion of the back frame incorporates arm rest support mounts 2050*a*, 2050*b*, for receiving arm rest supports in the form of posts 2051*a*, 2051*b* (see FIG. 90) that support arm rests in a cantilevered manner as described in more detail below with reference to FIGS. 92 to 98. The arm rest posts 2051*a*, 2051*b* are preferably mountable to the arm rest support mounts 2050*a*, 2050*b* via any suitable means, such as in built attachment features such as clips, or by fasteners such as bolts for example. The attachable nature of the posts means that the chair can readily be configured with or without arm rests as desired. By mounting the arm rest posts to the portion of the frame that supports the back from the remainder of the chair, any downward loading through the arm rest posts can be transferred directly to that portion of the back and doesn't need to be accommodated by the remainder of the back frame.

The arm rest support mounts comprise recesses that extend from the lower part of the back portion, and up around the spaced apart members 2037*a*, 2037*b*. That enables the arm rest posts to be positioned in close proximity to the back frame, and enables the arm rests to remain adjacent the frame throughout height adjustment of the arm rests. In an alternative embodiment, recesses may only be provided at the lower position where the posts mount to the frame, and the posts may extend around the L=outside and upward and forward adjacent the spaced apart frame members 2037*a*, 2037*b*.

Referring to FIGS. 81*a* to 88, a resiliently flexible cover is pulled taut and operatively connected to the back frame to provide a supporting surface for the back of Other seated occupant. In this form, the cover is moulded with the longitudinally extending elongate members 2063*a* that differ from the transversely extending elongate members 2063*b*. In the form shown, the longitudinally extending members 2063*a* are thicker in the transverse direction of the cover than the transversely extending members 2063*b* are in the longitudinal direction of the cover. Due to the relatively thick longitudinal members, when the cover is expanded transversely, the horizontal members will elongate a greater amount than the width elongation of the longitudinal members. That is, the transverse strands between the longitudinal members will elongate a greater amount than the width elongation of the longitudinal members. The cover may be formed from any of the materials outlined above with reference to FIGS. 35*a* to 40, but is preferably an elastomeric material such as HYTREL.

At least some of the generally longitudinally extending elongate members 2063*a* may have a greater depth (in a direction through the page in FIG. 81*a*) than at least some of the generally transversely extending elongate members 2063*b*. For example, a generally centrally disposed plurality of the generally longitudinally extending elongate members may have a greater depth than the generally transversely extending elongate members. The generally centrally disposed plurality of the generally longitudinally extending elongate members may have a greater depth than the remaining generally longitudinally extending elongate members. Other configurations could be provided. Alternatively or in addition, at least some of the generally longitudinally extending elongate members may project further forward in a body supporting direction than at least some of the generally transversely extending elongate members.

Preferably, the stretched dimension SW is between about 1.4 and about 2.9 times the as-moulded dimension IW, and preferably about 2.15 times the as-moulded dimension. Each strand (between adjacent longitudinal members) of the elongate members oriented in the stretching direction is preferably stretched to between about 3 and about 10 times, more preferably to between about 3 and about 8 times its as-moulded length.

Preferably, the post-relaxation dimension RW of the cover is between about 1.1 and about 1.75 times the as-moulded dimension, preferably about 1.2 times the as-moulded dimension. The post-relaxation length of each strand (between adjacent longitudinal members) of the elongate members oriented in the stretching direction is preferably between about 1.5 and about 4.5 times its original length, more preferably about 2.1 times its original length.

In the preferred form shown, the greatest as-moulded width dimension of the cover is 390 mm. That is stretched out to 840 mm, but could be stretched to anywhere between 555 mm and 1130 mm. When stretching the width of the cover from 390 mm to 840 mm, the transverse strands stretch to about 21 mm.

The cover then relaxes to 475 mm width, but that could vary between 450 mm and 680 mm. The post-stretching relation length of the strands is 7 mm in comparison to a 3.3 mm starting length. That could vary between 5 mm and 15 mm.

The cover is then stretched prior to connection to the frame. The corresponding frame dimension is 510 mm, meaning the cover is stretched to about 1.3 times its as-moulded width.

The cover preferably has a surface texture inmoulded as part of the moulding process.

The cover is preferably provided with attachment features that are integrally formed as part of the moulding process, and that are used to attach the cover to the frame. The cover could be relaxed onto the frame after expanding, or could be attached to the frame following relaxing of the cover, such as by expanding the cover a small amount as mentioned above.

Figure 83:
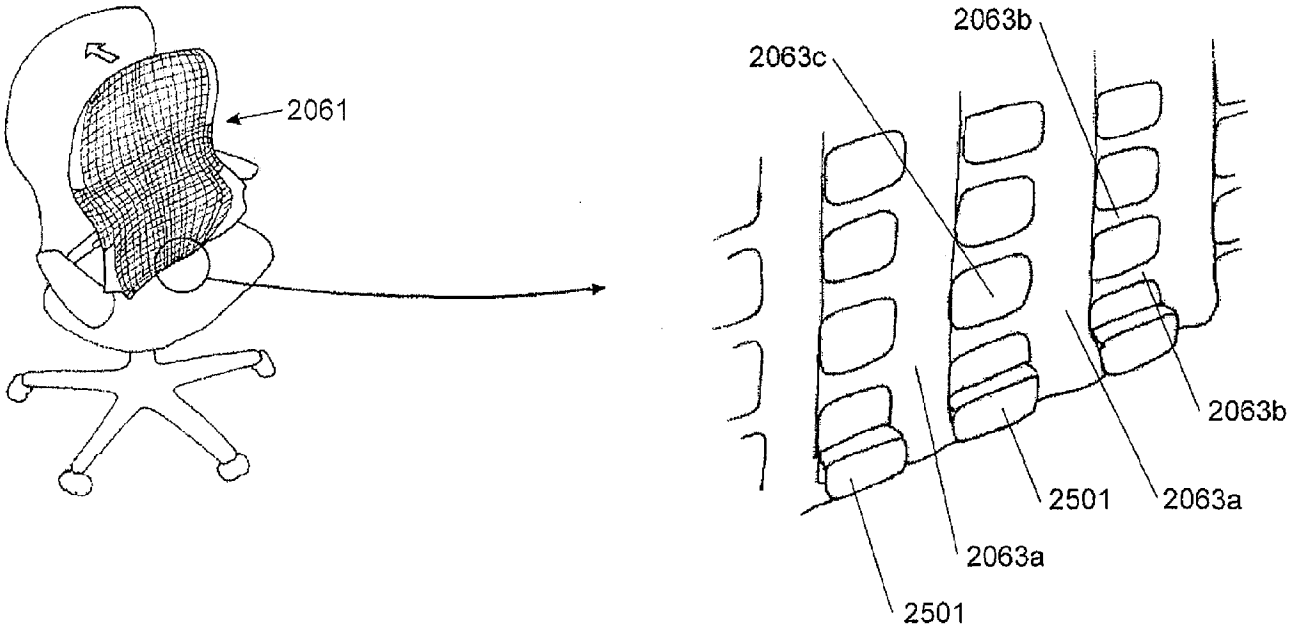
FIG. 83 is a view of a preferred form mounting arrangement of the lower end of the cover/skin to the back portion of the chair of FIG. 56.

FIG. 83 shows a preferred attachment of the lower portion of the cover to the lower portion of the back frame. The lower portion of the back frame is provided with a plurality of hooks 2501 that are integrally moulded as part of the frame. In the preferred form, the hooks are spaced apart across the front face of the bottom transverse frame member 2035, and will be positioned behind the seat portion in use. The hooks 2501 define recesses that extend upwardly from the underside of the hooks.

The cover is provided with a plurality of apertures 2063*c* that are provided between adjacent pairs of longitudinal elongate members 2063*a* and adjacent pairs of transverse elongate members 2063*b*. The lower portion of the cover can be mounted to the lower portion of the back frame by inserting the hooks 2501 through the apertures 2063*c* in the cover, such that a lowest transverse elongate member 2063*b* is received in the recesses of the hooks.

Figure 84:
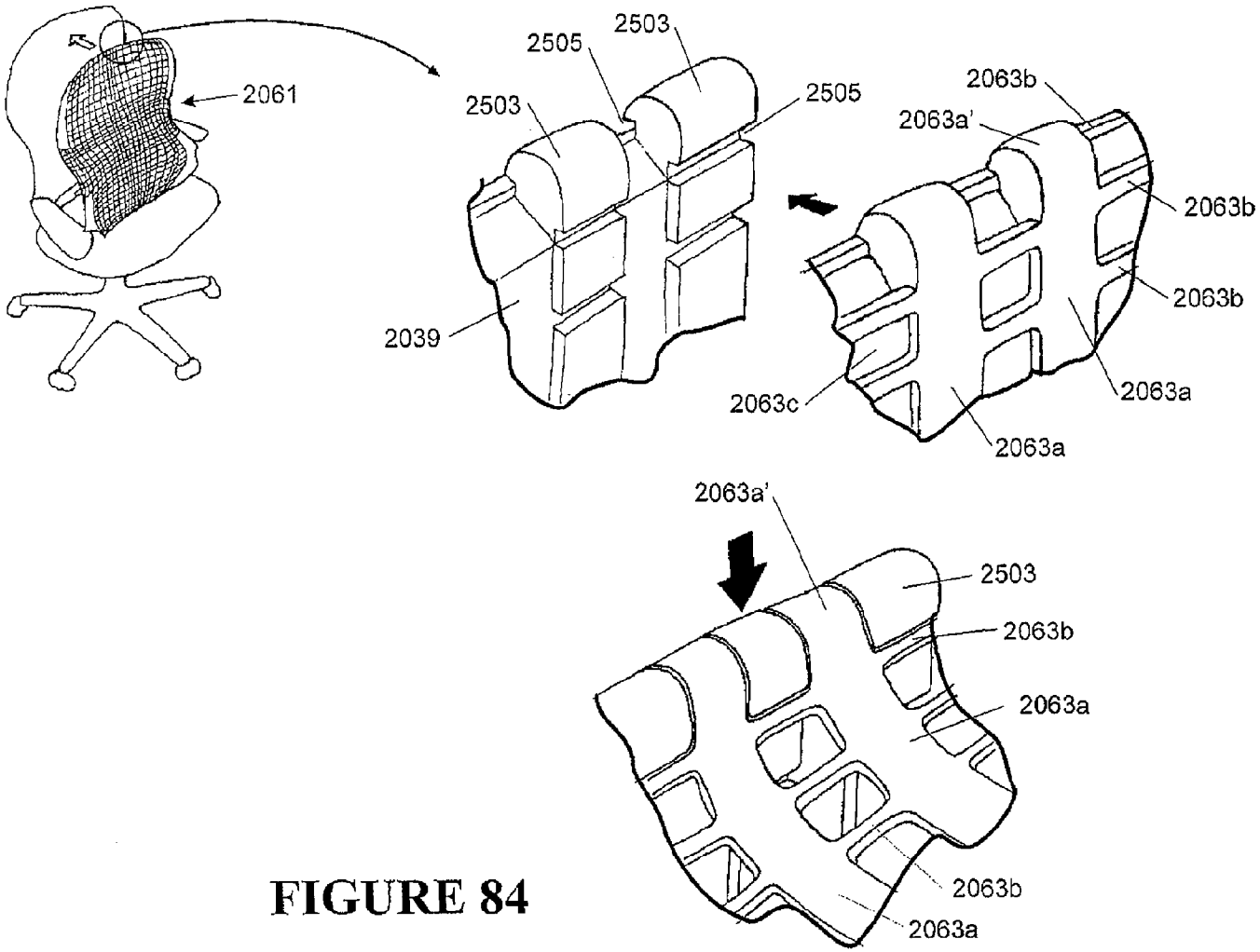
FIG. 84 is a view of a preferred form mounting arrangement of the upper end of the cover/skin to the back portion of the chair of FIG. 56.

FIG. 84 shows a preferred attachment of the upper portion of the cover to the upper portion of the back frame. The upper portion of the back frame is provided with a plurality of heads 2503 that are integrally moulded as part of the frame. In the preferred form, the heads are provided along the top edge of the back frame member 2039. The heads 2503 define recesses 2505 that extend under the front and rear of the hook.

The top edge of the cover is moulded to provide an upper curved head 2063*a*' at the top of each longitudinally extending member 2063*a*. The heads have a transversely extending member 2063*b* extending across the heads in front of and behind the heads. Those transversely extending members are complementary to the recesses 2505 in the frame, and the shape and configuration of the heads 2063*a*' on the cover correspond substantially to the shape and configuration of the heads 2503 on the frame.

To mount the upper portion of the cover to the upper portion of the frame, the rear transverse member 2063*b* will be positioned in the recesses 2505 behind the heads 2503, and the cover will then be pulled over the top of the frame so that the cover heads 2063*a*' are received between the frame heads, and the front transverse member 2063*b* is positioned in the recesses in front of the heads.

Figure 85:
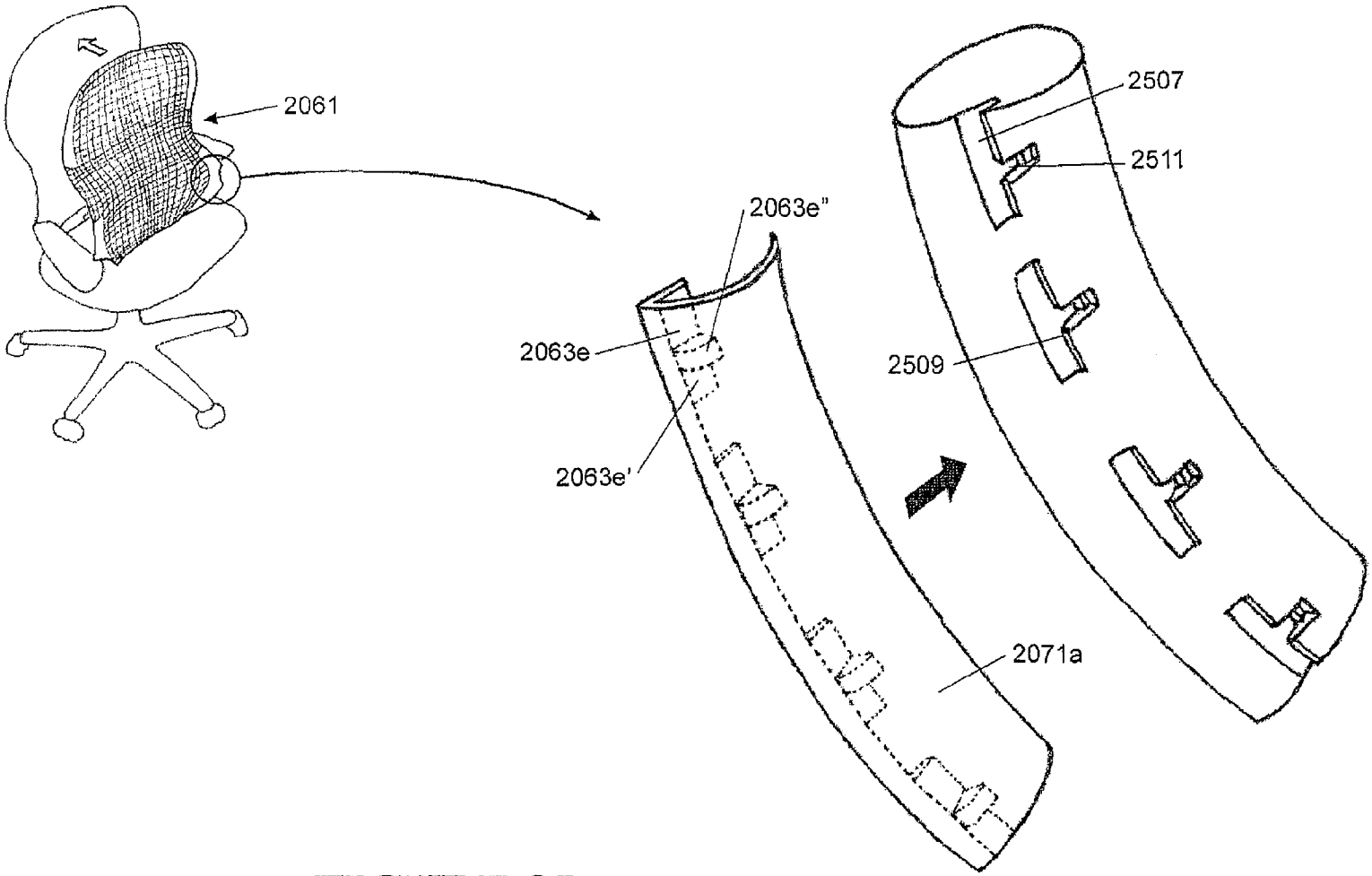
FIG. 85 is a view of a preferred form mounting arrangement of the sides of the cover/skin to the back portion of the chair of FIG. 56.

FIG. 85 shows a preferred attachment of the side portions of the cover to the side members of the back frame. The side portions of the back frame are provided with spaced apart slots 2507 extending into the frame. The slots define generally T-shaped openings with a transverse opening portion 2509 and a generally centrally disposed opening portion 2511.

As can be seen in FIGS. 81*a*-81*c* and 85, the sides of the cover comprise solid regions 2069*a*, 2069*b*, 2071*a*, 2071*b*. In the regions corresponding to the side frame members, the sides of the cover are provided with attachment features 2063*e*. The attachment features each have a generally planar portion 2063*e*' that reverses back toward the remainder of the cover from the edge of portion 2063*d*, and a web 2063*e*" that connects the generally planar portion 2063*e*' to the remainder portion 2063*d*. The web minimises flexing of the planar portion and provides additional strength to the attachment feature. The substantially planar portion 2063*e*' is sized and configured to fit into the transverse opening portion 2509 in the frame, and the web extends through the opening portion 2511.

The recesses in the frame will generally be provided in a rear surface of the frame, such that the cover extends around the edge of the frame (the right side of the frame member shown in FIG. 85) and back across the opposite side of the frame member from the recesses (the rear side of the frame shown in FIG. 85) and across the opening between the side frame members (to the left side of the frame shown in FIG. 85).

To mount the cover to the frame, the cover will be expanded and the sides of the cover will be pulled around the side members of the frame, and the attachment features 2063*e* inserted in the recesses in the frame to attach the sides of the cover to the frame. The attachment features may primarily serve a locating function. The cover could additionally be secured to the frame by any suitable means, such as adhesive, fasteners, or welding the cover to the frame for example. The top of the cover will then be attached to the top of the frame as described above. The lower portion of the cover will then be mounted to the hooks on the lower portion of the frame.

As can be seen in FIGS. 81*a*-81*c* and 88, the cover comprises a recessed section 2073*a*, 2073*b* extending into each side of the cover from opposite sides. The recessed sections correspond generally in vertical position to the relatively narrow interconnecting region 2031 of the back frame, to provide a clearance space for the elbows of a seated occupant. The cover is substantially unsupported in the recessed sections, to provide a compliant support surface for an occupant's elbows resting against the recessed sections. The recessed sections are smaller than those of the first embodiment above.

The cover comprises a section 2061*a*, 2061*b* that extends rearwardly and inwardly from each recessed section 2073*a*, 2073*b*. The sections 2061*a*, 2061*b* may connect to the relatively narrow interconnecting region 2031 of the back frame. Alternatively, or in addition, the sections 2061*a*, 2061*b* may connect to the frame members 2033, 2041 of the back frame. The configurations of the frame and sections 2061*a*, 2061*b* are such that the rear of the back portion has a desirable "bow tie" type aesthetic in that region. The sections 2061*a*, 2061*b* that extend rearwardly and inwardly may be an integrally moulded part of the cover, or they may be separate components that are connected to the front part of the cover in that region.

Figure 86A:
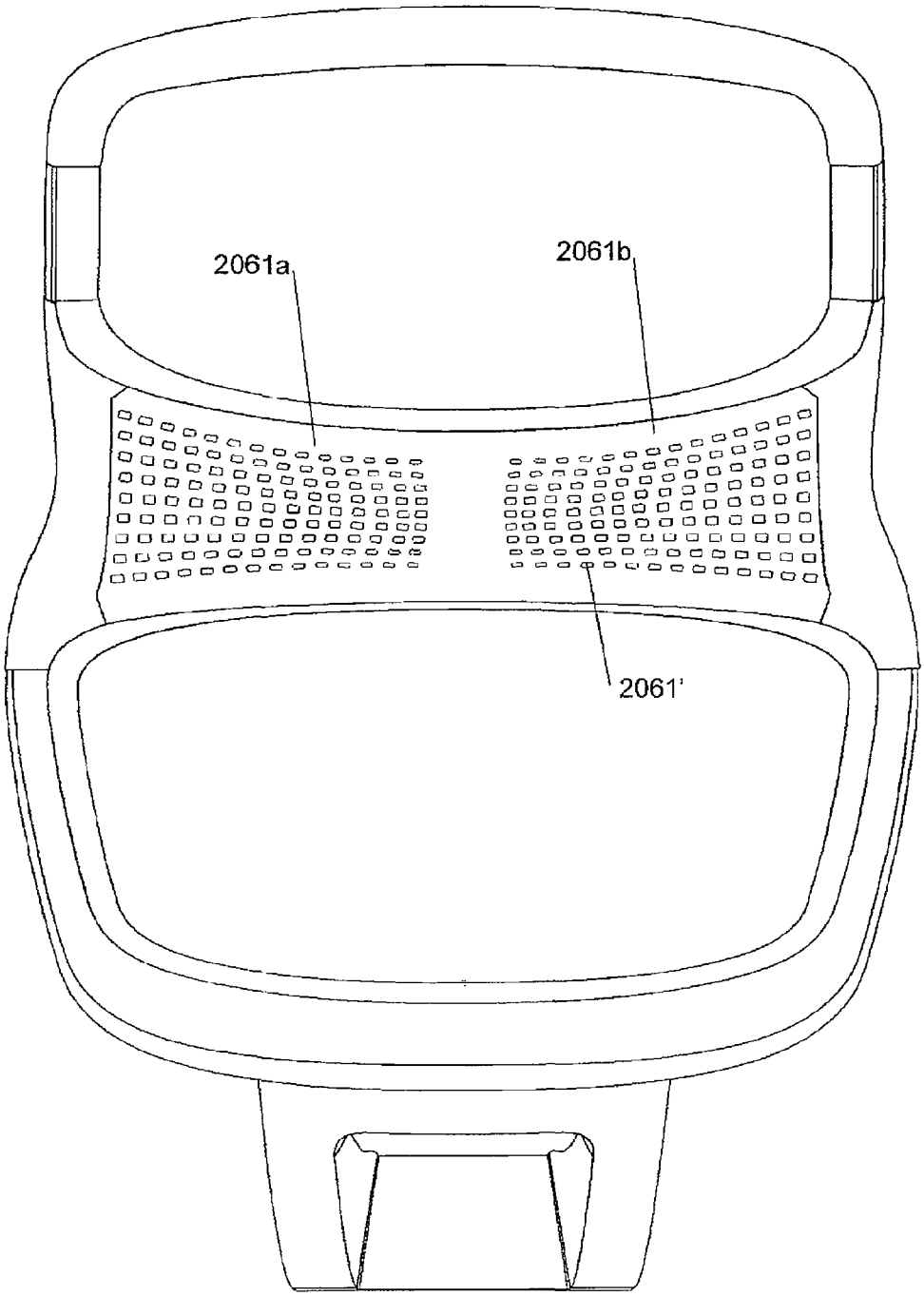
FIG. 86*a* is a rear view of the back portion of the chair, showing a preferred form of the "bow tie" feature.
Figure 86B:
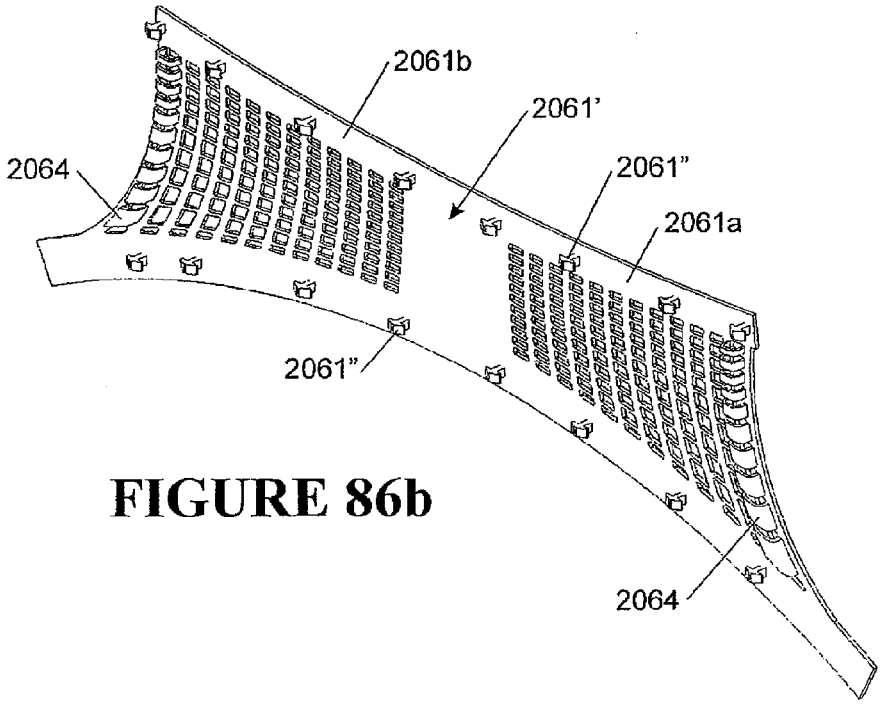
FIG. 86*b* is a front view of the bow tie feature, showing attachment features.

FIG. 86*a* shows a preferred form rearward cover section 2061' mounted to the back frame, and FIG. 86*b* shows the preferred form rearward cover section prior to mounting to the frame. In this form, the sections 2061*a*, 2061*b* form part of a unitary integrally moulded rearward cover section 2061' that is mounted to the frame and to the front cover section 2061.

Figure 87A:
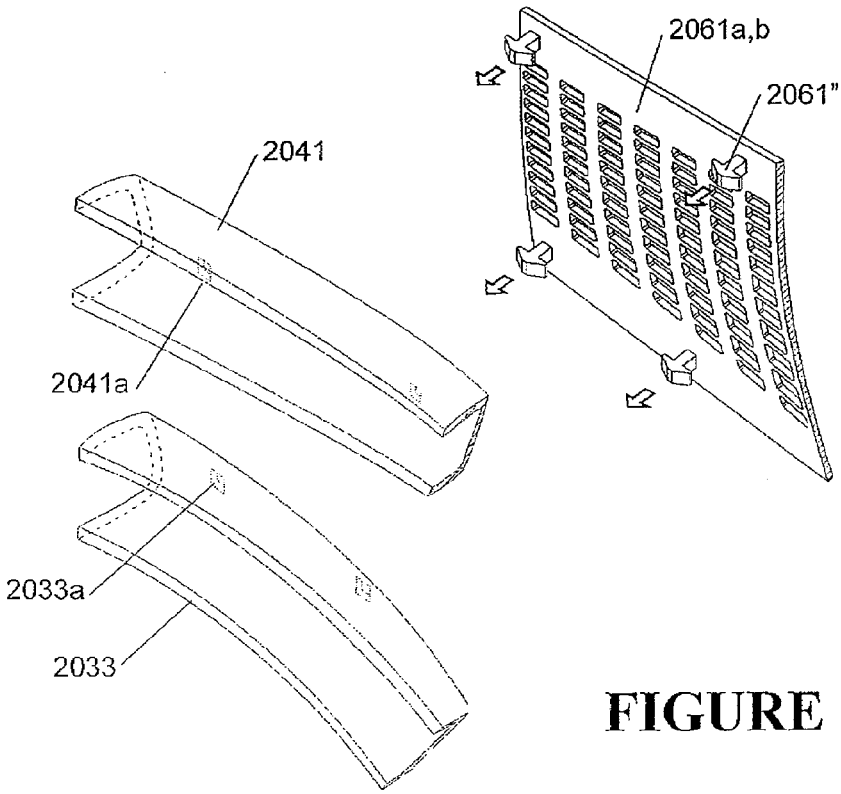
FIG. 87*a* is a view of a preferred form mounting arrangement of the bow tie feature to the back portion of the chair of FIG. 56.

As can be seen in FIG. 86*b*, the rearward cover section 2061' has a plurality of spaced apart attachment features 2061" that are integrally moulded as part of the rearward cover section 2061'. The features 2061" have enlarged heads that are received in slots 2033*a*, 2041*a* in frame members 2033, 2041 as shown in FIG. 87*a*, and maintain the cover in position on the frame members.

Figure 87B:
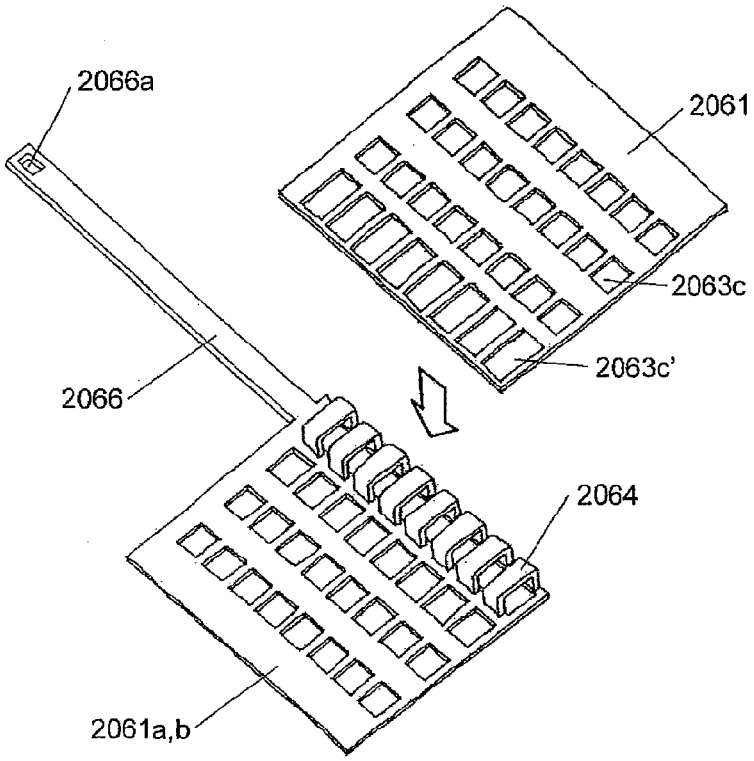
FIG. 87*b* is a view of a first step in a preferred form mounting method for the cover in the recessed sections and the rear cover that forms the bow tie feature.
Figure 87C:
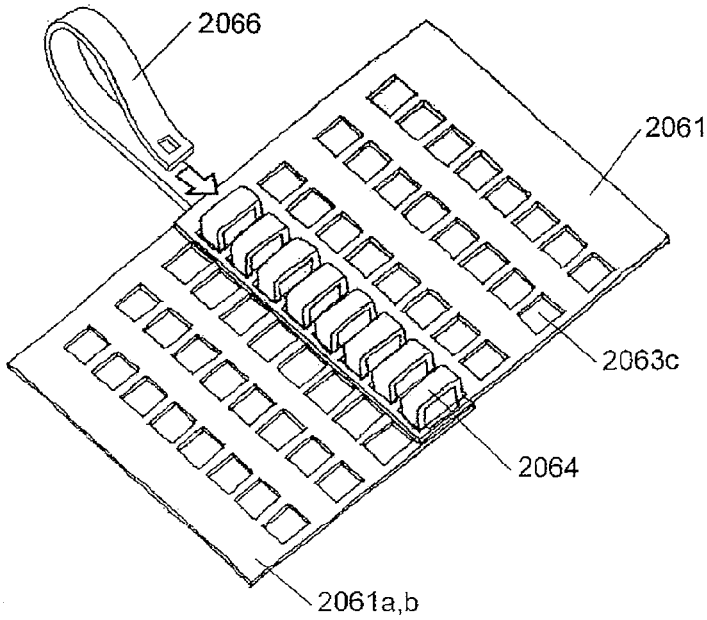
FIG. 87*c* is a view of a second step in a preferred form mounting method for the cover in the recessed sections and the rear cover that forms the bow tie feature.
Figure 87D:
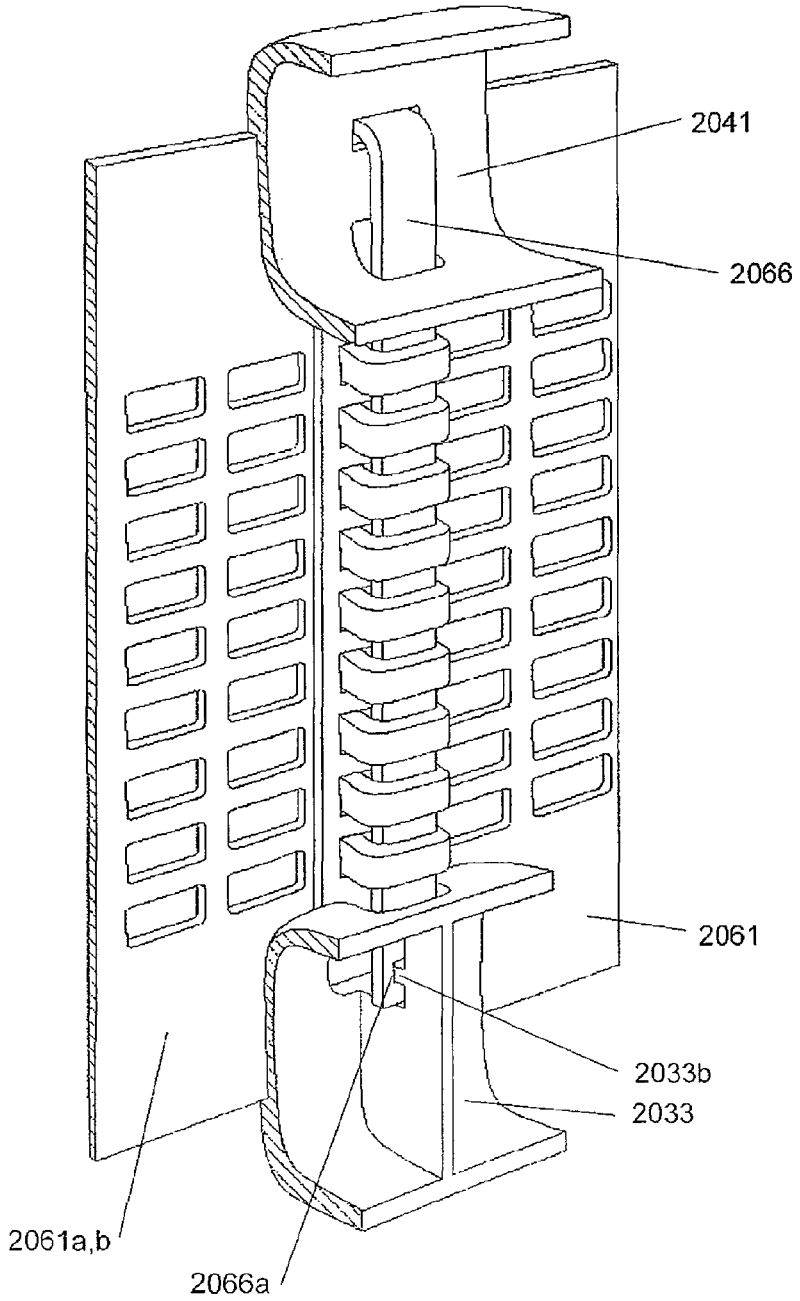
FIG. 87*d* is a view of a third step in a preferred form mounting method for the cover in the recessed sections and the rear cover that forms the bow tie feature.

FIGS. 87*b* to 87*d* show a suitable attachment method for attaching the rear cover section 2061' to the front part 2061 of the cover. In the recessed regions, the side portions of the cover are not substantially solid. Rather, the apertures 2063*c* extend substantially to the edge of the cover. On each side, the cover is provided with one row of apertures 2063*c*' that are elongated, and are configured to receive connectors 2064 on the sections 2061*a*, 2061*b*. To attach each section to the cover, the connectors 2064 are positioned through the corresponding apertures 2063*c*', and a retainer 2066 is inserted through the connectors. In the form shown, the retainer is an integrally moulded part of the rear cover section 2061', although it could be a separate component. As can be seen in FIG. 87*d*, the frame members 2033, 2041 are provided with apertures for receipt of the retainer 2066. An engagement projection 2033*b* is provided in frame member 2033, and is received in an aperture 2066*a* in the retainer, to maintain the front part of the cover in connection with the rear part of the cover and the retainer in position through the connectors 2064. Other than the connections of the retainer 2066 to the frame members 2041, 2033, the cover is unsupported in the side recessed regions.

The cover and sections 2061*a*, 2061*b* will be assembled so the connectors 2064 and retainers 2066 are on the inside of the cover. It will be appreciated that the connectors could instead be moulded as part of the cover, and the apertures 2063*c*' moulded as part of the sections 2061*a*, 2061*b*. On one side of the cover, the connectors may be moulded as part of the front cover section, and on the other side the connectors may be moulded as part of the rear cover section.

Figure 88:
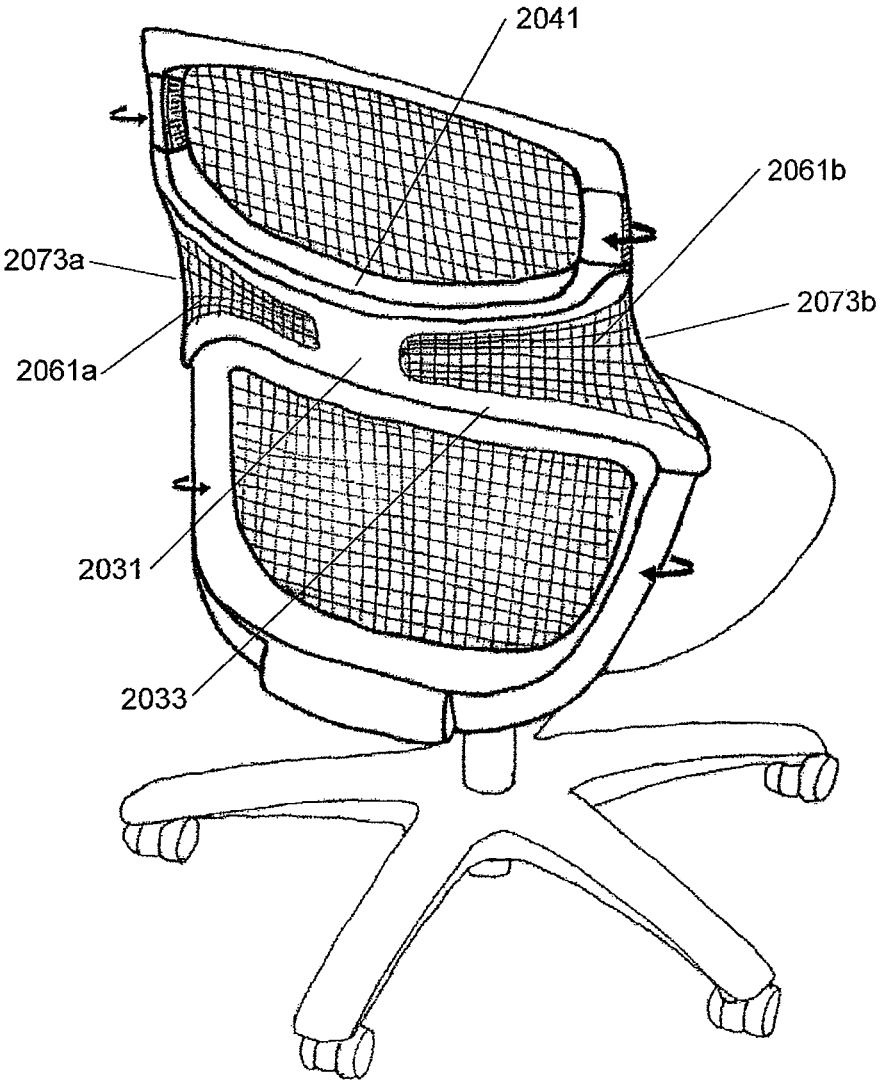
FIG. 88 is a rear overhead perspective view of the back portion of the chair of FIG. 56, showing a preferred form mounting arrangement of the cover/skin to the back frame.

FIG. 88 shows an alternative form in which the rear cover sections 2061*a*, 2061*b* are separated.

Referring now to FIGS. 76 to 80, the upper portion 2029 of the back frame comprises an upper section 2029*a* that is adapted to be selectively folded rearwardly relative to a remainder 2029*b* of the upper portion, to reduce the overall vertical height of the back portion. The reduction in the overall vertical height of the back portion enables an adult occupant to sit sideways in the chair with an upper end of the back portion positioned under their armpit and/or to rest their arm on the upper end of the back portion when sitting in that position.

The generally vertical support members 2043*a*, 2043*b* of the upper portion are configured to flex rearwardly, such that the upper section 2029*a* folds rearwardly upon a rearward or a rearward/downward force being applied to the upper section. In the form shown, the support members 2043*a*, 2043*b* each comprise a resilient block 2044 formed of an elastomeric material having a plurality of slots 2044*a* extending into the rear face thereof. The elastomeric material may be any of the suitable materials listed elsewhere in this specification.

The slots, when closed, limit rearward movement of the upper section relative to the remainder of the upper portion.

The upper portion is provided with an additional limit mechanism that defines a forward and rearward limit of movement of the upper section 2029*a* relative to the remainder 2029*b* of the upper portion. The limit mechanism comprises a resilient strap 2046 connected to the remainder 2029*b* of the upper portion and which extends upwardly beyond the elastomeric block 2044. The strap carries an engagement member 2046*a* which in the form shown is a block. The block is slidably received in a recess 2048 in the upper section 2029*a*. As the block is fixed relative to the strap, engagement of the block with the upper wall of the recess 2048 defines a rearward limit of the upper section movement as shown in solid lines in FIG. 80, and engagement of the block with the lower wall of the recess defines the forward limit of the upper section movement as shown in phantom lines in FIG. 80.

Alternatively, the strap could be connected to the upper section 2029*a* and the engagement member could be slidably received in the remainder section 2029*b*. Rather than using a block and a recess, an alternative configuration could be used such as a pin that is fixed relative to a strap and is slidably received in a slot, for example.

This configuration provides a rearward folding action of the upper section that is substantially smooth.

When it is folded rearwardly, the upper section 2029*a* provides a platform for resting the occupant's arm and distributes load therefrom.

Arm Assembly

Figure 89:
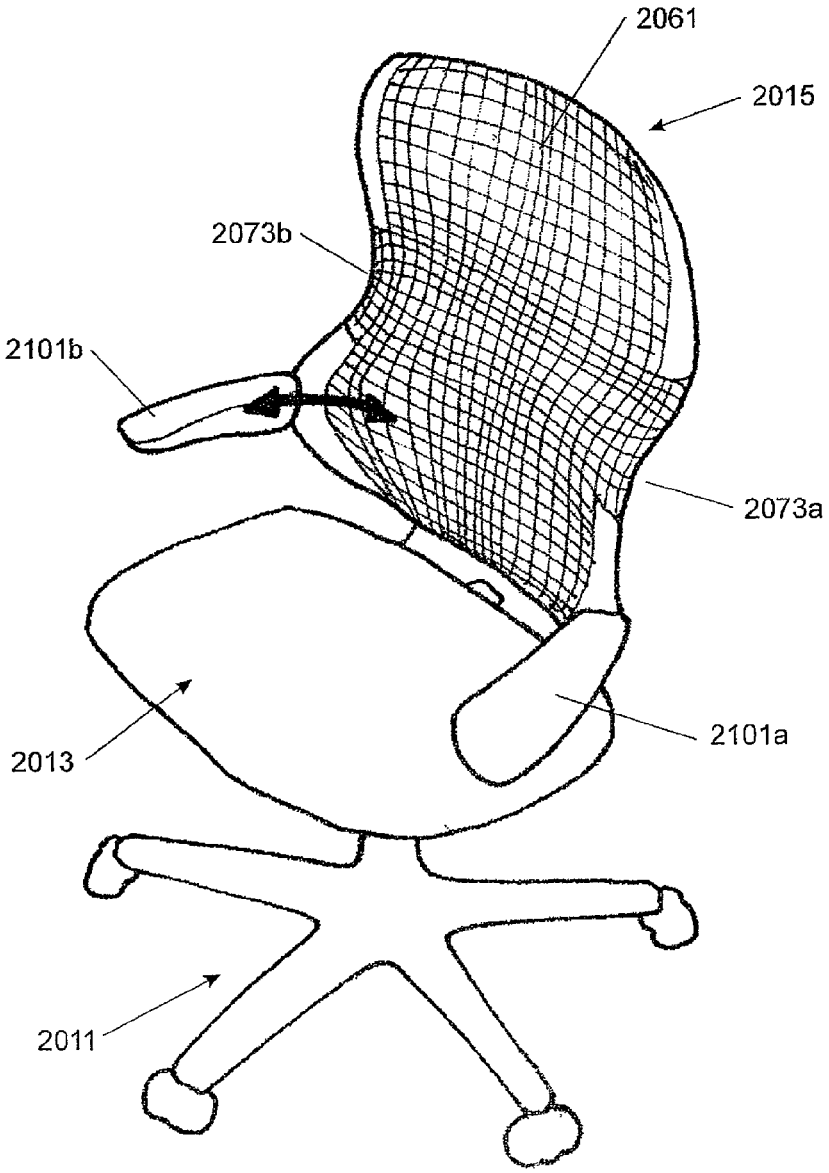
FIG. 89 is a front overhead perspective view of a preferred form arm assembly incorporated into the back portion of the chair of FIG. 56.
Figure 90:
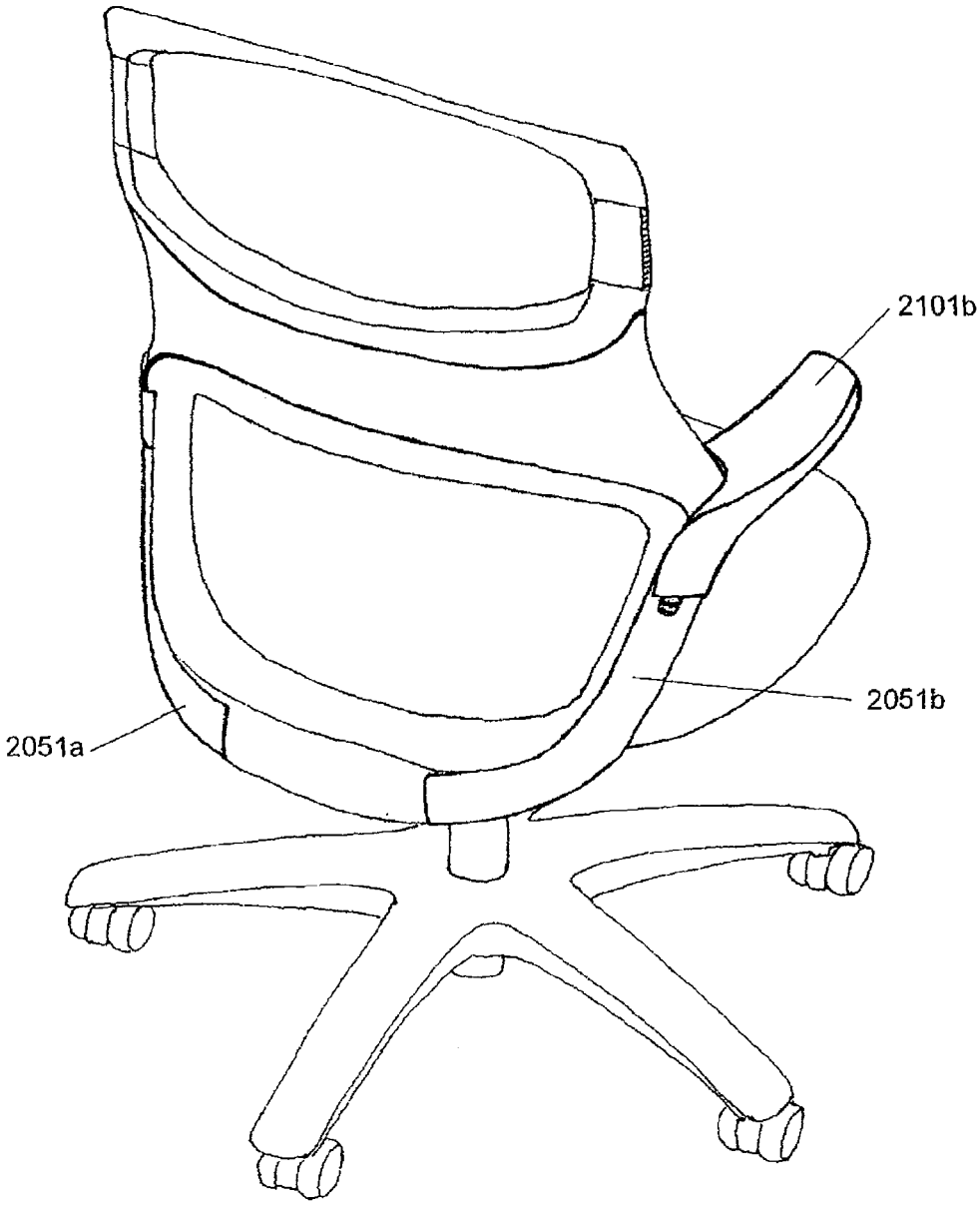
FIG. 90 is a rear overhead perspective view of the back portion of the chair of FIG. 56 with arm assemblies.
Figure 91:
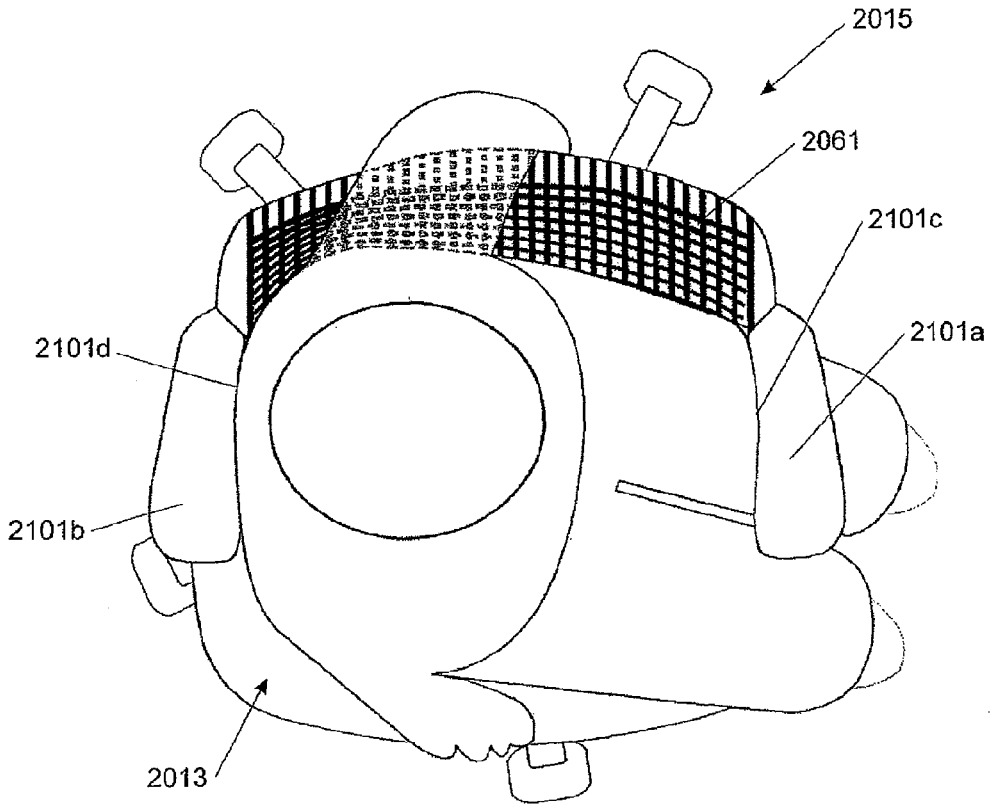
FIG. 91 is a schematic plan view showing an adult occupant sitting sideways in the preferred form chair of FIG. 56.

The back portion preferably incorporates support posts 2051*a*, 2051*b* that form parts of arm assemblies for supporting arm rests 2101*a*, 2101*b* from the back portion. As discussed above, the lower portion 2027 of the back frame curves around to encompass the sides of a seated occupant's back. As shown in FIGS. 89 to 91, the arm rests 2101*a*, 2101*b* of the arm assemblies are configured such that their inner surfaces effectively form a continuation of the cover of the back portion in that region. In the form shown, the inner surfaces 2101*c*, 2101*d* have a concave curvature, and form a continuation of the curvature of the cover of the back portion in that region, at least when the occupant is side-sitting in the chair and leaning against the back portion. Instead, the inner surfaces 2101*c*, 2101*d* could be substantially planar. The entire inner surface of each arm rest is preferably cushioned.

The arm rests 2101*a*, 2101*b* extend forwardly in a cantilevered arrangement from the arm support posts 2051*a*, 2051*b*.

Figure 92:
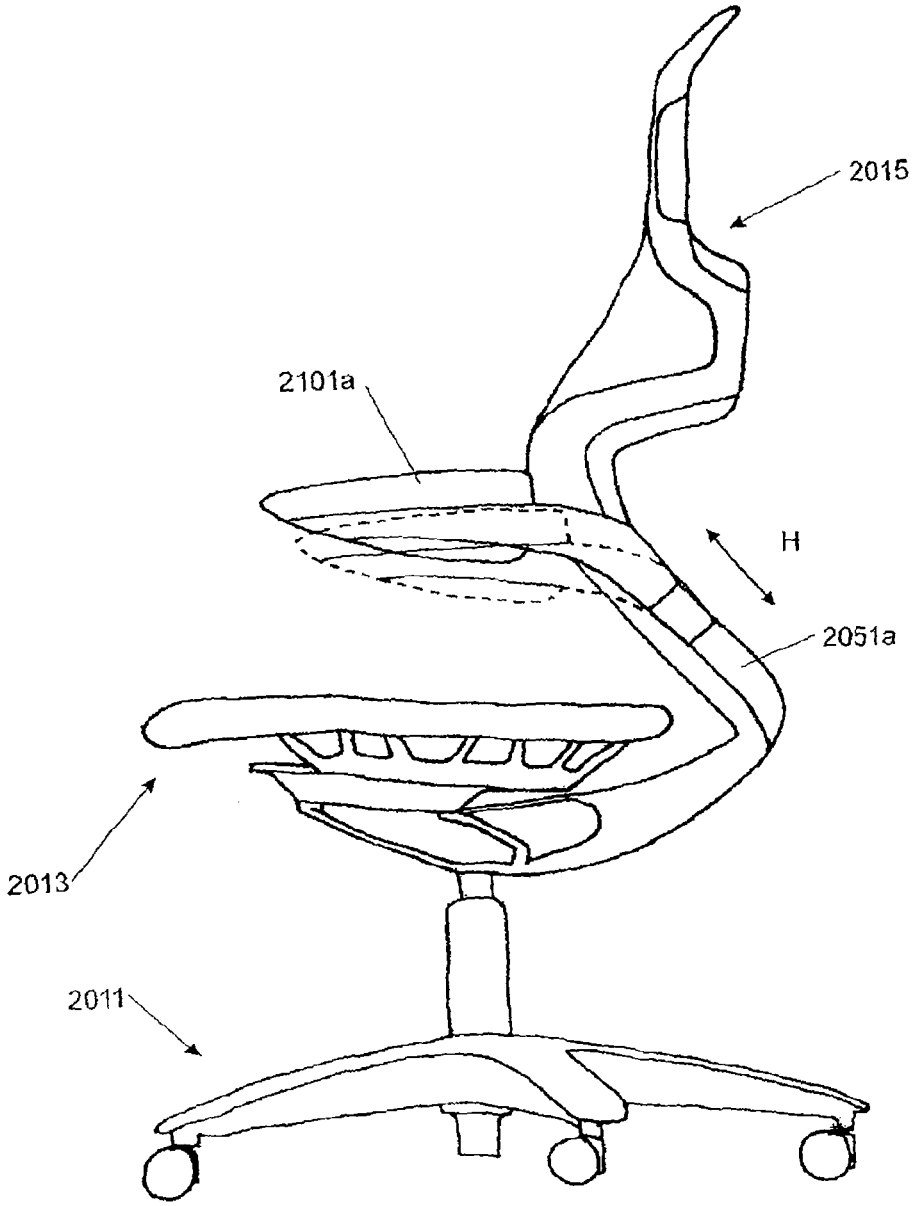
FIG. 92 is a schematic side elevation view of the chair of FIG. 56 showing height adjustment of the arm rest.
Figure 93:
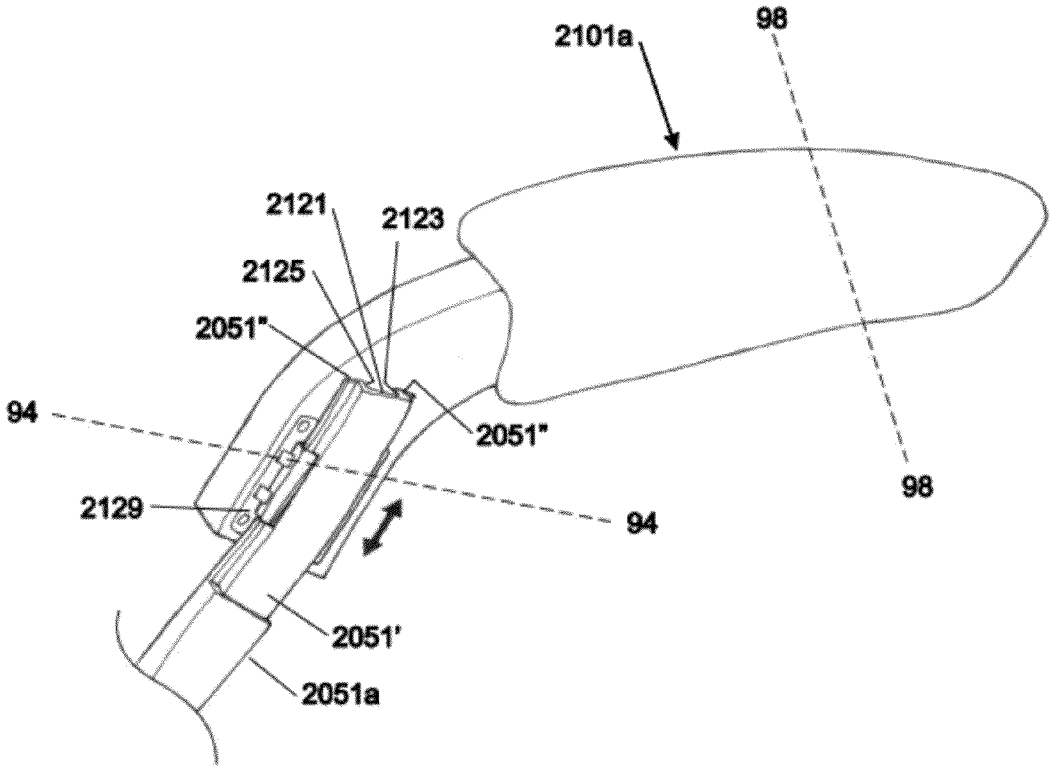
FIG. 93 is a perspective view of the arm rest and support arrangement.
Figure 94:
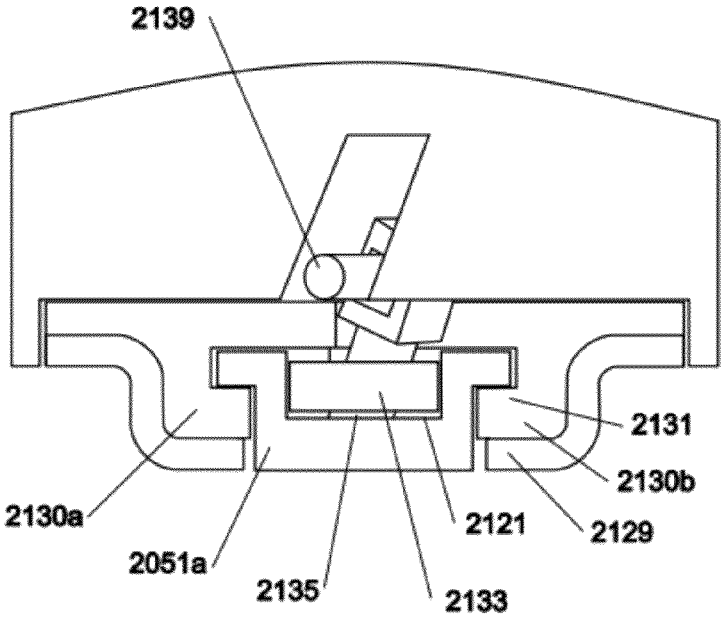
FIG. 94 is a plan sectional view of the support arrangement along line 94-94 of FIG. 93.

The arm rests are preferably height adjustable H relative to the back portion as shown in FIG. 92 and using the mechanism described below. Again, sufficient spacing will preferably be provided beneath the arm rests in at least one adjusted position of the arm rests that the occupant's legs can fit between the arm rests and the seat. Due to the forward angle of the arm rest posts, the arm rests move forward and upward relative to the seat as the arm rests are increased in height, and move down and rearward relative to the seat as the arm rests are decreased in height.

Figure 95:
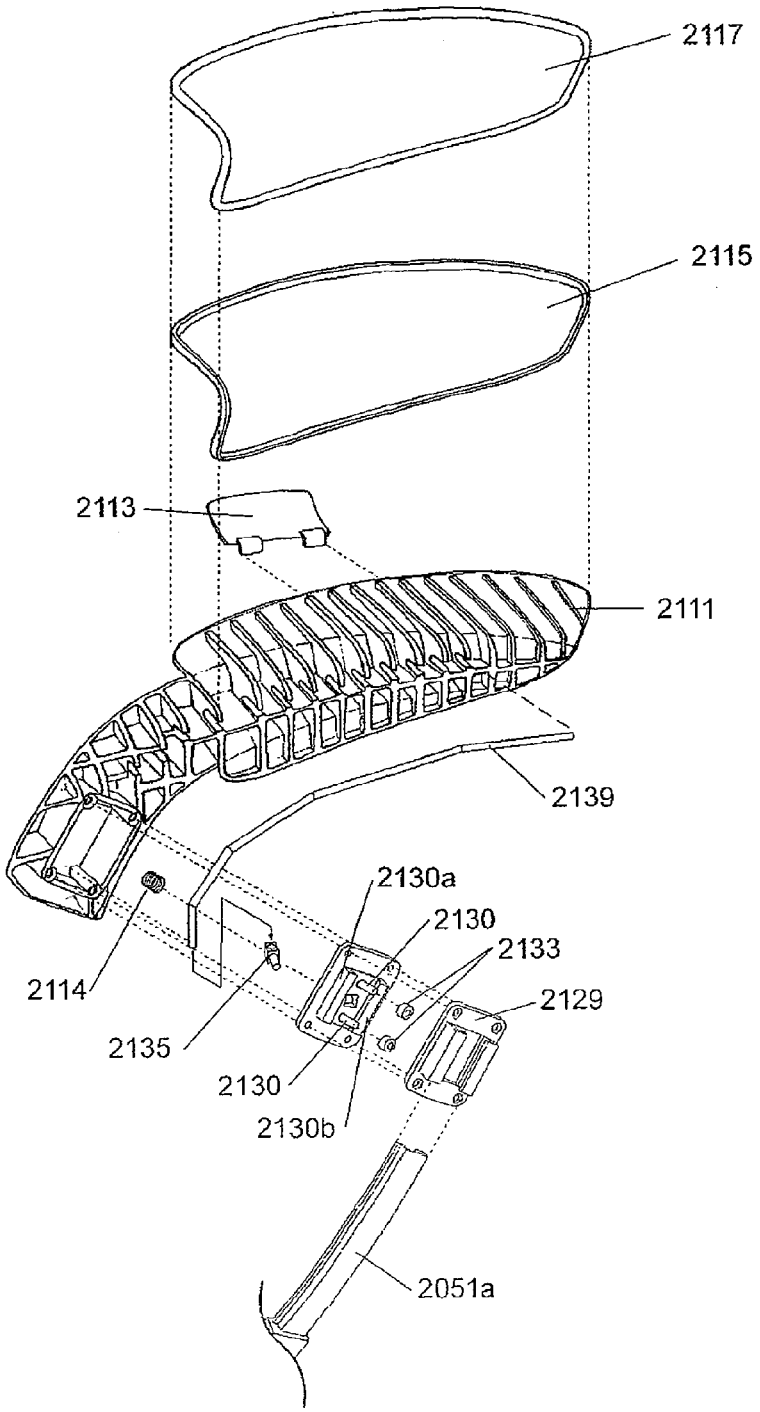
FIG. 95 is an exploded perspective view of one of the arm assemblies of FIG. 41.
Figure 96:
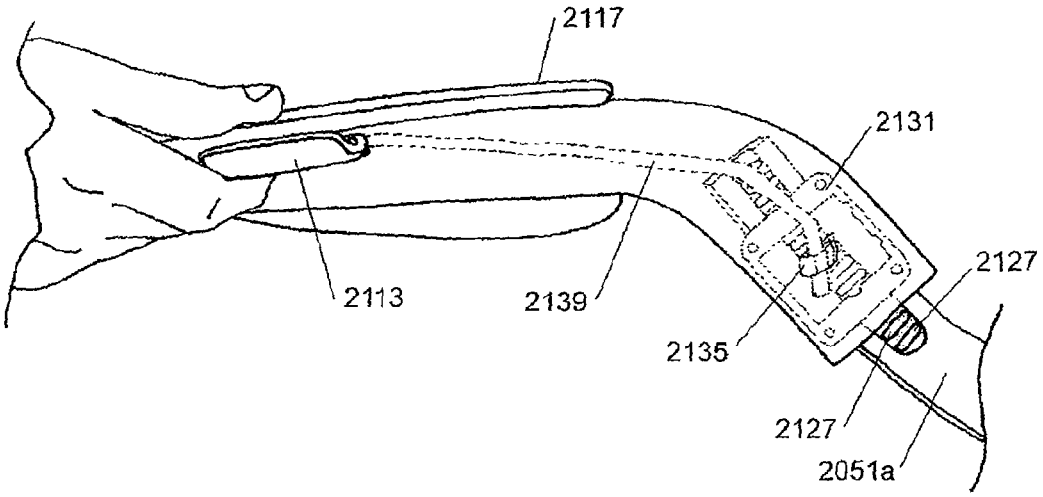
FIG. 96 is a view of some of the components of the arm assembly prior to incorporation into the chair of FIG. 56, showing details of the mechanism that provides height adjustment of the arm assembly.
Figure 97:
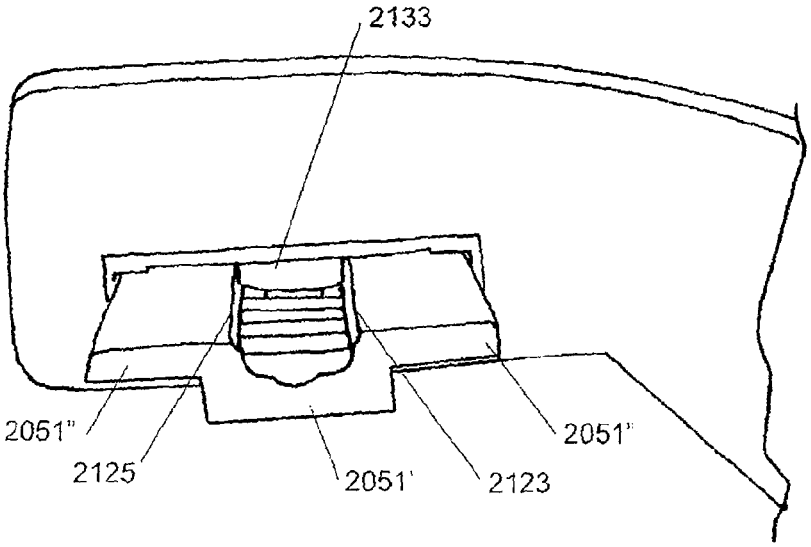
FIG. 97 is a plan view of part of the preferred form height adjustment mechanism of the arm assemblies.

FIGS. 93 to 97 show the preferred construction of the arm rest. Referring to FIG. 95, each arm rest comprises a base member 2111 which is suitably a moulded polymeric component comprising a plurality of webs and recesses. An actuator 2113 of a locking mechanism for adjusting the height of the arm rest is articulated to the underside of the outside of the base member 2111, so it is accessible by a user with their hand resting on the arm rest. A relatively rigid cushion substrate 2115 is sized and configured to rest on the base member 2111, and a cushion construction 2117, fits onto the cushion substrate. The cushion substrate and cushion construction cover the upper and inner surfaces of the base member 2111.

Figure 98:
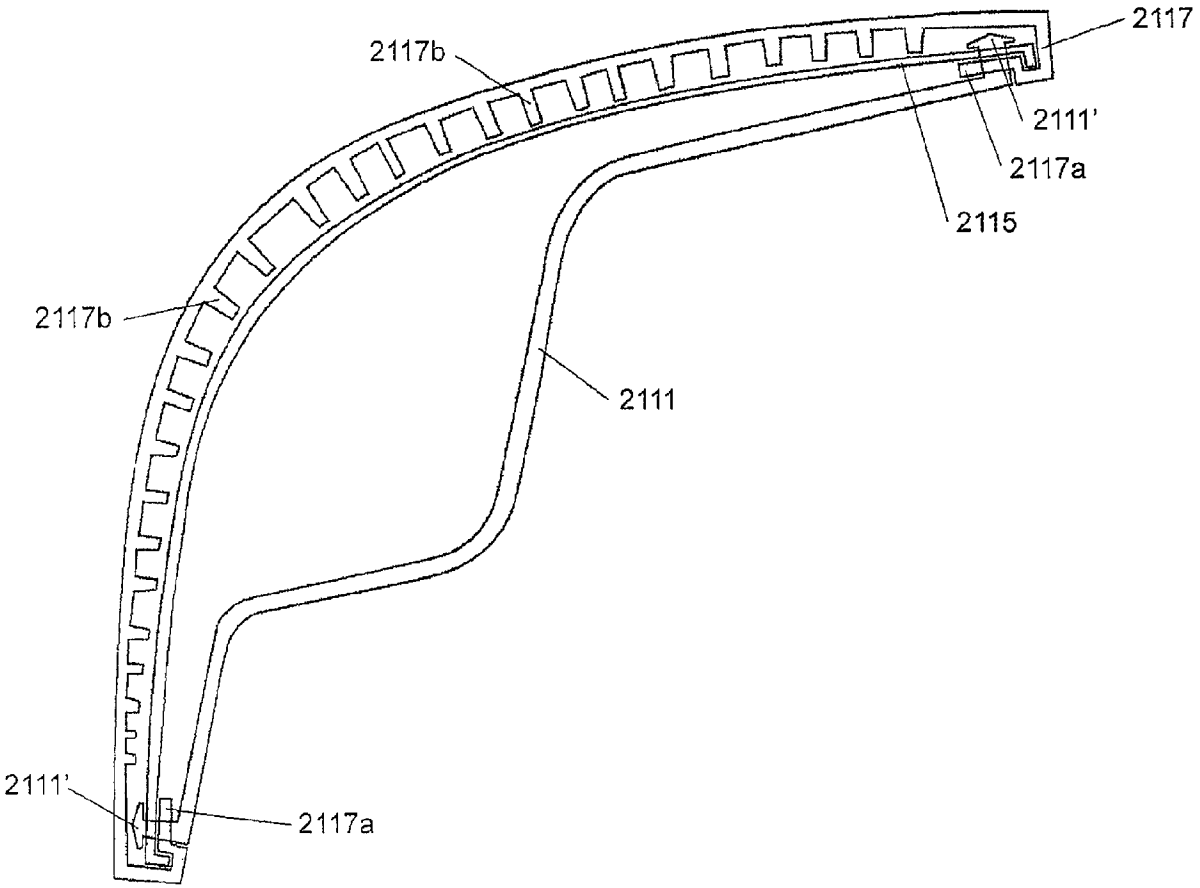
FIG. 98 is a side sectional view along line 98-98 of FIG. 93, showing a preferred form spring structure.
Figure 99:
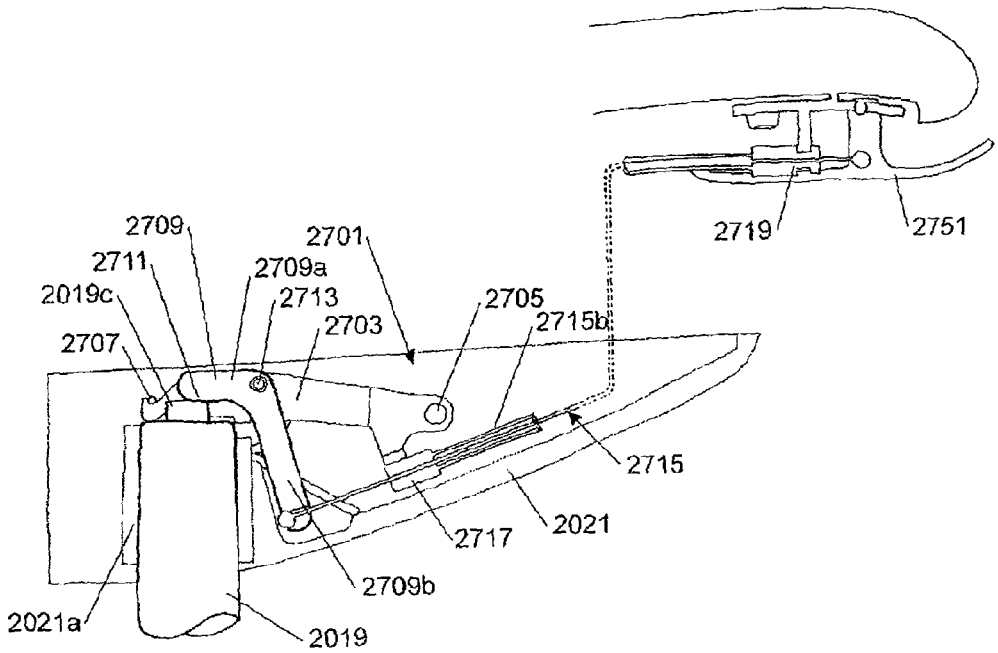
FIG. 99 is a side view of a preferred form height adjust pedestal control mechanism for the chair of FIG. 56, showing the mechanism in a relaxed state.
Figure 100:
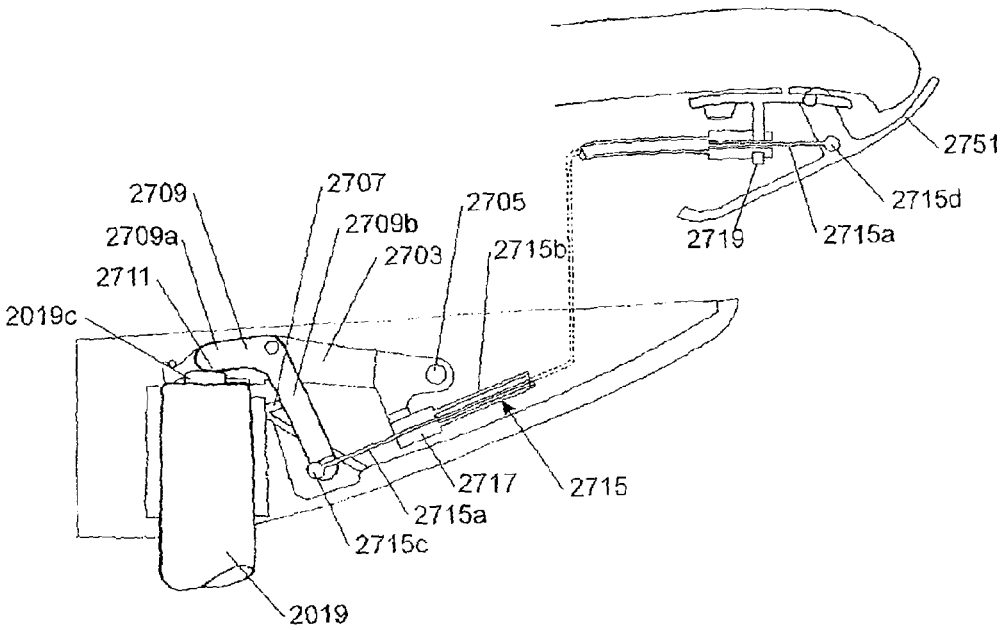
FIG. 100 is a side view similar to FIG. 99, but showing the mechanism in an actuated state.

FIG. 98 is a cross section along line 98-98 of FIG. 92, showing a suitable way of connecting the arm rest components. The base member 2111 is provided with a plurality of locking projections 2111' along its side and top surfaces. The cushion substrate 2115 contains complementary apertures. The cushion construction 2117 includes an overhanging lip 2117*a*, that is received between the cushion substrate and the base member 2111, and the overhanging lip 2117*a* also contains complementary apertures. The locking projections provide tapered enlarged heads, to provide a one-way engagement of the base member, cushion substrate, and cushion construction.

The cushion construction comprises a plurality of resilient pins 2117*b* that retain the outer surface of the cushion construction in a spaced apart position from the cushion substrate when no loading is applied to the outer surface of the cushion construction. The pins are preferably oriented at a non-perpendicular angle to the outer surface of the cushion construction and the corresponding area of the cushion substrate, so the pins are encouraged to collapse in a pre-determined direction.

In some embodiments, the portion of the arm rest that supports a user's arm may be selectively movable in a generally horizontal plane.

The mechanism for this arm rest is substantially the same as that described above with reference to FIGS. 45*a* to 48. Namely, the arm rest supports 2051*a* each comprise an elongate slot 2121 having spaced apart generally parallel first and second elongate walls 2123, 2125. The support also has a plurality of spaced discrete locking positions defined by locking features which, in the form shown, are transverse slots 2127.

Each arm rest support comprises a base portion 2051', and two flange portions 2051". An end of the armrest proximal the support comprises an engagement mechanism for engaging with the support on the back of the chair. The arm rest is cantilevered from the support in a direction generally transverse to the slot 2121—that is in a generally forwardly extending direction—by the engagement mechanism. The engagement mechanism comprises a polymeric mounting component 2131 that has mounting portions 2130*a*, 2130*b* that extend around and captures the flanges 2051" of the arm rest support. In the form shown, the mounting component 2131 is received in an outer housing 2129 and is attached to the arm rest base 2111. Alternatively, it could be formed as an integral part of the arm rest base 2111.

The engagement mechanism again comprises at least two spaced apart bearing mechanisms 2133 that are spaced apart in the elongate direction of the slot and are slidably received in the elongate slot 2121. The engagement of the bearing mechanisms with the first and second longitudinal walls is the same as for the first preferred form described above. The bearing mechanisms 2133 are rotatably mounted on shafts 2130 in the polymeric mounting component 2131. The mounting component 2131 also has an aperture 2132 through which part of the locking member 2135 extends in use. The bearing mechanisms may be any of the types described for the first preferred form chair above.

A locking mechanism is provided for locking the arm rest in a selected position relative to the support. The locking mechanism has a locking member 2135 that is slidably mounted in the arm rest, an actuator 2113 which is positioned at or toward a distal end of the arm rest, a connecting member 2139 that connects the locking member and the actuator, and a spring 2114. The connecting member is received internally within the arm rest base 2111. In this form, the spring is a coil compression spring that biases the locking member 2135 into engagement with the locking slots 2127 in the arm rest support. The spring could be any other suitable type. A spring may be provided to bias the lever away from the underside of the arm rest.

Again, the locking member 2135 extends from the engagement portion of the arm rest and engages in one of the locking slots 2127 of the support to maintain the arm rest in a desired position. When the occupant wishes to adjust the height of the arm rest, he or she pulls up on the actuator 2113 against the bias of the spring, which causes the locking member 2135 to release from engagement with the support thereby enabling a sliding movement therebetween. In the form shown, the actuator 2113 is a lever that is pivoted relative to the arm rest and the connecting member causes a sliding movement of the locking member upon movement of the lever, so that a pivoting movement of the actuator as it is pulled upward toward the underside of the arm rest slides the locking member 2139 out of engagement from a locking slot so the height of the arm rest can be adjusted. Instead, the actuator could be connected to the locking member by a cable or any suitable alternative device. A different type of actuator could be used instead of an articulated actuator lever.

Seat Construction, Cushion, and Seat Support Mechanism

Figure 61:
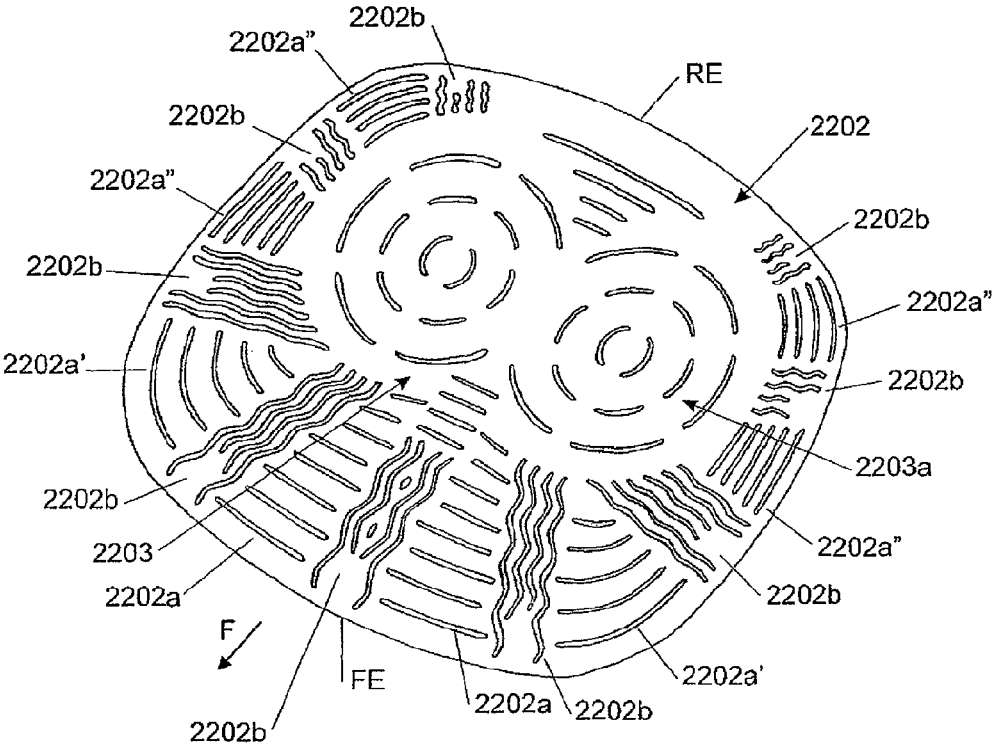
FIG. 61 is an overhead perspective view of a preferred form seat panel that forms part of a seat portion of the chair of FIG. 56.
Figure 62:
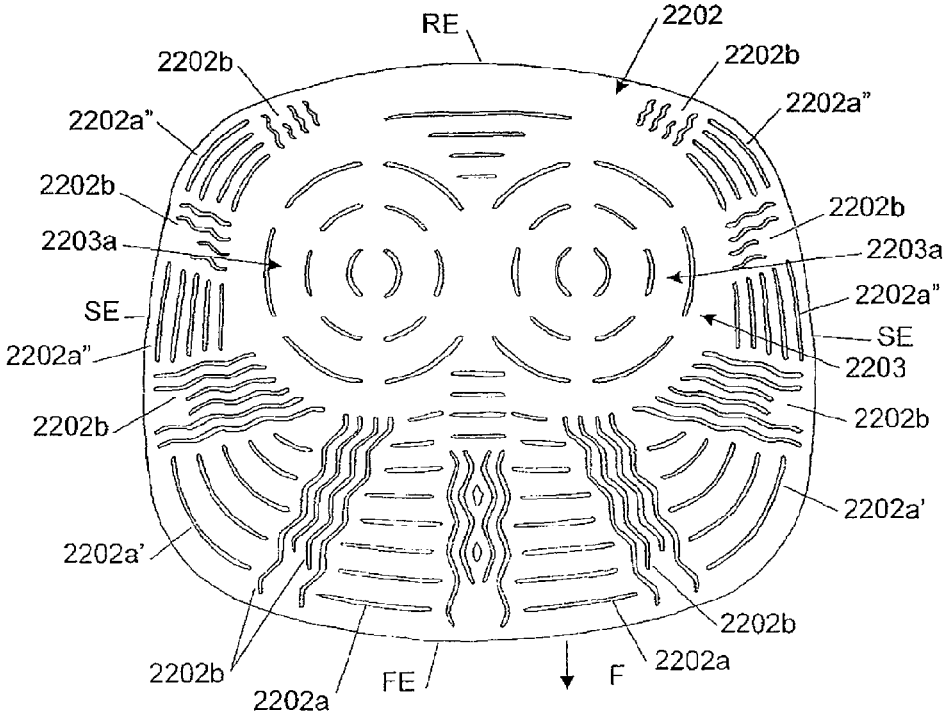
FIG. 62 is a plan view of the seat panel of FIG. 61.

Referring to FIGS. 61 to 71, the seat portion comprises a seat support pan 2201. The pan is a unitary moulded polymeric construction. A seat panel 2202 shown in detail in FIGS. 61 and 62 is mounted to the top of the seat pan. The seat panel 2202 is in the form of a flexible polymeric panel, whose flexibility is enhanced by the arrangement of slots as indicated. The plastic panel and pan may be made of injection moulded plastic or any other suitable material.

It will be noted that while the seat panel 2202 is depicted to be a flat panel, the seat panel may be dish shaped. Strengthening ribs may be provided on the underside of the panel to support the panel in a desired dished shape.

The seat panel is flexible to accommodate the occupant and to respond to movement of the occupant. The arrangement of slots in the seat panel 2202 as shown in FIGS. 61 and 62 is designed to enhance the flexibility of the seat panel 2202.

The arrangement of slots in the forward half of the panel is designed to facilitate folding of the seat panel along a transverse fold. In particular, it can be seen that the slots are arranged in a series of spaced parallel lines 2202*a* extending transversely across the seat portion and generally parallel to the forward edge FE of the seat panel. The lines of slots 2202*a* are discontinuous. The forward half of the panel also comprises a plurality of generally radially extending sinuous slot weakeners 2202*b*. Each transverse slot 2202*a* is separated from an adjacent slot 2202*a* transversely across the seat panel by a plurality of generally radially extending weakeners 2202*b*.

The series of spaced weakeners 2202*a* enable the forward edge of the seat panel to fold downwardly under the weight of an occupant's legs. Furthermore, at the front corners, the slotted pattern 2202*a*' is such as to extend around the corners generally following the shape of the edge of the seat panel. In this way, if the user moves a leg to one of the forward corners then the diagonal arrangement of the slots 2202*a*' will enable the forward corner to fold under the weight of the occupant's leg.

The arrangements of slots in the sides of the seat panel are designed to facilitate folding of the sides of the seat panel under the weight of a user's legs if the user is side-sitting on the seat panel. In particular, it can be seen that the slots are arranged in a series of spaced parallel lines 2202*a*" extending longitudinally along the seat portion and generally parallel to each side edge SE of the seat panel. The lines of slots 2202*a*" are discontinuous. The sides of the panel also comprise a plurality of generally radially extending sinuous slot weakeners 2202*b*. Each transverse slot 2202*a*" is separated from an adjacent slot 2202*a*" longitudinally along the seat panel by a plurality of generally radially extending weakeners 2202*b*. The weakeners 2202*a*", 2202*b* extend around the rear corners of the seat panel, but the majority of the rear edge of the seat panel is free of weakeners.

The rear half of the panel constitutes a central zone 2203 which defines a primary supporting region for a seated occupant when in a normal forward oriented seated position on the seat portion. In the central zone 2203, the slots are arranged in a pattern to accommodate the ischial protuberosities of the occupant. In particular, the slotted pattern provides two spaced, approximately circular zones 2203*a* whose locations correspond to the ischial protuberosities of the occupant. Each zone 2203*a* is comprised of slots arranged in a series of generally concentric circles, with each circle comprising a plurality of discontinuous slots. The arrangement of slots in each zone 2203*a* enables the remaining material between the slots to spread apart thereby creating pockets, one for each ischial protuberosity of the seat occupant.

Figure 63:
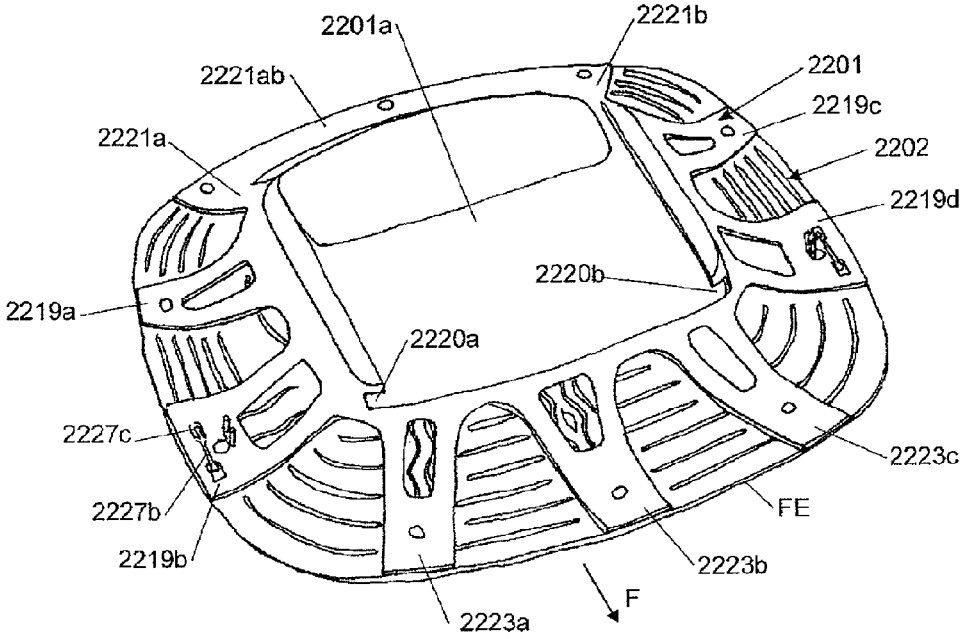
FIG. 63 is an underside perspective view of a seat support and the seat panel of FIG. 61.
Figure 64:
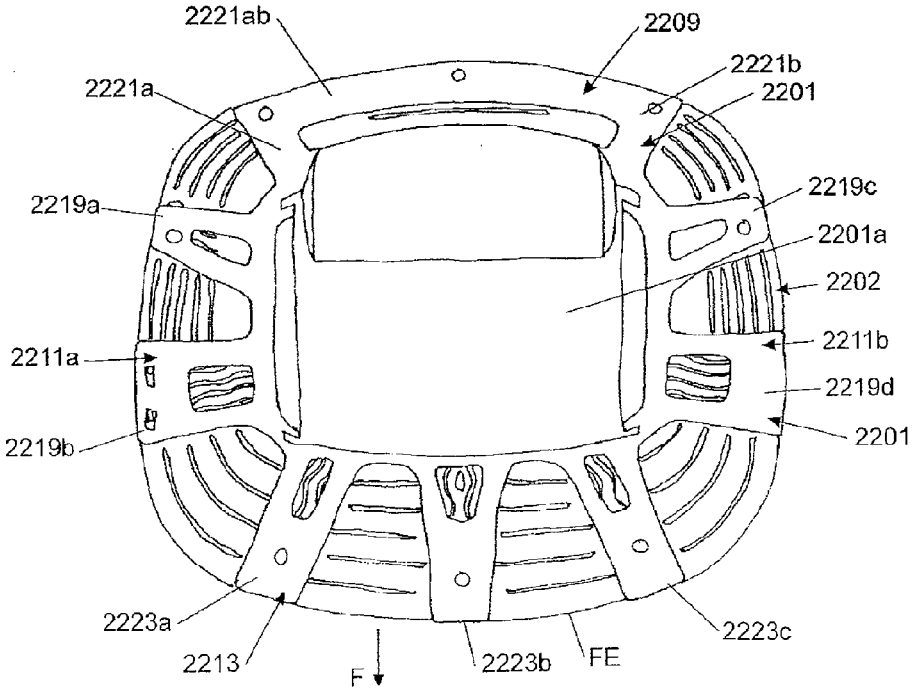
FIG. 64 is an underside view of the seat support and seat panel of FIG. 61.

As can be seen in FIGS. 63 and 64, the central zone of the seat panel is located above a relatively rigid central zone 2201*a* of the seat support pan. The seat support pan forms part of the seat portion along with the panel and cushion, as well as part of the seat support along with the seat depth mounting described below. The central zone 2201*a* of the seat pan is surrounded by an outer zone that is made up of a rear zone 2209, left and right side zones 2211*a*, 2211*b*, and a front zone 2213. The pan has a generally dished shape to provide clearance for deflection of the seat panel 2202 when the seat panel is supporting the weight of a seated occupant.

The seat pan supports the seat panel and cushion 2204. The seat support comprises the base member 2201*a*, and a plurality of resilient support members that extend upwardly and outwardly from the central zone 2201*a* to support the seat panel at their upper ends. In the preferred form shown, the support has two side resilient support members 2219*a*, 2219*b*, 2219*c*, 2219*d* located along either side of the central zone of the seat pan. The upper ends of the members 2219*a*, 2219*b*, 2219*c*, 2219*d* support the flexible side portions of the seat panel.

Additionally, in the form shown, the seat support pan has two rear resilient support members 2221*a*, 2221*b* that are connected by an integral curved connector member 2221*ab*, that has a curvature corresponding to the curvature of the rear edge RE of the seat portion. The rear support members 2221*a*, 2221*b* and curved connector member support the rear edge of the seat panel.

The seat support has three front resilient support members 2223*a*, 2223*b*, 2223*c* that support a forward part of the seat portion.

The central portion 2203 of the seat panel is adapted for receipt of the majority of an occupant's weight when in a normal forward oriented seated position on the seat portion.

Figure 65:
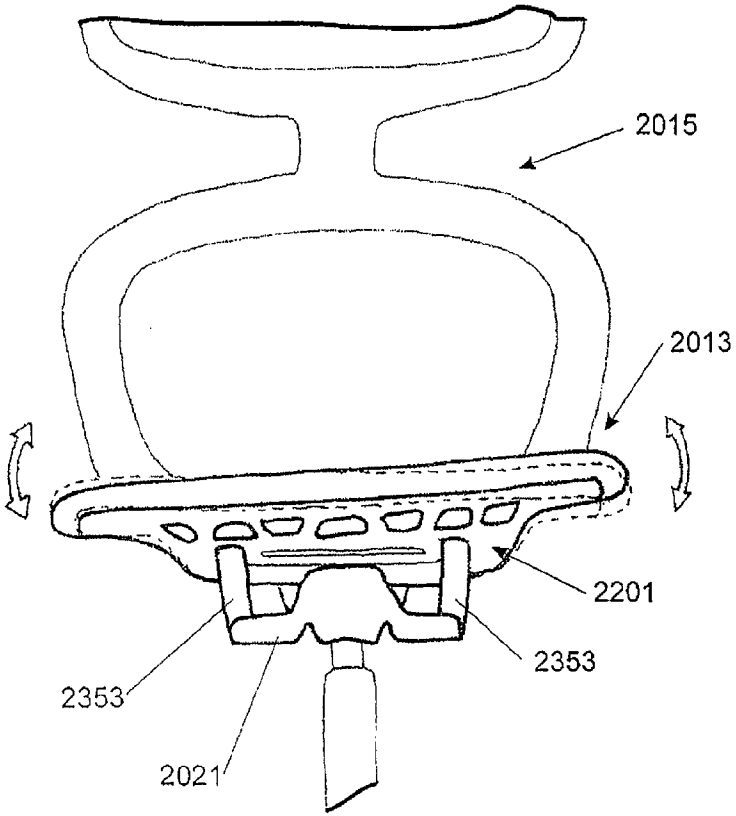
FIG. 65 is a schematic front elevation view showing a preferred tilting action of the seat portion of the chair of FIG. 56.

Each resilient support member is configured to deform/flex as the occupant applies weight either to the side, rearwardly, or forwardly on the seat portion, thereby providing angular movement of the seat portion. FIG. 65 schematically shows a tilting action of the seat portion when an occupant's weight is offset to the left 2211*a* or right 2211*b* side of a centre of the seat portion.

It will be appreciated that there could be a different number or type of resilient support members along the sides, front, or back of the seat portion.

Figure 66:
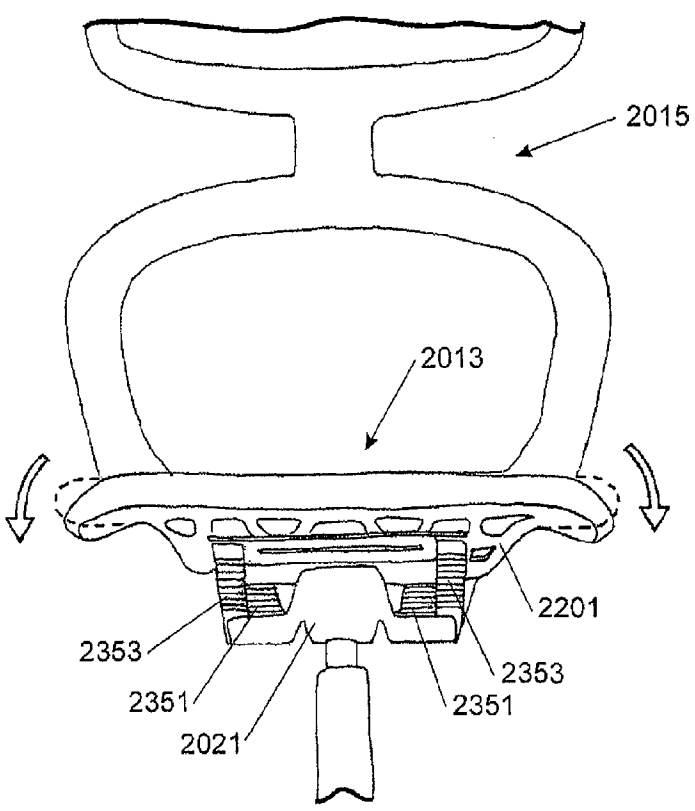
FIG. 66 is a schematic front elevation view showing a preferred flexing action of the sides of the seat portion of the chair of FIG. 56.
Figure 67:
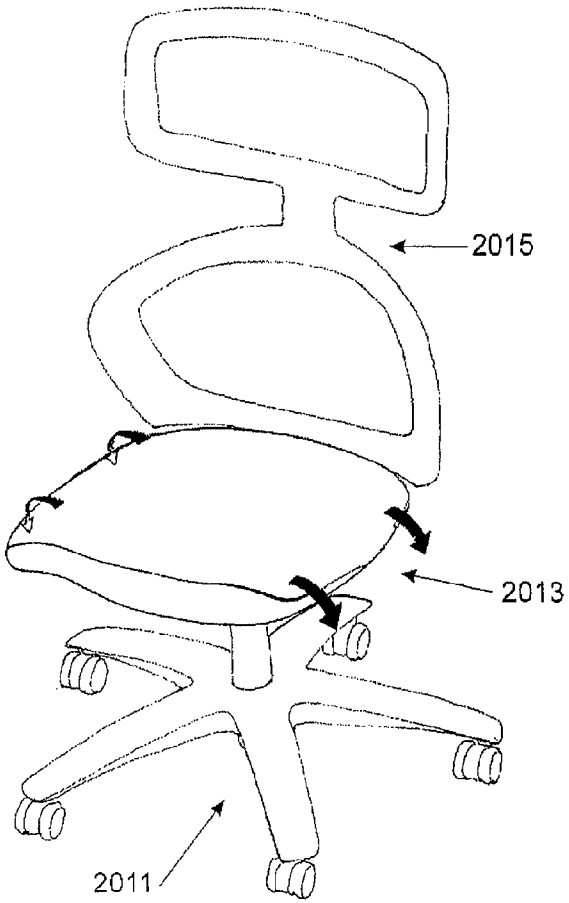
FIG. 67 is a front overhead perspective view showing the preferred flexing action of the sides of the seat portion of the chair of FIG. 56.

The resilience of the resilient members 2219*a*, 2219*b*, 2219*c*, 2219*d*, in addition to the enhanced flexibility of the sides of the seat panel, enables the sides and front of the seat panel to fold downwardly under the weight of an occupant's legs if the occupant sits sideways on the seat portion. FIGS. 66 and 67 schematically show the side zones of the seat portion flexing under the weight of an occupant's legs. It will be appreciated that the resilient side support members of the seat pan and the flexibility in the sides of the seat panel will work together to form a compliant comfortable surface for a seated occupant positioned sideways on the chair. For example, a occupant could sit sideways on the chair with their weight offset to the right side which would cause the seat panel to tilt to the right by virtue of the resilient supports, which would result in the left side of the seat panel lifting but the left side zone to flex under the weight of the occupant's legs so as to not apply excessive pressure to the underside of the occupant's legs.

The central portion 2203 defines a rearward supported portion of the seat panel, and the forward portion in front of the central portion has enhanced flexibility. That enhanced flexibility and the resilience of members 2223*a*, 2223*b*, 2223*c* enable the forward portion of the seat panel to deform under the weight of an occupant's legs as the occupant sits forward on the seat portion. The forward portion is designed to generally exhibit greater flexibility than the side zones. As the preferred form recline mechanism causes the seat to lift as the back portion reclines, there is benefit in having a flexible front portion of the seat panel, to prevent the front portion from applying excessive force to the underside of the occupant's legs.

The seat panel 2202 may form the seating surface that is contacted by the seated occupant in use. Alternatively, and preferably, a cushion 2204 may be provided to provide a compliant support surface for the seated occupant. The cushion preferably comprises a foam item that is attached to the seat panel, such as by adhesive or the like. A cover will be provided for the cushion. The cover is preferably configured to cover the top and sides of the cushion and attached seat panel, and extend around beneath the seat panel to at least some extent. The seat panel may be connected to the upper ends of the resilient members of the seat pan via any suitable means. For example, the seat panel and resilient members could be provided with moulded attachment features that enable the components to be connected. As another example, fasteners could be used. Preferably, the portion of the cover that extends beneath the seat panel is captured between the seat panel and the resilient members as the seat panel is connected to the resilient members.

Figure 68:
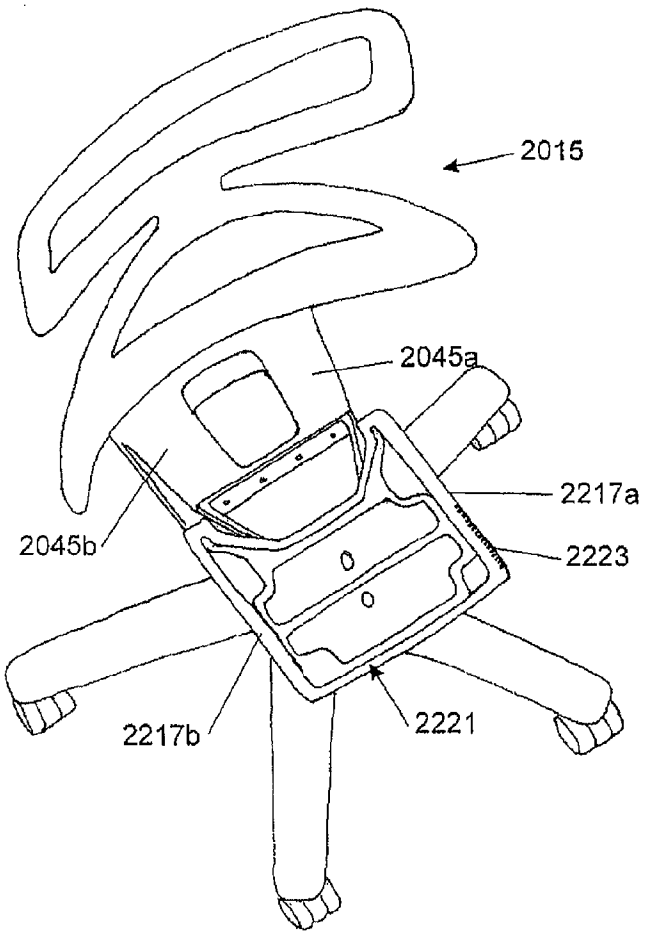
FIG. 68 is an overhead perspective view of a supporting frame of the chair of FIG. 56, showing a preferred form mechanism for adjusting the seat portion depth.

The seat support pan 2201 also includes a pair of longitudinally extending channels 2220*a*, 2220*b* that form a slide and that slidably receive corresponding edges 2217*a*, 2217*b* of a seat depth mounting 2221 is shown in FIG. 68. The seat support is lockable in a selected position relative to the seat depth mounting 2221. The seat depth mounting 2221 has a number of spaced locking features 2223 along one edge which define discrete locking positions of the seat support. The locking features are in the form of slots.

Figure 69:
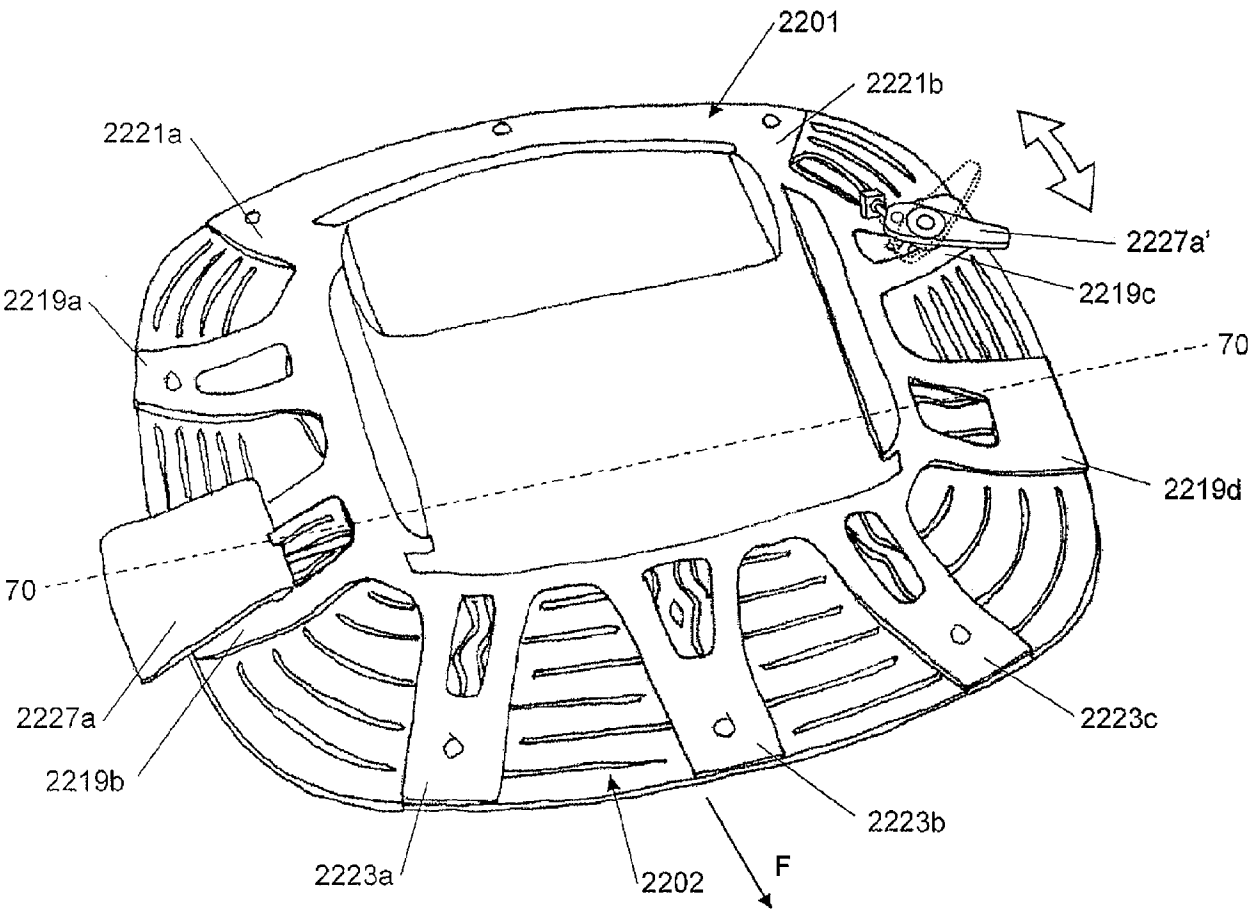
FIG. 69 is a schematic underside view of the seat portion of the chair of FIG. 56.
Figure 70:
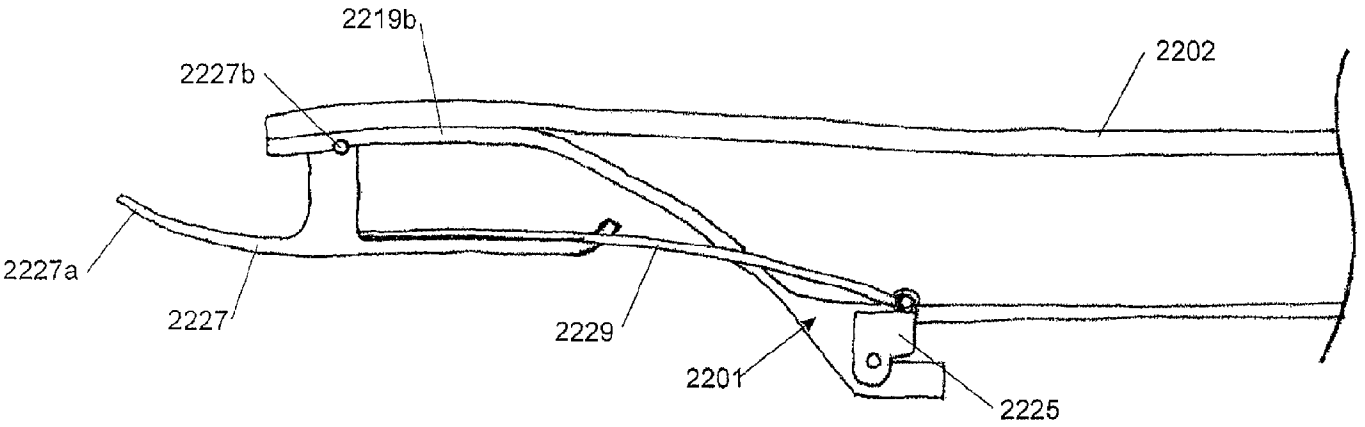
FIG. 70 is a sectional view along line 70-70 of FIG. 69, showing an actuator and controller for providing selective seat portion depth adjustment, with the controller in a locked position.
Figure 71:
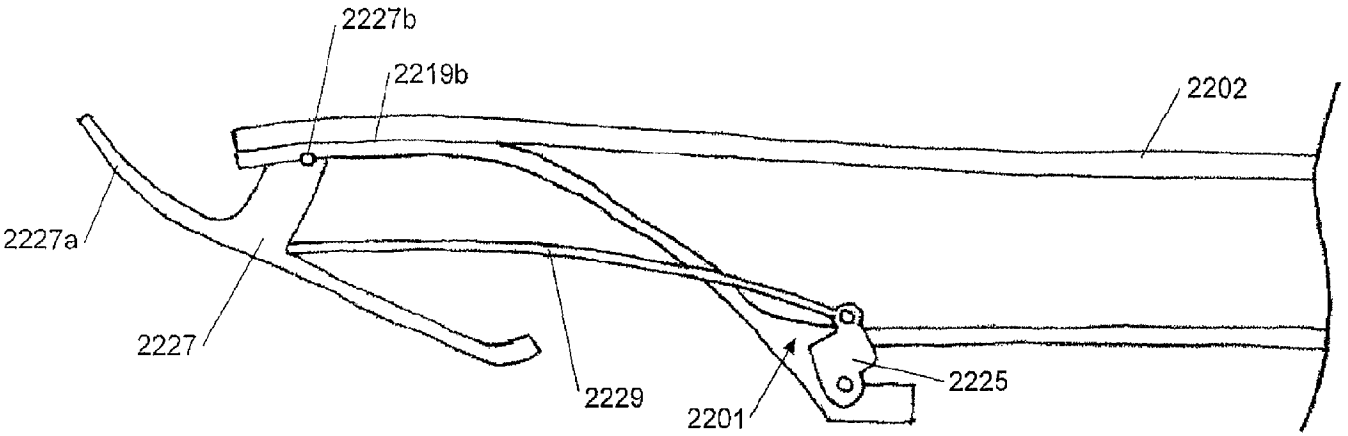
FIG. 71 is a view similar to FIG. 70 but with the controller in a released position.

Referring to FIGS. 69 to 71, the seat support carries a locking member 2225 that is pivoted to the seat support and biased inwardly to engage with one of the locking features to lock the seat in a depth adjusted position. The locking member is operatively connected to an actuator lever 2227 by a flexible member such as a cable 2229, and is configured such that lifting the outer portion of the actuator lever upwardly toward the seating surface will release the locking member from engagement with a locking feature in the seat depth mounting, thereby enabling the depth of the seat to be adjusted. FIG. 71 shows the locking member 2225 in the released position.

The actuator lever 2227 is positioned to be accessible by a seated occupant reaching under a peripheral edge region of the seat portion. The actuator lever has a paddle surface 2227*a* sized and configured to receive a plurality of an occupant's fingers. The actuator lever is articulated beneath the peripheral edge region of the seat portion, to the underside of the seat portion. In the embodiment shown, the actuator lever is pivoted to the underside of the resilient member 2219*b* via a pivot shaft 2227*b* that is received in recesses 2227*c*. As the actuator lever is articulated to the underside of the flexible peripheral edge region of the seat portion, the entire lever including the pivot attachment moves when the peripheral edge region flexes under the weight of an occupant's legs. That helps prevent the lever from being inadvertently actuated as the peripheral edge region is deformed.

While in the form shown, the lever requires upward pulling toward the seat portion to actuate the mechanism, the lever could alternatively require downward pushing away from the seat portion to actuate the mechanism. An alternative lever may require movement in a generally horizontal plane to actuate the mechanism. That lever may pivot about a generally vertical pivot.

The same type of actuation lever could be used for actuating other mechanisms that enable the chair to be reconfigured. By way of example, a similar mechanism is used for the height adjust spring controller described below.

The actuator lever(s) may be provided along the side(s) of the seat portion, or could alternatively be provided under the front of the seat portion such as under the front corners for example.

Recline Mechanism

In this preferred form, the chair is not provided with an intermediate support. Therefore, the recline mechanism is connected directly between the main transom 2021 and the seat depth mounting 2221. The preferred form recline mechanism is shown in FIGS. 56 to 60. The recline mechanism comprises a pair of rear deformable members 2351 extending between a rearward portion of the main transom 2021 and a rearward portion of the seat depth mounting 2221, thereby operatively connecting a rearward portion of the seat portion and the supporting frame. The two members 2351 are transversely spaced apart, and are positioned toward respective sides of the seat portion.

The recline mechanism further comprises a pair of front deformable member 2353 extending between a forward portion of the main transom 2021 and a forward portion of the seat depth mounting 2221, thereby operatively connecting a more forward portion of the seat portion and the supporting frame. The two members 2353 are transversely spaced apart, and are positioned toward respective sides of the seat portion.

The front members 2353 and rear members 2351 are narrower in a transverse direction than they are long in a longitudinal direction. By providing narrower discrete front and rear deformable members, material savings are achieved over using transverse members. Also, more independent movement of the sides of the seat portion may be achieved if a user's weight is offset toward one of the sides of the seat portion when reclining the back portion of the chair.

The upper ends of the front members 2353 and rear members 2351 are connected to the seat depth mounting by any suitable means. In the form shown, fasteners such as bolts are used.

The elastomeric material of the members 2351, 2353 may be any of the types outlined for the first preferred form recline mechanism above.

A lower deformable member 2357 extends rearwardly from the main transom of the chair to a lower portion 2049*b* of the back support, thereby operatively connecting a lower part of the back portion and the supporting frame. The lower deformable member can be connected to the back support by any suitable means, such as bolts or other fasteners for example. The lower deformable member is preferably in the form of a panel which extends substantially the width of the main transom, and may be made of any of the materials outlined in relation to the panels 351, 353 for the first preferred form above.

The recline mechanism further comprises a puller member 2361 above the lower deformable member and extending from a rearward part of the seat depth mounting 2221 to an upper portion 2049*a* of the back support, thereby operatively connecting the back portion to the seat portion. The puller can be connected to the back support and seat depth mounting by any suitable means, such as bolts or other fasteners for example. Again, the puller member is preferably in the form of a panel which extends substantially the width of the main transom, and may be made of any of the materials outlined in relation to the panels 351, 353 for the first preferred form above. However, depending on the particular configuration, the puller member could be substantially rigid rather than deformable, is its primary purpose is to apply a rearward pulling action to move the seat portion.

Figure 57:
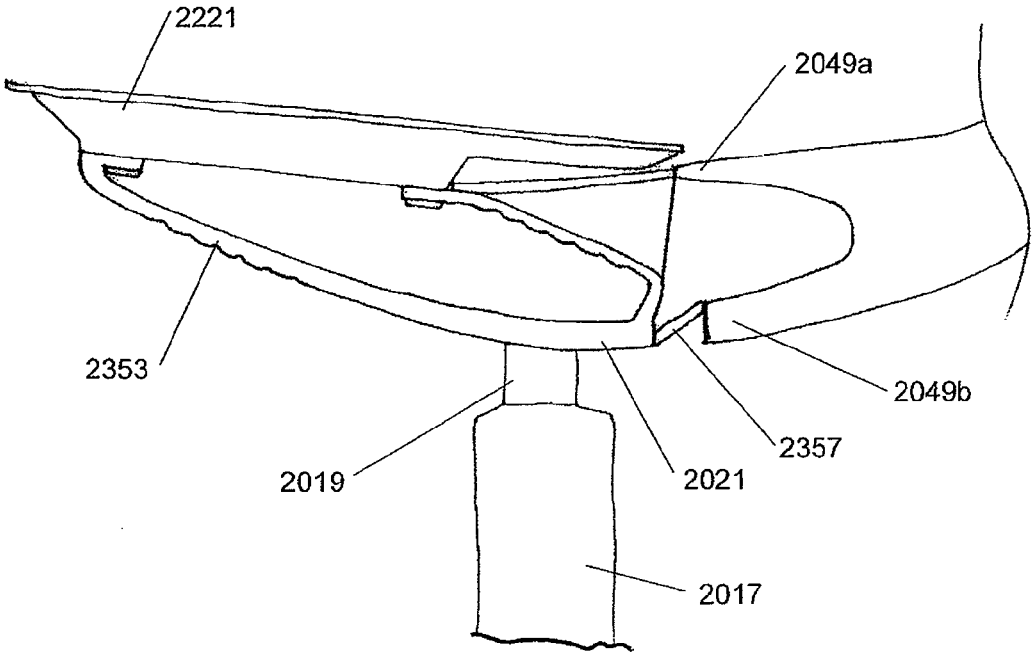
FIG. 57 is a side view of a preferred form recline mechanism of the chair of FIG. 56.
Figure 58:
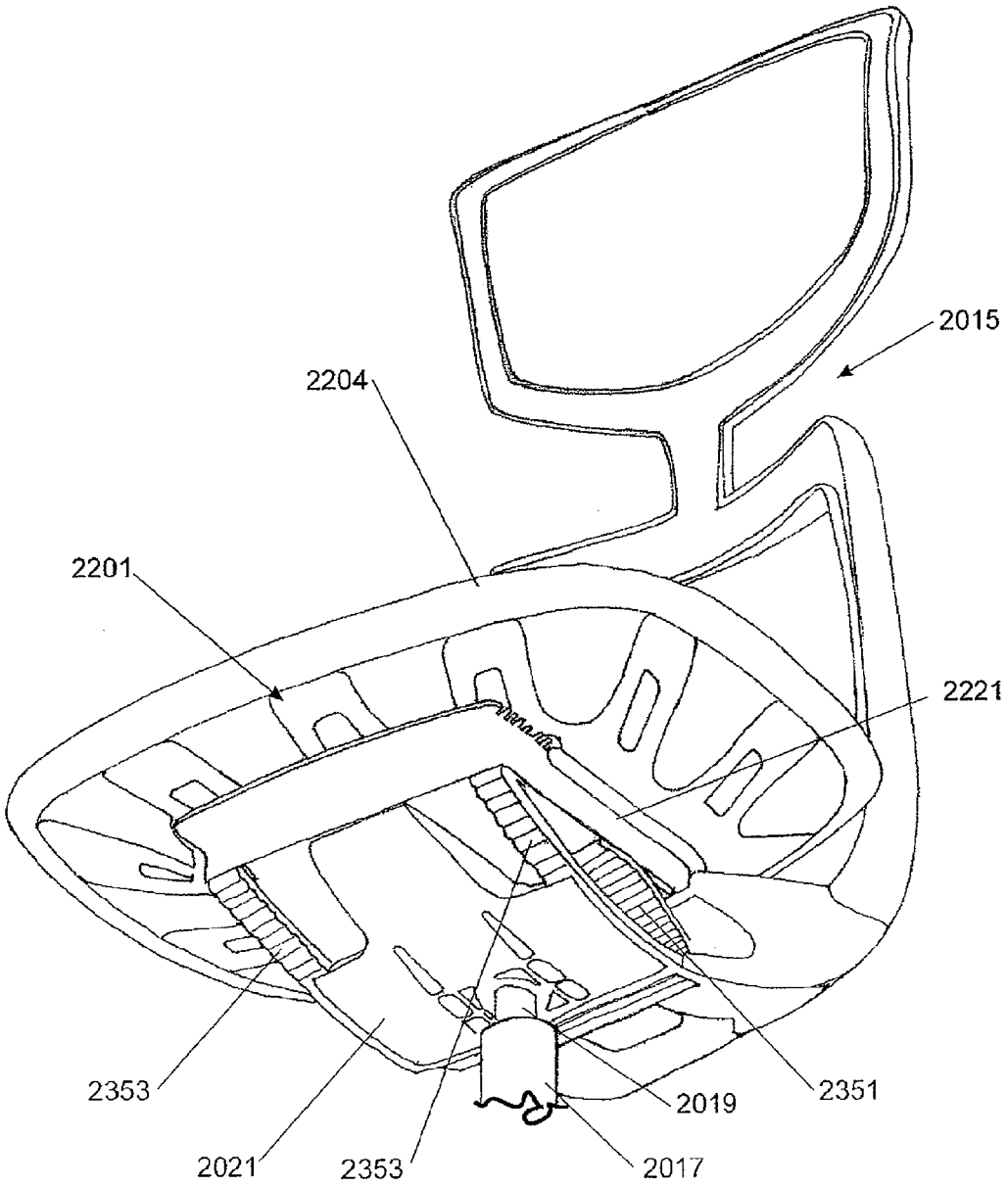
FIG. 58 is a front underside perspective view of the recline mechanism of FIG. 57.
Figure 59:
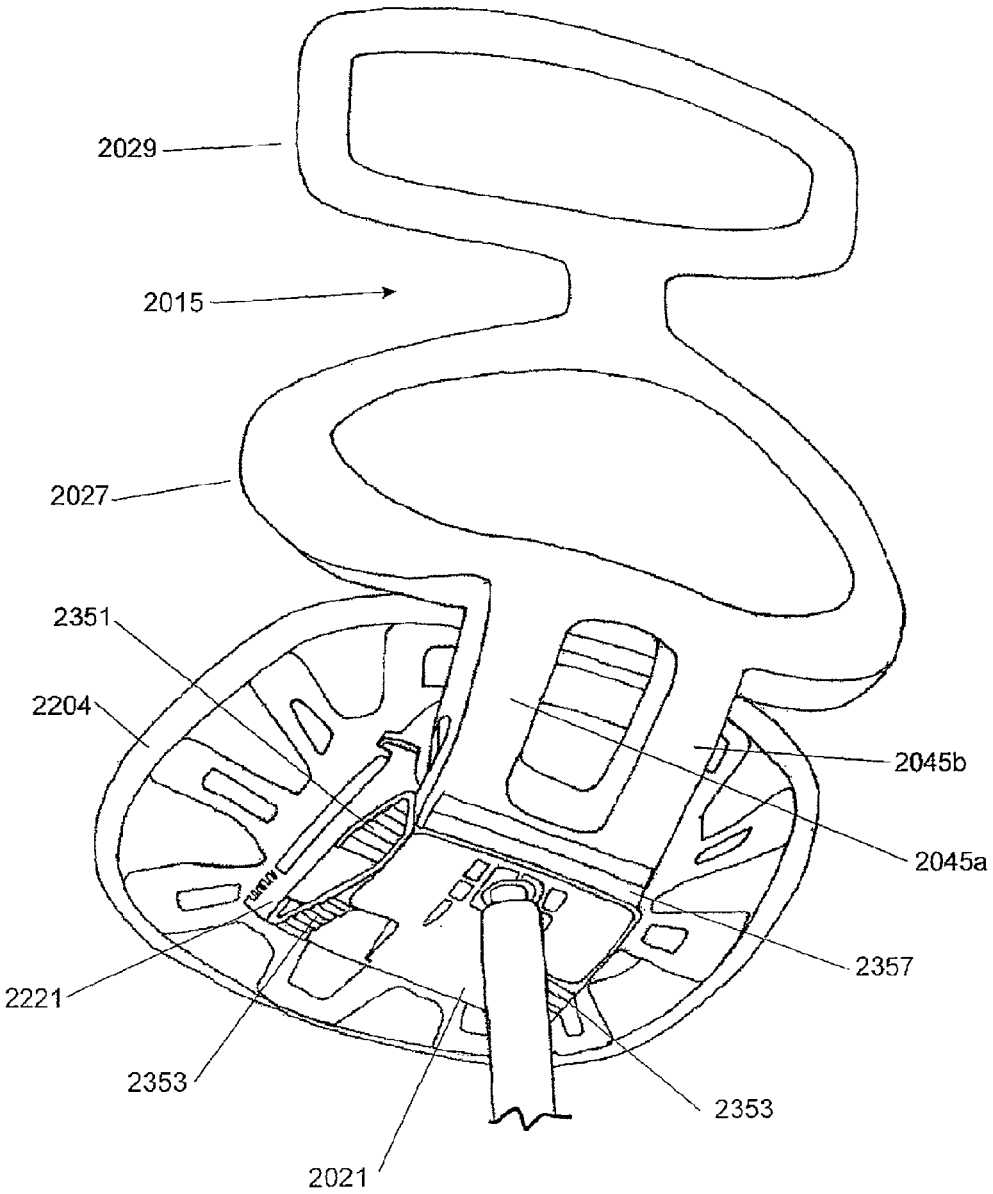
FIG. 59 is a rear underside perspective view of the recline mechanism of FIG. 57.
Figure 60:
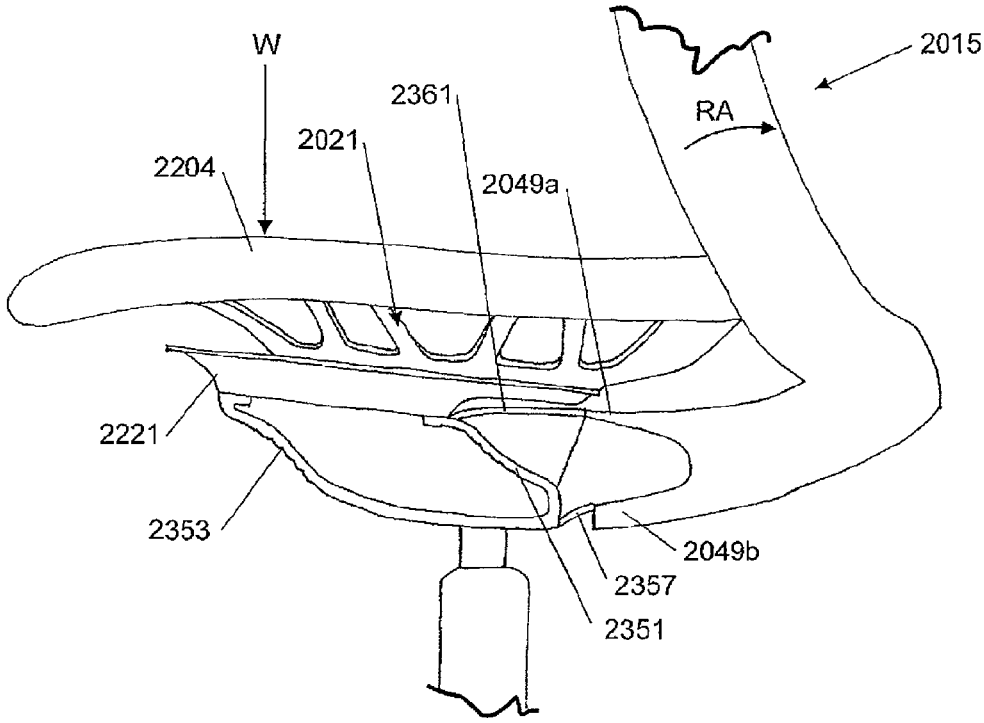
FIG. 60 is a side view of the recline mechanism of FIG. 57, showing deformation of the members as the back portion undergoes a reclining action.
Figure 72:
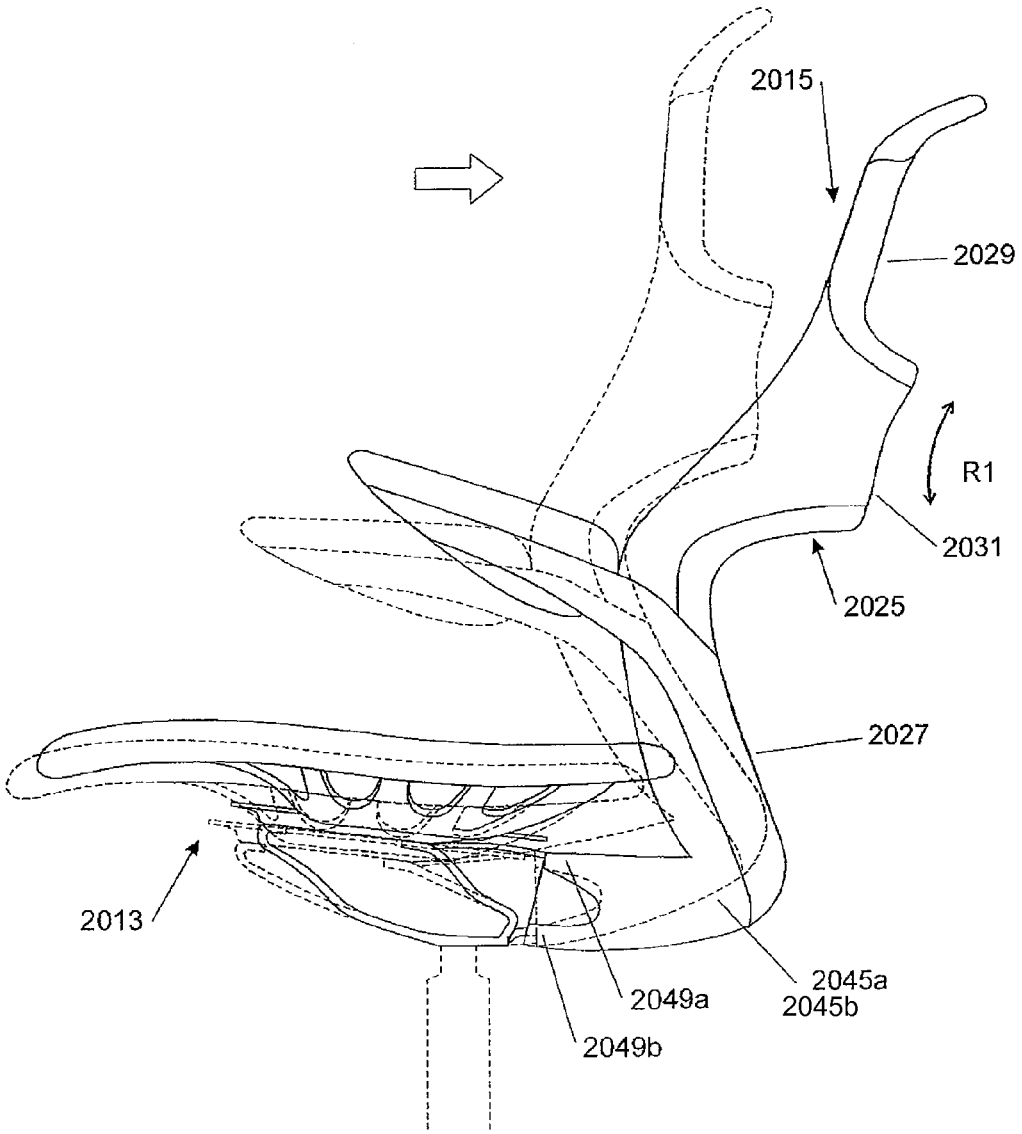
FIG. 72 is a side elevation view showing a reclining action of the preferred form back portion of the chair of FIG. 56.
Figure 73:
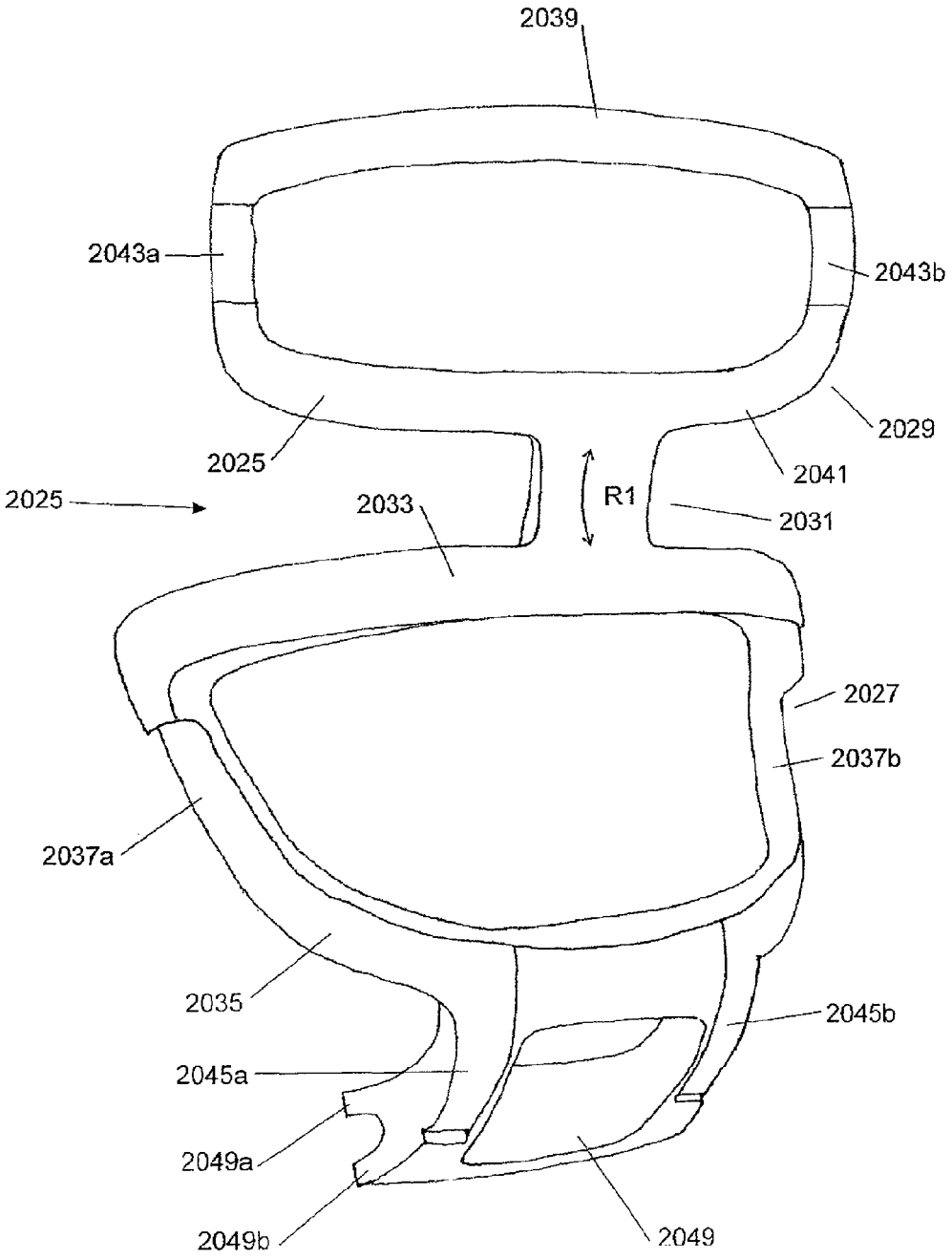
FIG. 73 is a rear perspective view of the preferred form back portion of the chair of FIG. 56, showing regions of flexibility.
Figure 74:
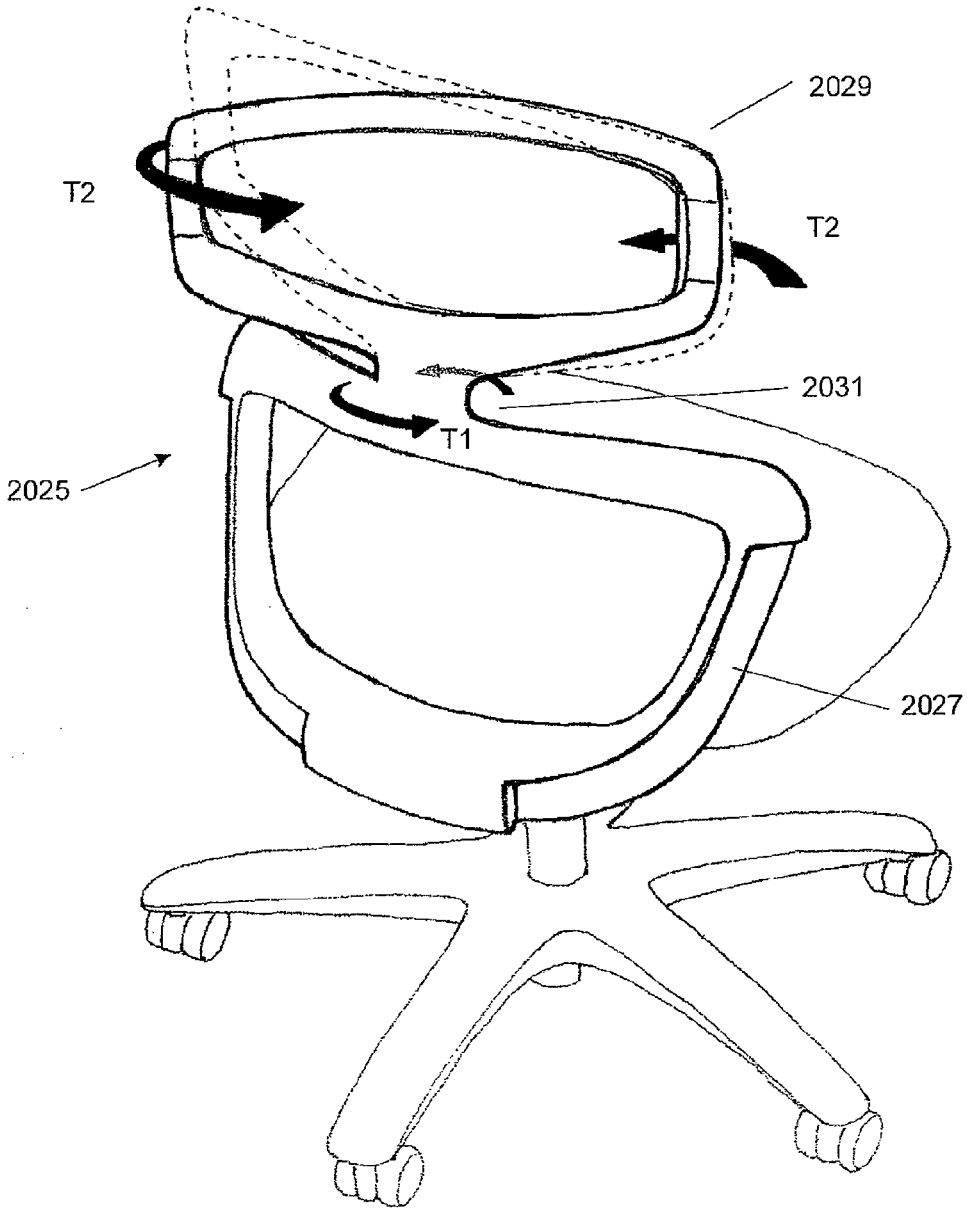
FIG. 74 is a view similar to FIG. 73, showing the twisting actions of the upper portion of the back portion.

Again, the recline mechanism is configured such that as the back portion 2015 of the chair is reclined, the lower deformable member 2357 deforms and the puller member 2361 applies a rearward pulling action which causes the seat to move rearwardly and the front and rear deformable members to deform. FIGS. 57 to 59 show the chair with the back portion 2015 in the upright configuration. FIGS. 60 and 72 show the chair with the back portion 2015 in the reclined configuration. FIG. 60 shows the seat portion with the weight W of a seated occupant (not shown) applied to the seat portion and the back undergoing a reclining action RA. The lower deformable member 2357 has flexed to enable the lower back support portion 2049*b* to recline, and the puller 2361 has applied a rearward pulling action to the seat depth mounting, causing it to raise and move rearwardly from the position it is in when a load is applied to the seat but the back is not undergoing a reclining action. The front and rear deformable members 2353, 2351 have flexed into a sinuous shape, to provide the movement of the seat depth mounting and thereby the seat portion.

Because at least a major part—namely at least the rearward part—of the seat portion lifts and moves rearwardly as the back portion is reclined, the occupant's weight compensates the reclining action of the back portion. Accordingly, as the rearward force is removed from the back portion, the occupant's weight will cause the back portion to return to the upright position.

The members 2351, 2353 are provided with shaped front faces.

The recline mechanism will again be provided with a downstop configured such that the downstop rests on the main transom to support the weight of the seated occupant on the seat portion via the supporting frame when the back portion is not being reclined. There are preferably recline limits and downstops provided at or toward either side of the chair. Any suitable type or configuration of downstop and recline limit could be used.

At least two of the deformable members may form an integrally moulded structure. In particular, the front deformable members 2353, rear deformable members 2351 and lower deformable member 2357 preferably form an integrally moulded structure. That integrally moulded structure is preferably then overmoulded onto the main transom 2021.

It will be appreciated that this recline mechanism can be incorporated into a chair that does not have a depth adjustable seat portion.

By using deformable members in the recline mechanism, the mechanism can be tuned to obtain a desirable reclining action. For example, the deformable members can be formed to provide variable resistance throughout the reclining action—such as greater resistance toward the reclined position for example. Further, the members can be formed to provide a seat movement with or without a change in seat angle, and with or without an arcuate movement, depending on the action required.

Height Adjust Pedestal Actuation

FIGS. 99 to 102 show a preferred form actuation mechanism 2701 for controlling a height adjust spring in a height adjust pedestal to vary the height of the seat portion 2013 above the ground. The main transom 2021 comprises a mounting section having an aperture 2021*a* for receipt of the upper end 2019 of the height adjust spring and therefore the upper end of the height adjust pedestal. The height adjust spring of the pedestal has a release button 2019*c* on the upper end. When the release button is not pushed in, the height adjust spring is substantially locked in a selected position. When a user desires to adjust the height of the seat portion of the chair above the floor, the button 2019*c* must be pushed inwardly to release the position of the height adjust spring. Releasing the button 2019*c* of the height adjust spring will again substantially lock the height adjust spring in a selected position, thereby substantially locking the position of the seat portion above the floor.

The height adjust spring of the pedestal can be any suitable type, such as a pneumatic spring, hydraulic spring, or mechanical spring for example.

The actuation mechanism compensates for tolerancing issues in manufacturing the height adjust spring or transom, and for assembly inaccuracies when the transom is mounted to the height adjust pedestal.

The actuation mechanism has a first lever 2703 that is articulated to the main transom 2021 of the supporting frame. In the form shown, the first lever is articulated to the main transom by being pivoted to the main transom at first pivot connection 2705. A spring 2707 biases the lever 2703 toward the mounting section to engage with an upper end 2019 of the height adjust spring when the upper end of the height adjust spring is inserted into the mounting section of the main transom.

Figure 101:
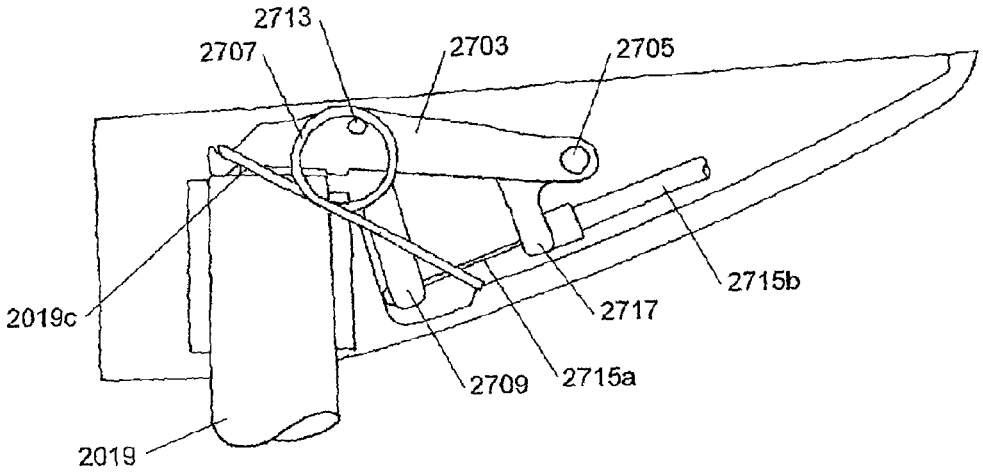
FIG. 101 is a side view of the compensation mechanism of the height adjust pedestal control mechanism of FIG. 99, accommodating a height adjust pedestal in a relatively high mounting position.
Figure 102:
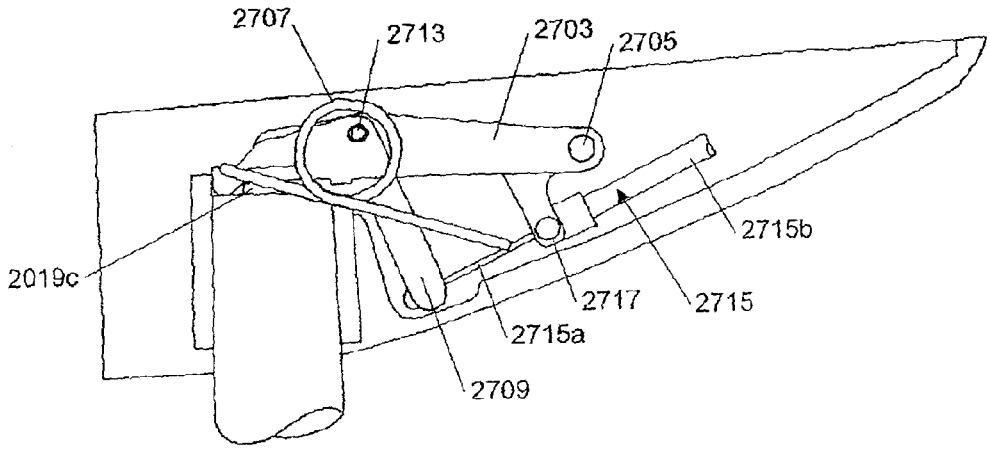
FIG. 102 is a side view similar to FIG. 101, but accommodating a height adjust pedestal in a relatively low mounting position.
Figure 103:
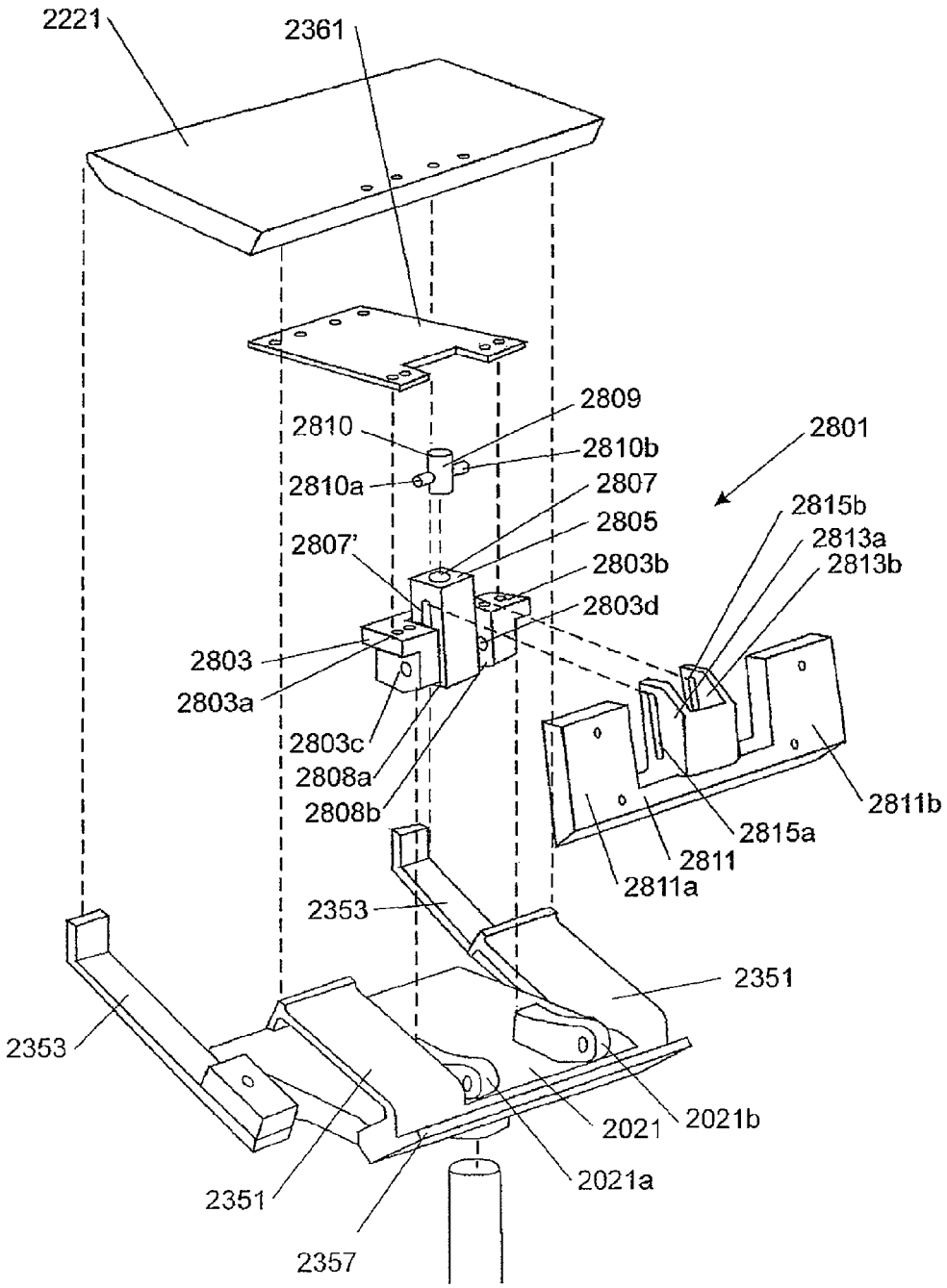
FIG. 103 is a rear overhead exploded perspective view of a preferred form preference control for the chair of FIG. 56, that adjusts the mechanical advantage of the back.
Figure 104:
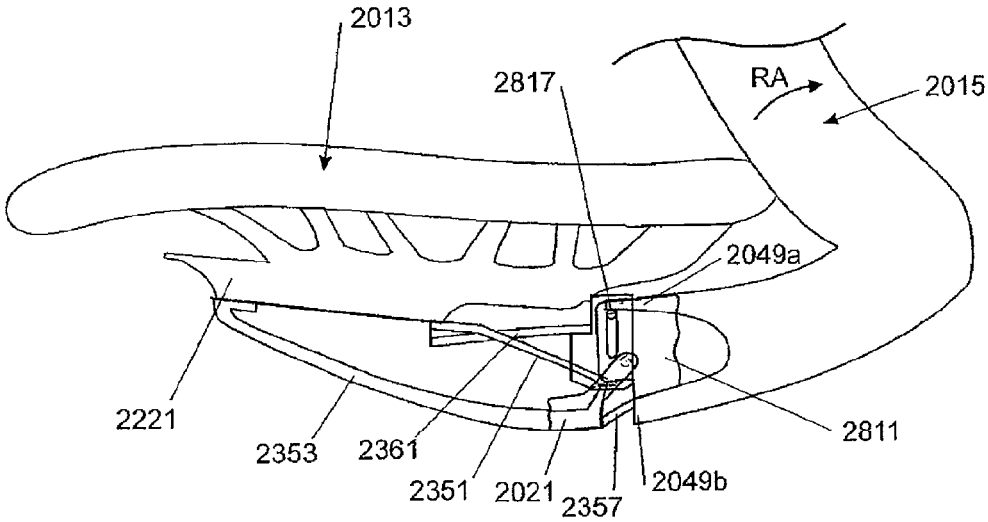
FIG. 104 is a side view of part of the chair of FIG. 56, showing the preference control in one adjusted position when the back is not being reclined.
Figure 105:
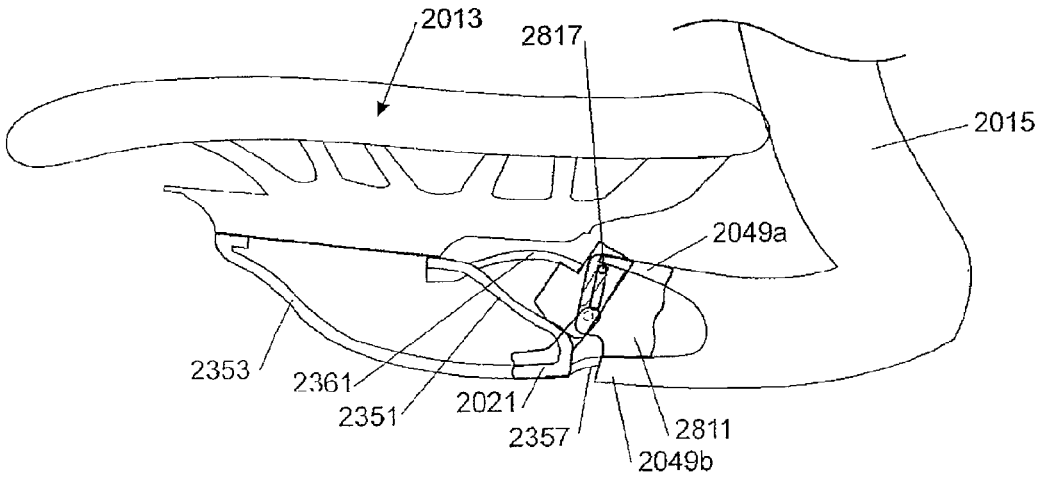
FIG. 105 is a side view of part of the chair of FIG. 56, showing the preference control in one adjusted position when the back is being reclined.

In the form shown, the spring is a torsion spring, although an alternative type of spring such as a leaf spring for example could instead be used. FIG. 101 shows a height adjust spring 2019 that has been inserted into the mounting section of the transom to a relatively high position, and FIG. 102 shows a height adjust spring that has been inserted into the mounting section of the transom to a relatively low position. The biasing of the first lever 2703 causes the portion of the first lever opposite to the pivot 2705 to contact and rest on the upper end of the height adjust spring in either position of the height adjust spring.

The actuation mechanism also has a second lever 2709 that is articulated to the first lever 2703. The second lever has a portion 2711 adapted to selectively engage the release button 2019*c* on the height adjust spring to enable height adjustment of the height adjust spring. In the form shown, the second lever 2709 is articulated to the first lever 2703 by being pivoted to the first lever at second pivot connection 2713. In the form shown, the second lever has a first section 2709*a* positioned generally parallel to the first lever and which comprises the portion for engaging the button on the height adjust spring, and a second section 2709*b* that extends generally transverse to the first section. That configuration means that moving the second portion 2709*b* of the second lever in a direction generally transverse to the downward release direction of the height adjust spring button and away from the height adjust spring, enables the height of the supporting frame to be adjusted.

A flexible linkage 2715 operatively connects the second section 2709*b* of the second lever to an actuator 2751 positioned for use by a seated occupant. In the form shown, the actuator is a cable assembly having a cable 2715*a* slidably received in a cable housing 2715*b*. The first lever 2703 has a cable guide 2717 that receives the end of the cable housing 2715*b*, and the cable 2715*a* extends beyond the cable guide 2715*b* to engage with the second lever 2709. An enlarged head 2715*c* of the cable is received in a recess in the second portion 2709*b* of the second lever. A cable guide 2719 is provided adjacent the actuation lever 2751, with the other end of the cable housing 2715*b* received in the cable guide 2719 and the cable 2715*a* extending beyond the cable guide to engage with the actuation lever 2751. An enlarged head 2715*d* of the cable is received in a recess in the actuation lever 2751.

The actuation lever is preferably of the type described above in relation to the seat depth mounting, and is preferably mounted in the same way. The alternatives described above for the seat depth actuator also have application here.

Actuation of the actuator lever 2751 by a seated occupant causes the portion 2711 of the second lever to engage the release button on the height adjust spring, thereby enabling the height of the supporting frame to be adjusted.

It will be appreciated that the features described for the actuation mechanism are preferred options only, and modifications could be made. For example, in the form shown first pivot connection 2705 is positioned at one end of the first lever, and the second lever is articulated to the first lever by a second pivot connection 2713 positioned toward the mounting section of the transom from the first pivot connection. It will be appreciated that the pivot positions could be changed, while still providing the same functionality.

The actuator may be any suitable type, and may be provided in any suitable position for use by a seated occupant. However, the benefit of using a flexible linkage is that the actuator can be provided on or in part of the chair that is configured to move relative to the support frame, and the height adjust spring will not be inadvertently released as the part of the chair moves relative to the support frame. For example, the actuator may be provided on or in any suitable part of the seat, back, or arm of the chair.

Preference Control

FIGS. 103 to 109 show the features and operation of a preferred form preference control. As discussed above, in the preferred form chairs the recline mechanism is configured so that as the back portion 2015 of the chair is reclined from a generally upright position toward a generally reclined position the seat portion 2013 lifts. That is, the preferred form chair has a weight compensated recline mechanism.

The preference control 2801 is operatively engaged between the back portion and the seat portion, and is adjustable to vary the mechanical advantage of the back portion 2015 relative to the seat portion 2013, and thereby the amount of displacement of the seat portion for a given amount of displacement of the back portion toward the generally reclined position.

As mentioned above, and as shown in FIGS. 104 and 105, the front deformable members and rear deformable members connect the seat depth mounting 2221 to the main transom 2021. The puller member 2361 extends rearward from the seat depth mounting, and operatively connects the back to the seat depth mounting and thereby the seat portion, so that a reclining action of the back causes the seat to lift and move rearwardly.

The preference control 2801 comprises a preference control block 2803 that is connected to the rear end of the puller 2361. The preference control block 2803 comprises two mounting regions 2803*a*, 2803*b* for mounting to corresponding regions on the puller 2361, via any suitable method such as adhesive or fasteners for example. The preference control block could be integrally moulded with the puller.

The preference control block comprises a centrally disposed region 2805 for receipt of a preference adjustment member 2809. The sides of the centrally disposed region 2805 are spaced apart from the mounting regions 2803*a*, 2803*b* by respective slots 2808*a*, 2808*b*. The region 2805 comprises a generally vertically extending aperture 2807 for receipt of the adjustment member 2809. Sides of the aperture are open to slots 2807', that correspond generally in position to the slots 2808*a*, 2808*b*. The preference adjustment member 2809 comprises a central cylindrical body portion 2810, and two transverse extensions 2810*a*, 2810*b* that are defined by a transverse pin. When the adjustment member 2809 is mounted in the aperture 2807, the extensions 2810*a*, 2810*b* extend from respective elongate slots 2807' on either side of the region 2805, and extend into slots 2808*a*, 2808*b*. The adjustment member provides an articulated connection between the preference block 2803 and the back portion in the manner described below.

The preference block 2803 is also articulated to the supporting frame, and more particularly to the main transom 2021. In the form shown, the main transom 2021 comprises two upwardly extending pivot mountings 2021*a*, 2021*b*. A pivot pin (not shown) connects each pivot mounting to a respective pivot aperture 2803*c*, 2803*d*, to pivotally mount the preference block to the main transom 2021 about pivot axis 2022. The pivot axis 2022 for the preference block is vertically spaced above the bottom flexible member 2357 that provides a reclining connection of the back portion to the main transom.

In the form shown, a back mounting block 2811 is rigidly mounted to the back portion 2015. The back mounting block comprises two mounting regions 2811*a*, 2811*b* for mounting to corresponding regions 2049*a*, 2049*b* on the back portion, via any suitable method such as adhesive or fasteners for example. The back mounting block could be integrally moulded with the back portion. As the back mounting block 2811 is rigidly mounted to the back portion, the features of the mounting block 2811 become part of the back portion 2015. The lower deformable member 2357 may be connected to the underside of the back mounting block, or alternatively to the back support member 2049*b*.

The back mounting block 2811 comprises two forwardly directed extensions 2813*a*, 2813*b*. Each extension comprises an elongate slot 2815*a*, 2815*b*. The extensions 2813*a*, 2813*b* are received in slots 2808*a*, 2808*b* of the preference block. The extensions 2810*a*, 2810*b* of the preference pin are received in the slots 2815*a*, 2815*b* of the back mounting block 2811. That forms an articulated connection between the back portion 2015 and the preference block 2803. More particularly, the back portion 2015 is pivoted to the preference block 2803 about pivot axis 2817.

The adjustment member and thereby the preference pin is movable up and down the elongate aperture 2807, which adjusts the point of the pivot between the back portion 2015 and the preference block 2803. That changes the angular amount the back would have to recline rearwardly to achieve a desired lifting of the seat portion, and therefore the mechanical advantage the back portion 2015 has to move the user's weight on the seat portion 2013.

Figure 106:
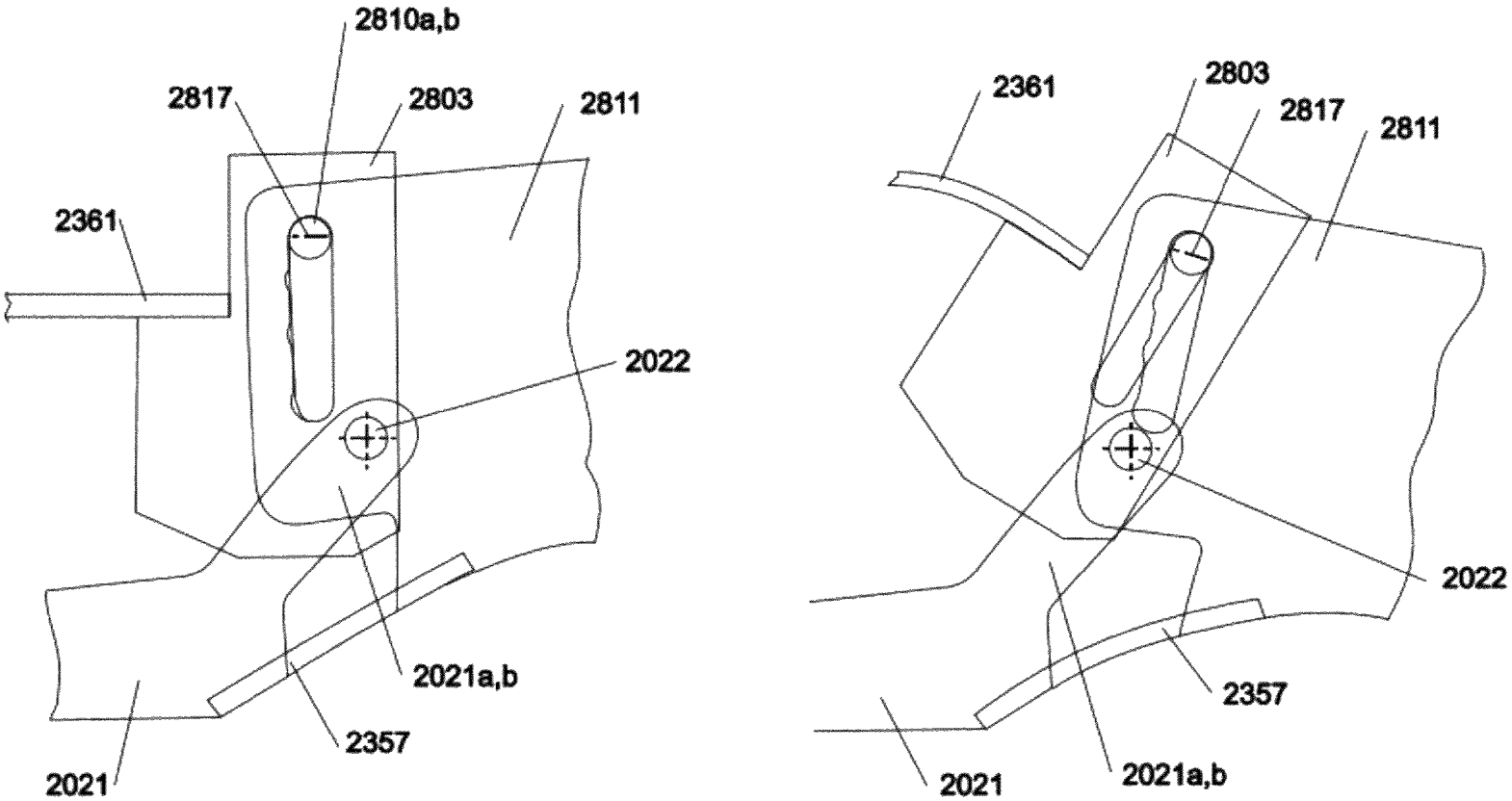
FIG. 106 is a side view of the preference control showing a maximum mechanical advantage setting.

FIG. 106 shows the preference control with the preference pin positioned at the top of the slots 2807', 2815*a*, 2815*b*, which is a maximum mechanical advantage position. In that position, the mechanical advantage of the back portion is a maximum. For a given displacement of the back portion during recline, the upward displacement of the seat portion will be a minimum. Therefore, the rearward force that must be applied to the back portion to achieve a desired amount of recline of the back portion is a minimum. The right side of FIG. 106 schematically shows the amount of seat portion displacement that would result from a 15 degree rearward recline of the back portion.

Figure 107:
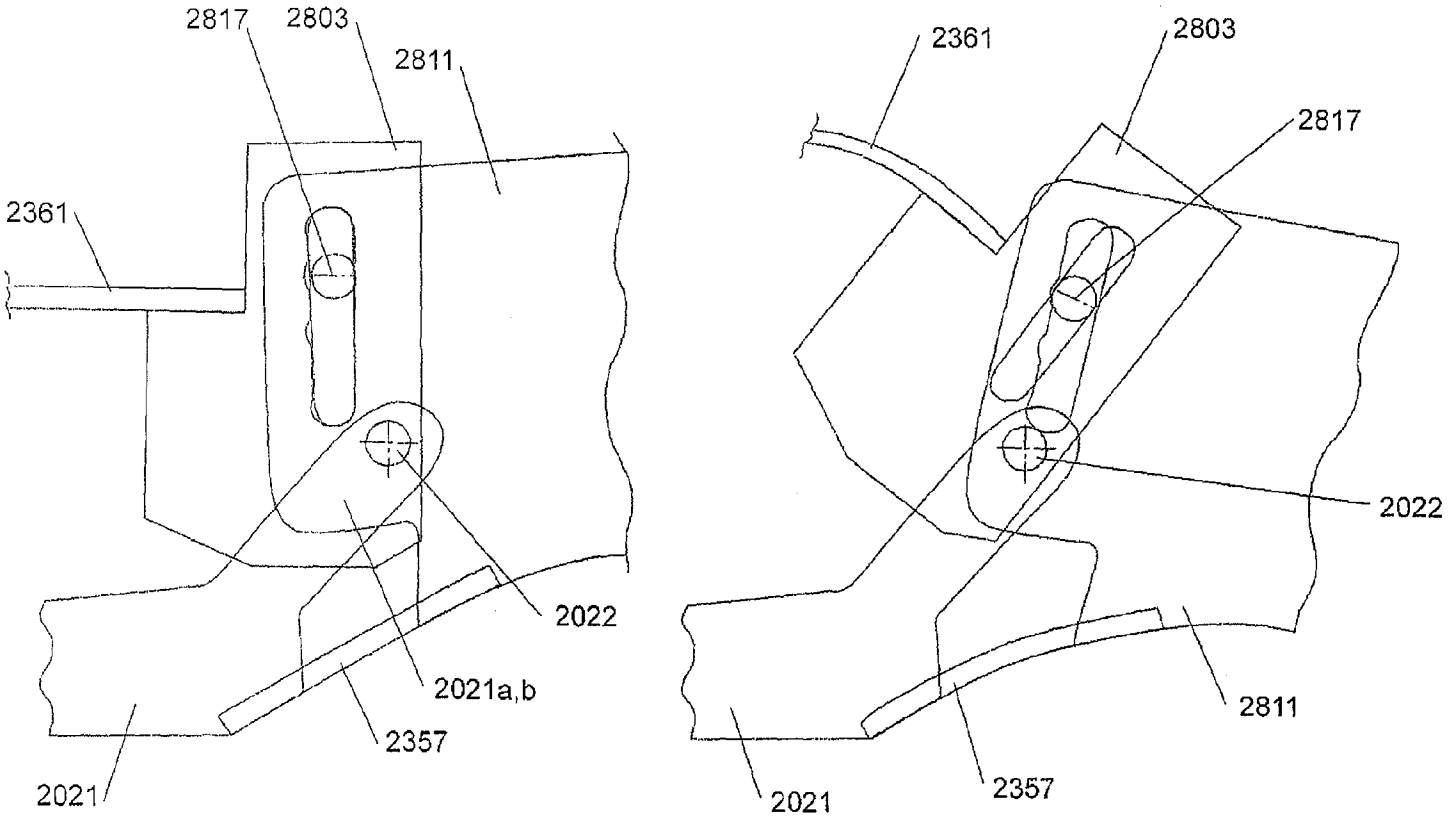
FIG. 107 is a side view similar to FIG. 106, but showing a first intermediate mechanical advantage setting, in which the mechanical advantage is lower than the position of FIG. 106.

FIG. 107 shows the preference control with the preference pin positioned at a first intermediate mechanical advantage position, in which the adjustment member is positioned lower in the slots 2807', 2815*a*, 2815*b* than in FIG. 106. In that position, the mechanical advantage of the back is lower than in FIG. 106. In other words, for a given displacement of the back portion during recline, the upward displacement of the seat portion will be greater than in the position of FIG. 106. Therefore, the rearward force that must be applied to the back portion to achieve a desired amount of recline of the back portion is higher. The right side of FIG. 107 schematically shows the amount of seat portion displacement that would result from a 15 degree rearward recline of the back portion, which is greater than FIG. 106.

Figure 108:
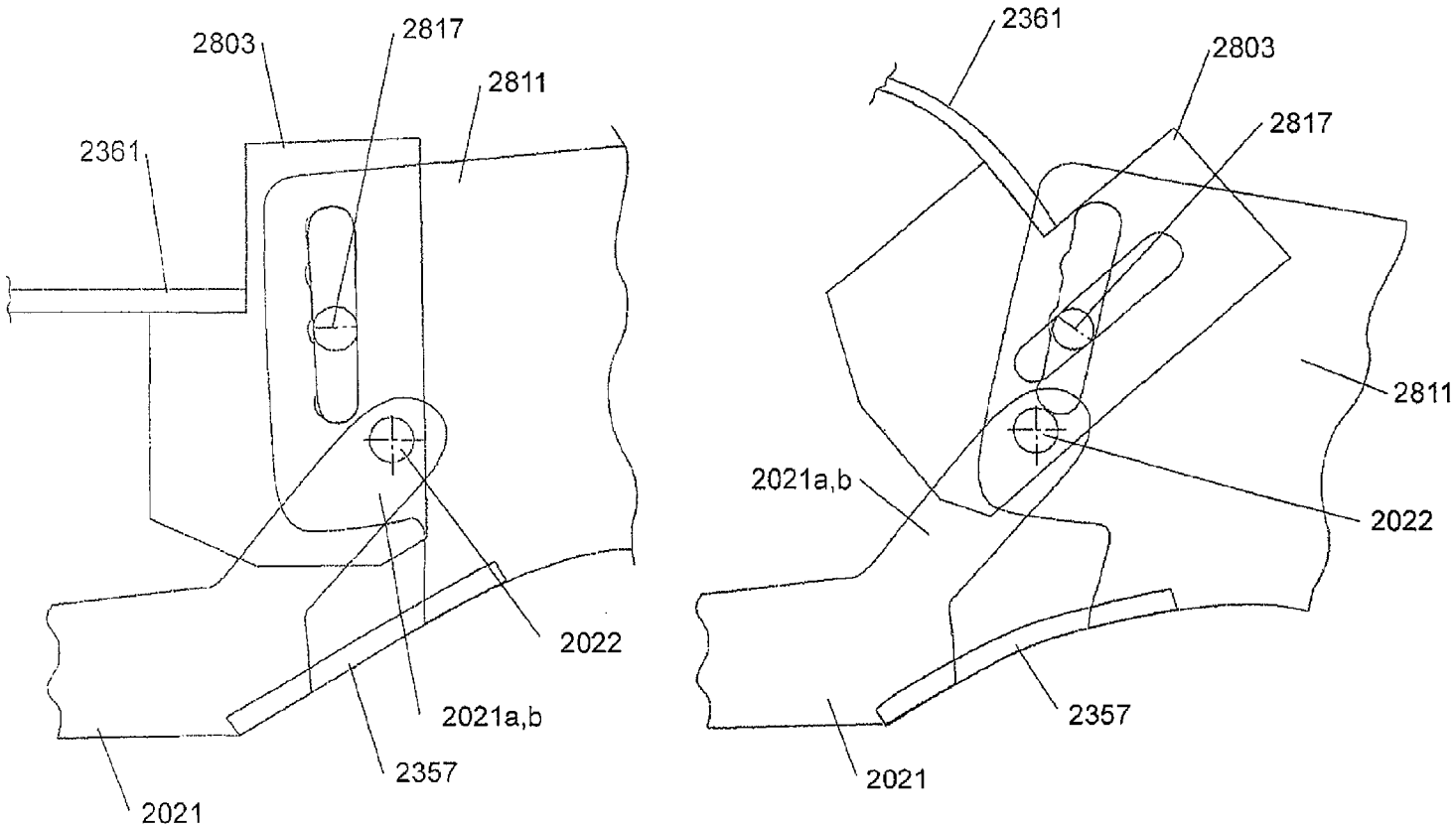
FIG. 108 is a side view similar to FIG. 107, but showing a second intermediate mechanical advantage setting, in which the mechanical advantage is lower than the position of FIG. 107.

FIG. 108 shows the preference control with the preference pin positioned at a second intermediate mechanical advantage position, in which the adjustment member is positioned lower in the slots 2807', 2815*a*, 2815*b* than in FIG. 107. In that position, the mechanical advantage of the back portion is lower than in FIG. 107. In other words, for a given displacement of the back portion during recline, the upward displacement of the seat portion will be greater than in the position of FIG. 107. Therefore, the rearward force that must be applied to the back portion to achieve the desired lifting of the seat portion is higher. The right side of FIG. 108 schematically shows the amount of seat portion displacement that would result from a 15 degree rearward recline of the back portion, which is greater than for FIG. 107.

Figure 109:
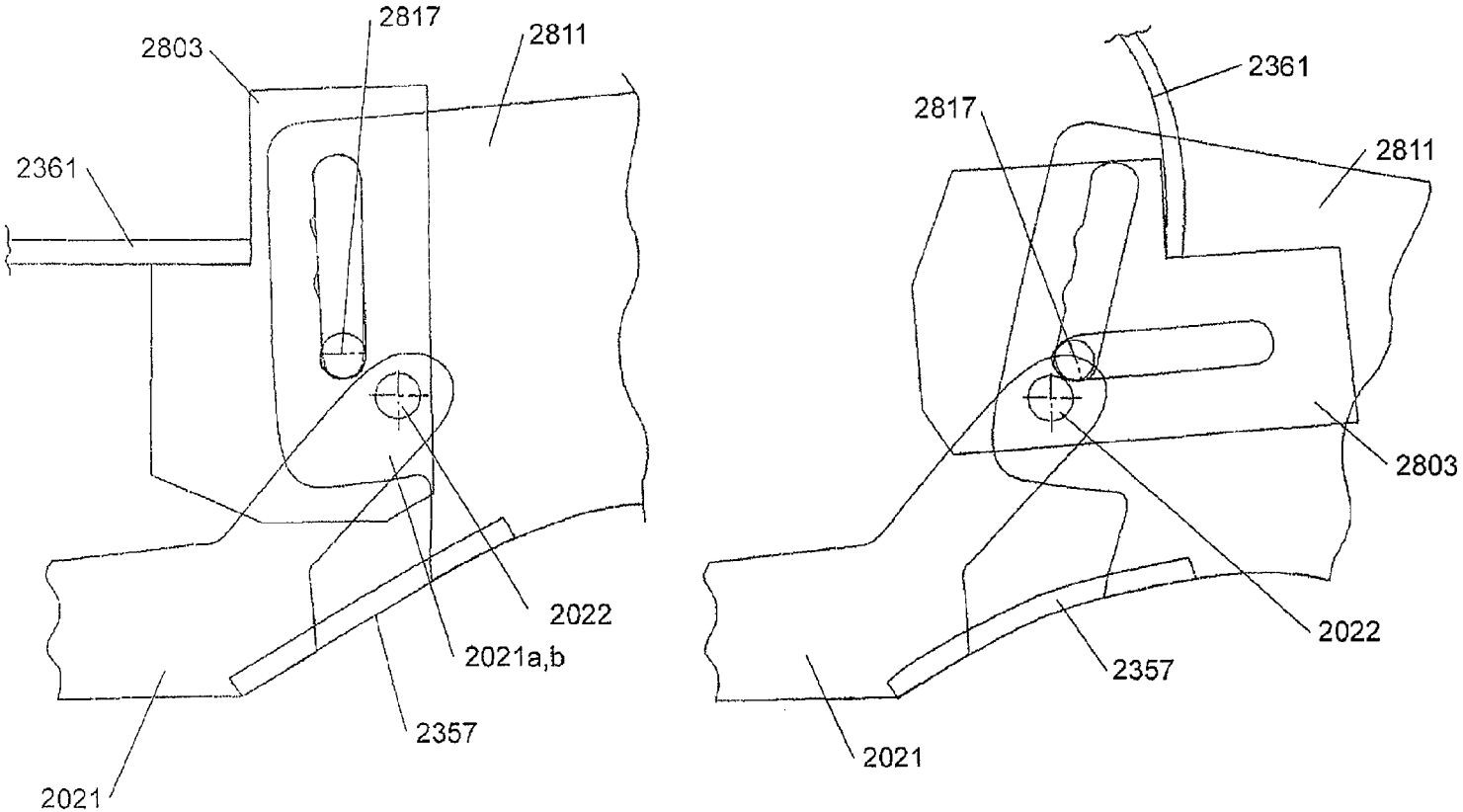

FIG. 109 shows the preference control with the preference pin positioned at a lowest mechanical advantage position, in which the adjustment member is positioned at the bottom of the slots 2807', 2815*a*, 2815*b*. In that position, the mechanical advantage of the back portion is at a minimum. In other words, for a given displacement of the back portion during recline, the upward displacement of the seat portion will be greatest. Therefore, the rearward force that must be applied to the back portion to achieve the desired lifting of the seat portion is at its highest setting. The right side of FIG. 109 schematically shows the amount of seat portion displacement that would result from a 15 degree rearward recline of the back portion, which is greater than for FIG. 108.

The preference control will be provided with any suitable type of actuator (not shown) for actuating the preference control to enable a user to select a desired mechanical advantage of the back portion to move a user's weight on the seat portion. For example, the actuator could comprise a lever and flexible linkage for moving the actuation member in the slots. The preferred actuator is a lever that is mounted under the peripheral edge region of the seat and is pivoted about a generally vertical axis such that generally horizontal movement of the lever moves the actuation member. Such an actuator is shown in FIG. 69 as item 2227*a*'. More than one actuator could be provided, with the different actuators configured to select a desired setting of the preference control. The preference control could be provided with a plurality of buttons that are selectively engageable to select the desired point of articulation between the back portion and the preference block.

The preference positions may be indexed. In the form shown, at least one of the slots 2807', 2815*a*, 2815*b* is provided with a plurality of recesses in which the preference pin engages, to define discrete indexed adjustment positions of the preference pin. Alternatively, an infinite number of preference positions may be provided, with the preference position selected by the preference actuator.

The preference control could have a smaller number of adjusted positions. For example, the preference control could have only a minimum mechanical advantage position and a maximum mechanical advantage position. Alternatively, the preference control may have one, two, or more intermediate mechanical advantage positions.

The preference control could be provided elsewhere in the recline mechanism. For example, the preference block could be mounted to the seat depth mounting, and the puller could be mounted to the preference pin and could extend rearwardly to the back connection. The preference control could be used in a recline mechanism having an intermediate support or without a seat depth mounting. The preference control could additionally be provided in a chair having a different type of recline mechanism, such as one that is not weight compensated for example.

Rather than operatively engaging the seat portion (via the seat depth mounting in the preferred embodiment), the preference control could operatively engage another chair component. As an example, an alternative type of chair could be provided with a back portion that is reclinable relative to the supporting frame, but does not cause any movement of the seat portion. A recline spring, such as a torsion spring for example, may be provided between the back portion and the supporting frame. The preference control may be operatively engaged between the back portion and the recline spring and is adjustable to vary the displacement of part of the recline spring for a given amount of displacement of the back portion toward the generally reclined position.

Lumbar Support

Figure 110:
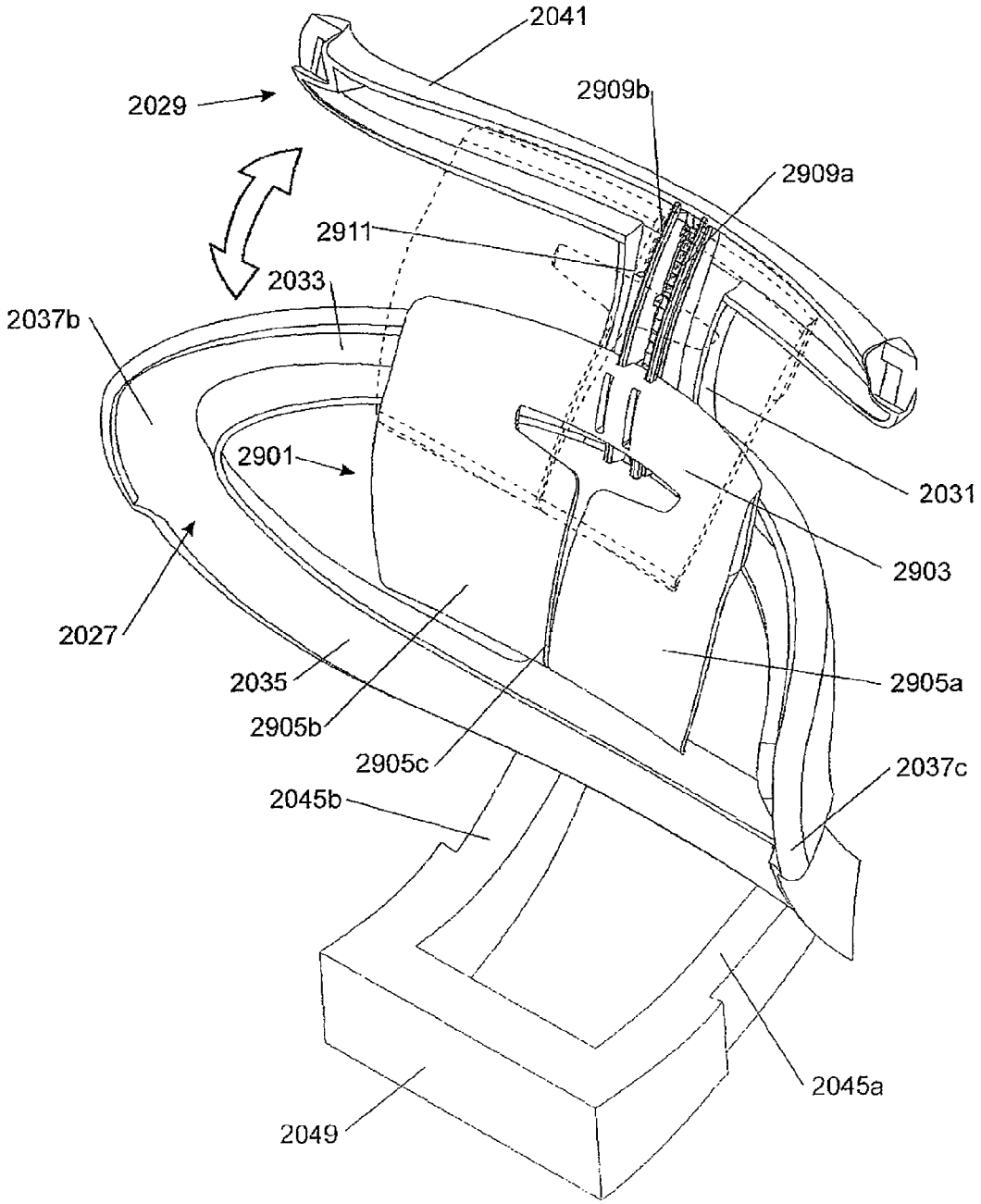
Figure 111:
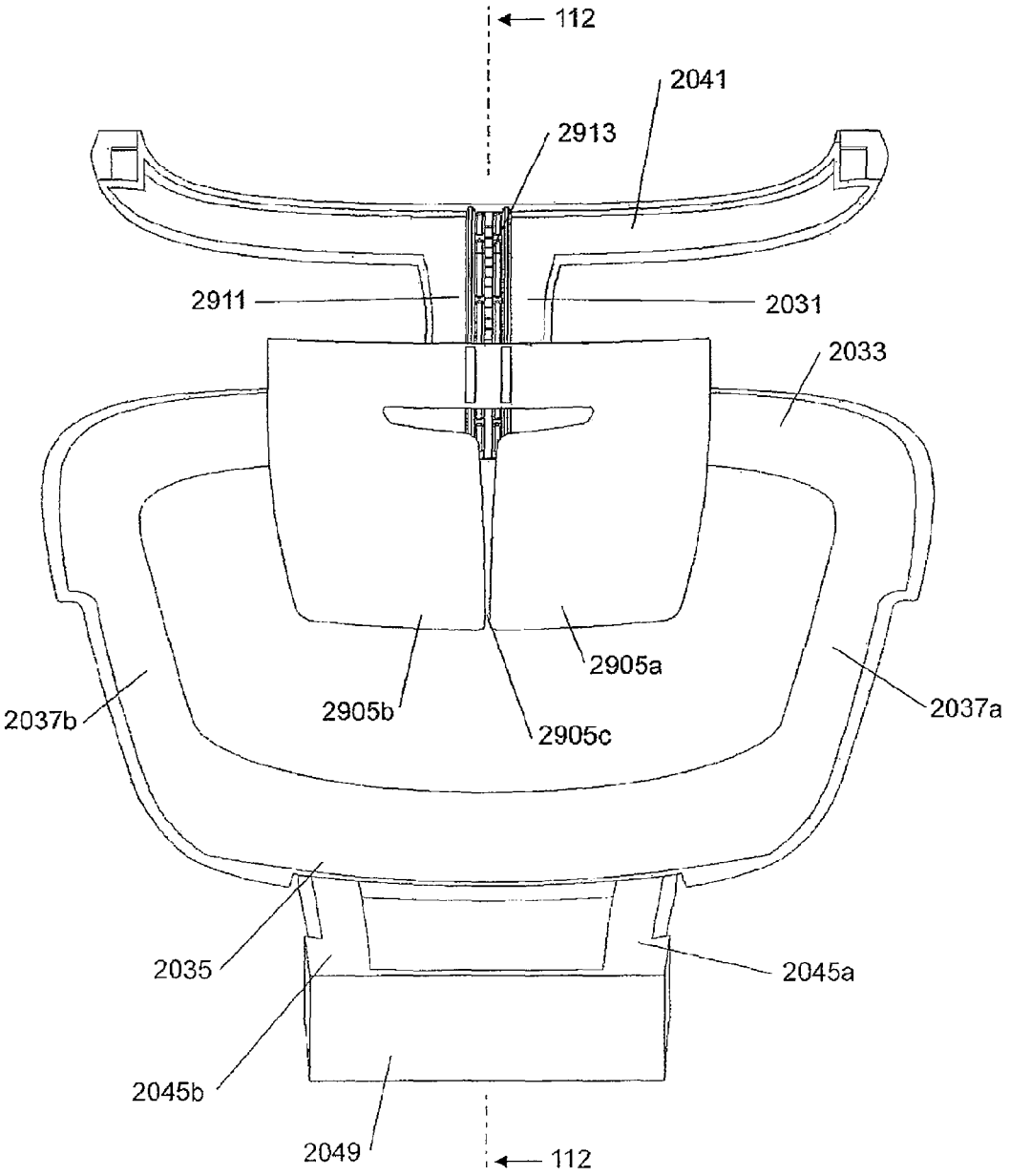
Figure 112:
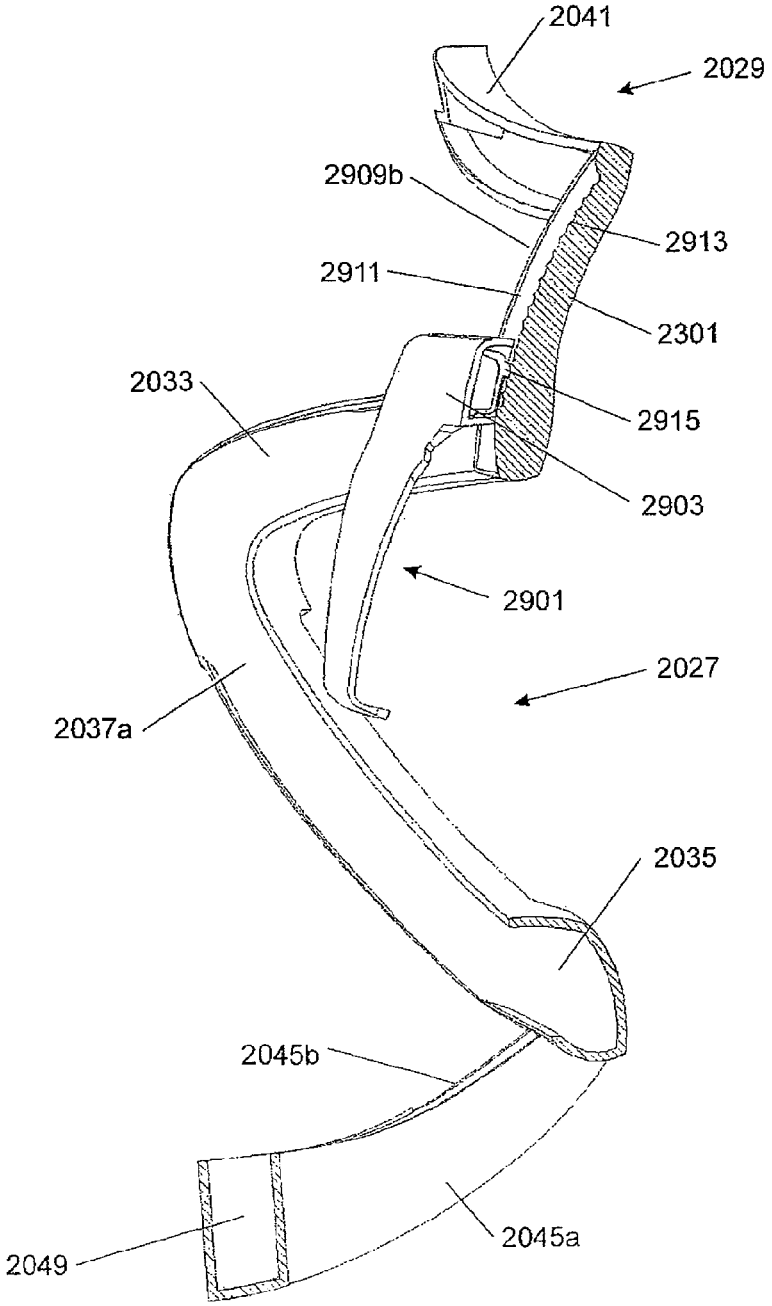

The preferred form chairs may or may not be provided with a lumbar support mechanism to provide additional support to an occupant's lumbar region. FIGS. 110 to 112 show a preferred form lumbar support incorporated into the chair of FIG. 56. It will be appreciated that any other suitable type of lumbar support could be used.

The lumbar support 2901 is positioned between the back frame and the cover, and is preferably height adjustable relative to the back frame. As can be seen most clearly from FIG. 111, the lumbar support 2901 is a passive lumbar support. That is, the lumbar support sits behind the cover and is not contacted by the cover until an occupant applies a rearward force to the cover.

The lumbar support comprises a mounting portion 2903 and two occupant supporting portions 2905*a*, 2905*b*. The occupant supporting portions 2905*a*, 2905*b* are cantilevered downwardly from the mounting portion, and thereby from member 2031 on the back frame. The mounting portion comprises two spaced apart recesses 2907*a*, 2907*b* to received respective tracks 2909*a*, 2909*b* on member 2031 of the back frame. The tracks and recesses provide a height adjustment of the lumbar support 2901 relative to the back frame. The maximum height adjusted position of the lumbar support 2901 is shown in phantom lines in FIG. 110, and the minimum height adjusted position is shown in solid lines.

Member 2301 defines a recess 2911 that comprises a plurality of notches 2913 along its length. The notches provide indexed height adjusted positions of the lumbar support relative to the back frame. As can be seen in FIG. 112, the lumbar support mounting portion 2903 carries a detent 2915 that is biased toward and engages the notches and maintains the lumbar support in a desired height adjusted position. The engagement can be overridden by pushing or pulling the lumbar support upwardly or downwardly relative to the back frame, so that the lumbar support can be moved to a new height adjusted position.

The occupant supporting portions 2905*a*, 2905*b* are spaced apart and separated by a spacing 2905*c*, which will be aligned with an occupant's spine when the occupant is in a normal forward oriented position on the seat portion. As the occupant supporting portions 2905*a*, 2905*b* are spaced apart, they provide substantially independent support of the two sides of the occupant's lower back when the user applies rearward force to the back portion. The independent rearward movement of the occupant supporting portions is represented in FIG. 113.

As discussed above, the upper part of the back portion can be twisted relative to the lower part of the back portion. When the user is turning their upper body to push rearwardly on one side of the upper part of the back portion, the corresponding occupant supporting portion will also move rearwardly.

The preferred form chairs described above provide supportive and comfortable positions for an occupant when in a number of different orientations in the chair.

The above describes preferred forms of the present invention, and modifications can be made thereto without departing from the scope of the present invention. For example, the preferred form features are described and shown with reference to a reclining office chair. However, it will be appreciated that many of the features can readily be incorporated into different types of chairs, such as meeting chairs, vehicle chairs, or theatre chairs for example. The supporting frame could be modified accordingly, so as to be fixed to the ground or a wall panel for example for a theatre chair.

Additionally, a number of the features described herein can be incorporated into chairs having different features. They need not all be incorporated into the same chair.

Other example modifications are listed in the "Summary of the Invention" section.

What is claimed is:

1. A chair comprising:

a back portion comprising:

a back frame, the back frame comprising a lower portion supported from another part of the chair and adapted to extend across at least a major part of a lower region of a seated adult occupant's back, wherein the lower portion of the back frame comprises a transversely extending top member, a transversely extending bottom member, and at least two spaced apart members interconnecting the top and bottom members, an upper portion adapted to extend across at least a major part of an upper region of the occupant's back, wherein the upper portion of the back frame comprises a transversely extending top member, a transversely extending bottom member, and at least two spaced apart generally vertical members interconnecting the top and bottom members, and a relatively narrow interconnecting region that is centrally disposed in a horizontal width direction of the back frame and that extends between and is connected to the transversely extending bottom member of the upper portion and to the transversely extending top member of the lower portion to connect a lower part of the upper portion to an upper part of the lower portion and provide a vertical spacing between the upper portion and lower portion, wherein the relatively narrow interconnecting region is resiliently flexible to provide a flexing movement in a rearward direction of the upper portion relative to the lower portion and relative to said another part of the chair; and a cover operatively connected to the back frame to provide a supporting surface for the back of the seated occupant, wherein the cover is connected to at least the transversely extending top member of the upper portion of the back frame and to at least the transversely extending bottom member of the lower portion of the back frame, and wherein a portion of the cover is suspended between the upper portion of the back frame and the lower portion of the back frame across the relatively narrow interconnecting region of the back frame, with the suspended portion being spaced in front of the relatively narrow interconnecting region of the back frame.

2. A chair as claimed in claim 1, wherein the interconnecting region is further configured to twist with a torsional action about an axis extending along the relatively narrow interconnecting region between the upper portion of the back frame and lower portion of the back frame, to enable the upper portion of the back frame to twist relative to the lower portion of the back frame as a seated occupant turns their shoulder region while seated in the chair, and wherein the lower portion of the back frame is substantially unable to twist about an axis substantially parallel to and positioned between said at least two spaced apart members of the lower portion of the back frame.

3. A chair as claimed in claim 1, wherein the relatively narrow interconnecting region consists of a single member.

4. A chair as claimed in claim 1, wherein at least the lower part of the upper portion and at least the upper part of the lower portion are resiliently flexible.

5. A chair as claimed in claim 1, wherein the back portion is reclinable relative to said another part of the chair between an upright position and a reclined position, and wherein the back portion comprises at least one support member that is connected to and extends from the transversely extending bottom member of the lower portion of the back frame, to support the back portion from said another part of the chair, and wherein said at least one support member is connected to and extends from the transversely extending bottom member of the lower portion of the back frame such that substantially the entire back portion moves rearwardly and downwardly relative to said another part of the chair upon recline of the back portion.

6. A chair as claimed in claim 1, wherein the generally vertical members are positioned at or toward a respective end of the top and bottom transverse members of the upper portion of the back frame.

7. A chair as claimed in claim 1, wherein the top member of the upper portion of the back frame is generally linear when viewed from above the back portion, while the bottom member of the upper portion of the back frame is generally concave when viewed from the front of the back portion.

8. A chair as claimed in claim 1, wherein the two spaced apart members of the lower portion of the back frame connect respective ends of the top and bottom transverse members of the lower portion of the back frame.

9. A chair as claimed in claim 1, wherein at least the top member of the lower portion of the back frame is generally concave when viewed from the front, and the outer ends of the top member of the lower portion of the back frame and the spaced apart members of the lower portion of the back frame extend around the sides of the lower back of a seated adult occupant.

10. A chair as claimed in claim 1, wherein the back portion comprises arm assemblies having arm rests that are supported by the lower portion of the back portion.

11. A chair as claimed in claim 10, wherein arm supports extend from a lower region of the back portion, with the arm rests mounted to the arm supports.

12. A chair as claimed in claim 11, wherein the arm rests extend forwardly in a cantilevered arrangement from the arm supports adjacent the lower region of the back frame, and have inner surfaces that form a general continuation of the portion of the cover corresponding in position to the lower portion of the back frame when supporting a user.

13. A chair as claimed in claim 12, wherein the inner surface of each arm rest is curved.

14. A chair as claimed in claim 13, wherein the inner surface of each arm rest forms a general continuation of the concave curvature of the cover, at least when an occupant is side-sitting in the chair and applying force against the back portion by leaning sideways against the back portion.

15. A chair as claimed in claim 12, wherein each arm rest has a horizontal cushion panel on its upper surface for supporting an occupant's arm when the occupant is sitting in a forward-facing orientation in the chair, and a vertical cushion panel on its inner surface and extending downwardly from the horizontal cushion panel for supporting said part of the occupant's back when the occupant is sitting sideways on the seat portion.

16. A chair as claimed in claim 12, wherein there is sufficient spacing beneath the arm rests that an occupant's legs can fit under the arm rests when sitting generally sideways in the chair incorporating the back portion in use.

17. A chair as claimed in claim 16, wherein the arm rests are height adjustable relative to the back frame, and wherein in at least one of the height adjusted positions of the arm rests, there is sufficient spacing beneath the arm rests that an occupant's legs can fit under the arm rests when sitting generally sideways in the chair incorporating the back portion in use.

18. A chair as claimed in claim 1, wherein the cover is a resilient material, and wherein the cover consists of a molded polymeric material.

19. A chair as claimed in claim 18, wherein the cover comprises integrally molded attachment features for connecting the cover to the back frame.

20. A chair as claimed in claim 18, wherein the molded polymeric material is an elastomeric material.

21. A chair as claimed in claim 20, wherein the molded polymeric material is a thermoplastic polyester elastomer.

22. A chair as claimed in claim 18, wherein the cover is formed as a mesh to provide enhanced breathability through the cover.

23. A chair as claimed in claim 1, further comprising a lumbar support to provide additional support to a lumbar region of an occupant's back when sitting in a normal forward orientation in the chair, the lumbar support being supported from the back frame by being connected to the relatively narrow interconnecting region, the lumbar support comprising two spaced apart occupant supporting portions that are independently rearwardly moveable to provide substantially independent support for the two sides of the occupant's lower back.

24. A chair as claimed in claim 1, wherein the cover comprises a resilient material and two recessed sections, one extending into each side of the cover, wherein the recessed sections correspond generally in vertical position to the relatively narrow interconnecting region, to provide a clearance space for the elbows of a seated occupant in use, and wherein at least a major part of each of the recessed sections is spaced from any members of the back frame so that the recessed sections provide a compliant support surface for an occupant's elbows resting against the recessed sections in use.

25. A chair as claimed in claim 1, wherein said another part of the chair comprises a seat portion of the chair.

26. A chair as claimed in claim 1, wherein said another part of the chair comprises a supporting frame of the chair.

27. A chair comprising:

a supporting frame;

a seat portion for supporting a seated occupant;

a back portion, at least a part of which has a concave curvature for supporting the back of the occupant when in a normal forward oriented position in the chair; wherein the seat portion, the back portion, and the supporting frame are operatively connected by a recline mechanism, the recline mechanism configured such that as the back portion of the chair is moved from an upright position to a reclined position, the seat portion is caused to move relative to the supporting frame, and wherein the recline mechanism is operatively connected to an underside of the seat portion by at least one operative connection, the at least one operative connection being positioned lower than any part of the seating surface of the seat portion; the chair further comprising a pair of arm rests positioned vertically higher than and at or toward either side of the seat portion adjacent the part of the back portion, wherein each arm rest has an inner surface that is cushioned and forms a general continuation of the concave curvature of the part of the back portion, at least when an occupant is side-sitting in the chair and applying force against the back portion by leaning sideways against the back portion;

wherein a sufficient clearance is provided between the arm rest and the seat portion that an occupant can sit sideways on the seat portion with their legs extending under one arm rest and part of their back supported by the cushioned inner surface of the other arm rest and wherein said part of the back portion comprises a lower portion of the back portion having spaced apart curved side frame members, wherein the arm rests are supported from the back portion by arm supports having a curvature corresponding generally to that of the curved side frame members, the arm supports defining curved travel paths each having a curvature such that toward a lower end of the travel path, the travel path is oriented fowardly and upwardly, and toward an upper end of the travel path, the travel path is oriented more vertically than at the lower end thereof, wherein the arm rests are height adjustable relative to the arm supports, wherein in at least one of the height adjusted positions of the arm rests, there is sufficient spacing beneath the arm rests that an occupant's legs can fit under the arm rests when sitting generally sideways in the chair, and wherein the arm rests remain adjacent the curved side frame members throughout height adjustment of the arm rests as they travel along the curved travel paths defined by the arm supports.

28. A chair as claimed in claim 27, wherein each arm rest has a horizontal cushion panel on its upper surface for supporting an occupant's arm when the occupant is sitting in a forward-facing orientation in the chair, and a vertical cushion panel on its inner surface and extending downwardly from the horizontal cushion panel for supporting said part of the occupant's back when the occupant is sitting sideways on the seat portion.

29. A chair as claimed in claim 27, wherein the seat portion comprises a seat depth mounting that enables the seating surface of the seat portion to be selectively moved in a forward and rearward direction relative to the supporting frame independent of any movement of the back portion, and wherein the recline mechanism is operatively connected to the seat portion by being connected to the seat depth mounting.

30. A chair as claimed in claim 27, wherein the seat portion comprises a seat panel for supporting a cushion for supporting the seated occupant, and wherein the seat panel is substantially planar and has a central zone and two exterior side zones, one on either side of the central zone, and wherein the exterior side zones extend horizontally outwardly or horizontally outwardly and downwardly from the central zone so that the exterior side zones are not raised relative to the central zone.

31. A chair as claimed in claim 30, wherein the exterior side zones are resiliently flexible to enable the exterior side zones to deform downwardly from the central zone under the weight of an occupant's legs when the occupant sits sideways on the seat portion.

32. A chair as claimed in claim 27, wherein the recline mechanism comprises a recline member that spans between the support frame and the seat member, the recline member flexing without hingedly pivoting relative to the support frame as the back portion of the chair is moved from the upright position to the reclined position.

33. A chair as claimed in claim 27, wherein all of the operative connections between the recline mechanism and the underside of the seat portion are positioned lower than any part of the seating surface of the seat portion.

* * * * *